US005115705A

United States Patent [19]

Monte et al.

[11] Patent Number: 5,115,705

[45] Date of Patent: May 26, 1992

[54] MODULAR ELECTRONIC KEYBOARD WITH IMPROVED SIGNAL GENERATION

[76] Inventors: Charles Monte, 10 Brodea Way, San Rafael, Calif. 94901; Paul J. White, 3441 Beethaven St.; Anne C. Graham, 3701 Meier St., both of Los Angeles, Calif. 90066

[21] Appl. No.: 600,693

[22] Filed: Oct. 22, 1990

Related U.S. Application Data

[62] Division of Ser. No. 311,601, Feb. 16, 1989, Pat. No. 5,003,859.

[51] Int. Cl.[5] ..... G10H 1/055; G10H 1/18

[52] U.S. Cl. ..... 84/617; 84/655; 84/658; 84/DIG. 7; 338/69; 341/26; 341/27; 341/34

[58] Field of Search ..... 84/617, 626, 655, 658, 84/682, 687-690, 21, 22, DIG. 7, DIG. 19; 338/69; 341/26-34

[56] References Cited

U.S. PATENT DOCUMENTS

| | | | |
|---|---|---|---|
| 4,503,745 | 3/1985 | Clark, Jr. et al. | 84/DIG. 7 |
| 4,520,706 | 6/1985 | Deforeit | 84/DIG. 7 |
| 4,558,623 | 12/1985 | Buchla | 84/DIG. 7 |
| 4,979,423 | 12/1990 | Watanabe | 84/690 |

*Primary Examiner*—Stanley J. Witkowski
*Attorney, Agent, or Firm*—James E. Eakin

[57] ABSTRACT

An improved percussive action electronic keyboard for play as a musical instrument of the type having pivoted playing keys having camming surfaces distal from finger contact surfaces thereof, pivoted hammers having cam follower surfaces for following the playing key camming surfaces, hammer stop for stopping the swing of the hammer in response to depression of its associated key, includes an electronic sensor for generating an electrical signal for each key which is related in amplitude to the pressure with which the key is depressed during play of the keyboard, and a scanning keyboard state monitor connected to said sensor including a keyboard scanner for scanning each of the keys of the keyboard to determine if a key event has occurred, an amplitude comparator for determining when a key depression causes a said key depression signal amplitude to pass predetermined minimum and maximum amplitude threshold values, a scan counter for counting the number of scans occurring between the scans when the key depression amplitude signal passes between the minimum and maximum amplitude threshold values and a digital output for putting out the number of scans as a digital value. A programmed microprocessor is connected to receive the digital value scan count for a key and converts the scan count into a key velocity signal. A keyboard setup memory is connected to the microprocessor for recording user provided setup parameters for operation of the keyboard, and the microprocessor is programmed to operate the keyboard in accordance with the setup parameters recorded in the keyboard setup memory. A programmable output path is connected to the microprocessor for putting out the key velocity signal to music generation equipment.

31 Claims, 39 Drawing Sheets

MODULAR ELECTRONIC KEYBOARD WITH IMPROVED SIGNAL GENERATION

This is a division of application Ser. No. 07/311,601, filed Feb. 16, 1989, U.S. Pat. No. 5,003,859.

FIELD OF THE INVENTION

The present invention relates to a percussive action electronic musical instrument keyboard. More particularly, the present invention relates to a number of improvements in a percussive action silent electronic keyboard which aid its manufacturability, extend its adaptability to a wide variety of tactile playing conditions and responses, and provide extended programmability as a data source for digital musical generation.

RELATED PATENT

The present invention is directly related to U.S. Pat. No. 4,679,477, issued on Jul. 14, 1987, for Percussive Action Silent Electronic Keyboard, the disclosure of which is incorporated by reference.

BACKGROUND OF THE INVENTION

While the concepts disclosed in the referenced U.S. Pat. No. 4,679,477 have proven to be most valuable and useful, the keyboard device described therein was essentially a pre-production, handmade prototype which was not readily adapted for mass production. Also, it lacked many useful features and adjustments which, when included in the keyboard, greatly extend its ease of manufacture, flexibility and usefulness as a source of programmable data for digital musical sound generation.

SUMMARY OF THE INVENTION WITH OBJECTS

A general object of the present invention is to provide a programmable, percussive action, electronic keyboard for musical sound generation which overcomes limitations and drawbacks of the prior art.

A specific object of the present invention is to provide a percussive keyboard action and electronic data entry device which is comprised of molded and formed elements which may be snap locked together and adjusted at the factory and by the user in order to provide the keyboard with a wide variety of tactile characteristics and responses to the player.

Another specific object of the present invention is to provide modular percussive action units including the keys, and hammer assemblies which may be formed into percussive action keyboards having a selectable number of playing keys.

One more specific object of the present invention is to provide a key and hammer assembly for a percussive action electronic keyboard which may be adjusted to simulate the tactile response ("kerchunk") of the action of an acoustical piano when the jack comes in contact with the regulation button thus pulling the jack out from under the hammer butt knuckle just before the hammer comes in contact with the string.

Yet another specific object of the present invention is to provide a hammer and flange assembly which includes at least one hammer bounce, vibration dampening mechanism and which maintains proper hammer alignment in the resting position.

A still further specific object of the present invention is to provide a hammer assembly with a slideable hammer weight, thereby enabling the hammer mass to be adjusted at the factory and by the player in the field.

One more specific object of the present invention is to provide a percussive action keyboard which enables player adjustment of the sensitivity and multiple dynamic velocity ranges of the keyboard.

One further specific object of the present invention is to provide a percussive action electronic keyboard with vastly improved and extended data entry and programmability capability including the playing keys as program data entry ports.

An improved percussive action electronic keyboard is provided for play as a musical instrument of the type having pivoted playing keys having camming surfaces distal from finger contact surfaces thereof, pivoted hammers having cam follower surfaces for following the playing key camming surfaces, a hammer stop for stopping the swing of the hammer in response to depression of its associated key, an electronic sensor for generating an electrical signal for each key which is related in amplitude to the combined impact and velocity (key speed) with which the key is struck during play of the keyboard, and a scanning keyboard state monitoring circuit connected to the sensor including keyboard scanner for scanning each of the keys of the keyboard to determine if a timed key event has occurred, comparator for determining when a key impact causes a key impact signal amplitude to pass predetermined minimum and maximum threshold values, a scan counter for counting the number of scans the scans when the key impact signal passes between the minimum and maximum threshold values and a digital output for putting out the number of scans as a digital value. A programmed microprocessor is connected to receive the digital value scan count for a key and converts the scan count into a key velocity signal. A keyboard setup memory is connected to the microprocessor for recording user provided setup parameters for operation of the keyboard; and, the microprocessor is programmed to operate the keyboard in accordance with the setup parameters recorded in the keyboard setup memory. A programmable output path is connected to the microprocessor for putting out the key velocity signal to music generation equipment via the programmable output path.

In one aspect of the present invention the keyboard has a performance mode during which the playing keys emulate play of the musical instrument and has an edit mode during which the playing keys act as data entry ports for entry of the setup parameters provided by the user.

In another aspect of the present invention a disk file subsystem is connected to the microprocessor for recording as disk files a plurality of different user provided setup parameters for operation of the keyboard.

In a further aspect of the present invention the scanning keyboard state monitoring circuit includes aftertouch, i.e. key pressure, determining circuitry for determining the compression with which a key is compressed during play.

In one more aspect of the present invention the electronic sensor comprises force sensitive resistance material having an electrical resistance characteristic which is inversely related to the force with which the material is urged toward electrical conductors.

In yet another aspect of the present invention the electronic sensor comprises an XYZ force sensitive array.

In a still further aspect of the present invention the electronic sensor comprises a continuous film substrate carrying a force sensitive resistance coating on at least one side and at least one printed circuit substrate carrying arrays of interleaved conductors forming individual sense cells for each key of the keyboard facing the one side.

In one more aspect of the present invention a strip of elastomeric material is placed between the keys and the continuous film substrate.

In a still further aspect of the present invention the individual sense cells are grouped into predetermined groups and the keyboard scanner includes a group select for individually enabling each group of the groups and the cells within each group are individually connected to plural scan buses, there being in number as many scan buses as there are cells within each group, so that by enabling a group and then by scanning each scan bus, each key of the keyboard may thereby be scanned in its turn.

In one more aspect of the present invention an action rail is provided for aligning the cam follower surfaces of the pivoted hammers relative to the camming surfaces of the playing keys, and each camming surface and cam follower surface has a first positional relationship which establishes a continuously following action arrangement and having a second positional relationship which establishes a discontinuous following action arrangement providing kerchunk which is timed to the key impact upon the key sensor. The action rail is adjustable to position the pivoted hammers between the first positional relationship and the second positional relationship.

In yet one more aspect of the present invention an action rail is provided for aligning the cam follower surfaces of the pivoted hammers relative to the camming surfaces of the playing keys, the action rail defining a longitudinal slot for receiving at least one preformed hammer flange in snap locking arrangement therein. At least one preformed hammer flange defines a plurality of hammer stations adapted to receive a hammer in snap locking arrangement therewith. Each of the pivoted hammers includes a journal adapted to snap lock into any one of the hammer stations of the hammer flange.

In one more aspect of the present invention each of the pivoted hammers includes a tapered web region radially extending from the journal; and, each hammer station includes a pair of blades facing the tapered web region, the blades contacting the web when the hammer is located in a rest position and the blades moving out of contact with the web as the hammer moves toward the striking position.

In yet another aspect of the present invention the hammer flange includes an adjustable hammer locus adjustment screw, and each pivoted hammer includes a radially extending shelf adapted to contact the screw when the hammer is in a rest position, the screw enabling adjustment of the rest position of the pivoted hammer and further providing simultaneous hammer bounce dampening when the hammer is abruptly returned to resting position during play.

In still one more aspect of the present invention the hammer flange is formed of moldable material, the hammer locus adjustment screw is formed of a material which is dissimilar to the material of the hammer flange and the screw is integrally molded into the flange during the manufacturing process. The molding process permits the use of an optional length screw or for manufacture of a flange without screws.

In yet another aspect of the present invention the hammer flange includes an adjustable hammer locus adjustment screw, and each pivoted hammer includes a radially extending shelf adapted to contact the screw when the hammer is in a rest position, and each hammer has a leaf spring connected thereto by a bridle strap, the bridle strap including an end extension adapted to cover and thereby provide padding to the shelf for damping the contact between the adjustment screw and the shelf as the hammer returns to its rest position following actuation during play.

In still one more aspect of the present invention leaf springs are connected to each pivotal hammer by bridle straps and a leaf spring pivot rail mounts the leaf spring and enables common rotational and twist adjustment of all of the leaf spring means. Leaf spring pivot rail bushings enable the leaf spring pivot rail to be set at a predetermined distance relative to the pivoted hammers. The bridle strap is factory adjustable in length to accommodate the predetermined relative distance between the leaf spring and the pivoted hammer to which it is attached.

In still one more aspect of the present invention an improved hammer includes a hammer shank having a top rail with hammer weight holding and positioning structure; a hammer head is positioned at a free end of the hammer for engagement with the hammer stop; a hammer journal end with structure for mounting the hammer on a flange for pivoted action; and, a user and/or manufacturer adjustable hammer weight having engagement structure for engaging the hammer weight holding and positioning structure at a position selectable by the user or manufacturer; thereby setting the weight of the hammer.

Further objects, aspects, advantages and features of the present invention will be more fully understood and appreciated by consideration of the following detailed description of a preferred embodiment, presented in conjunction with the accompanying drawings.

DETAILED DESCRIPTION OF A PREFERRED EMBODIMENT

Description of Keyboard Mechanism

Figure 1:
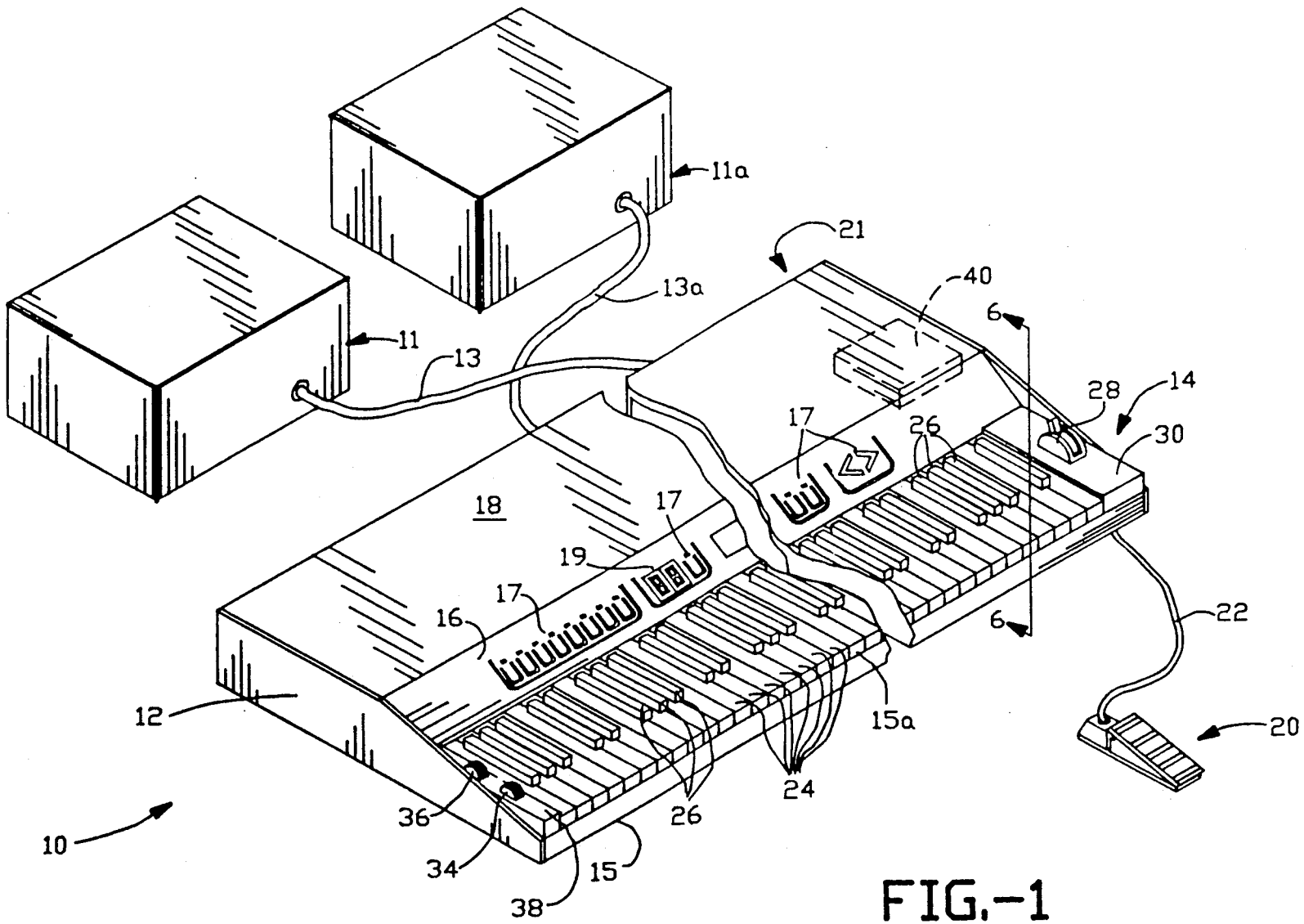
FIG. 1 is a diagrammatic view in perspective of an improved percussive action electronic keyboard shown connected by a cable to plural electronic musical sound generation devices, the keyboard incorporating the principles of the present invention.

As seen in FIG. 1, an improved percussive action electronic keyboard 10 includes a mounting base or substrate 15 to which a front panel 15*a*, a left side panel 12, a right side panel 14, and a rear panel 21 are secured. A front control panel 16 containing pressure sensitive input switches 17, digital readout displays 19 and a top cover 18 are both mounted between the side panels 12 and 14.

The keyboard 10 is connected to one or more electronic music generation devices 11, 11*a* via suitable connecting cables 13, 13*a* which plug into a jack panel at the rear of the keyboard 10. The music sound generation devices 11, 11*a* may be a single or multiple stacked musical synthesizer or sampled sound generators, or other such sound generation devices, and ultimately connects to loudspeaking equipment for sound reproduction (not shown). The connection cables 13 and 13*a* enable a standard interface connection, e.g. a musical instrument digital interface (MIDI) connection, to be established between the keyboard 10 and the electronic music sound generation devices 11 and 11*a*.

A variable adjustment foot pedal 20 is connected to the keyboard 10 via a connection cable 22. The footpedal provides an electrical signal which is related in magnitude or value to present pedal position and can be programmed to control multiple selected MIDI control function parameters such as volume, pan, portamento, and data entry. A foot switch (not shown) may also be attached by a suitable connection cable to the keyboard 10 to enable the player to have programmable control of multiple selected MIDI control function parameters such as damper, sustain, soft, sequencer, start, stop, and continue. The footswitch can also be selected to control multiple MIDI system—exclusive messages, thus communicating with exclusive control parameters indicative of different manufacturer's MIDI products. The keyboard 10 accommodates simultaneously up to four foot pedals 20 and up to three foot switches.

In addition, program advance library (PAL)/edit mode foot switch (not shown) is used to facilitate selection of edit operations and, when PAL switch 80 is selected on and in play mode, to easily advance through a preprogrammed sequence of global set ups entered into the PAL.

In the keyboard 10 shown in FIG. 1, eighty eight grand-piano-scaled wooden white keys 24, and black keys 26 are provided in conventional keyboard arrangement. While it is possible to include more playing keys, it is often useful to configure keyboards with fewer than 88 keys, and the components comprising the keyboard 10 are readily adaptable at the factory to the assembly of keyboards having fewer keys, as may be desired.

Figure 6:
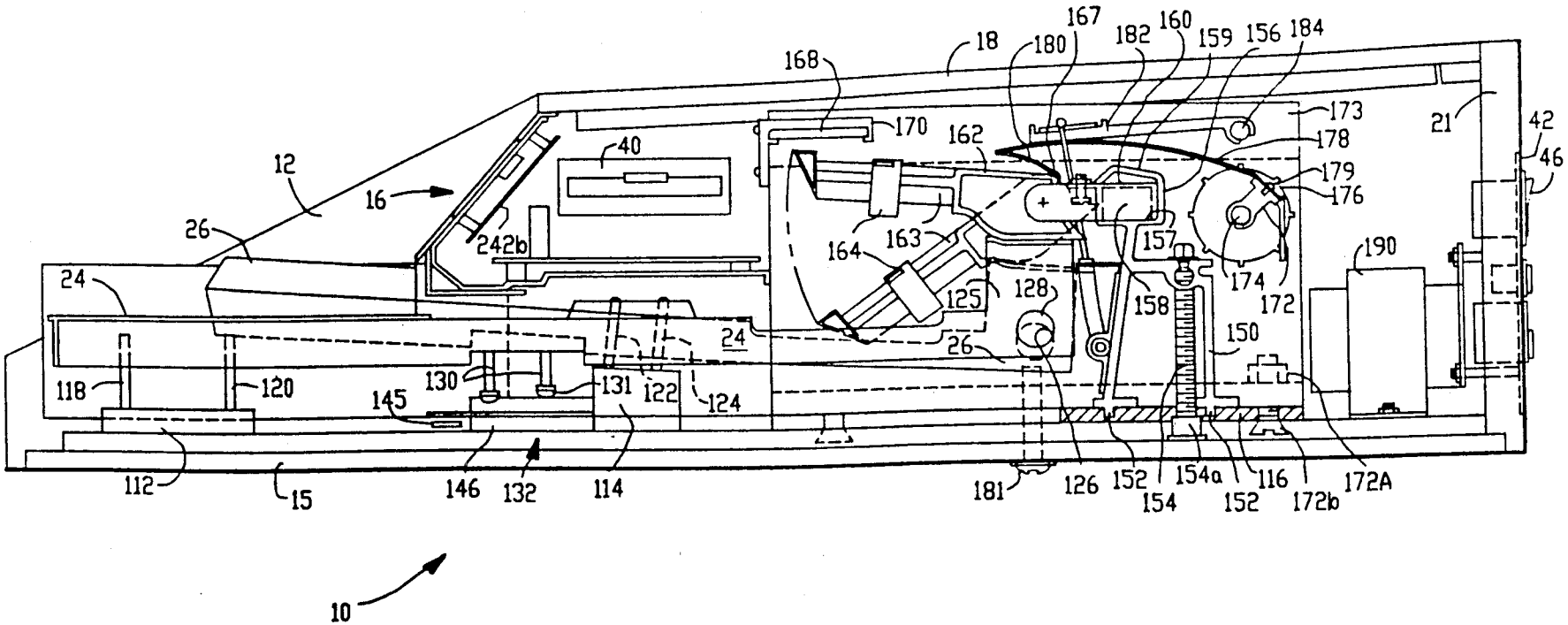
FIG. 6 is a somewhat diagrammatic right side section view in elevation of the FIG. 1 keyboard taken along the line 6—6 in FIG. 1.
Figure 18A:
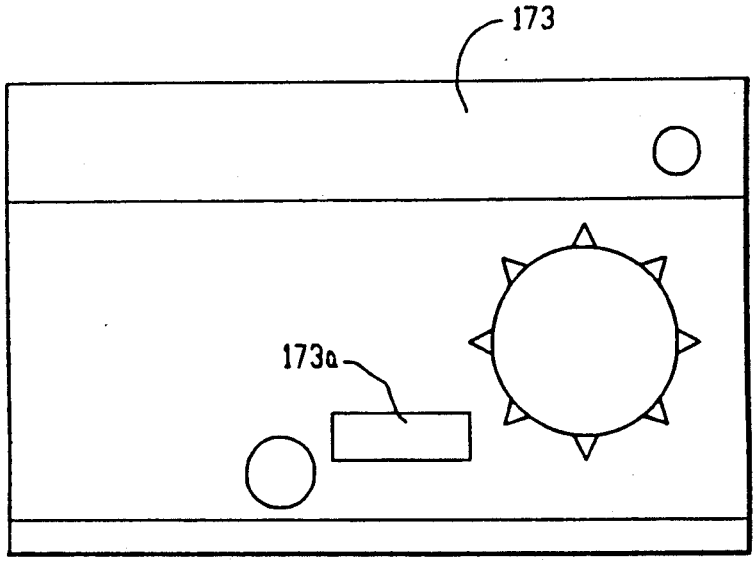
FIG. 18A is a front view of a portion of an end support block showing a slotted hole for connecting the end support block to the action rail.

A global mechanical action adjust wheel and lever 28 located in a right end raised portion 30 of the keyboard 10 connects to move a central wire relative to an outer shell of a coaxial control cable 32 (FIGS. 6 and 18(a). The cable 32 connects to a leaf spring adjustment assembly which adjusts the preload tension simultaneously for all the leafsprings when the leafsprings contact all of the hammer assemblies during play.

Referring to FIG. 1, two controller wheels, a continuous movement wheel 34 and a continuous movement return to center wheel 36 are mounted within a left side raised portion 38 of the keyboard 10. The continuous movement controller wheel 34 provides an electrical signal which is related in magnitude or value to present position; and, when in play mode, is programmable to control multiple selected MIDI control functions. Wheel 34 will enable rapid, smooth and variable manipulative control of the selected parameters; and, when in edit mode, will provide rapid, smoothly variable selection of alpha/numeric data entry values for edit functions selected by the user. The continuous movement return to center wheel 36 is programmable to control pitch blending and multiple selected MIDI control functions; and, while enabling rapid, smoothly variable control, will return to a spring loaded center position and corresponding value.

A three and one half inch micro-floppy disk drive 40 is mounted in the keyboard 10 with disk access provided through the right side panel 14. The disk drive 40 enables an unlimited number and variety of keyboard setups, system exclusive MIDI sound patch libraries and system exclusive function control messages, user definable velocity scales, user definable controller reset messages, program advance libraries (PAL), any MIDI to disk recorded system exclusive file saved from any MIDI device through the keyboard 10, and software MIDI dump requests to be stored and retrieved, thereby greatly extending the flexibility of the keyboard 10.

Figure 2:
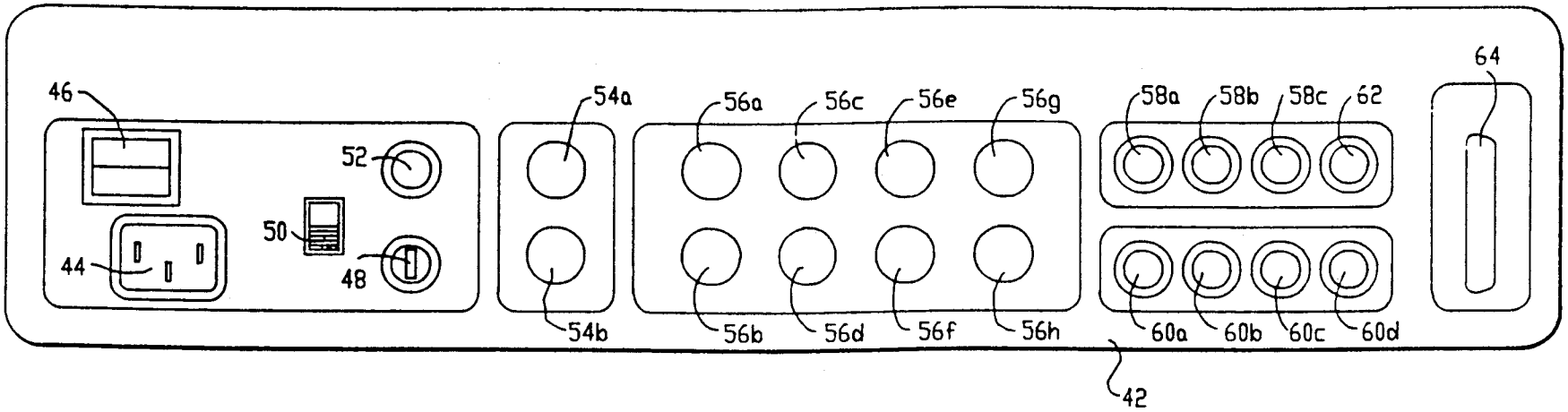
FIG. 2 is an enlarged diagrammatic view in elevation of a rear power switch and connection panel of the FIG. 1 keyboard.

Referring to FIG. 2, a rear panel 42 provides a jack 44 for primary power. A rocker switch 46 enables the user to apply primary power to the electronics circuitry within the keyboard 10. A fuse 48 protects the circuitry from overload. A switch 50 enables the user to select primary power level between 110 and 230 volts, so that the portable keyboard 10 may be used in foreign countries in which the primary wall power supply is 230 volts. A front panel lamp dimmer rheostat 52 enables adjustability of backlighting level at the front panel 16.

There are two MIDI input jacks 54*a* and 54*b*. These jacks enable MIDI signals to be received into the keyboard and processed therein. There are eight MIDI outport/processed thru port jacks 56*a*, 56*b*, 56*c*, 56*d*, 56*e*, 56*f*, 56*g* and 56*h*. These eight jacks enable eight simultaneous outputs to be transmitted by the keyboard 10 to external music generation devices 13, 13*a*, each output being programmably selected and configured within the keyboard 10. There are three MIDI assignable foot switch input jacks 58*a*, 58*b* and 58*c*; and there are four assignable foot pedal input jacks 60*a*, 60*b*, 60*c*, and 60*d*. PAL/edit footswitch input jack 62 is also provided to enable the user to step through a programmable chain of e.g. 100 global routines merely by depressing the footswitch (not shown). An external disk drive connection jack 64 enables a second, externally mounted disk drive to be connected to the keyboard 10.

Figure 3:
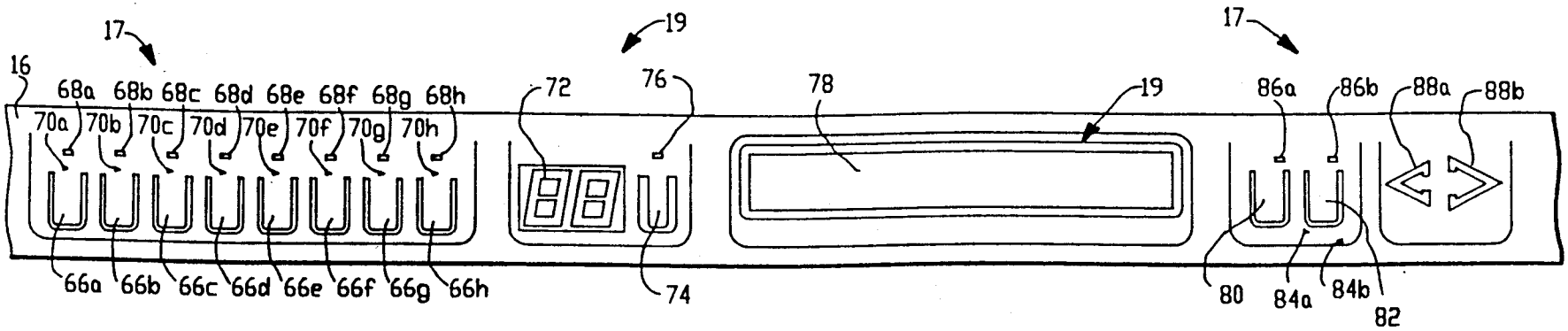
FIG. 3 is a diagrammatic view in elevation of the switch and display portion of the front control panel of the FIG. 1 keyboard.

FIG. 3 provides a further illustration of the control and display portion of the front panel 16. Within the array 17 of input switches at the front panel 16, eight MIDI operator switches 66*a*, 66*b*, 66*c*, 66*d*, 66*e*, 66*f*, 66*g* and 66*h* enable eight MIDI operator functions to be selected on or off for play for each global set up routine while in play mode, with each switch having a respective operator on/off indicator lamp 68*a*, 68*b*, 68*c*, 68*d*, 68*e*, 68*f*, 68*g* and 68*h*. Operator edit/compare indicator lamps 70*a*, 70*b*, 70*c*, 70*d*, 70*e*, 70*f*, 70*g* and 70*h* are respectively provided for each of the switches 66*a* through 66*h*. When operating in edit mode and when the edit lamp is not flashing, the lamps display which one of the eight operators have been selected for a "page two" edit.

When in "page two" operator edit mode and when a page two parameter has been changed and not saved into the global program set up by pressing write switch 74, when any one of the operator switches 66*a*, 66*b*, 66*c*, 66*d*, 66*e*, 66*f*, 66*g*, and 66*h* is pressed a second time, that respective operator will recall the original page two parameter values, prior to the newly edited parameters, and the corresponding operator edit mode indicator lamp will flash on and off. The previously selected and the newly selected function parameters will appear on the LCD upon each edit or compare selection.

When in play mode, continuous depression of the switch corresponding to the edited operator which was not written into the global program, will, in real time, result in rotation through three operator play mode states, the edited page two parameters, the previously unedited parameters, and the operator off selection; transmitting the unedited parameters or the edited parameters in the buffers simultaneously to selection. The third state is the operator off state which is an interval no-transmission state.

The digital displays 19 include a two digit global set up routine display 72 and a two line 80 character LCD display 78. The display 72 indicates numerically from zero through 99 which one of an available one hundred global set up routines is presently available for selection. The display 72 is also used to display certain system errors. A write switch 74 and write activity indicator lamp 76 enable entire global set ups, individual page two operator edits and manufacturer diagnostic and calibration parameters to be written into an interval memory, as well as copy page two operator edits to be moved to other locations within the 100 program global library. The liquid crystal function display 78 enables up to 80 characters and spaces to be displayed at a time in order to display the selected global program name, or, momentarily to display an operator name when that operator switch is pressed in play mode. A user movable cursor indicates and points to parameter information relating to each selected global setup program, etc.

PAL on-off switch 80 and an Edit selector switch 82 are also provided at the front panel 16. Indicator lamps 84*a* and 84*b* indicate whether Page One or Page Two has been selected; and indicator lamps 86*a* and 86*b* indicate whether PAL or EDIT mode has been selected. Data entry selector switches 88*a* and 88*b* enable the user to enter data incrementally or to enter "yes" and "no" response during edit mode operation.

Figure 4:
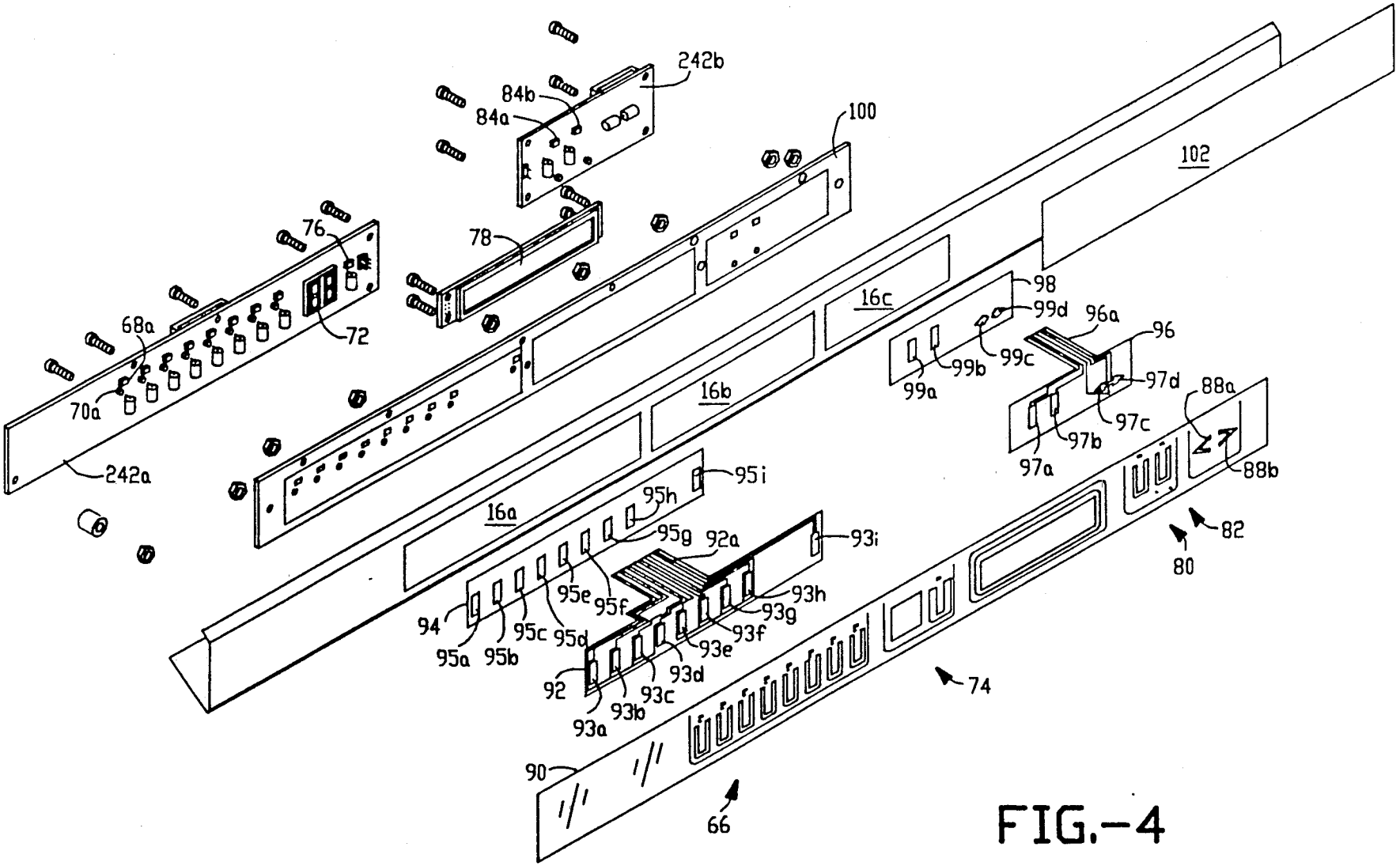
FIG. 4 is an exploded isometric view of the front panel assembly and electronics circuitry of the FIG. 1 keyboard.

FIG. 4 illustrates the sandwich construction of the switch portion of the front panel 16. A switch-indicia overlay 90 formed of transparent plastic flexible film material, such as Lexan TM is printed with the outlines of the switches 66, 74, 80, 82 and 88. A left contact array 92 is aligned in registration directly behind the switch 66 and 74 portion of the panel overlay 90. The left contact array is formed on a transparent plastic film substrate, such as Mylar TM or Ultem TM, and it contains conductive trace arrays 93*a*, 93*b*, 93*c*, 93*d*, 93*e*, 93*f*, 93*g*, 93*h*, and 93*i* in respective alignment with the indicia on the overlay for the switches 66*a* through 66*h* and switch 74.

Connections for the arrays 93*a* through 93*i* are gathered into parallel traces which extend along a rearwardly extending connection portion 92*a* of the left contact array 92 and extends through a slot in a transparent lens 100 and to a connector on a printed circuit board 242*a* carrying decode latch circuitry and light emitting diodes 68, 70, 76. A transparent plastic film 94, such as Mylar or Ultem, includes rectangular deposits 95*a*, 95*b*, 95*c*, 95*d*, 95*e*, 95*f*, 95*g*, 95*h*, and 95*i* of force sensitive resistance (FSR) material.

Each FSR rectangle is aligned with and faces a corresponding interleaved trace array 93*a* through 93*h*. An FSR rectangle 95*i* is aligned with the array 93*i* for the switch 74. As pressure is applied to one of the switches 66, 74, that pressure causes the corresponding trace array 93 to come into contact pressure with the FSR material, resulting in a bridge conduction path between the interleaved fingers having a resistance inversely related to applied pressure.

A right contact array 96 includes trace arrays 97*a*, 97*b*, 97*c* and 97*d*; and a film 98 carries FSR deposits 99*a*, 99*b*, 99*c* and 99*d* which are shaped and aligned to register with the trace arrays 97*a* through 97*d*. Connections for the arrays 97 are gathered into parallel traces which extend along a rearwardly extending connection portion 96*a* of the right contact array 96 and through a slot in transparent lens 100 to a connector on the circuit board 242*b*.

The front panel 16 is formed of suitably bent sheet metal and it defines openings 16*a*, 16*b* and 16*c*. The opening 16*a* is for the left contact array 92 and its FSR film 94 and for the two digit global set up routine display; the opening 16*b* is for the liquid crystal display 78; and, the opening 16*c* is for the right contact array 96 and its FSR film 98. Rigid transparent lens 100 attaches to the backside of the panel 16 and provides a substrate or base to support the flexible arrays 92 and 96 and their respective FSR films 94 and 98. Lens 100 also provides a transparent base so that the indicator lamps 68, 70, 76, 84*a*, 84*b*, 86*a* and 86*b* that are located directly behind the lens 100 will back illuminate the graphic indicia 90. The LED digital global display 72 and LCD function display 78 are also located directly behind the lens 100.

A brand or logo decal 102 coated with a suitable pressure sensitive adhesive may be affixed to the front panel 16 at a right side segment thereof.

Figure 5:
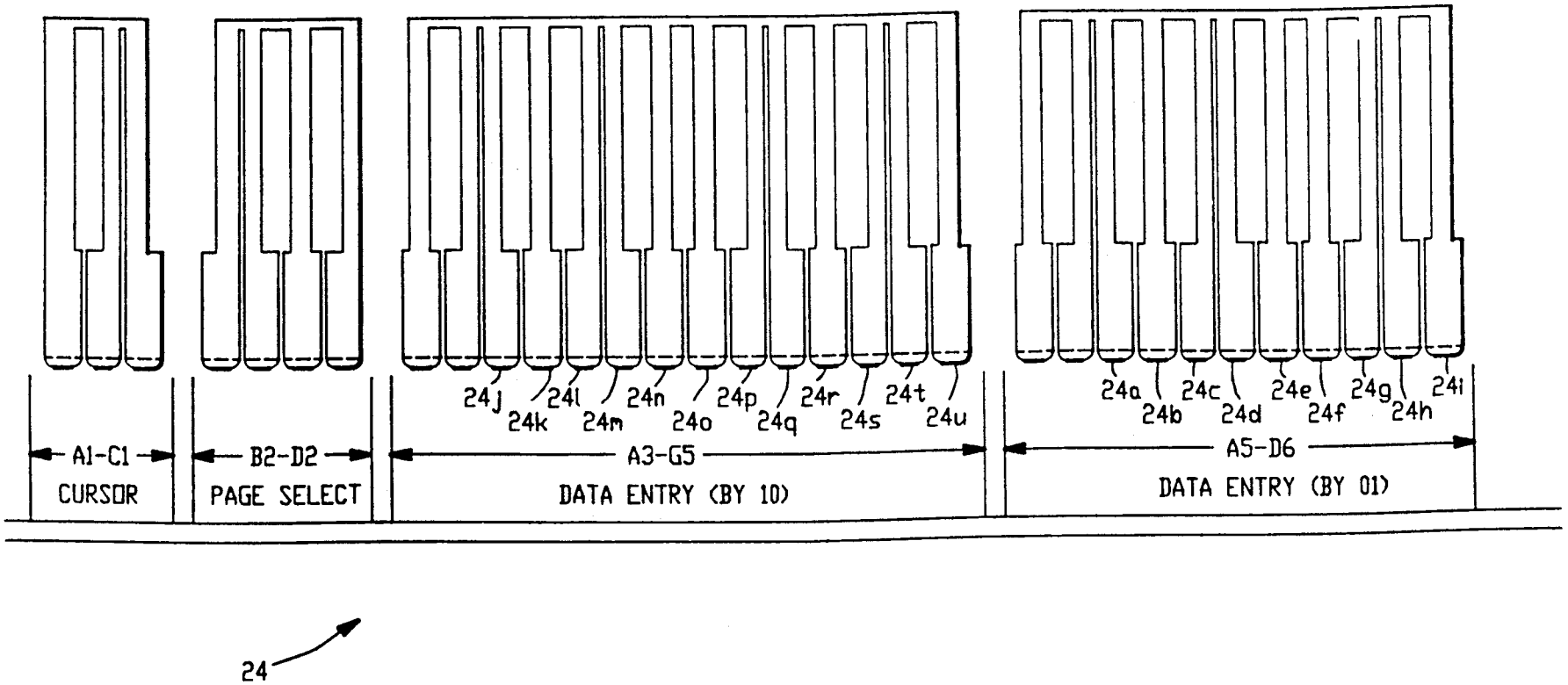
FIG. 5 is a diagrammatic plan view of the playing keys of the FIG. 1 keyboard illustrating indicia by which the keys may be switched to perform digital control and data entry functions.

FIG. 5 illustrates a pattern of graphical indicia affixed to, or printed or etched onto, the playing keys. When the keyboard 10 is operating in its edit mode as opposed to the performance mode, as selected by depression of the switch 82 or edit/PAL footswitch 62 when PAL switch 80 is selected off, some of the white keys 24 assume new roles. These roles are indicated by the overlay indicia illustrated in FIG. 5. For example one predetermined key moves the function display cursor to the left, while another key moves the cursor to the right. One key moves the cursor to its home or function select position. Three page access keys select whether the EDIT mode is page zero (utilities), page one (global functions) or page two (operator functions). A negative shift key enables a data input value assigned to data entry units keys 24*a* through 24*i* to have a negative or minus sign. Twelve decade keys 24*j* through 24*u* enable tens selection from zero to one hundred twenty, while the ten units keys 24*a* through 24*i* enable single digits to be entered. Thus, the number 39 would be entered by depressing the 30 tens key 24*l* and the 9 units key 24*i* at the same time or separately starting with a tens selection key etc. Alpha numeric and status data entry values and functions assigned to the white keys 24 allow for selection, additive accumulation, scrolling entry in negative value status, and left, right and home curser position selection. All key data entry and function page selection is accomplished in a configuration based on the "C" major scale, a rudiment of musical keyboard familiarization and education. The keyboard 10 is capable of acting as a digital data input device in a manner which is easily learned by the keyboardist and which is somewhat analogous to musical play. No separate keypad or keyboard is required in order to enter system (global) and operator parameter configuration data.

Turning now to FIG. 6, the baseplate 15 supports a solid keyframe 110. A longitudinal front rail 112, a longitudinal balance rail 114 and a transversely adjustable, longitudinal back rail 116 are attached to and supported by the keyframe 110 and baseplate 15. The front rail 112 includes an array of guide pins, one for each key; there is a longitudinally aligned series 118 for the white keys 24 and a longitudinally aligned series 120 for the black keys 26. The balance rail 114 includes an array of balance pins, one for each key; there is a longitudinally aligned series 122 of balance pins for the white keys 24 and a similarly aligned series 124 balance pins for the black keys 26.

Each key 24, 26 includes a raised hammer-strike end portion 125 for adjustably striking or cam sliding a corresponding hammer assembly depending upon the factory adjusted position of the hammer locus adjustment screw 211. The end portion defines a cylindrical opening 126 in which a weight 128 is fit. The mass (thickness) of the weight 128 is selectable, and each weight 128 is selected and positioned to provide a desired counterbalance to its key, so that each key is naturally balanced to be in the upward position at the play area of the keyboard 10, irrespective of the position of the hammer assembly.

Each key includes an adjustable key sensor screw 130 which is threaded into an opening of the key just to the left of the balance pin 122 or 124, as seen in FIG. 6. Each key sensor screw 130 has a downwardly dependent, hemispherically shaped contact surface 131 which engages in XYZ percussive force sensor control panel assembly 132, depicted in FIG. 7.

Figure 7:
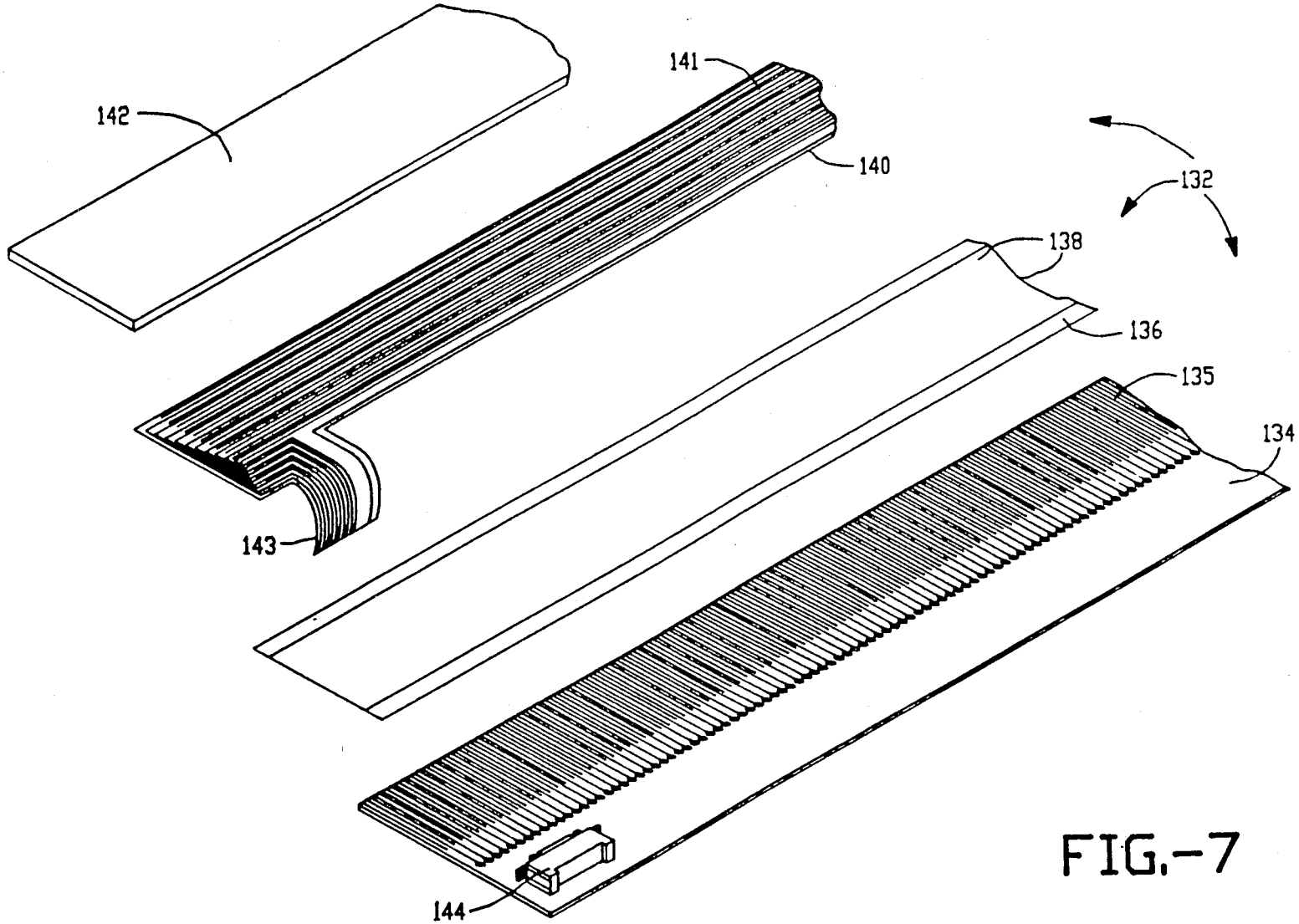
FIG. 7 is an exploded isometric view of an XYZ FSR key sensor assembly for use within the FIG. 1 keyboard with the right portion thereof broken off to save drawing room.

The FIG. 7 assembly 132 includes a printed circuit substrate 134 having an upwardly facing major surface defining an array of transverse interleaved sensor fingers 135. A thin, flexible film 136 has each of its major surfaces coated with a force sensitive resistance (FSR) ink coating 138. A thin, flexible film 140 supports an array of longitudinal interleaved sensor fingers 141 which downwardly face the upper FSR surface of the film 136. A longitudinal strip 142 of suitably elastomeric material, such as Poron TM or an equivalent, overlies the film 140. The hemispherical surface 131 of each screw 130 comes into contact with the top surface of the strip 142 at the impact location against the longitudinal trace film 140, FSR film 136, and transverse trace PCB 134. The longitudinal traces of the film 140 are connected to decode circuitry 145 mounted to the underside of the circuit board substrate 134 via a thin film extension 143 of the film 140 which connects to a plug 144 mounted on the PCB 134. The entire laminar sensor assembly 132 is mounted upon a longitudinal sensor assembly support rail 146.

Figure 21:
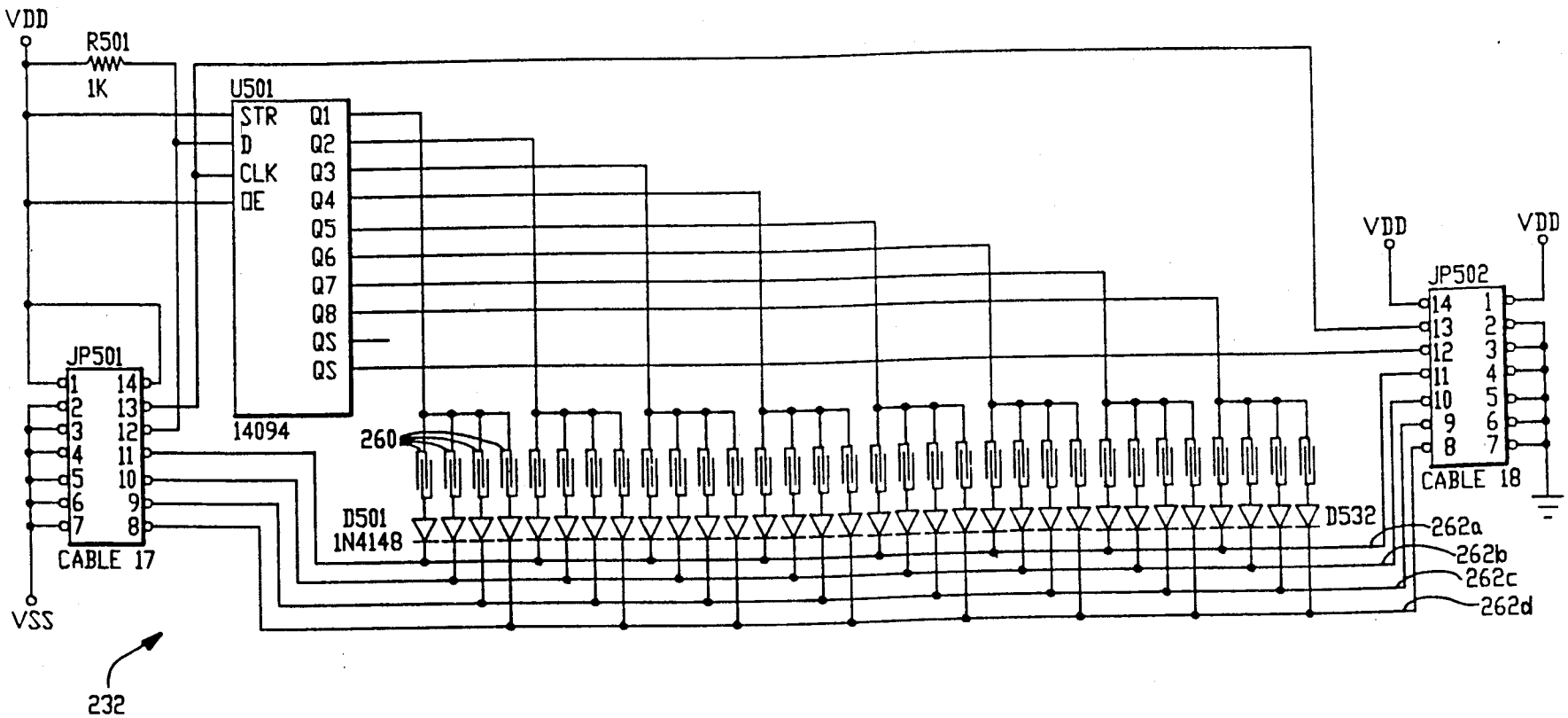
FIG. 21 is an electrical schematic and block diagram of one printed circuit substrate individual cell key sensor array for 32 playing keys. Several sensor arrays are employed in 88 key keyboards of the type shown in FIG. 1.

As a less expensive alternative to the XYZ sensor arrangement depicted in FIG. 7, a force impact sense resistance cell may be formed for each key, as depicted in the electrical schematic of FIG. 21. In this lower cost approach the individual interleaved conductors of each cell are formed on the printed circuit substrate 134' and the film 136' has a force impact sense resistance material coating only on the major surface thereof facing the traces of each cell of the substrate 134'. The longitudinal elastomeric strip 142 directly overlies the film 136'. One drawback of the use of dedicated force resistance cells is that conventional keyboard assemblies having keyboards that are made of wood can have a broad and inconsistant tolerance for the center spacing of each key and in the area between each key. This inconsistant tolerance causes a plunger, or any key impact actuation means, to be somewhat misaligned with each cell causing each cell to have its own peculiar electrical characteristics which requires additional timely alignment and calibration adjustments during the manufacturing process.

Referring again to FIG. 6, a longitudinally extending, "h" shaped action rail 150, preferably formed by extrusion of aluminum, includes at two lower ends two longitudinal keys 152 which seat in longitudinal keyways formed in the transversely positionable backrail 116. The action rail 150 (best shown in the FIG. 6A detail) is secured to the backrail 116 and solid keyframe 110 by several spaced apart action rail mounting bolts 154 and "T" nuts **154*a*. At its apex 156 the action rail 150 defines a horizontal shelf 157 which aligns and supports banks of tandem arranged, twelve station hammer flanges 158**.

Seven twelve station hammer flanges 158 and one four station hammer flange (formed by simply cutting off one of the twelve station flanges at the four station point) provide a keyboard having 88 keys in conventional acoustic piano arrangement. The hammer flanges 158 are preferably molded of a suitable plastic material, such as Delrin TM.

Figure 8:
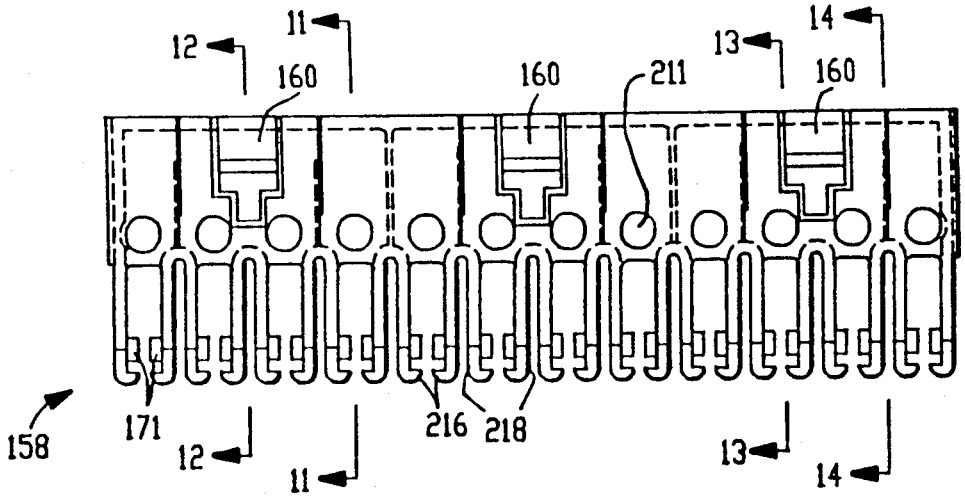
FIG. 8 is a top plan view of a snap-in modular hammer flange having 12 hammer stations which is included in the FIG. 1 keyboard.
Figure 9:
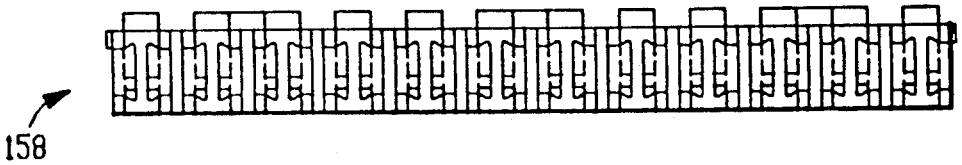
FIG. 9 is a front view in elevation of the FIG. 8 hammer flange.
Figure 10:
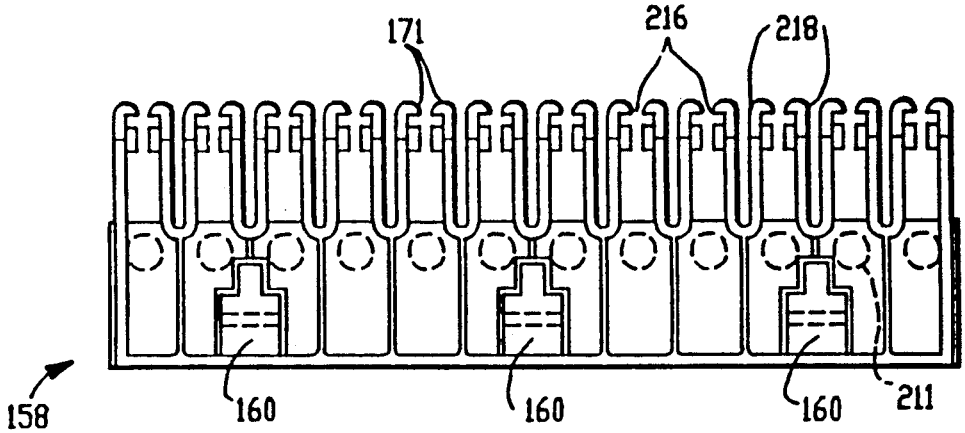
FIG. 10 is a bottom plan view of the FIG. 8 hammer flange.
Figure 11:
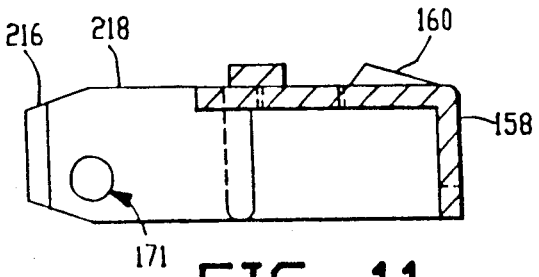
FIG. 11 is a transverse sectional view of the FIG. 8 hammer flange taken along the section line 11—11 in FIG. 8.
Figure 12:
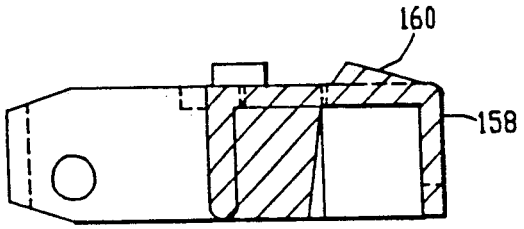
FIG. 12 is a transverse sectional view of the FIG. 8 hammer flange taken along the section line 12—12 in FIG. 8.
Figure 13:
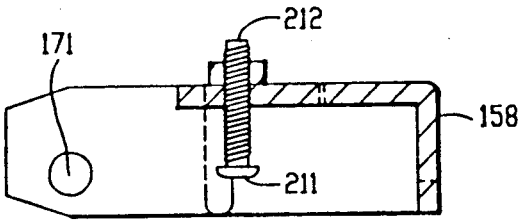
FIG. 13 is a transverse sectional view of the FIG. 8 hammer flange taken along the section line 13—13 in FIG. 8.
Figure 14:
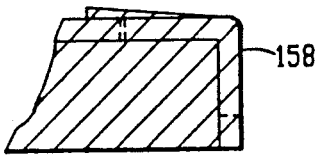
FIG. 14 is a transverse partial sectional view of the FIG. 8 hammer flange taken along the line 14—14 in FIG. 8.

The action rail 150 further includes a top clamping portion 159 which cooperates with three snap locks 160 formed in each flange 158 (FIGS. 8–10) to enable each flange 158 to be snap locked into the action rail between the horizontal shelf 157 and the top clamping portion 159. The snap locks 160 have outer contours which are congruent with the underside of the top clamping portion so that the flange 158 is precisely aligned with the action rail 150 when snap-locked into place.

Figure 6A:
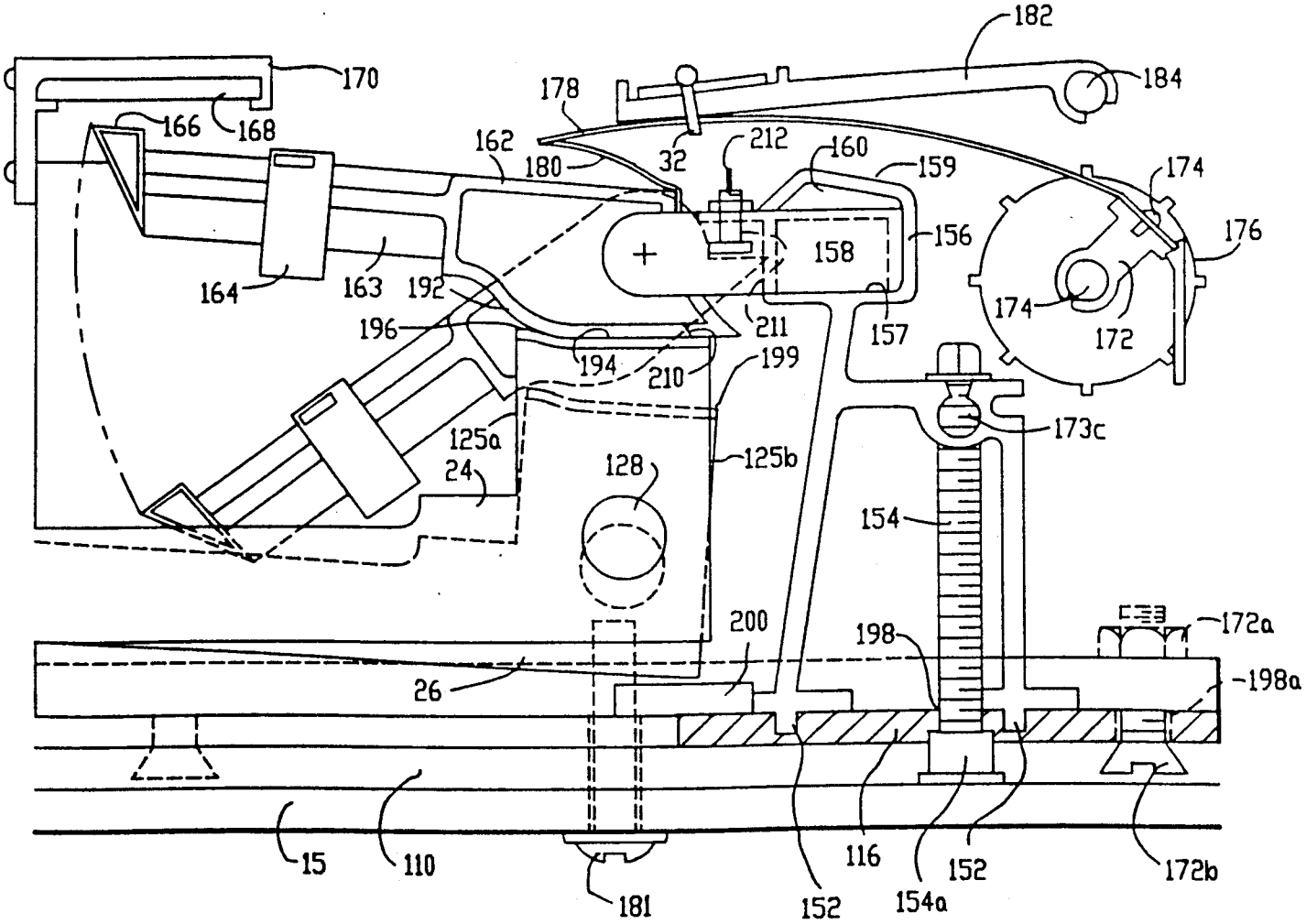
FIG. 6A is an enlarged, diagrammatic portion of the FIG. 6 right side sectional view, illustrating details of the hammer action assembly of the FIG. 1 keyboard.
Figure 6C:
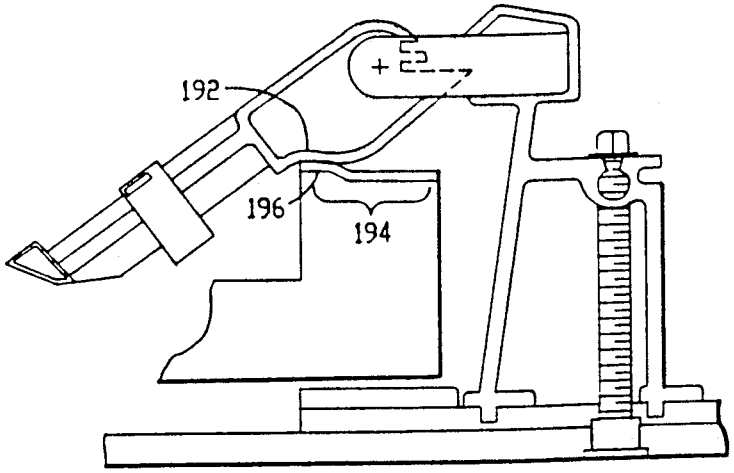
FIGS. 6B, 6C, 6D, 6E, 6F and 6G are diagrams illustrating establishment of discontinuity "kerchunk" between the playing key and the hammer, by virture of position adjustability of the action rail relative to the keys.
Figure 15:
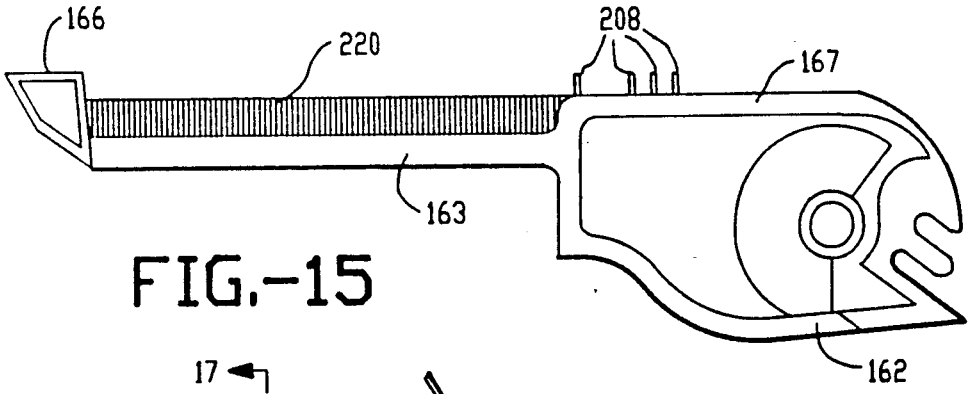
FIG. 15 is a side view in elevation of a hammer which snap-locks into the FIG. 8 hammer flange at one of the 12 hammer stations thereof.
Figure 16:
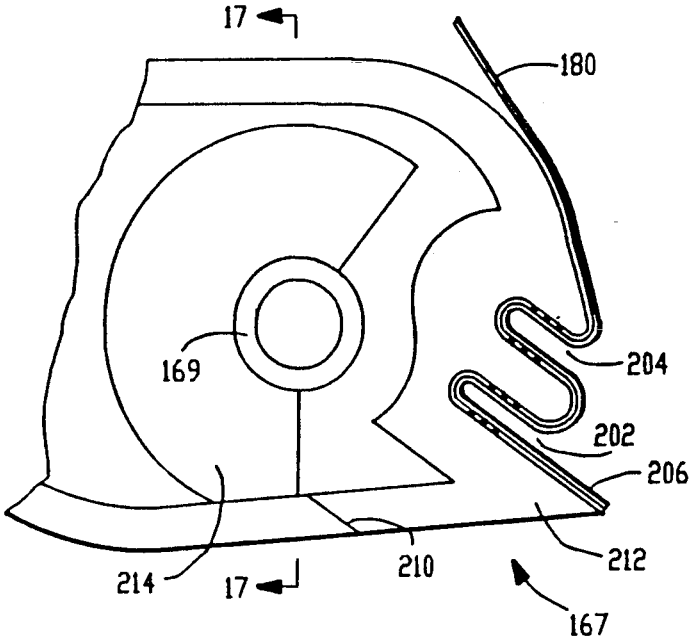
FIG. 16 is a greatly enlarged side view of the snap-engagement end of the FIG. 15 hammer.

Referring to FIG. 6A, a hammer 162, molded of a different plastic material than the flange, ABS plastic for example, snap-locks into each hammer station of the flange 158. The hammer 162 includes a hammer mass 164 which may be adjustably clamped at any desired location along a shank portion 163 of the hammer. A hammer head 166 at the free end of the hammer 162 comes into contact with a hammer stop compression pad 168 at the end of the upward throw of the hammer and then falls and locks into place via the chisel edges 210 at its escapement distance away from the hammer stop pad 168 when any of the keys 24, 26 are struck and held down, even momentarily. The compression pad 168 is mounted and carried within an extruded aluminum hammer stop rail 170. Referring to FIGS. 15 and 16, the hammer 162 includes a journal end 167 which is formed with a transversely extending cylindrical hub 169 which surroundingly engages hammer mounting pins 171 of the molded flange 158 at each hammer station (FIGS. 8–14) when the hammer 162 is snap-locked into the hammer station of the flange 158.

Figure 18:
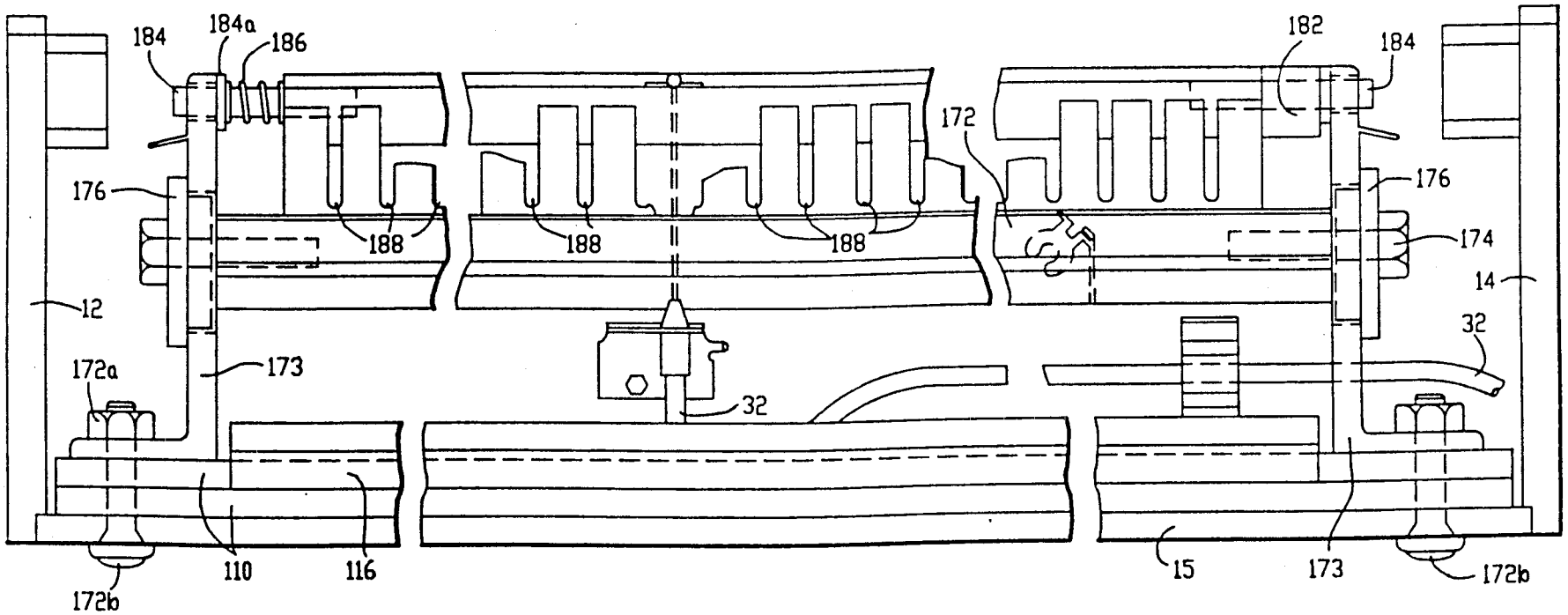
FIG. 18 is a diagrammatic view in front elevation of the leaf spring pivot rail and the leaf spring relief bar of the FIG. 1 keyboard.
Figure 18B:
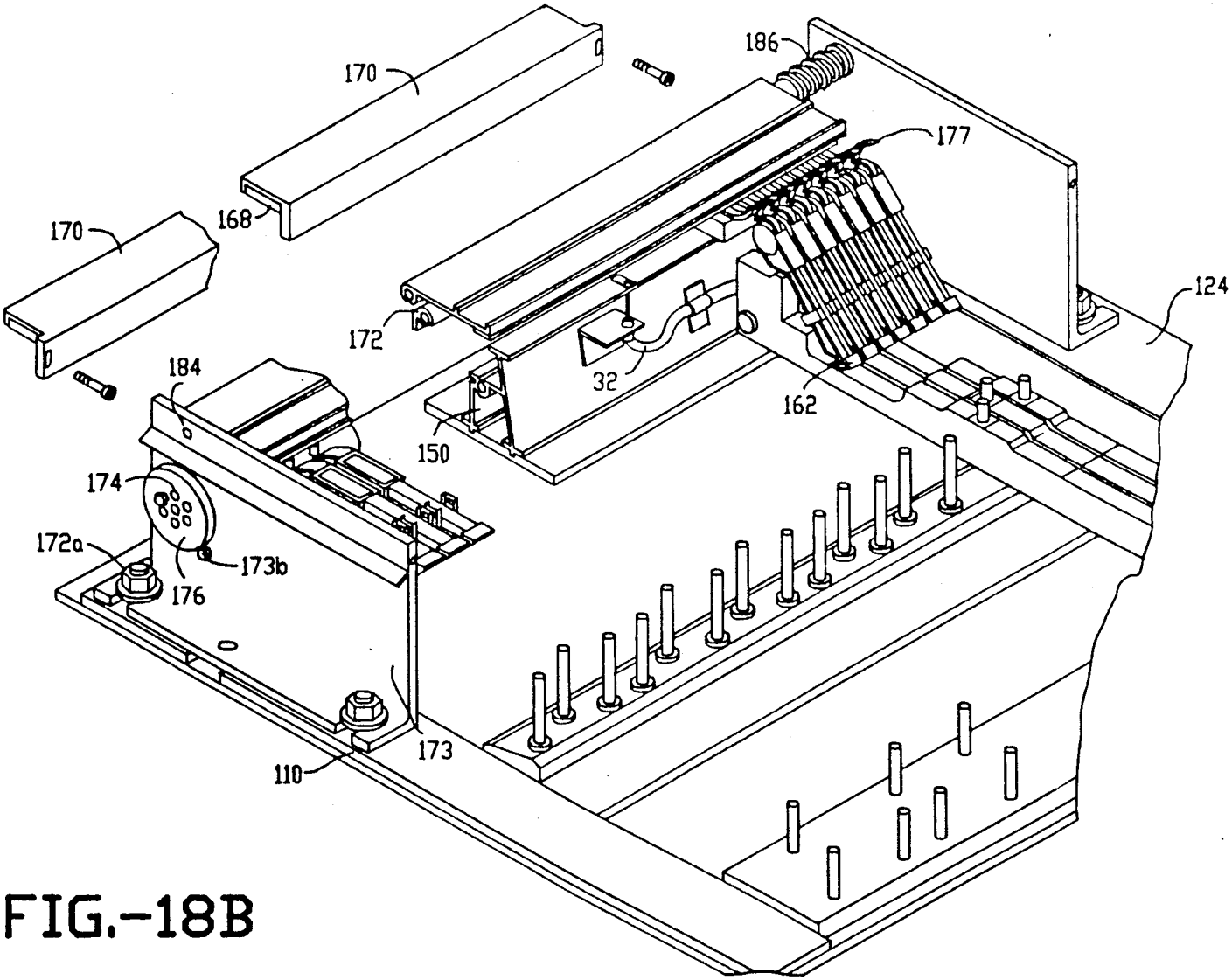
FIG. 18B is a diagrammatic view in perspective of a percussive action electronic keyboard with the cover removed and showing the alignment bushing positioned in the end block assembly, a single glange and hammer assembly positioned above several keys, and the control cable.
Figure 19B:
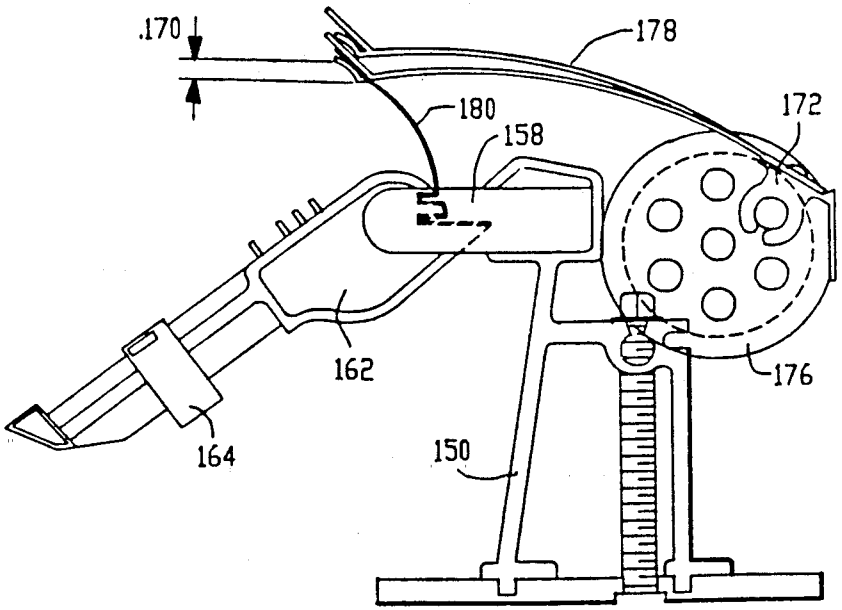
Figure 19A:
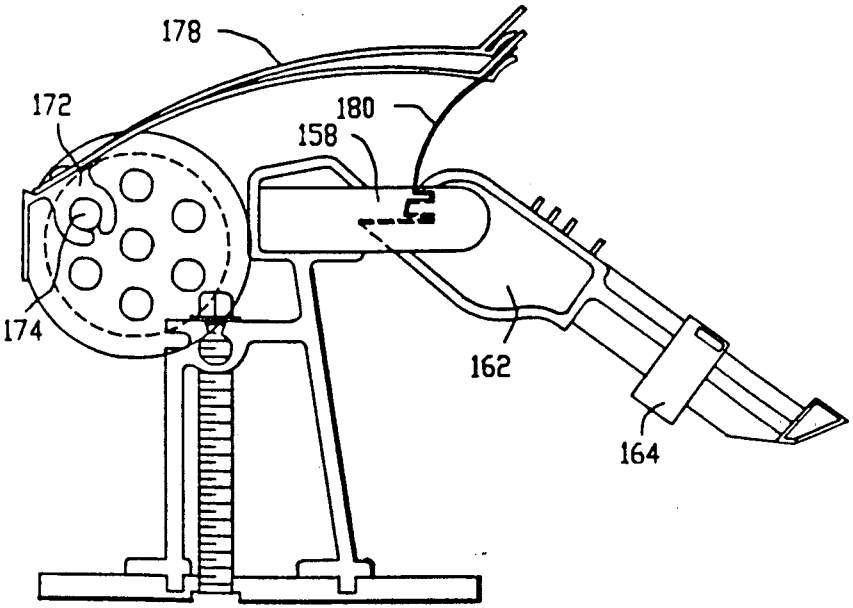
Figure 19C:
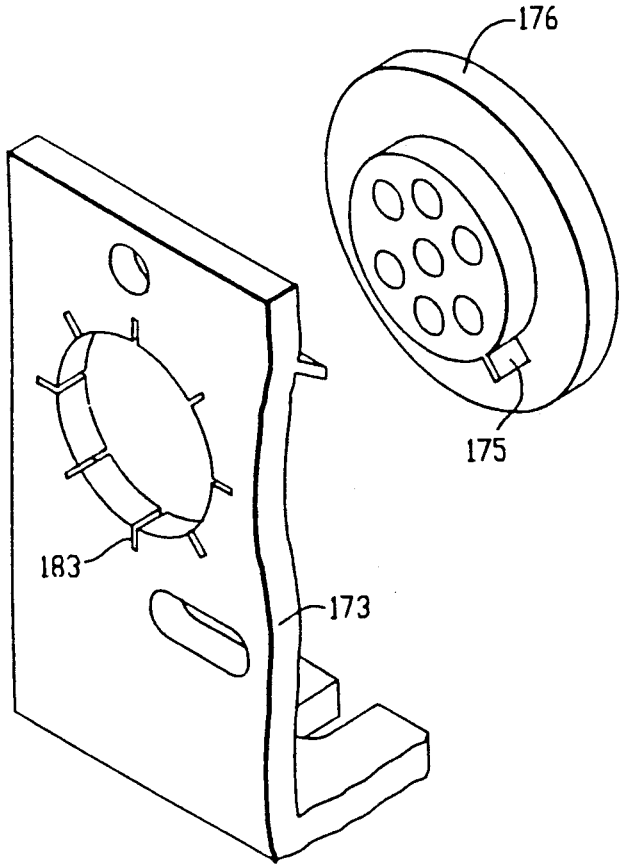
Figure 23P:
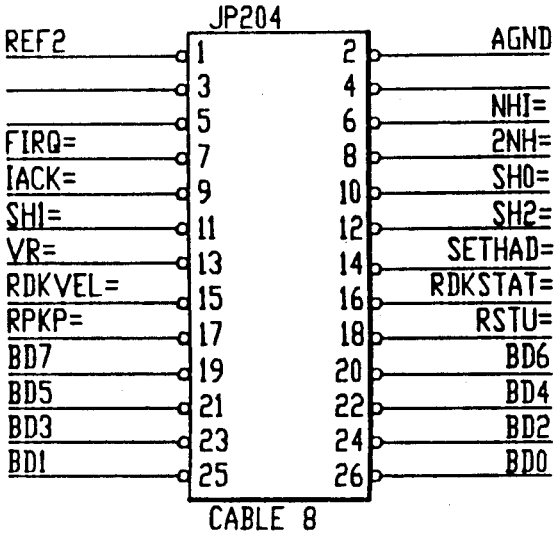
FIGS. 23A and 23AA, 23B, 23C, 23D, 23E, 23F, 23G, 23H, 23I, 23J, 23K, 23L, 23M, 23N, 23O, and 23P together form an electrical schematic and block diagram of a key scanner state machine for repetitively scanning each key cell of the key sensor array of FIG. 21 to determine if the key has been imported.
Figure 20A:
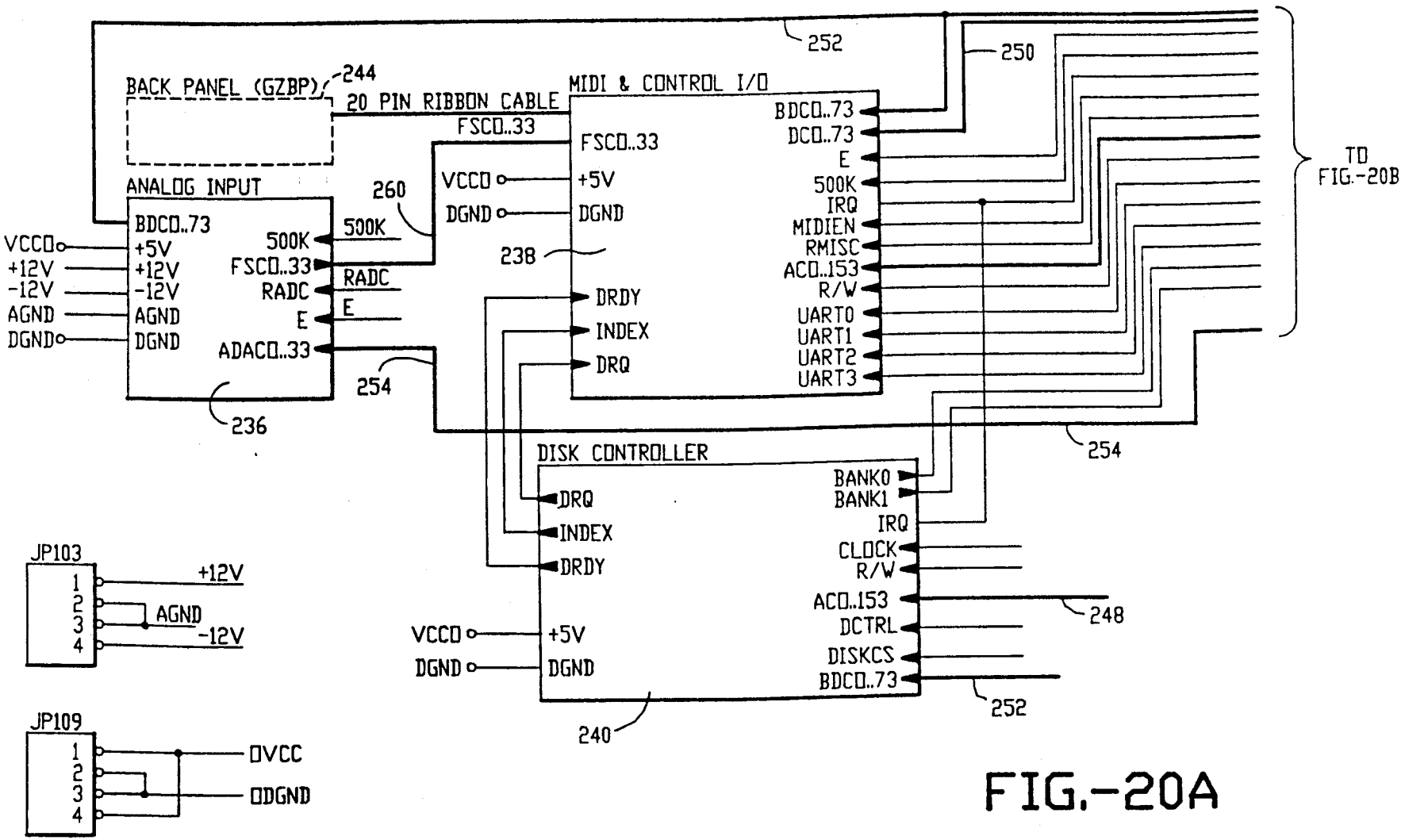
FIGS. 20A and 20B form an overall electrical system structural block diagram of a control system for controlling operations within the FIG. 1 keyboard.
Figure 20B:
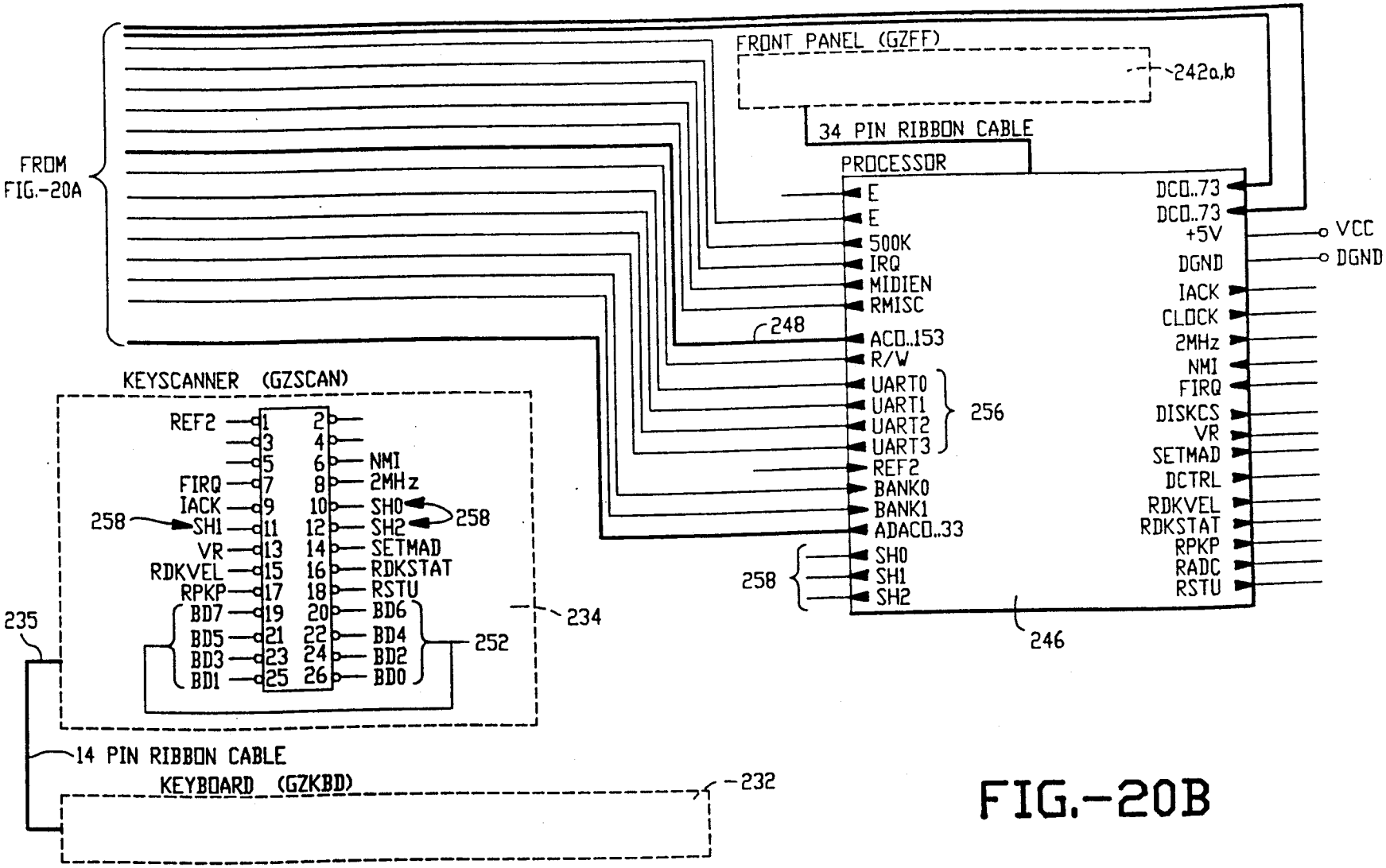

Referring to FIGS. 6, 18 and 18B, a leaf spring pivot rail 172 is mounted between two end support blocks 173 adjacent the respective side walls 12 and 14 by two leaf spring pivot rail fastener screws 174 which pass through two leaf spring pivot rail bushings 176 and thread into the rail 172. The end blocks 173 are secured to the baseplate 15 and keyframe 110 by the bolts 181 and threaded holes in support blocks 173 and to the keyframe 110 by the screws **172*b* and nuts 172*a*. Referring to FIGS. 18 and 18*b*, the end support blocks 173 are secured to action rail 150 by the self-threading bolts 173*b* passing through slotted holes 173*a* in support blocks 173 and secured in holeway 173*c* in action rail 150, as best seen in FIG. 18A. Securing support blocks 173 and action rail 150 to the baseplate 15 and keyframe 110 provides a non-warping base support for the solid keyframe assembly 110**, which is made of wood.

Alignment of the leaf spring pivot rail 172 relative to the action rail 150 is adjustably established at the factory with the aid of two leaf spring pivot rail bushings 176. As shown in FIGS. 19A, 19B, 19C, and 19D, each bushing 176 defines a plurality of openings 177 any one of which being sized to receive the screw 174 therethrough. A matching set of opposed holes 177 is selected at the factory per the customer's specification in order to establish the vertical and horizontal dimensions separating the leaf spring pivot rail 172 and the action rail 150. The opposed holes 177 define a plurality of factory settings which provide a plurality of playing action feels when action adjust level 28 is selected by the player in an effect position. A key 175 on the bushing 176 mates with one of a plurality of keyways 183 formed in a circular opening of the end block 173. Since the holes 177 are at different radii, rotation of the bushing 176 and alignment of its key 175 with the different keyways provides a simple way of obtaining a wide variety of relative distance alignment setups.

Referring to FIG. 6A, each hammer 162 has a corresponding leaf spring 178 which is attached at one end to the leaf spring pivot rail 172 by a screw 179. The leaf spring 178 attaches at its free end to a woven fabric or other suitable material bridle strap 180. The bridle strap attaches to the journal end 167 of the hammer 162 as best seen in FIG. 16 and provides a spring bias force which selectively resists the movement of the hammer 162 toward its impact position with the hammer stop compression pad 168 so as to impart further tactile sensation to the player of the keyboard.

Referring to FIGS. 18 and 18B, a transverse, pivotally mounted leaf spring relief bar 182 is controlled by position of the action wheel 28 and central strand of the control cable 32. The relief bar 182 is mounted to the end blocks 173 via two mounting pins 184 floating in two pivot pin bushings 184*a* for smooth pivot motion. A compression spring 186 is preloaded against support block 173 to hold the relief bar assembly 182 in place after a one pin at a time snap-in assembly procedure. The leaf spring relief bar is pivotally mounted against the upward pull of the leaf springs 178 within the distance dictated by the length of the bridle straps so that when the central strand of cable 32 is affected by the action adjust lever assembly 28, the preload of the leaf springs 178 will selectably encounter the movement of the hammers 162 during the upward strike motion caused by depressing keys 24, 26 during play, thereby adjusting when and how much leaf spring preload is experienced by the player, making the playing action of keyboard 10 adjustable from light to heavy by the player via the adjust lever 28. The compression spring 186 biases the relief bar 182 against the direction of pull against the leaf springs 178 imparted by the central strand of the cable 32. The leaf spring 178 includes tine openings 188 which enable individual hammers 162 to engage and release each of the leaf springs 178, thereby allowing for independent leaf spring and hammer interaction.

Referring again to FIG. 6, a keyboard system power supply includes a transformer 190 which is mounted to the substrate 15 and support frame 110 at a location inbetween and to the rear of the end blocks 173 within the housing of the keyboard 10. The power supply converts line current into low voltage DC required for the electronic control circuitry 230.

Referring to FIG. 6A, each hammer 162 includes a symmetrical S-shaped cam follower surface 192 which is contacted by an upwardly facing cam surface 194 of the raised hammer-strike or cam follower end portion 125 of each key 24, 26 when it is impacted. The cam surface 194 includes a raised portion 196. As is perhaps best seen in FIG. 6A, a mounting hole 198 defined through the backrail 116 for each bolt 154 and "T" nut 154*a*, and a mounting hole 198*a* defined through backrail 116 for each bolt 172*b*, have larger inside diameters than the outside diameter of the respective bolts 154 and 172*b*. The clearance between the backrail 116 and each bolt 154 and "T" nut 154*a* provides a range of adjustment, preferably about 0.060".

By providing this range of adjustment at the factory during assembly of the keyboard 10, the spacing of the action rail 150 is adjustable relative to each key 24, 26. This adjustment has a pronounced effect upon the relationship between the cam surface 194 of the key 24, 26 and the follower surface 192 of the associated hammer 162 as shown in FIGS. 6B–6G. In the alignment shown in FIGS. 6B, C and D, the follower surface 192 always follows the raised portion 196 of the cam surface 194 throughout its range of movement, and there is no noticeable discontinuity as the key is impacted during play. After the hammer has struck the hammer stop pad and fallen to its escapement position as shown in FIG. 6D, the follower surface 192 is completely contacted by the flat portion of the key cam surface 194 and the inside portion 125*c* of follower surface 192 is supported by the inside sloping portion 125*d* of the raised portion 125*b*. In the resting position shown in FIG. 6B, the end cam portion 125*b* and the entire raised cam portion 196 are both broadly contacted by the large curved portion 125*e* of the follower surface 192.

Figure 6E:
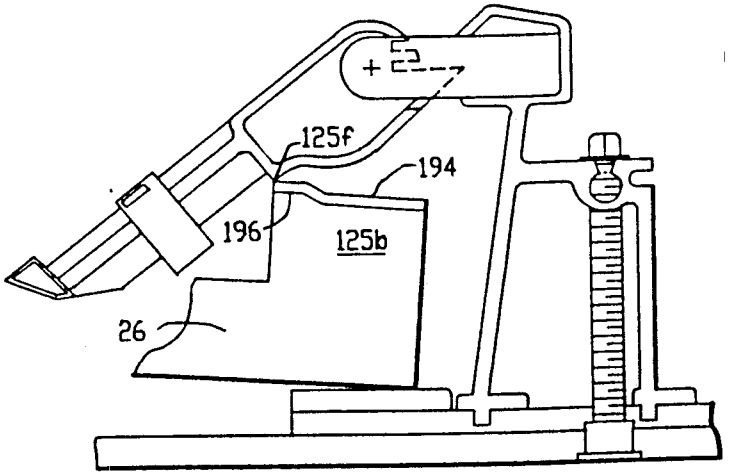
Figure 6B:
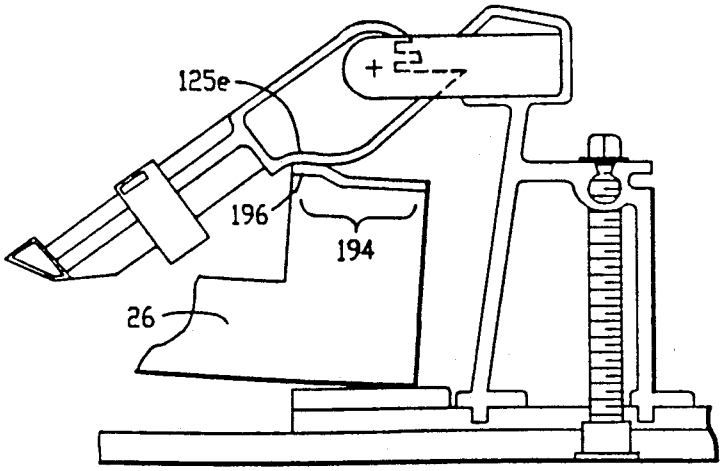
Figure 6D:
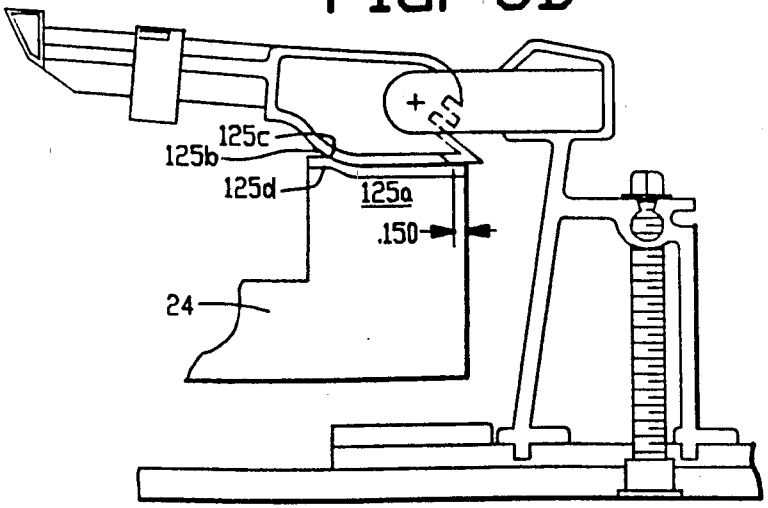
Figure 6G:
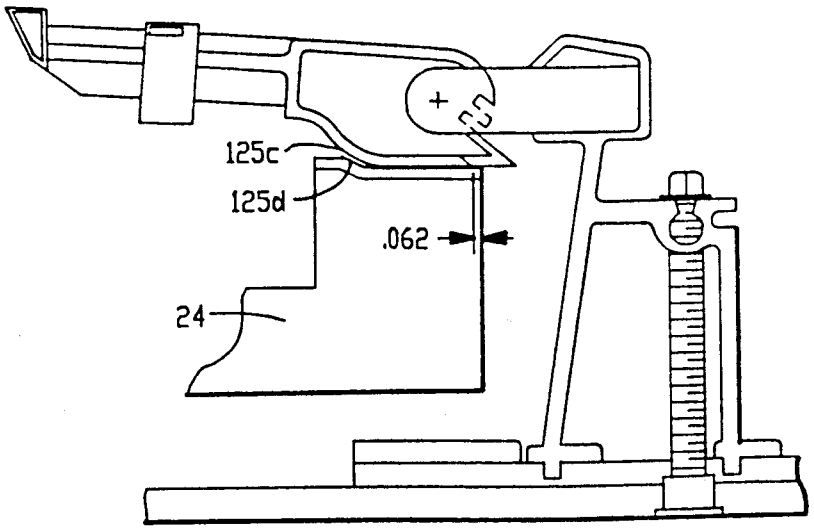
Figure 6F:
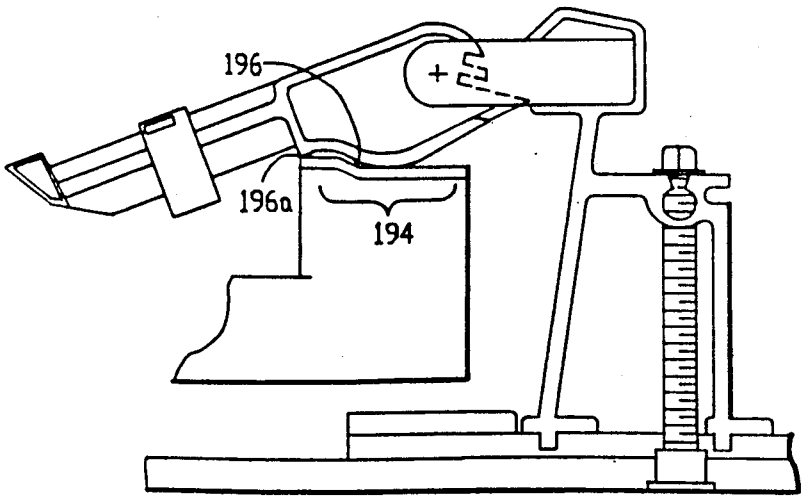

In another alignment shown in FIGS. 6E,F and G, the inside portion 125*c* of the follower surface 192 is not contacted by the inside sloping portion 125*d* after the hammer has struck and fallen to its escapement position, FIG. 6G. In the resting position shown in FIG. 6E, the leading edge portion 125*f* of the follower surface 192 is resting on the raised portion 196 of cam surface 194. In this second alignment as shown in FIG. 6F, there is a discontinuity of contact between the cam surface 194 and the follower surface 196 which creates the tactile sensation which the applicant calls "kerchunk". If kerchunk is desired, the back rail and action rail are aligned as shown in FIGS. 6A,E,F and G; if not, then the tack rail and action rail are moved toward the keys 24, 26 to eliminate the contact discontinuity, as shown in FIGS. 6B,C and D.

Each cam surface 194 is provided with a fabric pad 199 to dampen impact forces between the cam surface 194 and follower surface 192. A longitudinal felt strip 200 attached to the front of the back rail 116 dampens the fall of each key 24, 26 at its resting position.

Referring to FIGS. 15 and 16, the journal portion 167 of each hammer includes two slots 202 and 204 which have tines 205 formed therein. During assembly of the keyboard 10, the bridle strap 180 is looped in two places and then inserted into the slots 202 and 204, and then glued in place. A stop shelf 206 of the journal portion 167 extends outwardly adjacent to the slot 202, and the bridle strap 180 is dimensioned to cover the stop shelf 206 in order to provide a stop felt. Knock off pins 208 extend from the top of the hammer 162, and one of these pins will be used to secure the free end of the bridle strap 180 until it may be connected to its leaf spring 178 during final assembly. The multiple pins enable the bridle strap to be made to one of a variety of predetermined lengths, based upon the spatial relationship between the leaf spring pivot rail 172 and the action rail 150, as established by the selection of holes 177 in the leaf spring pivot rail bushings 176.

Each hammer 162 is formed with two chisel edges 210 separated by a central part 212 extending out to form the stop shelf 206. These chisel edges contact the fabric pad 198 at the cam surface 194 of each key 24, 26, and thereby reduce hammer bounce after the hammer 162 strikes the hammer stop pad 168 and falls to its escapement position.

Figure 17:
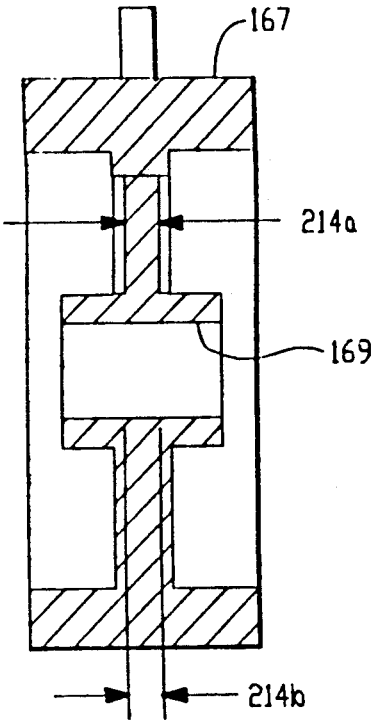
FIG. 17 is a sectional view of the FIG. 15 hammer taken along the line 17—17 in FIG. 16.
Figure 19D:
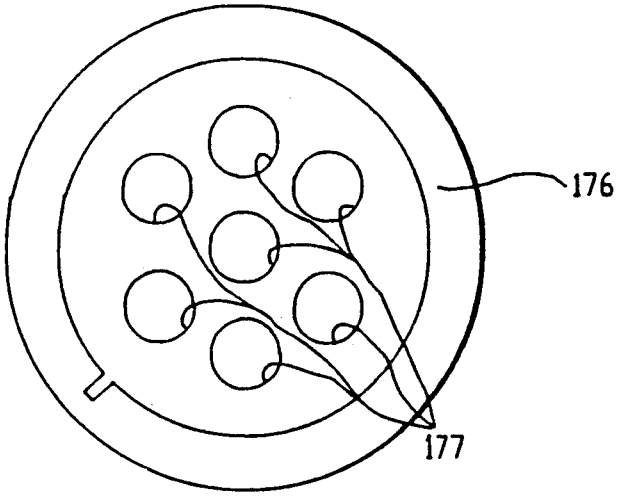
FIGS. 19A, 19B, 19C and 19D are detail views of the leaf spring pivot rail and end block assembly, showing the rotationally positionable alignment bushing for adjustably positioning the leaf spring pivot rail relative to the action rail in the FIG. 1 keyboard.

The journal portion 167 of each hammer 162 includes a semi-circular web 214 which may be provided with a predetermined surface treatment to add a controlled amount of texture or surface finish thereto on each side. The web portion 214 of the journal region of the hammer 162 cooperates with oppositely facing blade edges 216 of two front parts 218 formed at each hammer station in the hammer flange 158. As seen in FIG. 17, the thickness dimension of the web portion 214 smoothly varies from a thicker cross section dimension at the top 214*a* to a thinner cross section dimension at the bottom 214*b*.

With this arrangement, the oppositely facing blade edges 216 of the flange 158 come into contact with the thickened web portion 214*a* when the hammer 162 is at rest position, but go out of contact with the thinned web portion 214*b* as the hammer moves toward its striking position. This arrangement between the flange 158 and the hammer 162 causes all of the hammers to be precisely aligned at their rest positions, and enables them to be freely moveable in the region of impact during play. Also, when the edges 216 come into contact with the web 214 as the hammer 162 moves towards its resting position, hammer bounce is further dampened and impeded.

A threaded metal hammer locus adjustment screw 211 is integrally molded into the hammer flange 158 at each hammer station, as shown in FIGS. 6A, 8, 10 and 13. The adjustment screw 211 has a smooth hemispherical lower end which comes into contact with the stop shelf 206 of the hammer 162 which is cushioned by the bridle strap 180 at its rest position. A flattened tab end 212 of each screw 211 enables the screw to be rotated up and down in the flange 158 and thereby adjusts the range of throw of the hammer 162 between its resting position and its momentary impact position against the hammer stop compression pad 168.

The shank portion 163 of the hammer 162 has a top rail which is "coined" with vertical ridges and grooves 220 (FIG. 15), so that a weight clamp having opposed vertical blades may engage the grooves 220 so that the weight will maintain its preset position on the shank irrespective of hammer velocity and impact force during extended use of the keyboard 10.

Control System 230

Figure 27A:
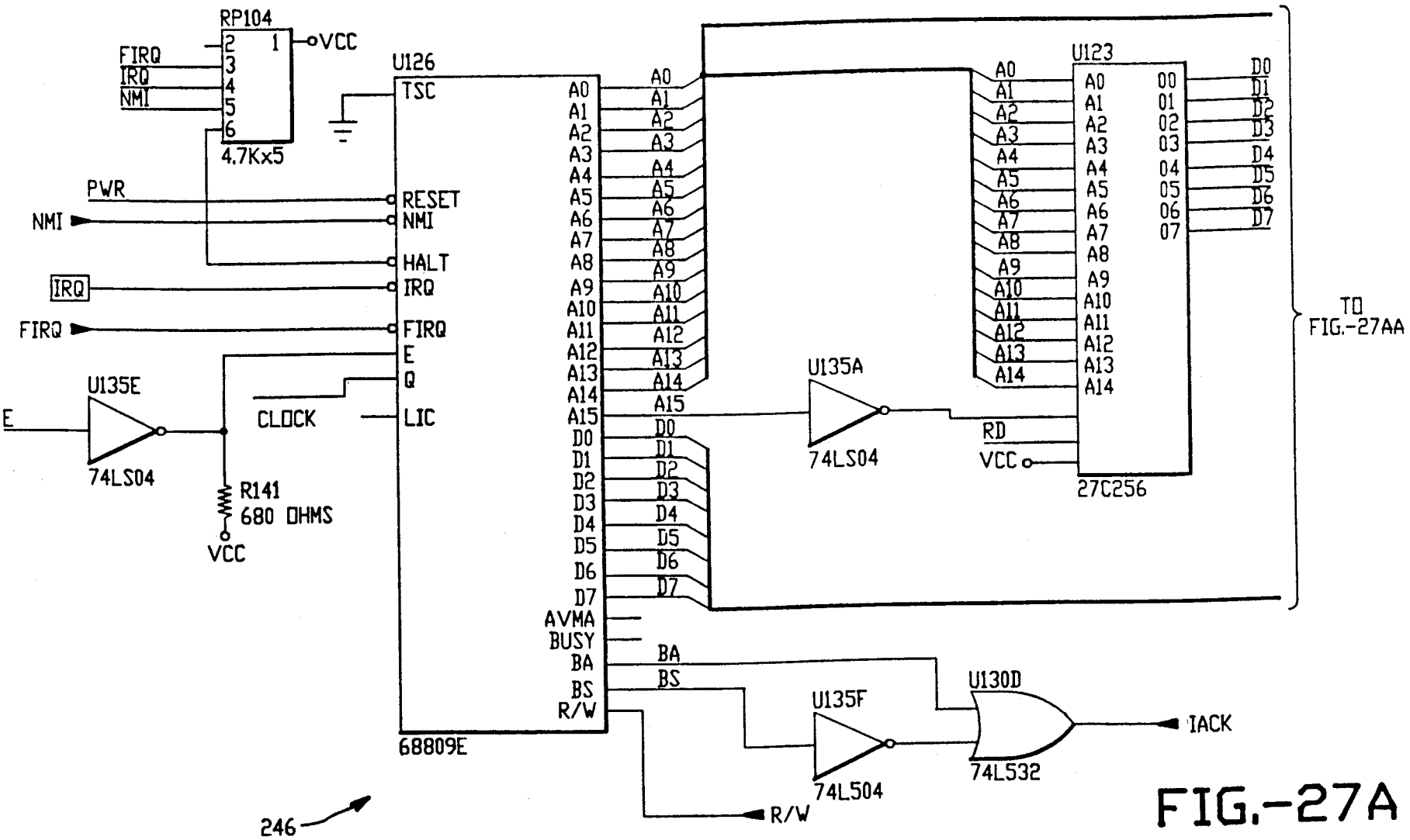
FIGS. 27A 27AA and 27B are electrical schematic and block diagrams of a microprocessor supervisor circuit of the FIG. 20 control circuit.
Figure 27A:
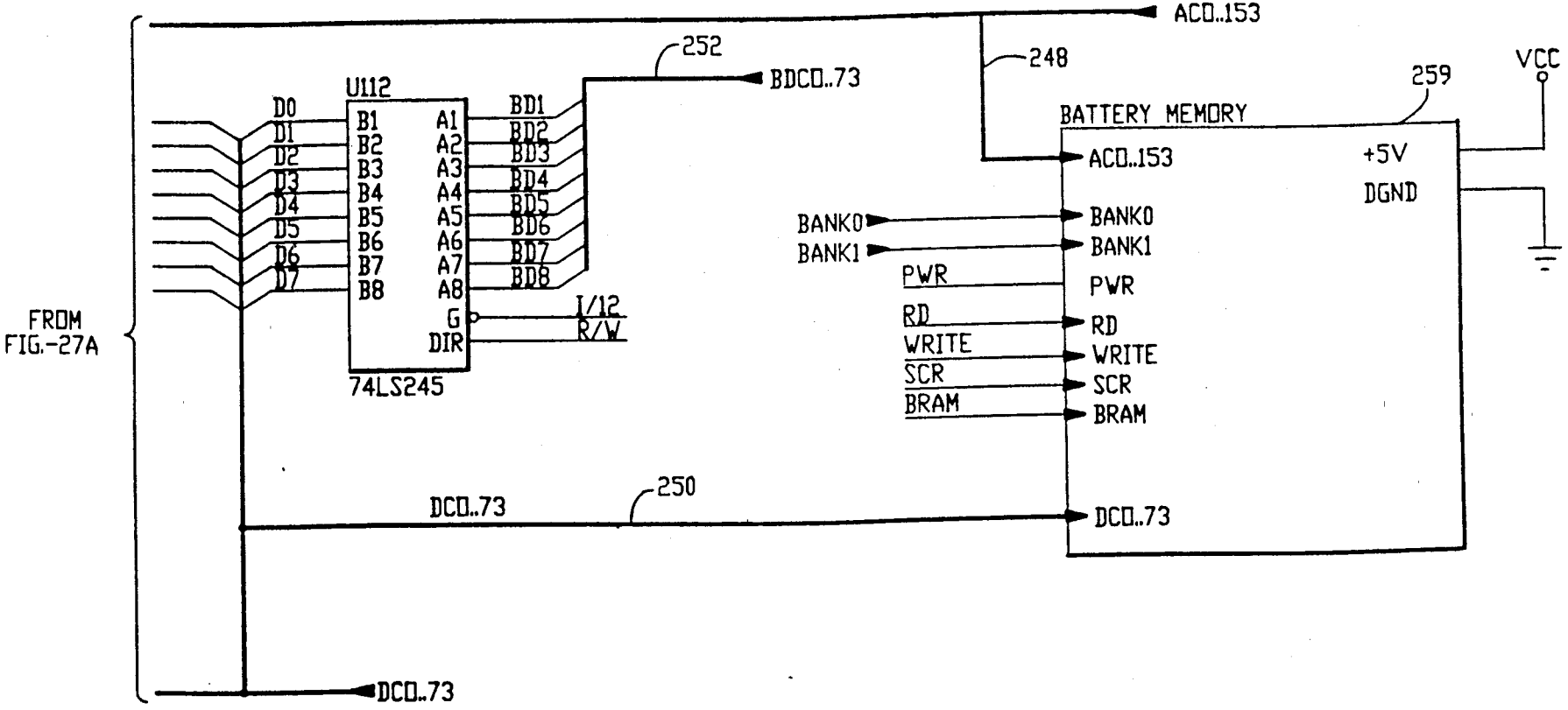
Figure 27B:
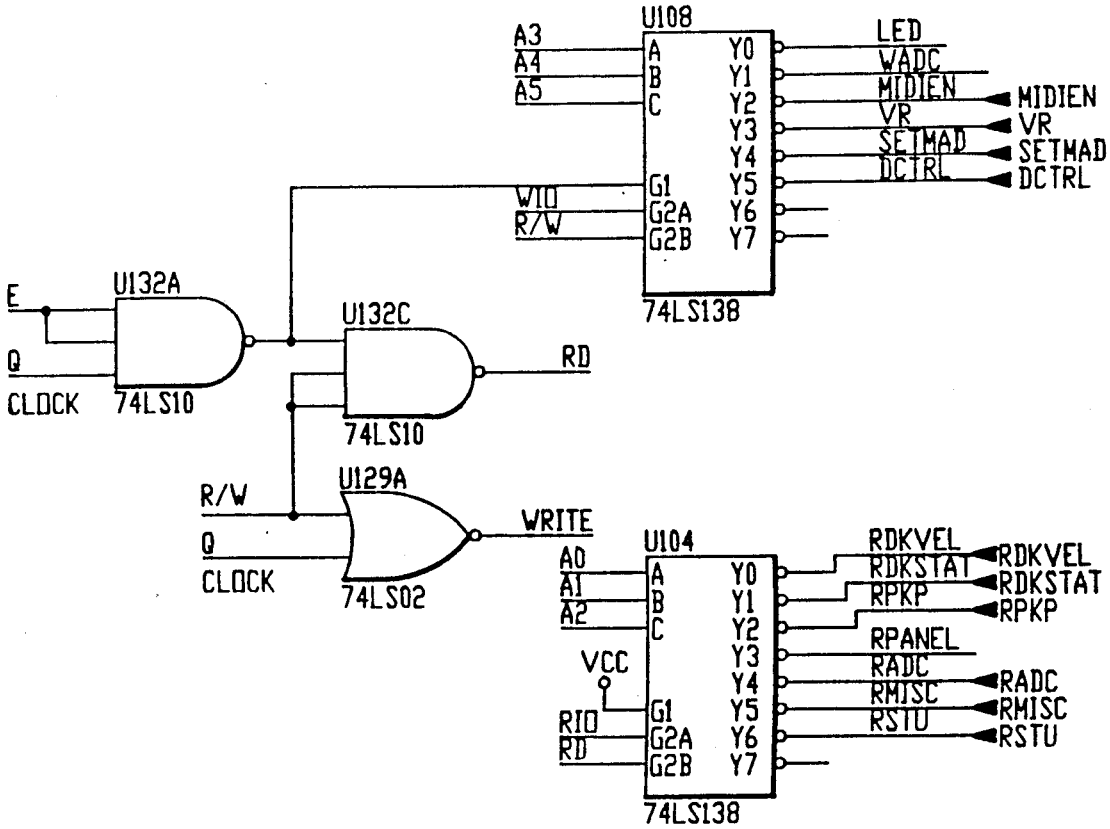

The microprocessor-based electronic control system 230 for controlling functionality of the keyboard 10 is set forth structurally in FIGS. 20 through 27, and functionally in FIGS. 5, and 28 through 30B. With reference to FIGS. 20A and 20B the control system 230 includes keyboard force impact sensor array 232 (FIG. 21), a keyboard scanner state machine 234 (FIGS. 22 and 23a–p), and a cable 235 connecting the keyboard sensor array 232 with the scanner 234. The control system 230 further includes an analog input circuit 236 (FIGS. 24 and 24A), a MIDI input/output circuit 238 (FIG. 25), a floppy disk controller circuit 240 (FIG. 26), a front panel circuit 242 including the printed circuit boards 242*a*, 242*b*, a rear panel circuit 244, and a microprocessor supervisor and memory circuit 246 (FIG. 27).

The control system 230 includes a 16 bit address bus 248, a "D" 8 bit data bus 250, a "BD" 8 bit data bus 252, an "ADA" four bit analog multiplexer address bus 254, four UART lines 256, three "SH" sample and hold select lines 258 and a number of additional single control lines which will be referred to by the name given to each in the figures. Common reference numerals and common names indicate that the lines indicated thereby are commonly connected.

Referring to FIG. 21, the individual key cell keyboard sensor array implementation 232 defines an arrangement of key cells 260 of interleaved contacts. The individual key cells are arranged in groups of four. One contact for each cell is parallel connected with like contacts of three other, adjacent cells. The other contact for each cell leads through a one way diode to one of four scan buses 262*a*, 262*b*, 262*c* and 262*d*. A decoder U501 is clocked at a predetermined clocking rate. The decoder has eight outputs, each of which are connected to four parallel contacts of four adjacent key cells 260.

If FSR material is pressed onto one of the cells as its associated key is impacted current from the one contact flows through the FSR material into the other contact and is led through the diode to one of the four scan buses 262*a*, 262*b*, 262*c* and 262*d*. The amount of current flow is directly related to the physical position of the key after impact activation by the player. Thus, it is possible to detect current flow during a scan by sequentially monitoring the four scan buses. Each key is thereby identified by the enabled output of the decoder and the particular scan bus during each phase of the bus scan operation.

Key Scanner State Machine 234

Figure 22:
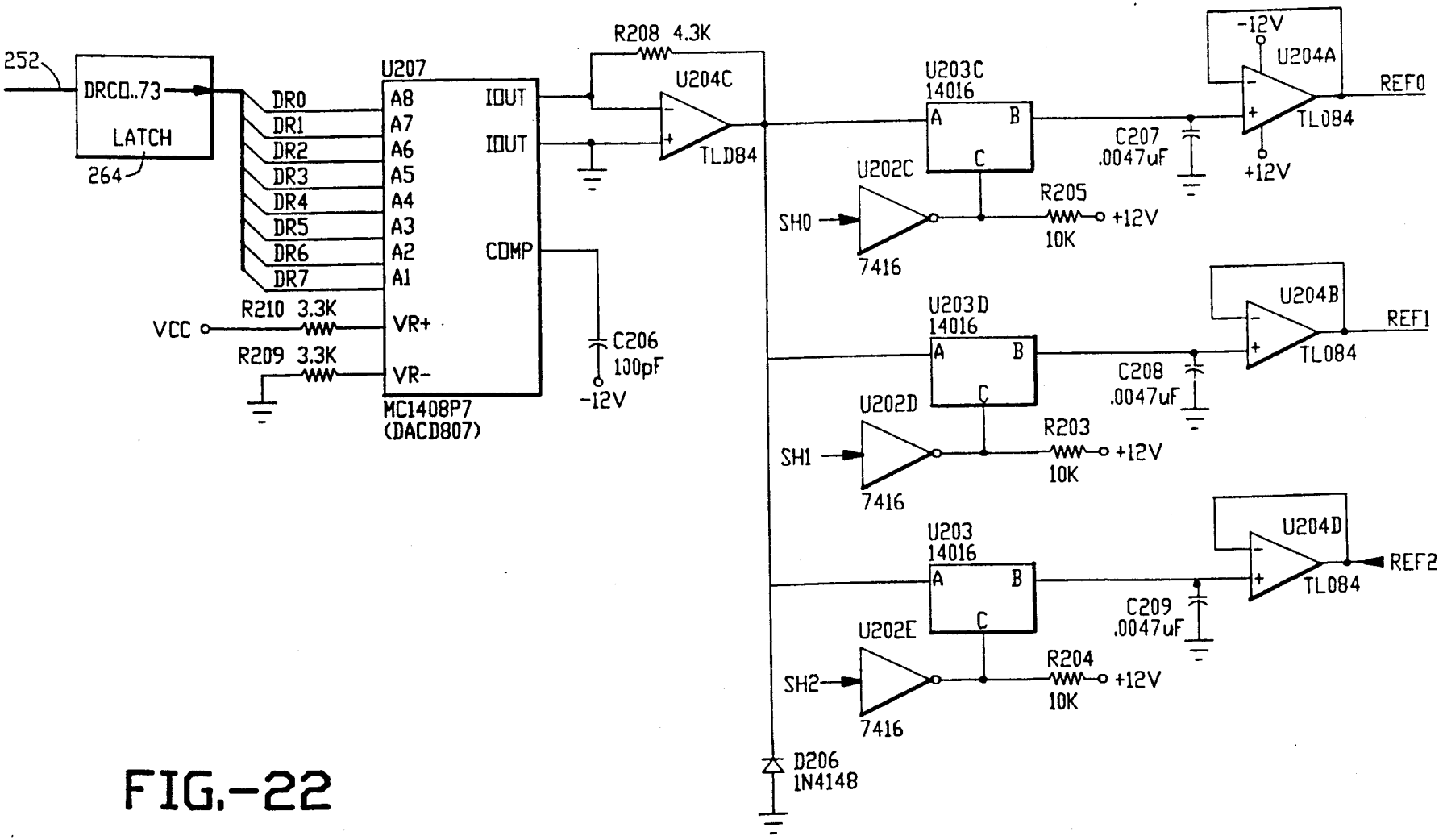
FIG. 22 is an electrical schematic and block diagram of a key sensor programmable threshold voltage establishment circuit for establishing a plurality of sensitivity thresholds for the key sensor array of FIG. 21.

Referring to FIG. 22, three voltage reference values REF 0, REF 1 and REF 2 are generated by a programmable threshold voltage generator circuit. An eight bit digital word generated by the microprocessor supervisor circuit 246, and put out on the bus 252, is latched into a latch 264 and is then put into a 256-step digital to analog converter U207. The analog voltage put out in response to the digital word by the converter U207 is then buffered in a buffer U204C and passed to three individually enabled, analog sample/hold circuits U203C, U203D and U203B. Each sample/hold is controlled by one of the SH lines of the bus 258, and leads to an output buffer/driver U204A, U204B and U204D. The buffer U204A puts out REF 0, the buffer U204B puts out REF 1, and the buffer U204D puts out REF 2.

The keyboard scanner state machine 234 serves as an interface between a musical instrument clavier type keyboard, such as the keyboard 10, and a microprocessor controller or computer, such as the microprocessor circuit 246. The keyboard scanner state machine is depicted structurally in FIGS. 23A through 23P, and commonly labelled signal lines appearing throughout these drawings denote common connections.

The keyboard scanner state machine 234 senses key-on and key-off events, including the velocity with which keys are impacted and released. Following impact events, the state machine 234 also measures the continuous downward force (pressure) on each depressed key. A dedicated state machine is preferred herein in order to provide a useable range of velocity measurements for 88 keys, instead of using the programming capability of the microprocessor. With new high speed processors, however, an implementation which relies entirely upon software to carry out the scan and velocity measurements is within the scope and contemplation of the present invention. In this preferred embodiment, the microprocessor circuit 246 is interrupted only when a key event is detected by the scanner circuit 234. A key count occurs whenever a key is impacted or released.

Figure 23A:
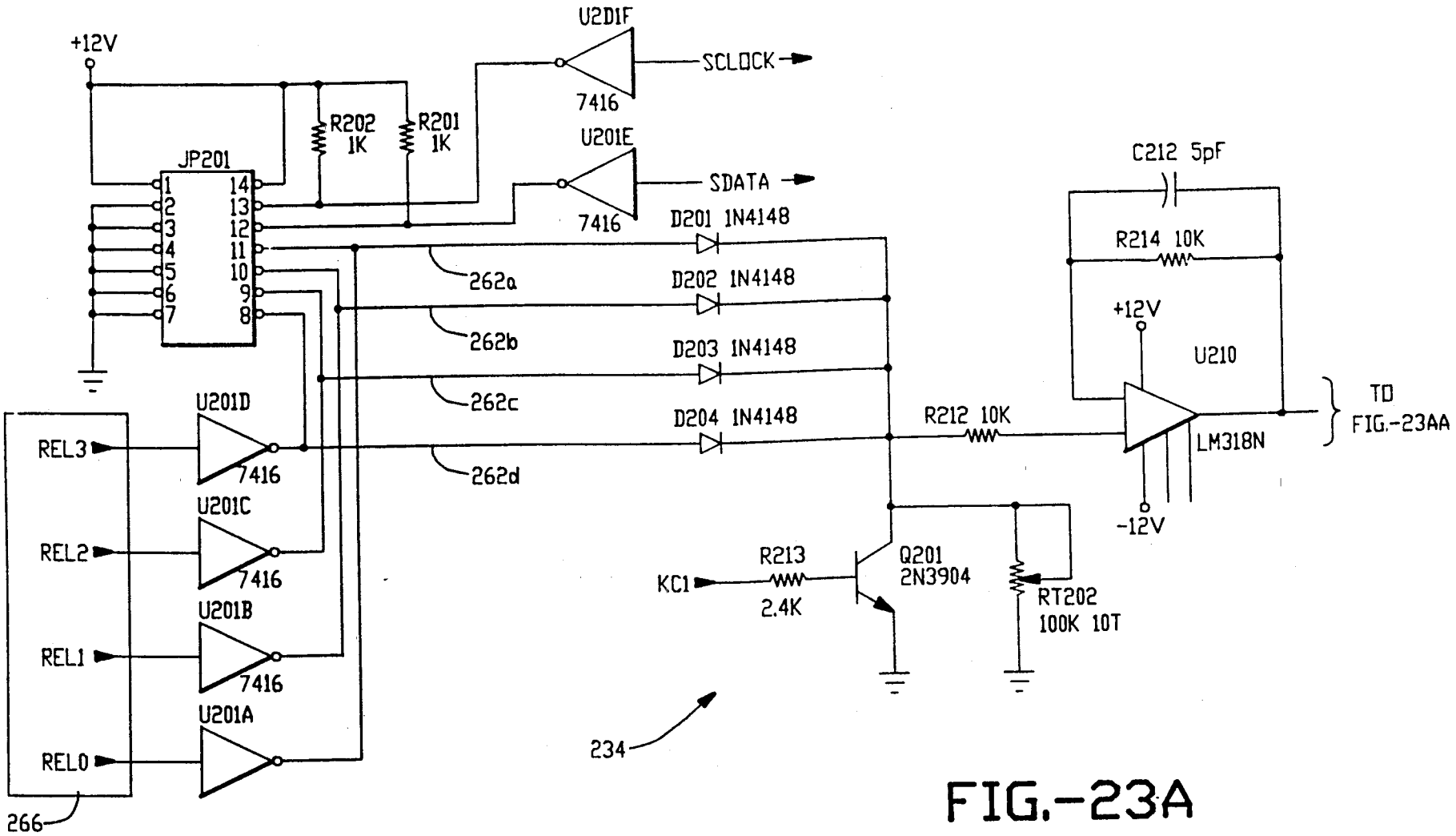
Figure 23A:
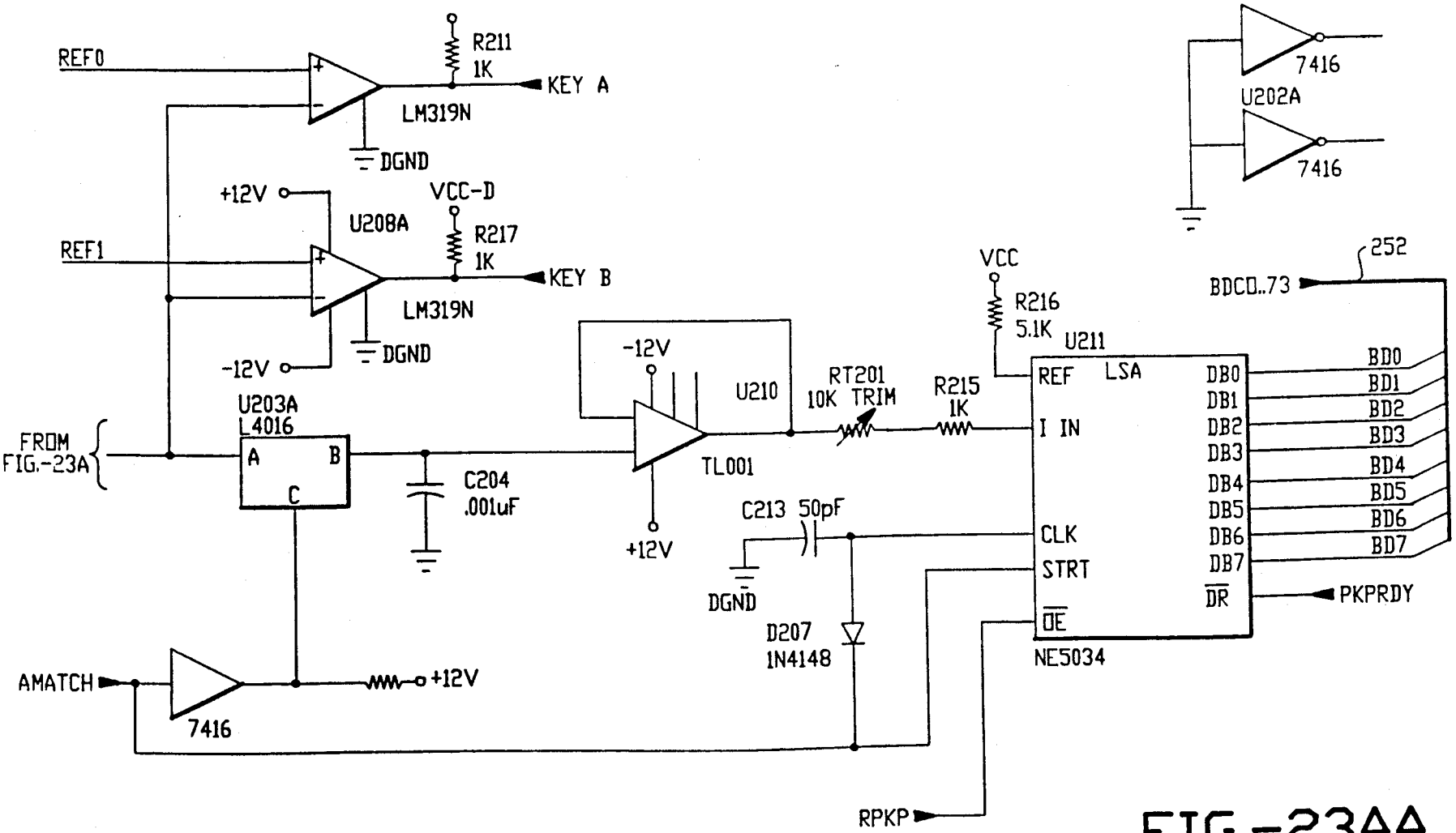
Figure 23B:
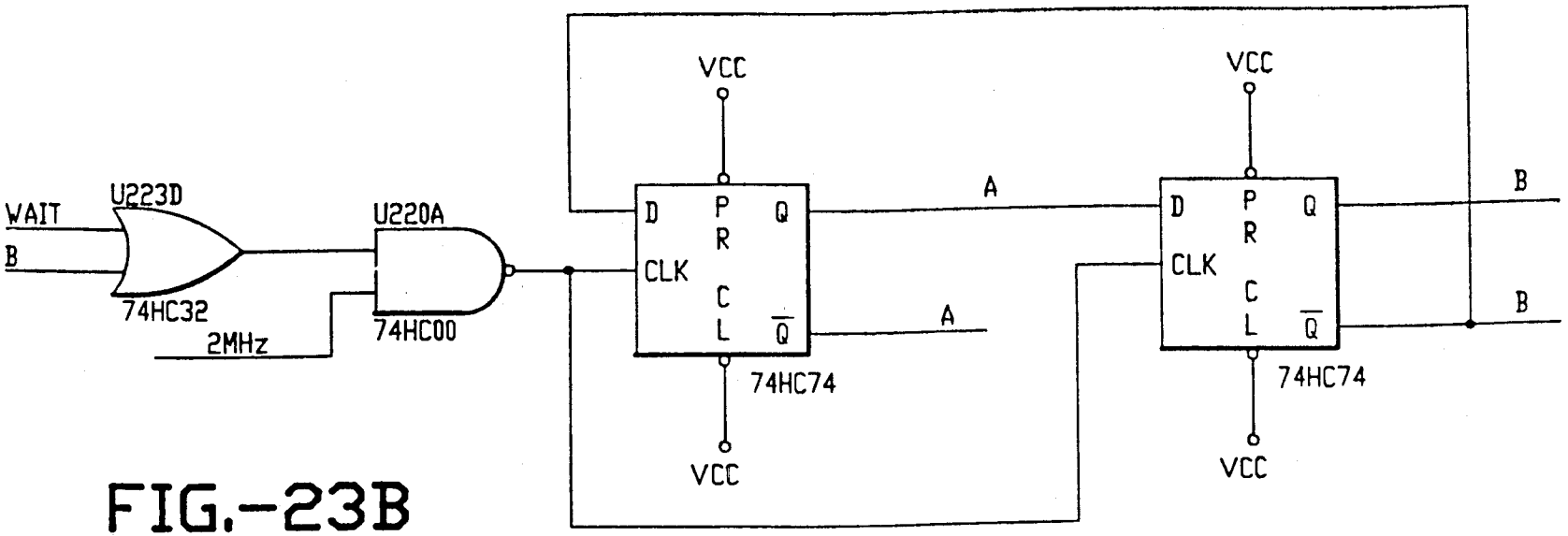
Figure 23F:
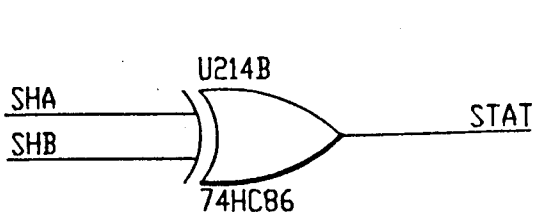
Figure 23D:
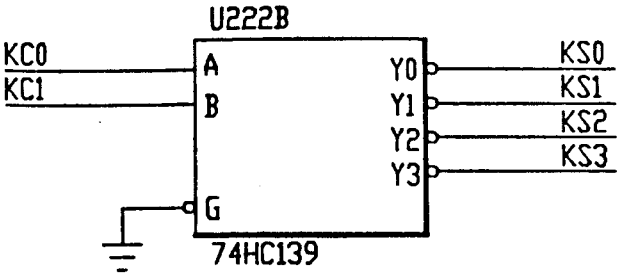
Figure 23C:
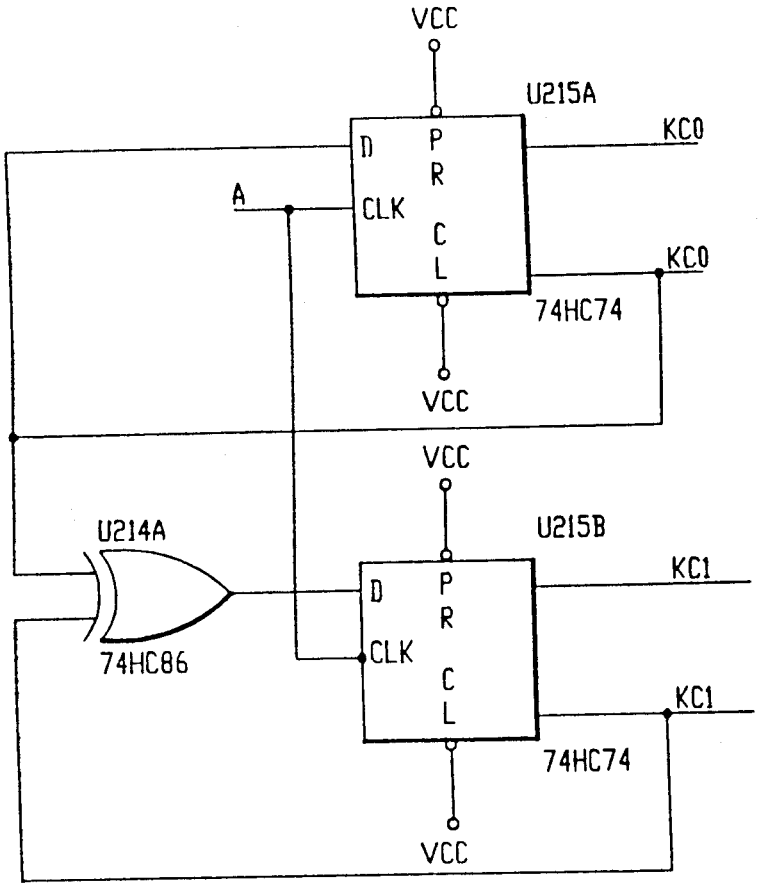
Figure 23E:
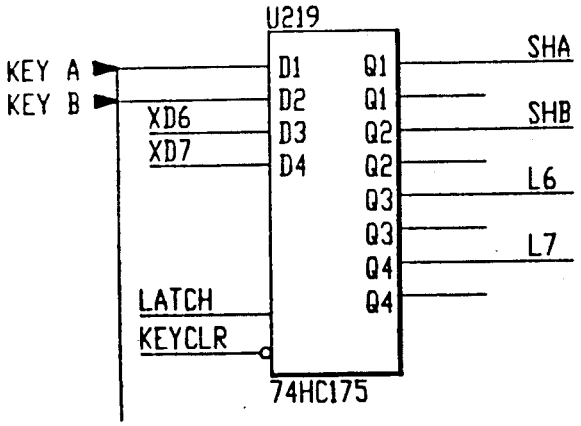
Figure 23G:
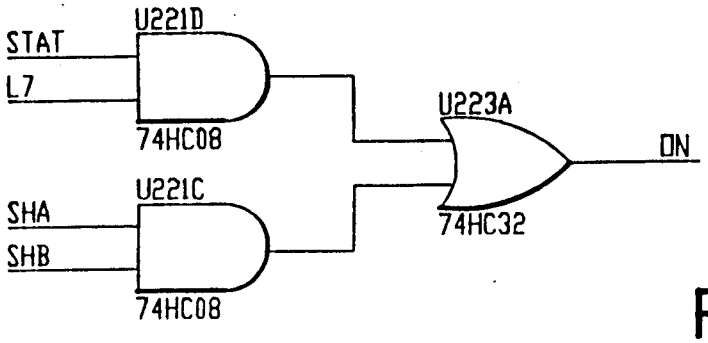
Figure 23H:
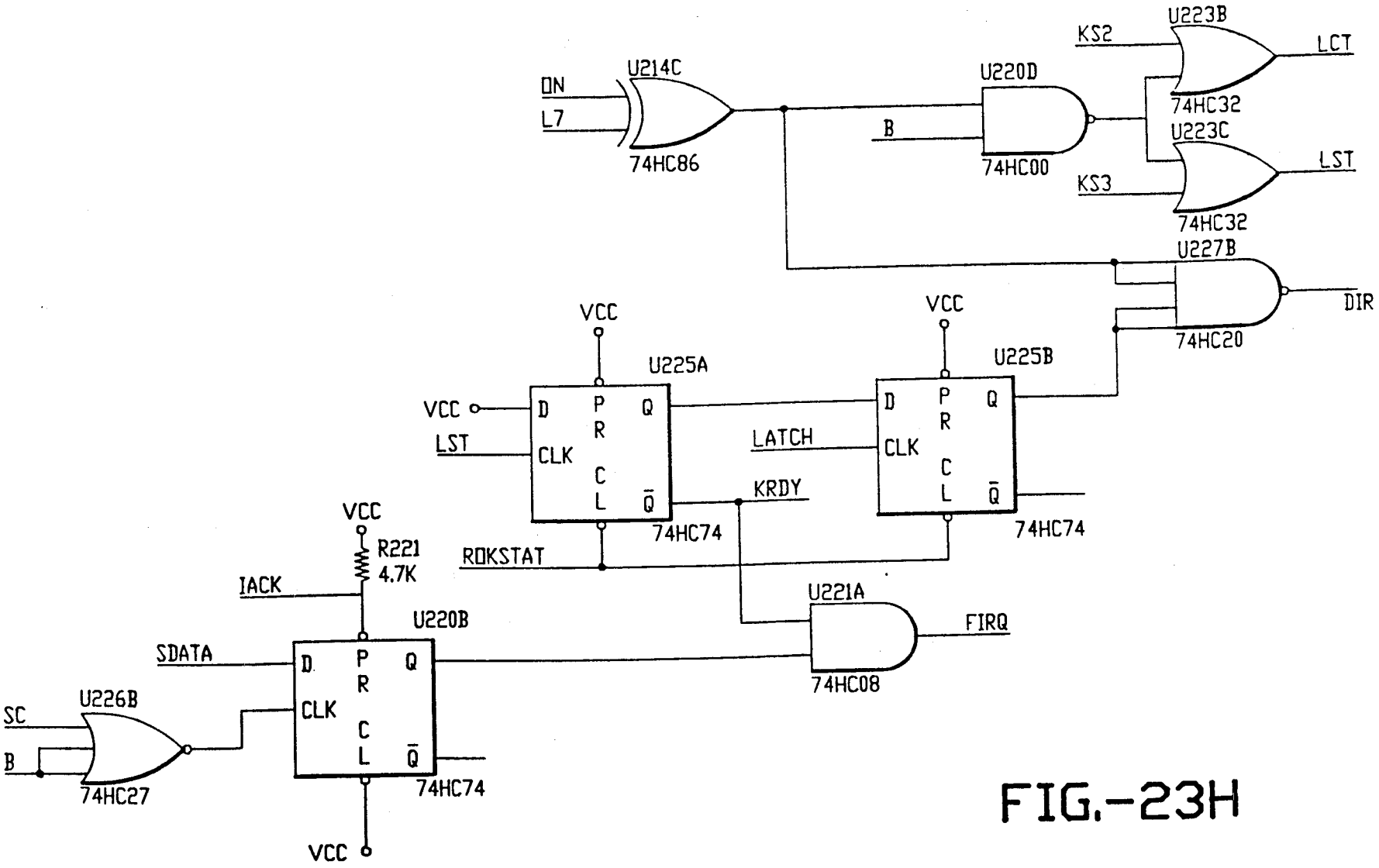
Figure 23I:
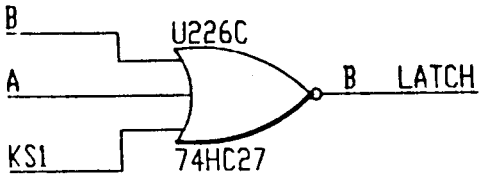
Figure 23J:
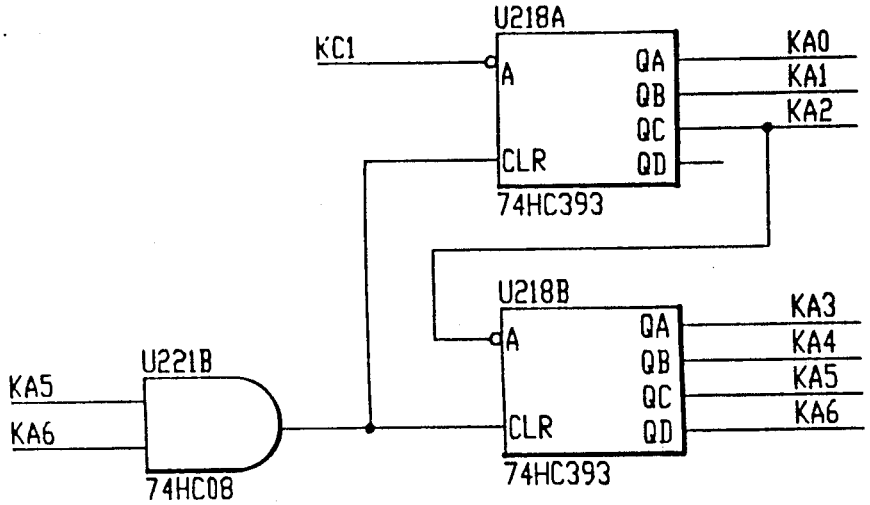
Figure 23M:
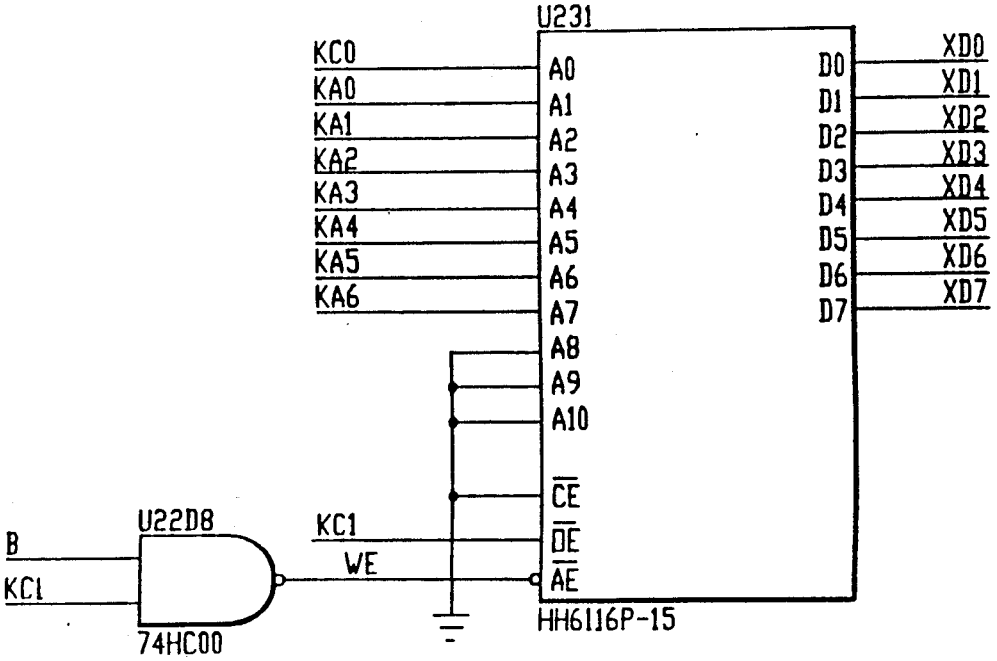
Figure 23K:
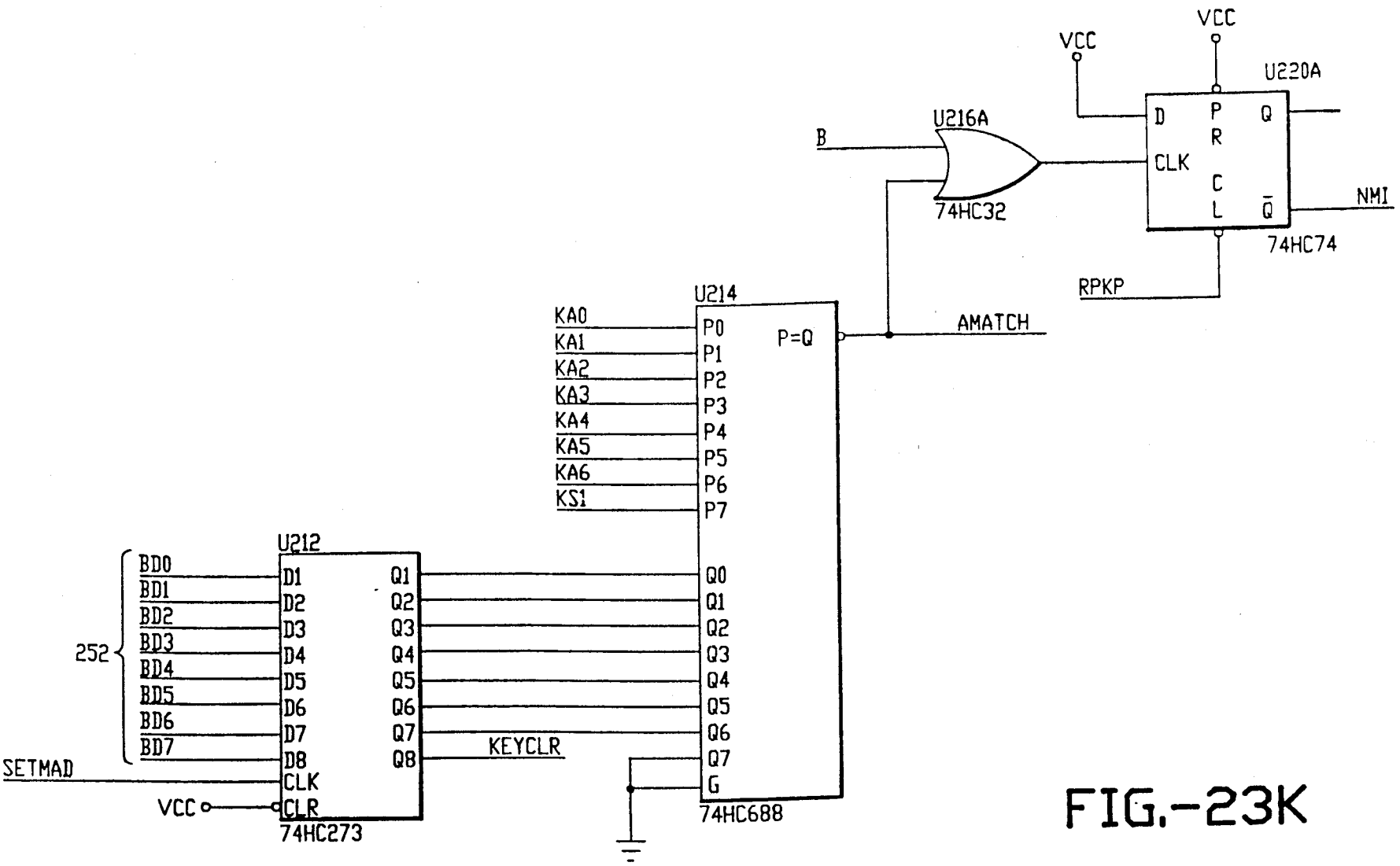
Figure 23L:
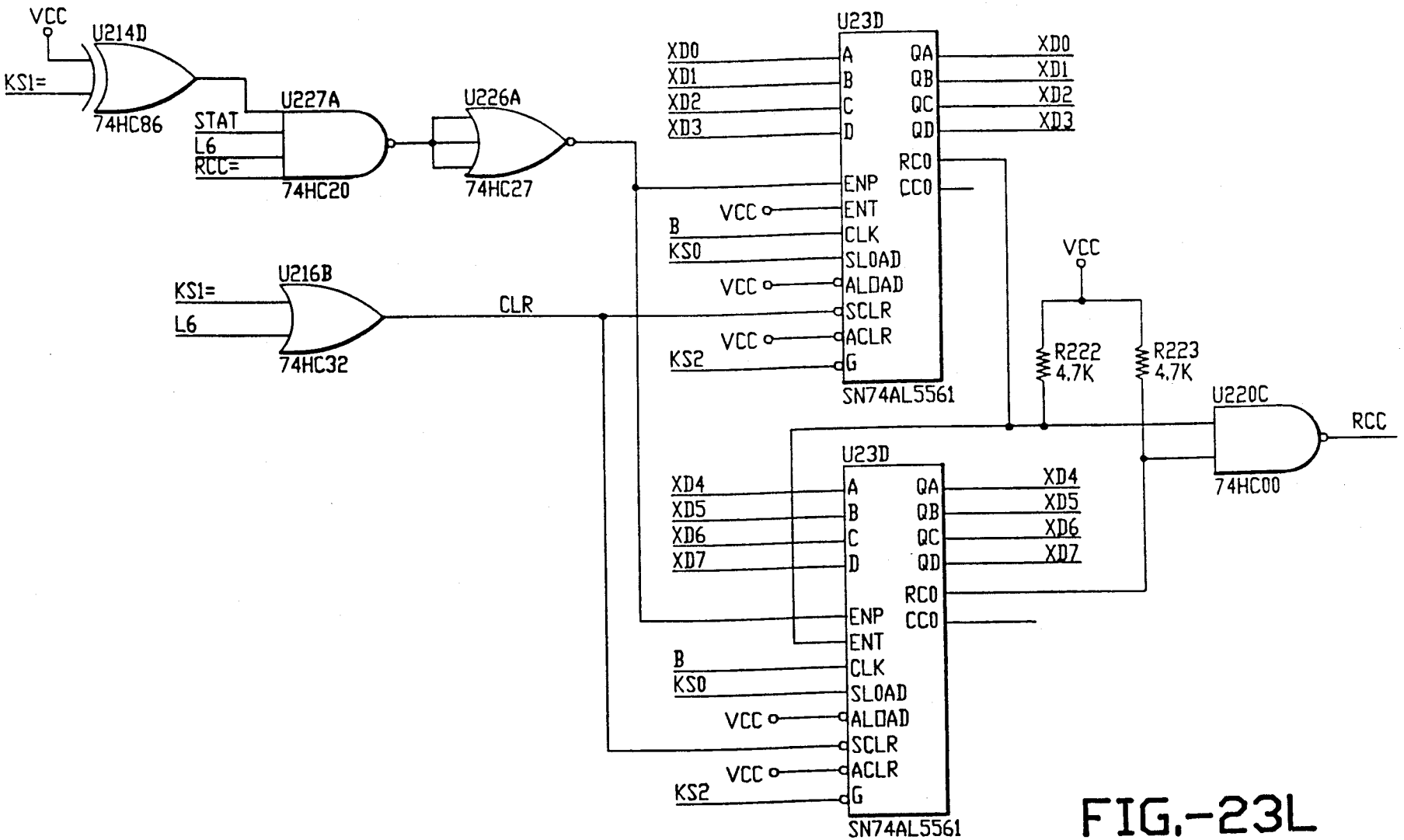
Figure 23N:
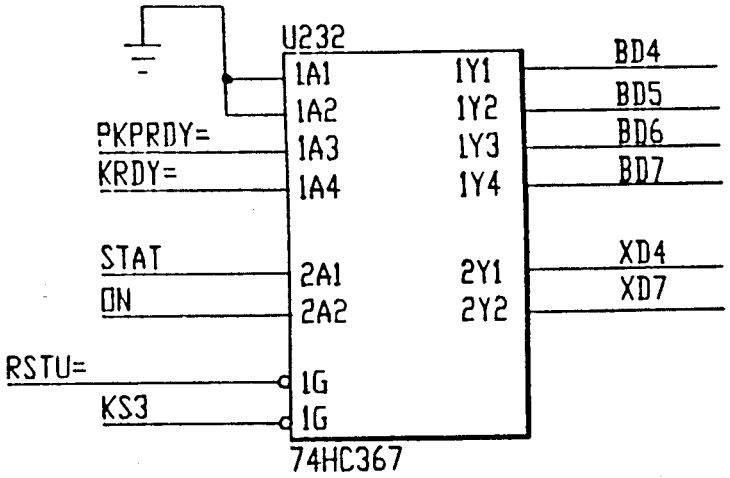
Figure 23O:
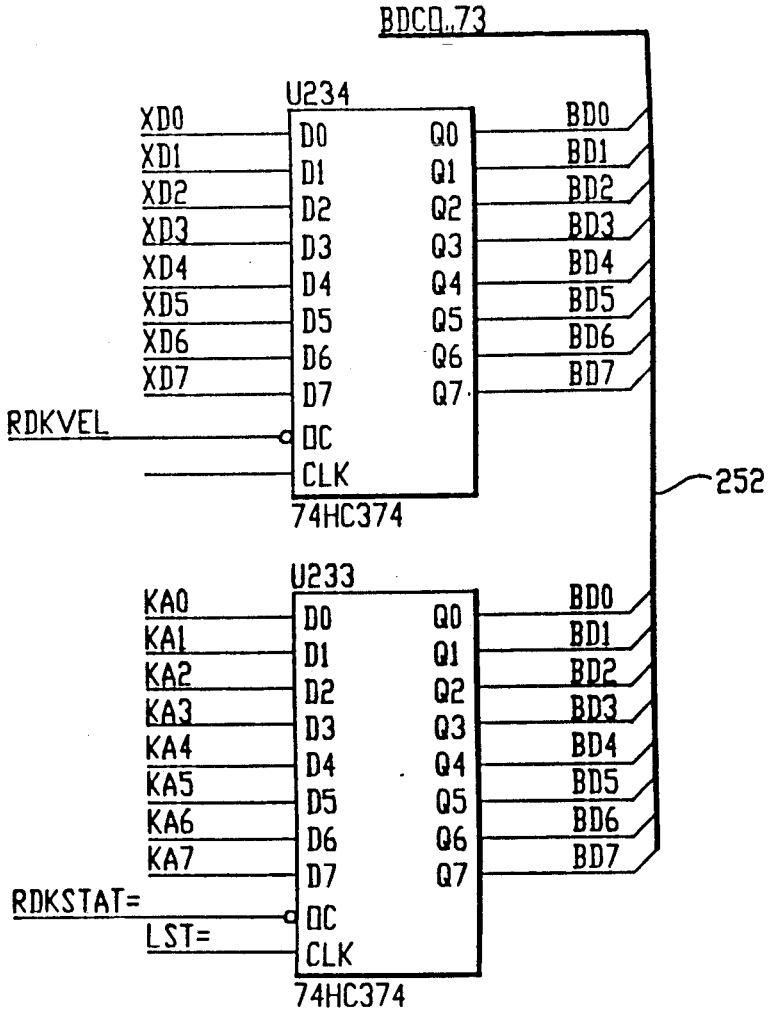

The keyboard scanner state machine 234 connects to the four scan buses 262*a*, 262*b*, 262*c* and 262*d* (FIGS. 23A and 23AA). A selector logic circuit 266 enables one of the scan buses at a time. A transistor Q201 grounds all four scan buses during switching intervals to discharge any distributed capacitance charges developed in the wiring and FSR material, etc. The current present on the enabled scan bus is converted into a voltage at a variable resistor RT 202 (which provides an adjustment to compensate for variations in FSR material characteristics), amplified and shaped in a fast buffer amplifier U210. The voltage is then passed on to two voltage comparator circuits: U208B which compares the scan bus signal amplitude with the REF 0 voltage, and U208A which compares the scan bus signal amplitude with the REF 1 voltage. If the scan amplitude is greater than REF 0, a KEY A logical signal is generated and put out. If the scan amplitude is greater than REF 1, then a KEY B logical signal is generated and put out. The KEY A and KEY B signals go to keyboard scanner velocity sensing circuitry.

Figure 28:
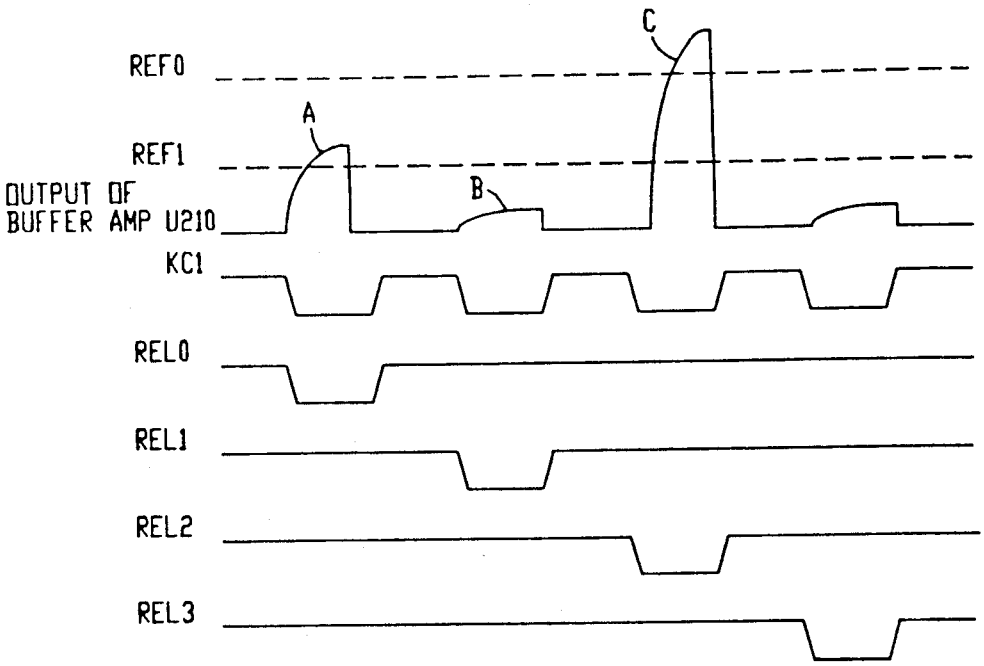
FIG. 28 is a graph of a series of waveform diagrams illustrating operation of the threshold circuits within the FIG. 23 keyboard scanner circuit.

With reference to FIG. 28, REF 0 represents a high voltage threshold value, and REF 1 represents a lower voltage threshold value. Signal peak A denotes a key which has started to turn on but has not yet crossed the upper threshold REF 0 i.e., a key event has occurred. Signal B represents a key which is off, and signal C represents a key which is fully on. The keyboard clock signal KC1 which controls the transistor Q201 and the four negative logic scan bus select signals REL 0, REL 1, REL 2 and REL 3 are also shown in time relationship with the A, B and C key amplitude signals in FIG. 28.

In order to develop a key pressure value (as compared to velocity), which may be read whenever desired by the microprocessor circuit 246, the incoming scan amplitude signal is also passed to a sample/hold circuit U203A and buffer U205. It is then available to be digitized in an analog to digital converter U211. The microprocessor controller 246 obtains a key pressure reading by enabling the U211 AtoD via a line RPKP and then by writing the converted value onto the data bus 252.

The scanner state machine 234 is based on a 2 MHz clock signal which is time divided into an A time phase and a B time phase by the two phase 500 KHz clock circuit shown in FIG. 23-B. Two keyboard clock signals KC0 and KC1, and their logical inverses, are generated from the A period by the latch circuit depicted in FIG. 23-C. Four keyboard scan signals KS0, KS1, KS2 and KS3 are generated from the KC0 and KC1 signals by a decoder depicted in FIG. 23-D.

A quad latch U219 receives the Key A and Key B values from the comparators U208A and B (FIGS. 23A and 23AA) and receives the prior status bit STAT as XD6 and the prior ON bit as XD7. Four signals are put out by the circuit U219: SWA, SWB, L6 and L7. An exclusive OR gate U214B (FIG. 23-F) compares SWA and SWB in order to develop a key status transition signal (key event) STAT. The STAT signal indicates whether the latched values for KEY A and KEY B are equal or not. STAT is true when a key is in transition from off to on, or from on to off. STAT is false when a key is either fully on or fully off.

A logic circuit depicted in FIG. 23-G develops an ON signal from L7, STAT, SWA and SWB. ON is true when a key is fully on, or if ON was true during the last scan, but is currently in transition.

A logic circuit depicted in FIG. 23-H develops from ON, L7, B, KS2 and KS3 certain control signals including LCT which is used to clock a key velocity value latch (U234, FIG. 23-O), and LST which is used to clock a key status value latch (U233, FIG. 23-O). The FIG. 23-H circuit also develops a WAIT* signal and a host processor interrupt signal and a host processor interrupt signal FIRQ which indicates to the host microprocessor circuit 246 that a key event has occurred. The flag FIRQ is cleared by the host processor 246 by reading the latch U233 or by generating an interrupt acknowledgement signal IACK.

A LATCH signal generated by a logic gate depicted in FIG. 23-I from B, A, and KS1 represents a single key scan interval, and it clocks the latch U219 (FIG. 23-E) and a latch U225B of the part of the FIG. 23-H circuit which generates the WAIT signal.

A logic circuit depicted in FIG. 23-J generates eight key address signals KA0 to KA6 from the KC1 signal. These address signals correspond to the particular key presently being scanned, and they are applied to address a 2048 by eight bit random access memory array U231 depicted in FIG. 23-M and containing information about the key recorded during the last scan.

A tri-state buffer U232 of FIG. 23-N places the PKPRDY and KRDY status signals respectively generated by the key pressure analog to digital converter U211 of FIGS. 23A and 23AA and the velocity logic key event circuitry of FIG. 23-H onto bit positions of the BD data bus in response to a microprocessor generated status request signal RSTU, so that each flag may be read and acted upon by the microprocessor supervisor circuit 246. Similarly, the STAT and ON signals are put out as XD6 and XD7 bit positions during the KS3 scan cycle.

The XD0 through XD7 values representing current velocity information for a key are latched and held in a latch U234 of FIG. 23-O and are put out onto the BD data bus 252 in response to a read keyboard velocity signal RDKVEL put out by the microprocessor 246. Similarly, the status of the keyboard scanner, as indicated by the present key address, is latched and held in a latch U233 of FIG. 23-O and put out onto the BD data bus 252 in response to a read keyboard status signal RDKSTAT generated by the microprocessor controller 246.

FIG. 23-P merely illustrates the signal lines which extend from the keyboard scanner 234 to the balance of the control system 230.

Key Pressure Sense Operation

A logic circuit depicted in FIG. 23-K compares a key address sent by the microprocessor 246 to the scanner over the BD data bus 252 with the address values KA0–7 generated by the FIG. 23-J circuit. If an equivalence is detected, indicating that the keyboard scan has reached the key whose pressure is to be sensed and converted to digital data, a signal AMATCH is generated and sent to enable the sample and hold circuit U203A of the FIG. 23-A pressure sense circuitry. This causes the incoming pressure valve from the key to be latched and held. At the same time, the AMATCH signal starts the pressure sensor analog to digital converter U211 to convert the held key pressure value into a digital word. The latch U220A of the FIG. 23-k comparison circuit generates a non maskable interrupt (NMI) and sends it to the microprocessor circuit 246. When the data conversion is complete, a PKPRDY signal is put out by the analog to digital converter U211 and sent as a bit position 7 value on the BD bus 252 as latched through the latch U232 (FIG. 23-N). This DB bus bit seven signal is read by the microprocessor circuit 246 and it thereupon generates and sends a RPKP signal to output the digital pressure value from the converter U211 onto the DB data bus 252 and to reset the NMI latch U220A. The pressure value for the selected key is then available on the data bus for further processing by the microprocessor circuit 246. A new NMI interrupt will be generated and sent out to the microprocessor each time the keyboard scan reaches the key value latched into the latch U212 of the FIG. 23-K, until a new key address is supplied by the microprocessor circuit 246.

Key Velocity Sense Operations

The key on/off sensing, velocity measurement and pressure sense operation use the single FSR sense cell 260 provided for each of the 88 keys in the FIG. 21 keyboard embodiment. Application of a downward force on a key 24, 26 causes a decrease in electrical resistance between the fingers of the cell 260 because of the characteristics of the FSR material. This change of resistance generates a higher direct current, which is converter to a voltage as explained above in conjunction with FIG. 28.

With one sensor 260 for each key, all keys on the keyboard 10 are rapidly scanned in sequence and the voltage developed from each key sensor 260 is compared with the programmed reference thresholds REF 0 and REF 1. When a key is impacted, the derived key voltage will cross one and then both of these programmed thresholds if impacted far enough. When the first threshold reference is reached, e.g. REF 1 in FIG. 28, the key scanner begins to count the number of full keyboard scans that occur until the other threshold is reached. When both thresholds REF 1 and REF 0 have been crossed, as at point C in FIG. 28, the key scanner generates an interrupt FIRQ at the gate U221A of FIG. 23-H for the microprocessor circuit 246 and then first sends the key number KA0-6 and a flag XD7 indicating whether the event was a key-on or key-off event as held in the status latch U233, and then the scan count XD0-7 held in the velocity latch U234. These bytes are sequentially presented to the BD data bus 252 by the control signals RDKVEL and RDKSTAT. The scan count value is used by the microprocessor circuit 246 to calculate a velocity value for the particular key being sensed, since the number of key scans occurring from the time the first threshold REF 1 was crossed until the time the second threshold REF 2 was crossed, or vice versa, is a direct analog of the rate at which the key is being impacted, or released.

By making the reference thresholds REF 0 and REF 1 programmable, either by using the microprocessor supervisor circuit 246 or by using potentiometers, the physical point at which keys turn on and off may be adjusted. Because the user adjustable "kerchunk" feature interacts with the key sensors, the adjustable software switches are relative to the physical position of the keys themselves. Having adjustable reference threshold values REF 0 and REF 1 also enables the dynamic range (or time scale) for velocity sensing to be altered.

The basic unit of time measurement is the keyboard scan. A keyboard scan is the time taken by the key scanner to address every key on the keyboard 10 and return to the beginning again. In the preferred embodiment disclosed herein, one keyboard scan requires 768 microseconds to complete. The velocity timing resolution is therefore 768 microseconds per increment per key. With an eight bit velocity counter (U229, U230 of FIG. 23-L), the slowest key transition that can be measured is 197 milliseconds (768 us. * 256).

The scan is subdivided into a bus address cycle during which a group of four keys are enabled on the sensor printed circuit 232. One bus address cycle takes 32 microseconds. The bus address cycle is further divided into the four 8 microsecond key address cycles KS0, KS1, KS2 and KS3, during each one of which the current present on the buses 262*a*, 262*b*, 262*c* and 262*d* are read and converted into voltages.

In order to measure the velocity of all of the keys of the keyboard 10, the key scanner must keep track of key status for each individual key through successive keyboard scan cycles. During the time interval between the occurrence of REF 1 and REF 0 for a key being depressed, which is counted by the eight bit counter, the intermediate status and counter values for each key in a transitional state are stored in the fast random access memory U231.

The random access memory U231 is addressed by the key address counter (U218) which is clocked at the beginning of each key address cycle. The key address counter U218 counts up to 95 and then resets to zero to start counting up again. The shift clock SDATA for the key sensor board shift registers (e.g. U501 of FIG. 21) is generated at the end of every fourth key address cycle, and the data for the shift registers (SDATA) is generated between the counts 92 and 95 of the address counter U218 in order to set up the sensor shift registers for the next scan.

During each key address cycle, the keyboard scanner goes through four separate phases, Phase Zero, Phase One, Phase Two and Phase Three.

Phase Zero occurs when KC0 equals zero and KC1 equals zero. During this first phase of a key address cycle, the RAM outputs are enabled and the value of the accumulated velocity count is loaded as a preset into the data inputs of the eight bit counter (U229 and U230).

Phase One occurs when KC0 equals one and KC1 equals zero. In phase one, a second byte of data is enabled on the RAM outputs, containing two status bits from the previous scan. These two bits represent the previous values of the signals STAT and ON are presented as inputs to the latch U219, along with the current values of KEY A and KEY B. Also, during phase one a combination of status signals is used to determine what will happen to the velocity counter. The counter will count up (increment) if the counter was not at its maximum count at the last scan and the key was in transition at the last scan and the key is presently in transition. The counter will reset to zero if the key was fully off or fully on during the last scan. Otherwise, the counter output will remain unchanged. Finally, during phase one, the address match comparator U213 is enabled to initiate a pressure reading if the current key address corresponds to the value stored in the latch U212.

Phase Two occurs when KC0 equals zero and KC1 equals one. In phase two the RAM switches to input (write) mode and the velocity counter outputs are written into memory at the address pointed to for this key, replacing the old count value. At this point, if a key event has just occurred, the count value is also written into the velocity output latch (U234). A key event occurs when: ON is false and ON was true at the last scan, or ON is true and was false at the last scan.

Phase Three occurs when KC0 and KC1 both equal one. During phase three, the current values of STAT and ON are written into the second byte of RAM at the current key address, replacing the previous status values. If a key event has happened during this key scan, the key address (7 bits) and ON are written into the eight bit key status output latch U233. Also, when a key event occurs, the interrupt generator flip-flop U225A is clocked, thereby setting the FIRQ interrupt request line to the microprocessor 246.

Ordinarily, the interrupt flip-flop U225A is cleared when the status output latch U233 has been read by the microprocessor circuit 246. If the interrupt flip-flop is not cleared, and the key scanner encounters a second key event, key scanner system operation will be halted during Phase One of the key address cycle at the key at which the event is detected. When the interrupt for the last key event is finally cleared, the key scanner will continue from the place where it stopped, and the new key event will be clocked into the output latches and another interrupt will be generated.

This method for handling multiple key events close together works well, since only rarely will two key events happen within the same 768 microsecond keyboard scan cycle. When two events do occur within this cycle, the microcomputer 246 usually responds to interrupts quickly enough that any resultant velocity errors are negligible.

The key scanner also generates an interrupt FIRQ every time that the key address reaches 92 (which is beyond key 88 of the 88 key keyboard 10, and therefore beyond occurrence of any key event). This interrupt is provided as a marker to the microprocessor circuit 246 and is not related to key scanning operations at the scanner. The interrupt is cleared automatically by the microprocessor 246 by enablement of the interrupt acknowledge line IACK.

Analog Input Circuit 236

Figure 24:
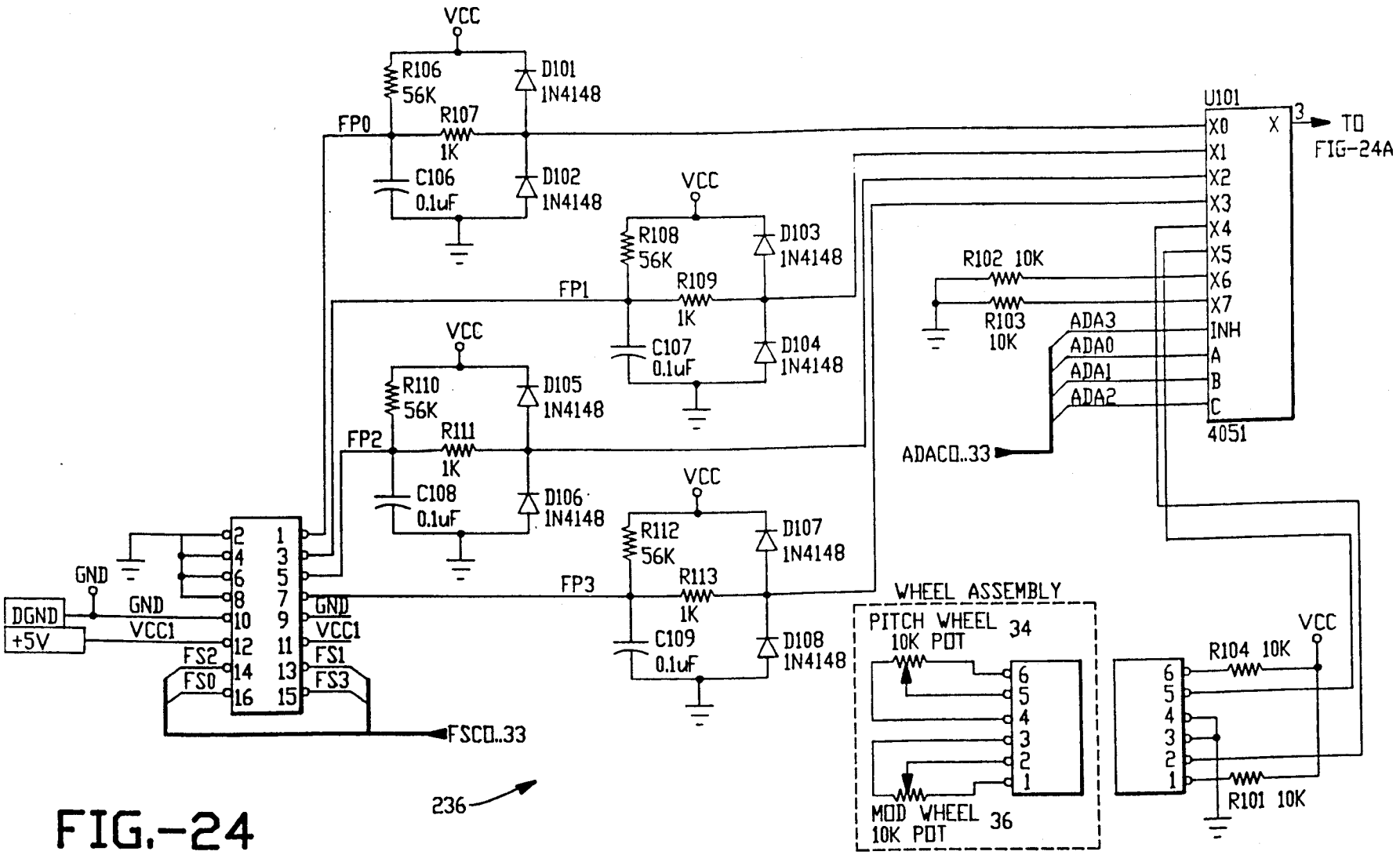
FIGS. 24 and 24A form an electrical schematic and block diagram of a multiplexed-input analog to digital conversion circuit of the FIG. 20 control circuit.
Figure 24A:
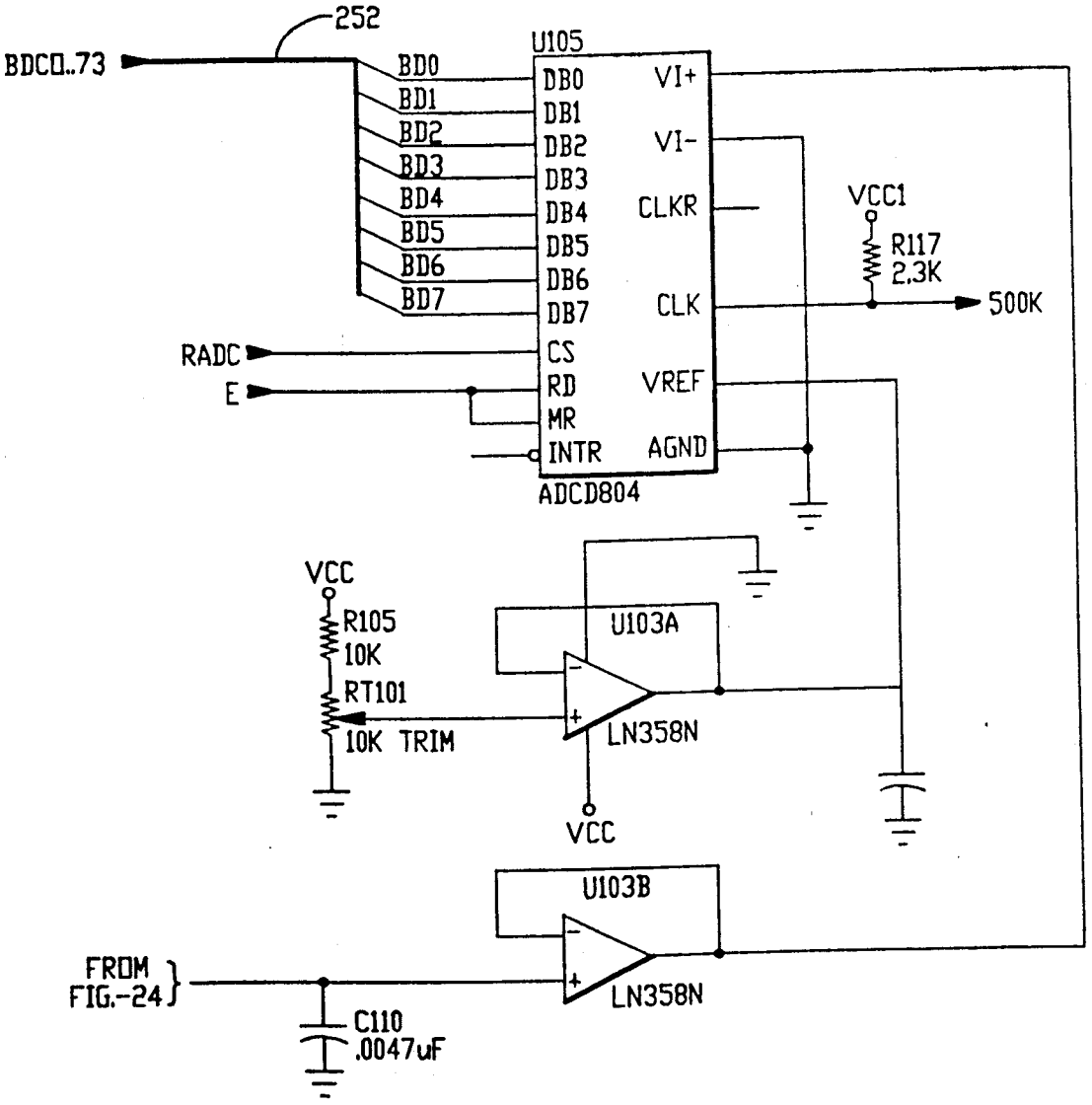

Referring to FIGS. 24 and 24A, electrical details of the analog input circuit are present. Four analog inputs FP0-3, leading from the foot pedal jacks 60*a-d* (and analog foot controls, such as the variable control 20) connect to four inputs of an eight input analog multiplexer U101. Two other inputs thereof are from the pitch wheel 34 and the controller wheel 36.

A particular analog input is selected in accordance with address information sent by the microprocessor circuit 246 over the ADA0-3 bus 254. The selected analog signal is buffered by passage through a buffer amplifier U103B and then delivered to an input of an analog to digital converter U105. A voltage reference for conversion of the incoming analog signal is established by a potentiometer RT101 and an amplifier U103A. An address value RADC for the A to D U105 is decoded at the microprocessor circuit 246 and causes the digital value converted by the converter to be put out on the BD data bus 252 and thereupon read by the microprocessor 246 for further processing and action. In this way, the microprocessor is able to obtain digital values corresponding to settings of the foot pedals and the pitch and controller wheels.

While the foot switch signals from the foot switch jacks 58*a-c* and 62 pass through the analog input circuit, these are digital values which are sent directly to the MIDI and control circuit 238 on the FS0-3 bus 260 where they are presented to the BD data bus (bits 0-4) via a three state buffer controlled by the microprocessor circuit 246.

MIDI and Control Input/Output Circuit 238

Figure 25:
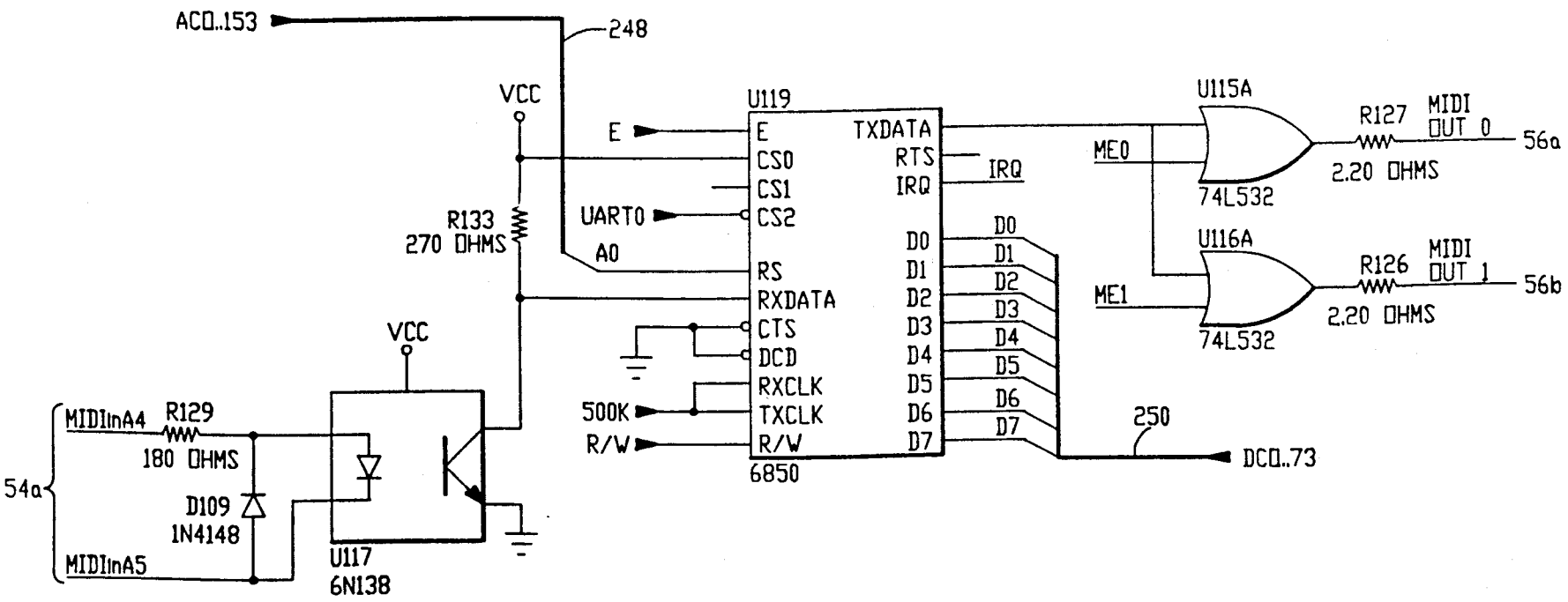
FIG. 25 is an electrical schematic and block diagram of one of four identical digital to MIDI input/output circuits of the FIG. 20 control circuit, the input being connected to one of the MIDI input paths and each of the output circuits being connected to two of the eight MIDI system output paths of the FIG. 1 keyboard.
Figure 26:
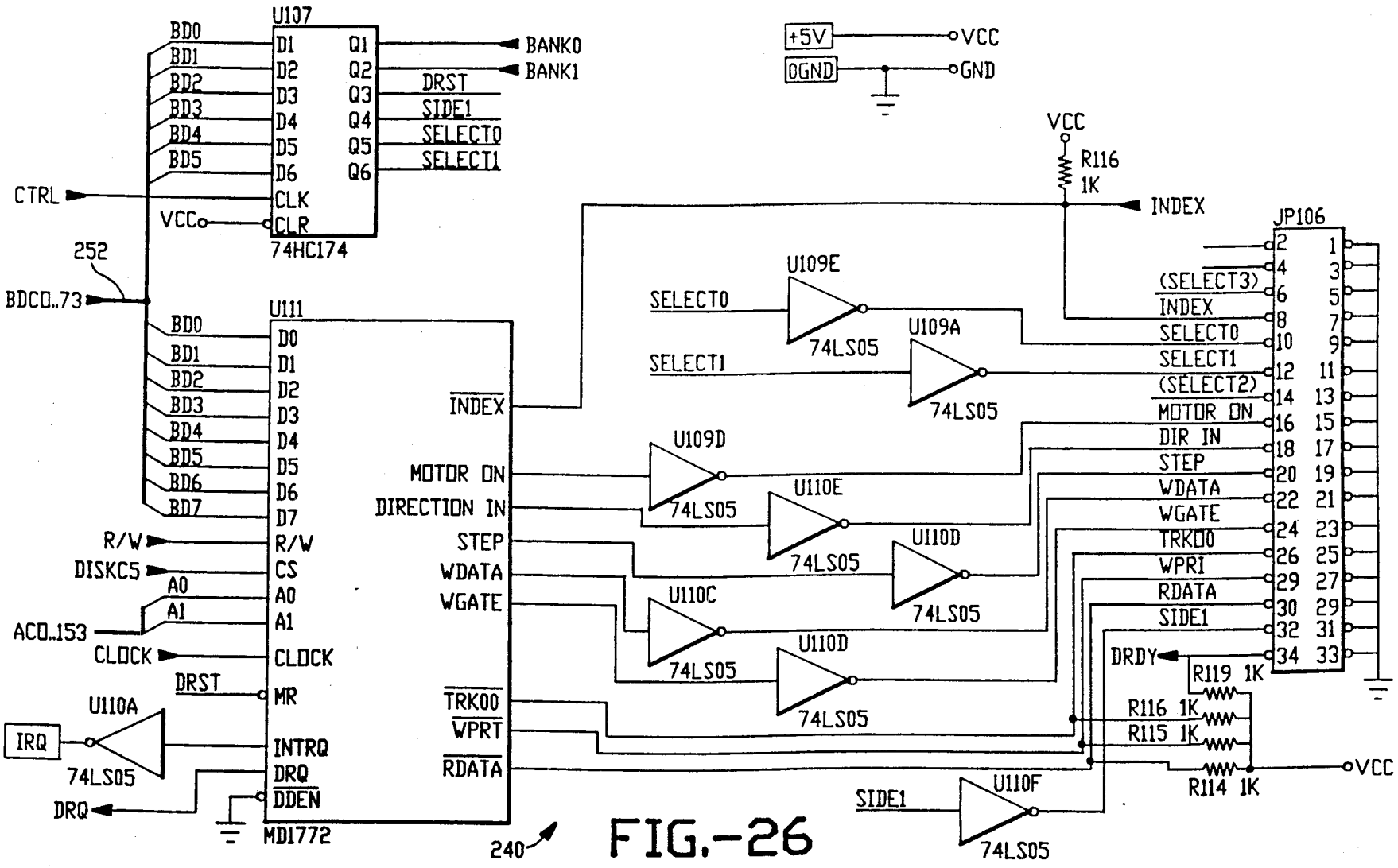
FIG. 26 is an electrical schematic and block diagram of a floppy disk drive controller circuit of the FIG. 20 control circuit.

FIG. 25 sets forth one unit of the MIDI and control input/output circuit 238. Four circuits are actually included in this circuit block, and the one presented in FIG. 25 is representative of each. It is based around a UART U119 which sends and receives digital data to and from the microprocessor controller circuit via a D bus 250. The UART U119 is addressed by a predetermined bit position of the address but 248. A MIDI serial data read data input is provided from one of the MIDI input jacks, e.g. the jack 54*a*. A MIDI serial data write data output is provided to e.g. two MIDI output jacks, such as the jacks 56*a* and 56*b*, through two selectors U115A and U115B, each enabled by a digital signal generated from the microprocessor circuit 246. The function of the UART U119 is to convert parallel by bit, eight bit data words into serial bit streams in MIDI format, and vice versa. The UART U119 is clocked at a basic clock rate of 500 KHz, for both send and receive, in accordance with the MIDI convention. It obtains the attention of the microprocessor circuit 246 by virtue of its connection to the interrupt request line IRQ.

Disk Controller 240

The disk controller circuit 240 is based around an integrated circuit chip, type WD 1772 floppy disk controller, or equivalent. Basically, this chip receives and sends digital command and user data to and from the other circuit elements via the BD data bus 252. The chip decodes digital commands from the microprocessor circuit 246 and controls the micro- floppy disk drive 40 by turning on its spindle motor, moving the head transducer actuator to a desired concentric track of the floppy disk, reading the sector identification information read from the formatted disk and then performing either write data or read data operations, as may be called for by the microprocessor controller 246. Two floppy disks, the internal disk 40 and an external disk connectable at the jack 64, may be controlled by the chip U111.

The controls and indicators at the front panel 16, including the global display 72 and the 80 character LCD display 78 are connected to driving and decode latch circuitry present on a circuit board 254 mounted directly behind the front panel 16, as shown in FIG. 6. A connector cable 256 provides data bus connections to and from the microprocessor controller circuit 246, so that the switches 66, 74, 80, 82, 88*a* and 88*b* may be sensed, indicator lamps 68, 70 76 84, and 86 illuminated, and data values written to and displayed by the displays 72 and 78.

Microprocessor Controller Circuit 246

The microprocessor controller circuit (FIGS. 27A and 27AA) is predicated upon a Motorola 68809E microprocessor (U126) operating at a clock cycle rate of 8 MHz generated by a two phase crystal clock (not shown). The circuit 246 includes a 32 kilobyte read only program memory (U123), as well as a battery backup memory 258 to save system setup values. Decoders U108 and U014 (FIG. 27B) attached to the address bus 248 and other control lines provide select and control signals to the MIDI interface circuit 238, the key scanner circuit 234, the disk drive interface circuit 240, and the analog input circuit 236. A bidirectional buffer U112 links the BD data bus 252 to the D data bus 250.

Figure 29:
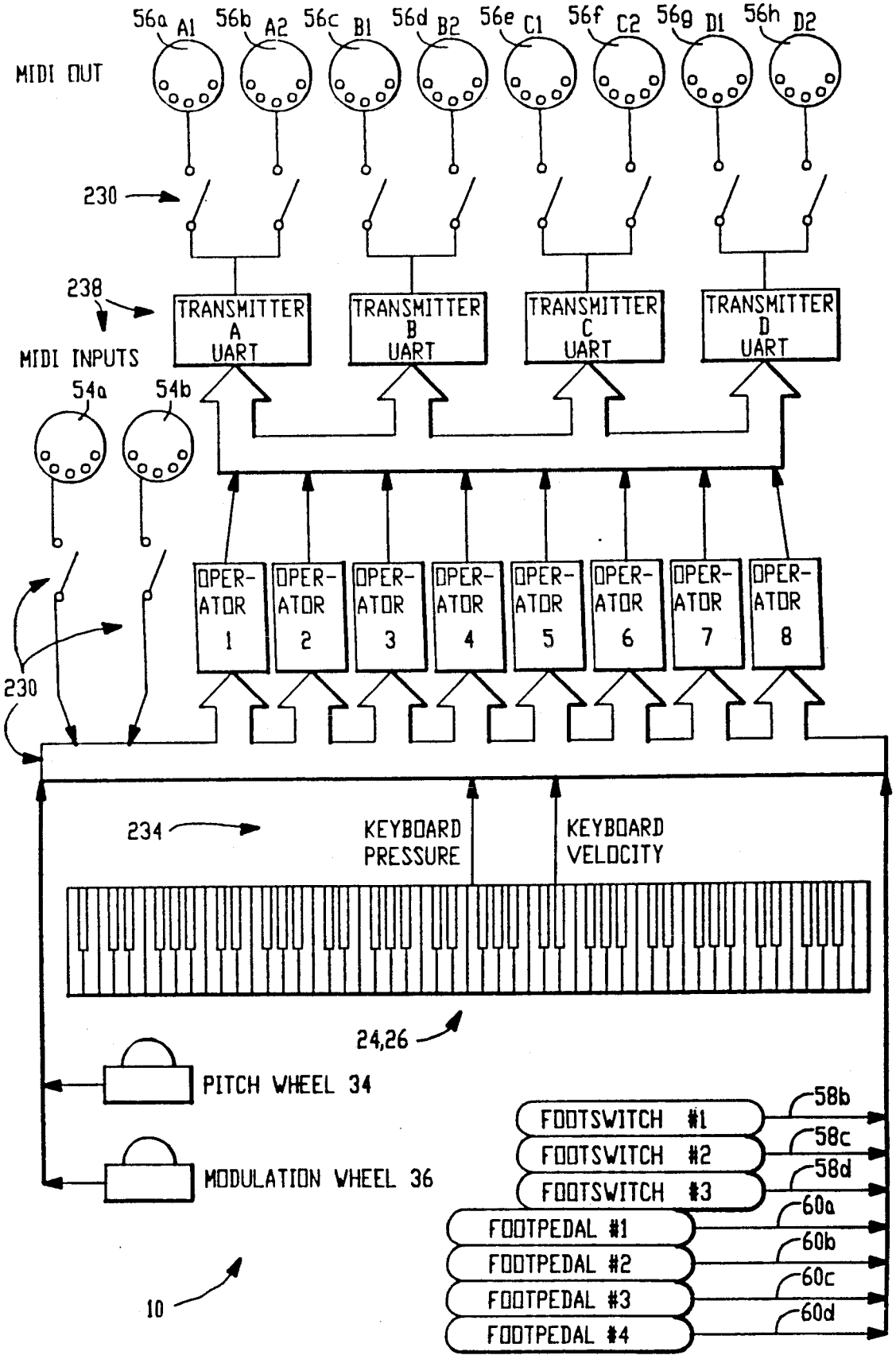
FIG. 29 is a functional operational block diagram illustrating the operation of the FIG. 20 control circuit within the FIG. 1 keyboard.

FIG. 29 provides an overview of signal paths and processes carried out within the keyboard 10. The keys 24 and 26 provide keyboard velocity and keyboard pressure values to the control system 230 via the keyboard scanner state machine 234. System global setups and system exclusive patch libraries may be selectively received via the two MIDI input ports 54*a* and 54*b*. Four MIDI output transmitters each selectively provide two MIDI outputs, for a total of eight MIDI outputs.

Other digital and analog inputs, such as the pitch wheel 34 and the controller wheel 36, footswitches 58 and footpedals 60, provide further operating parameters to the keyboard control system 230.

The various system setups may be carried out by up to eight separate operators, and each operator may communicate with a synthesis or music generation device via one of the eight MIDI ports 56*a–h*. Thus, the keyboard 10 may simultaneously control operation of up to eight external music and/or percussion generation devices, such as the device 11.

Figure 30A:
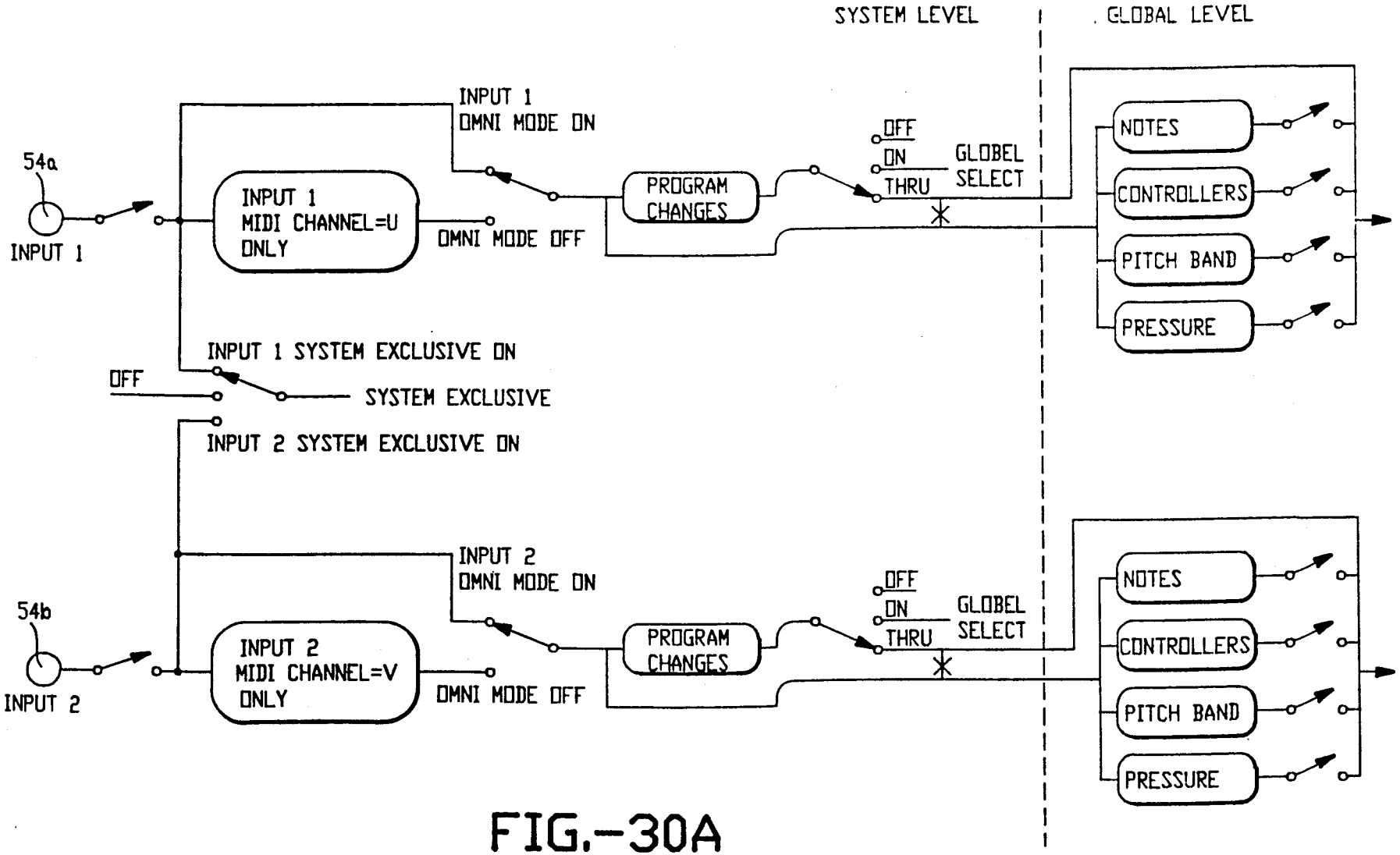
FIGS. 30A and 30B comprise a flow diagram of command flow through the FIG. 20 control circuit in response to externally supplied operational commands.
Figure 30B:
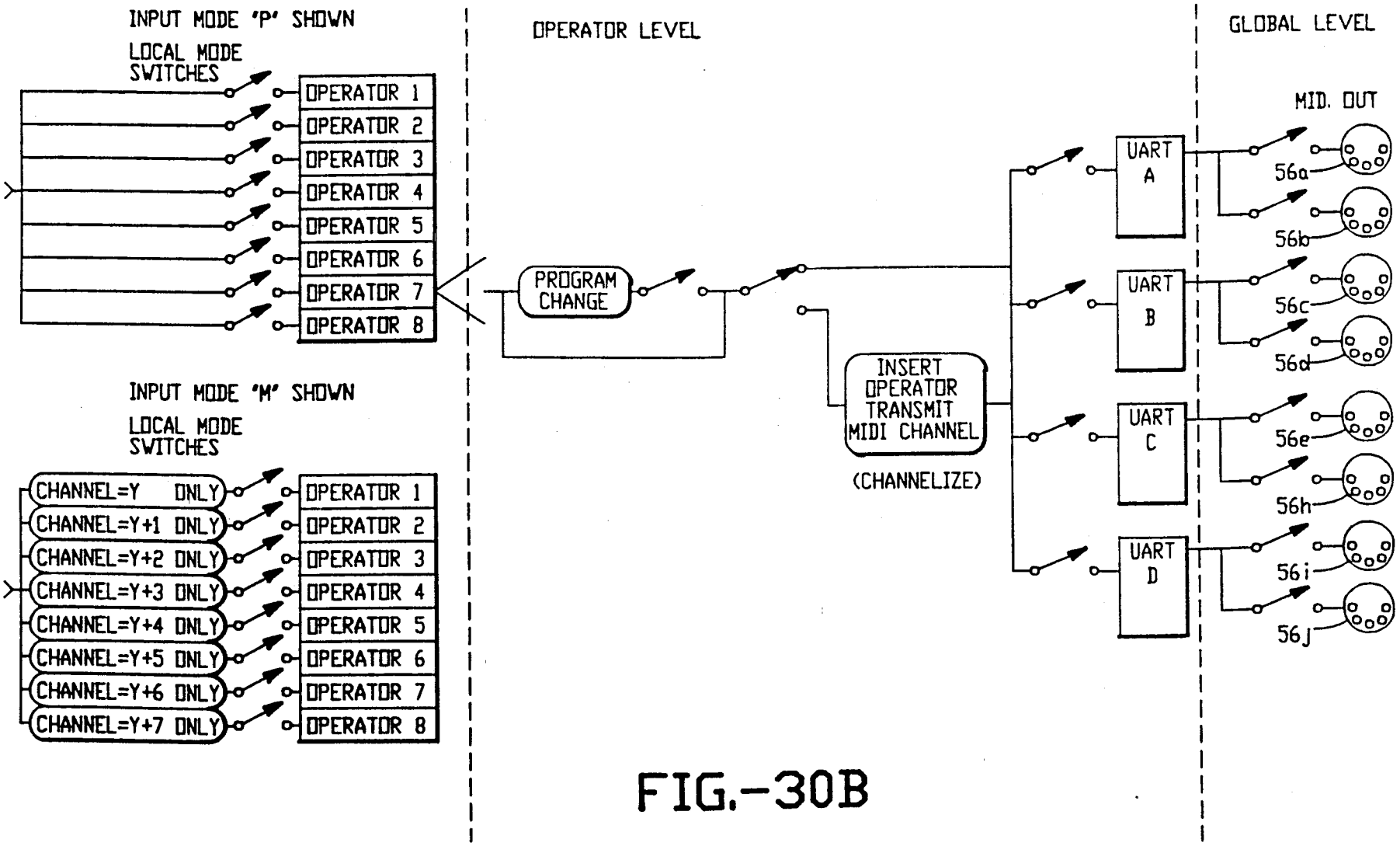

With reference to the flow diagram depicted in FIGS. 30A and 30B, there are two modes that can be used with the two MIDI input ports 54*a* and 54*b*. A first mode, called the "P" mode provides a normal operational input mode, while a second mode, called the "M" mode, has been implemented for use with external controllers such as a guitar controller. The two modes operate quite differently within the keyboard 10.

Each MIDI channel is given a channel number by convention. In the first or "P" mode the input channel is set to the MIDI channel actually being received by the keyboard 10, unless the OMNI mode is selected. If the OMNI mode is selected, then the keyboard will receive all of the 16 MIDI channels. The MIDI input channel number or selection of the OMNI mode is handled at the page zero utilities program level, functional command 15. Then, the particular MIDI input channel is enabled by a selection at page zero, functional command 16.

Functional command 17, page zero, enables internal routing of program changes being received by the keyboard 10 via the selected MIDI input channel. These program changes may be routed any one of three ways: off, on or through. When set to off, program changes will be ignored by the keyboard controller system 230. When set to on, incoming program changes will be sent to the global select functional level and cause the change of globals from these incoming program changes. When set to the through mode, program changes will go through the keyboard 10 directly to the synthesizer or synthesizers 11 and will change their patches. The operator local mode of the keyboard 10 should be off in order for the local user of the keyboard 10 to see MIDI input information, as displayed at page one, functional command 8.

Channelize is another function that affects how the selected MIDI input channel is routed (page two, functional command 6). In the "P" mode, channelization (or reassignment of input channel information) occurs only when the channelize option is selected on page two for the given operator. Otherwise, output of MIDI information goes through the normal channel assignments of global operators set up in the currently selected global program.

In the "M" mode, if OMNI is on, then the keyboard 10 will receive on all incoming MIDI channels, with one exception. If OMNI is on and an input channel is selected at page zero, functional command 15, then that channel becomes the "base" channel. At this point, the keyboard 10 will ignore any information coming in on channels below the "base" channel. For example, with OMNI on and a base channel of 5 selected, the keyboard 10 will receive MIDI commands and information on all incoming MIDI channels from 5 and up, but will ignore all information on channels from 0 to 4. If the OMNI mode is off, then the selected input channel must be the same as the received channel as is required in the "P" mode.

At least one of the four UARTS in the MIDI and control input/output circuit 238 must be enabled before any incoming MIDI information will be able to leave the keyboard 10 on a MIDI output. This is accomplished at page two, functional command 5. Also, the MIDI out enables must be on, page one, functional command 3.

The major difference between the P mode and the M mode is in the way the base channel affects the M mode at the operators level of program execution, and this difference is graphed at FIG. 30B. With the OMNI mode on and with a base channel selected, and with all operator channelize functions turned off, the base channel will be routed to all operators with a channelized offset beginning with operator 2 and above. Again, the local mode of the operators must be turned off or the MIDI input information will be ignored.

In the M mode, if the base channel "V" equals channel 5, for example, this channel will be sent to operator 1, whereas channel 6 will be sent to operator 2, channel 7 to operator 3, channel 8 to operator 4, channel 9 to operator 5, channel 10 to operator 6, channel 11 to operator 7, and channel 12 to operator 8. If the base channel V is set to 15, for example, operator 1 will see channel 15, operator 2 will see channel 16, but operator 3 will see channel 1 and so forth. That is to say, the channel selection process wraps around at channel 16. In addition, if an operators channelize function, page two, functional command 6 is on, then the operator's input channel will be forced to the particular operator's output channel. Again, the UART enables and the MIDI transmit enables must be on.

As explained above in conjunction with FIG. 5, the control software for the keyboard 10 is divided into three pages. The first page, page zero, controls system utilities. The second page, page one, controls the global system program setup; and, the third page, page two, controls set up of the eight operators which may be active within a global program setup.

In performance mode the LCD display 78 displays the currently selected global program. In the program advance library (PAL) mode, the current PAL position is displayed by the display 78.

Page Zero, Utilities

Page Zero, Functional Command (FC) 0: This command allows changing the current global program, the page number, or the functional command number. When the cursor of the display 78 is on the global program select field, the edit footswitch 58*a* acts as a momentary switch.

Page Zero, FC 1: When the cursor is placed on a "GO" field, and the "Yes" control 88*b* is pressed, a MIDI tune command is transmitted over all active MIDI utility outputs of the keyboard 10.

Page Zero, FC 2: This command is a Program Advance Library Edit command. In this command, the current PAL position is selected and the global program number for that position may be edited. Entering a value of 100 will place a marker that will cause the PAL to jump back to the beginning when advanced to this point.

Page Zero, FC 3: PAL insert/delete command. A new global program number may be entered in the list thereof at the selected PAL position. For a delete, the current position is selected and entered; the existing global program number is then displayed at the LCD display. The cursor is moved to Go and the Yes key is depressed, without entry of a new global program number.

Page Zero, FC 4: Copy current global to new position. A new PAL position is entered; the cursor is moved to Go and the yes key depressed. This command copies the current global program to another position in memory.

Page Zero, FC 5: This command exchanges a specified global program with the currently selected global program in memory.

Page Zero, FC 6: This command copies one operator in the current global program to another global program and operator location. Operator select button 66 on the front panel 16 are depressed during execution of this command to specify the origination and destination operators, the cursor is moved to Go, and the Yes button is then pressed.

Page Zero, FC 7: This command enables recall of the last edited global program from memory. If a global program was accidentally changed before writing edits, the edited global program can be recalled from an edit buffer memory location, so long as no edits were made since changing global programs.

Page Zero, FC 8: This command enables the front panel FSR membrane switches to be programmed to have sensitivity thresholds from zero to 99.

Page Zero, FC 9: This command sets the polarity of the edit footswitch 58*a*.

Page Zero, FC 10: This command enables the user to select one of three user definable key velocity/pressure scaling tables. These tables map input values from 0 to 127 to the corresponding scale values selected.

Page Zero, FC 11: This command enables the user to enter up to 32 user defined MIDI messages. The message number is selected, the message name is edited, and the message is entered with hex values. The first byte must be 80(Hex) or greater. The end of the message is set when FE(Hex) is entered. Parameters to be included later are indicated by placing FF(Hex) in the message. All status bytes 80(Hex) through EF(Hex) automatically have the operator MIDI channel inserted.

Page Zero, FC 12: This command enables global programs for the keyboard 10 to be transmitted and received over MIDI in the system exclusive format. Individual global programs, or all, may be selected for transmission and/or reception.

Page Zero, FC 13: This command enables the two MIDI input paths 54*a* and 54*b* to be enabled and disabled individually.

Page Zero, FC 14: This command selects the input MIDI channel for each of the MIDI paths 54*a* and 54*b* and also selects OMNI mode status.

Page Zero, FC 15: This command selects the MIDI output path or paths that will be active in the edit mode only.

Page Zero, FC 16: This command selects the method of handling incoming MIDI program select commands. As explained above in conjunction with FIG. 30*a* and 30*b*, options are off, on and through.

Page Zero, FC 17: This command enables selection of which MIDI input path 54*a* or 54*b* will be enabled for system exclusive recognition. Only one input at a time may be enabled for system exclusive recognition.

Page Zero, FC 18: This command enables short MIDI command sequences to be recorded into memory to be used later when requesting system exclusive data dumps. The recorded sequence may be given a ten character name. After the cursor is placed on Go and the Yes button is depressed, all received MIDI information on the selected system exclusive input will be stored in local memory, up to a limit of 244 bytes. The operation will be cancelled automatically after a set time period has elapsed during which no data has been received over the system exclusive input.

Page Zero, FC 19: This command selects whether the internal micro-floppy disk drive 40 or whether an optional external disk drive connected at the jack 64 will be used. Placing the cursor at Go and pressing the Yes button will cause the selected disk directory to be scanned, the number of files therein reported, and the percentage of available disk space indicated.

Page Zero, FC 20: This command causes all present global system set up programs and data to be written to disk as a file. The disk file name is entered or a random name is selected by entering a space character at the first character of the name. The cursor is moved to Go and the Yes button depressed. Up to 100 global set ups, PAL, User Scales and User MIDI messages presently stored in active memory may be recorded in this file.

Page Zero, FC 21: This command saves the currently loaded synthesizer name extraction subroutine to disk.

Page Zero, FC 22: This command saves all User Scales to disk as a separate file. User Scales may later be loaded back into current memory individually or all together.

Page Zero, FC 23: This command saves all user MIDI messages in a separate file.

Page Zero, FC 24: This command saves all current system exclusive data request messages to disk in a separate file.

Page Zero, FC 25: This command records incoming MIDI system exclusive data (in any format) directly to a specified disk file. This file may be retrieved and retransmitted from disk later. Within this command, the length of data expected is entered, the cursor is moved to Go and the Yes button is depressed. A data request message will be generated and transmitted via one of the UARTS and all received MIDI information will then be recorded to the disk file. The process will cancel if no data is received within a set time limit.

Page Zero, FC 26: This command enables a specified file to be loaded into active memory from disk. The file name is selected by number. For system files, user message files and user scale files, either all or individual sections may be loaded to a selected destination location.

Page Zero, FC 27: This command enables a specified file to be erased from the micro-floppy disk. Disk storage space freed by this operation is then available for storing other information.

Page Zero, FC 28: This command enables new disks to be formatted at initialization thereof. It also functions as a disk erase command, enabling erasure of an entire disk.

Page Zero, FC 29: This command enables the keyboard 10 to be "unlocked". When the keyboard "Lock" is on, the user must enter a six character code word the next time that the keyboard 10 is turned on. Otherwise, the keyboard 10 will not enter the performance mode and will not enter the edit mode.

Page Zero, FC 30: This command enables a test mode to be entered by the keyboard 10. This routine checks keyboard velocity/pressure calibration and pedal and wheel testing.

Page One, Globals

Page One parameters are stored as part of a global set up program.

Page One, FC 0: This command selects edit page one.

Page One, FC 1: This command enables a global pitch value to be transposed for all eight operators active within the current global setup. The range of transposition is minus 48 to plus 48 semitones.

Page One, FC 2: This command enables a global program to be named. A global program may have up to 16 characters for a name.

Page One, FC 3: This command enables the outputs of the four MIDI transmitters to be routed to any combination of two outputs for each. UART transmitters are labelled A, B, C and D, and each of the two possible output jacks thereof are labelled 1 and 2. The selected output enables apply to all operators in the current global setup program.

Page One, FC 4: This command enables operators to be programmed to wake up either On or Off. Wake up occurs when leaving edit mode, stepping through the Program Advance Library (PAL) or pressing the Write button 74. After wake up, operators may be turned on and off manually by depressing any of the eight operator control buttons 66*a* to 66*h* at the front panel 16.

Page One, FC 5: This command enables key action thresholds to be set. As previously explained in conjunction with FIG. 28, key action thresholds are used to adjust the sensitivity of the keyboard 10 and to set the dynamic range of the overall velocity of the 8 operator velocity scales. A low note-on threshold means that only a light touch on the keys is required for notes to be sensed during play. A wide difference between the note-on and note-off thresholds will increase the dynamic range of the velocity response of the keyboard. Typical values would be note-off=20 and note on=40.

Page One, FC 6: This command enables global set up programs to be protected against editing by preventing access to the edit buffer within memory. When this memory protect command is off, normal editing may be performed.

Page One, FC 7: This command permits viewing and editing all eight operator MIDI transmit channels on a single display which provides operator and MIDI channel correlation.

Page One, FC 8: This command enables the local mode of each of the eight internal MIDI operators to be turned off to enable received incoming MIDI information to pass through the operator. When an operator is turned off, keyboard control and pedal, footswitch and wheel control is disabled relative to the particular operator.

Page One, FC 9: This command enables received incoming MIDI information to be assigned to an operator. The normal mode is called "P" mode where all qualified MIDI commands go to all non-local MIDI operators (pass through). Mode "M" is designed with guitar controllers in mind, so that MIDI on sequential channels is assigned to corresponding operators. If mode M is selected, the MIDI input should also be in OMNI On mode.

Page One, FC 10: This command enables selected MIDI commands to be filtered out of the incoming MIDI data stream before the stream reaches the internal MIDI operators. Note-on and note-off commands may be filtered, and controllers, pitch bend and pressure may also be separately enabled and disabled.

Page One, FC 11: This command enables each MIDI input port to have MIDI commands enabled or disabled, including whether the Notes are on or off, the controls are on or off the pitch bend is on or off and the pressure is on or off.

Page One, FC 12: This sustain hold command enables notes being held with a sustain pedal to remain playing while an operator is turned off. When the operator is turned back on, the held notes will stop sustaining action if the sustain pedal has been released. When this sustain hold command is off, if any foot controls or wheels are assigned to MIDI sustain (controller number 66) a sustain off command is transmitted when an operator is turned off.

Page One, FC 13: This command allows disabling of all MIDI controllers in a global program without having to change any operator controller assignment. When MIDI Controller Output is turned off, the operator assignments are not changed, rather they are merely temporarily disabled. Turning MIDI controller output back on thereupon enables normal operation.

Page Two, Operators

There are two ways to select an operator to edit. The first is to press an operator button 66 while in the edit mode. The second is to position the display cursor of the LCD text display 78 on page two and enter the desired command number.

Page Two, FC 0: This command enables the operator edit page to be selected and also enables selection of a particular operator, such as "1=strings" for example, to be edited.

Page Two, FC 1: This command enables each operator to be programmed to transmit a program select command when it wakes up. A number from 0 to 127 is selected, or the-1 key is selected to disable a patch select. The operator name may also be edited.

Page Two, FC 2: This command sends a patch dump request to a particular synthesizer and extracts the synthesizer name from the resulting system exclusive dump. If a "name finder" file has been loaded from disk, and the proper MIDI cable arrangements have been established, the name of the selected synthesizer patch can be extracted and used as an operator's name. Moving the cursor between the patch number field and the first name character field should cause a display on the LCD display which associates an operator name with the particular synthesizer, such as "operator 1 name=-strings; get from synth: Yamaha DX-7", for example. In addition to a patch select command, any other short MIDI message can be transmitted during wake up, either before or after the patch select. Select -1 to disable, or a message number from 0 to 31 to choose a MIDI message defined at the system level. Up to two parameters may be defined which will be substituted into the message in place of default (X) and (Y) labels.

Page Two, FC 3: This command enables selection of the MIDI channel for all messages originating in the selected operator.

Page Two, FC 4: This command enables operator output to be routed to any combination of the four MIDI UART transmitters A, B, C and D.

Page Two, FC 5: This command enables selection of a channelize option and activation of the program change switch. Further processing of MIDI input is possible with the keyboard 10. The channelize option forces any incoming MIDI commands to take on the operator MIDI transmit channel. The program change switch enables filtering out of any program change commands.

Page Two, FC 6: This command sets the operating range of the current operator in a range from 01 to 88.

Page Two, FC 7: This command enables operators to be pitch transposed independently, in addition to the global transposition command at Page One. Herein, the range is minus 48 to plus 48 semitones.

Page Two, FC 8: This command disables the keyboard pitch completely. If keyboard pitch is disabled, any key played within the range of the keyboard will result in a middle C note, offset only by the selected operator pitch transposition.

Page Two, FC 9: This command selects a velocity scaling table and upper and lower limits in a range between 01 and 127. Eight scales are available (including three user scales) and all eight may also be inverted. Upper and lower limits allow setting the maximum and minimum velocity values that will be transmitted.

Page Two, FC 10: This command sets the velocity window limits, thus eliminating any played notes with scaled velocities below or above the selected range.

Page Two, FC 11: This command enables global (channel) and polyphonic aftertouch to be enabled independently.

Page Two, FC 12: This command permits key pressure to be scaled. The same scales available for velocity are also available for pressure (poly and channel). Upper and lower limits between 127 and 01 may also be set with this command.

Page Two, FC 13: This command enables footswitch polarity to be programmed differently for each operator.

Page Two, FC 14, 15, 16: Each of these commands enables one of the three footswitches to be routed to any MIDI controller number and also some other functions such as sequencer start, stop, all notes off, etc.

Page Two, FC 17: This command enables the four variable footpedals to be used normally or to be reversed in polarity.

Page Two, FC 18-24: These commands enable the four pedals and the two control wheels to be assigned to a wide range of controller numbers, from 01 through 128. Like the pedals, the wheels may also be reversed or used normally, programmed separately in each operator.

Here follows an object code listing of a control program which implements the above commands when installed within the structural environment of the control system 230 of the keyboard 10.

```
8000   8D AB C4 BE C0 99 C1 5B   C1 98 C2 67 A4 6A 94 92
8010   E4 77 94 E3 E9 1F E5 82   E6 1A 95 2A 8A 38 89 DF
8020   95 0B 95 06 A6 B9 AD 22   AD 2A 95 3A A7 02 AD 7D
8030   C0 24 C2 F1 E3 53 E3 3E   E3 31 E3 62 2A 2A 20 20
8040   20 20 20 20 20 20 20 20   20 20 4B 54 49 20 20 47
8050   5A 2D 31 30 30 30 20 20   20 20 20 20 20 20 20 20
8060   20 20 2A 2A FF 4B 54 49   20 47 5A 2D 44 49 53 4B
8070   20 4F 50 45 52 41 54 49   4E 47 20 53 59 53 54 45

8080   4D 20 28 43 29 20 31 39   38 38 20 20 20 47 5A 2D
8090   31 30 30 30 20 46 49 52   4D 57 41 52 45 20 56 45
80A0   52 53 49 4F 4E 20 31 2E   30 30 20 28 43 29 20 31
80B0   39 38 38 20 20 FF 45 6C   65 63 74 72 6F 6E 69 63
80C0   73 20 61 6E 64 20 73 6F   66 74 77 61 72 65 20 62
80D0   79 20 41 6E 6E 65 20 47   72 61 68 61 6D 20 61 6E
80E0   64 20 50 61 75 6C 20 4A   2E 20 57 68 69 74 65 20
80F0   28 43 29 20 31 39 38 38   FF 20 20 20 20 7B 47 5A

8100   20 31 2E 30 30 7D 20 20   20 20 53 45 4C 45 43 54
8110   20 45 44 49 54 20 50 41   47 45 20 3A 20 20 FF F0
8120   7E FD 00 06 02 00 00 24   01 00 01 00 31 2E 30 30
8130   F7 FE 34 02 A6 A0 A7 80   5A 26 F9 35 82 34 02 A6
8140   80 A7 A0 5A 26 F9 35 82   34 02 A6 A0 84 7F A7 80
8150   5A 26 F7 35 82 34 02 A6   80 84 7F A7 A0 5A 26 F7
8160   35 82 10 AE 81 27 10 A6   80 A7 A4 20 F5 4F 10 AE
8170   81 27 04 A7 A4 20 F7 39   50 23 5D C4 5D 87 52 C4

8180   52 C3 5D D9 5D DA 59 67   5D 90 5D 91 57 4C 59 65
8190   59 66 5D 99 5D 9A 30 02   30 03 30 04 5F E1 00 00
81A0   5D DD 5D DE 5D 7B 52 86   52 99 30 03 52 90 52 92
81B0   52 94 52 8F 52 91 52 93   52 95 52 96 52 97 5D 83
81C0   5D D3 52 9D 52 9E 67 00   00 00 5D AD 19 52 87 80
81D0   52 88 80 52 89 80 52 8A   80 5D 7E 0F 52 8B 01 00
81E0   00 1A 50 86 FF B7 30 10   4A 26 FD 86 40 1F 8B 8E
81F0   BF 78 B7 5D 5D BF 5D 5E   86 7F B7 30 20 86 FF B7

8200   52 C5 B7 5D 80 B6 38 02   10 CE 5C DD 10 FF 5A 86
8210   CC C6 E0 8E 5D 1D ED 83   ED 83 BF 5A 88 CC C7 66
```

| | | | | | | | | | | | | | | | | |
|---|---|---|---|---|---|---|---|---|---|---|---|---|---|---|---|---|
| 8220 | 8E | 5D | 5D | ED | 83 | ED | 83 | BF | 5A | 8A | BD | 8C | A0 | BD | 8C | F3 |
| 8230 | BD | E9 | 37 | 8E | 81 | 78 | BD | 81 | 6D | BE | 57 | 4A | 8C | 56 | E6 | 25 |
| 8240 | 05 | 8C | 57 | 4A | 25 | 06 | 8E | 56 | E6 | BF | 57 | 4A | B6 | 5D | AD | 81 |
| 8250 | 63 | 23 | 02 | 86 | 19 | 34 | 02 | 86 | 1E | B7 | 5D | AD | BD | 8B | DB | 35 |
| 8260 | 02 | B7 | 5D | AD | BD | D5 | D8 | CC | 86 | F9 | FD | 30 | 00 | BD | BF | A0 |
| 8270 | BD | D5 | D8 | BD | C2 | F1 | CC | 86 | A4 | FD | 30 | 00 | 8E | 8A | 16 | BD |
| 8280 | C0 | 24 | BD | C0 | 9C | BD | 8A | B8 | BD | D5 | D8 | BD | 8B | 04 | BD | D5 |
| 8290 | D8 | 86 | 7F | B7 | 30 | 04 | 12 | 12 | B6 | 38 | 03 | 8A | F0 | 81 | FE | 10 |
| 82A0 | 26 | 00 | 33 | 8E | 81 | CA | BD | 81 | 62 | 8E | 81 | A0 | BD | 81 | 6D | 4F |
| 82B0 | BD | 8B | 98 | 5F | 8E | FE | B7 | BD | 81 | 3D | 4F | BD | 8B | BE | C6 | 20 |
| 82C0 | 8E | FF | B7 | BD | 81 | 3D | B6 | 38 | 03 | 43 | 84 | 0F | 26 | F8 | 86 | FF |
| 82D0 | B7 | 52 | 8C | B7 | 30 | 03 | 8E | B7 | 56 | BD | C0 | 24 | BD | C0 | 9C | 86 |
| 82E0 | 01 | B7 | 5D | 84 | BD | FD | 87 | 7F | 5D | 84 | CC | 86 | 99 | FD | 30 | 00 |
| 82F0 | BD | F5 | 16 | 1C | AF | B6 | 52 | 99 | 81 | 63 | 23 | 04 | 4F | B7 | 52 | 99 |
| 8300 | B7 | 52 | 9A | BD | CD | 94 | 7F | 5D | 84 | BD | CE | 0C | 86 | FF | B7 | 52 |
| 8310 | 98 | 4F | BD | 8B | FB | BD | 8D | 07 | B6 | 52 | 83 | 4C | 81 | 07 | 23 | F2 |
| 8320 | 4F | 5F | B7 | 5D | 98 | B7 | 5D | DA | FD | 59 | 65 | BD | 8A | B8 | B6 | 5D |
| 8330 | 8A | 8A | 1F | B7 | 5D | 8A | B7 | 30 | 04 | 7F | 5D | 89 | 7F | 5D | AE | B6 |
| 8340 | 5D | 92 | B7 | 5D | 93 | 8E | 80 | 3C | BD | C0 | 24 | C6 | 28 | BD | 8C | 08 |
| 8350 | B6 | 57 | 4C | 27 | 21 | F6 | 5D | 8A | C4 | FD | F7 | 5D | 8A | CC | 50 | 41 |
| 8360 | FD | 50 | 94 | CC | 4C | 20 | FD | 50 | 96 | FC | 57 | 4A | 83 | 56 | E6 | 1F |
| 8370 | 98 | C6 | 4E | BD | C1 | 5B | BD | C0 | 9C | 20 | 2A | B7 | 5D | 93 | C6 | 07 |
| 8380 | 8E | D2 | 0D | A5 | 85 | 26 | 03 | 5A | 2A | F9 | 34 | 04 | BD | 8B | EE | 8E |
| 8390 | 8C | 3A | BD | C0 | 4C | 35 | 02 | 4C | C6 | 31 | BD | C1 | 5B | C6 | 36 | BD |
| 83A0 | AD | 69 | BD | C0 | 9C | B6 | 5D | 92 | B1 | 5D | 93 | 27 | 05 | 4D | 26 | CB |
| 83B0 | 20 | 90 | B6 | 5F | E1 | 27 | 27 | 8E | 50 | 8F | CC | 58 | 3D | ED | 84 | 4C |
| 83C0 | ED | 06 | 86 | 20 | A7 | 04 | A7 | 0A | B6 | 5F | DF | C6 | 47 | BD | C1 | 5B |
| 83D0 | B6 | 5F | E0 | C6 | 4D | BD | C1 | 5B | BD | C0 | 9C | 7F | 5F | E1 | BD | 8D |
| 83E0 | 43 | BD | D6 | BE | BD | D8 | 15 | BD | D6 | 5D | BD | D7 | B4 | BD | C3 | 3F |
| 83F0 | BD | C6 | A7 | B6 | 52 | 98 | 81 | 64 | 24 | 18 | BD | 8B | 35 | BD | 8B | 24 |
| 8400 | B6 | 52 | A3 | B7 | 5D | BC | B6 | 52 | 98 | B7 | 52 | 99 | BD | CD | 9B | 16 |
| 8410 | FE | F4 | B6 | 5D | 7C | 2A | 0E | 84 | 01 | 27 | 0A | 7D | 57 | 4C | 10 | 27 |
| 8420 | 01 | 51 | 16 | 03 | EC | B6 | 5D | 8F | 27 | 46 | 7F | 5D | 8F | 85 | 01 | 10 |
| 8430 | 26 | 01 | 40 | 85 | 02 | 10 | 26 | 03 | 81 | 85 | 0C | 10 | 26 | 03 | B4 | 85 |
| 8440 | 10 | 27 | 2D | B6 | 5D | 8A | 84 | EF | B7 | 30 | 04 | BD | 8B | 35 | BD | 8B |
| 8450 | 24 | B6 | 52 | 99 | BD | 88 | 70 | 86 | 65 | BD | 88 | 70 | B6 | 50 | 13 | B7 |
| 8460 | 5D | 88 | BD | 8C | 53 | B6 | 5D | 8A | 8A | 10 | B7 | 30 | 04 | 16 | FE | 96 |
| 8470 | B6 | 5D | 8E | 10 | 27 | FF | 2E | C6 | 07 | 8E | D2 | 0D | A5 | 85 | 26 | 03 |
| 8480 | 5A | 2A | F9 | BD | 8B | EE | D6 | 6C | 53 | F4 | 5D | 8E | F7 | 5D | 8E | 96 |
| 8490 | 6C | B5 | 5D | 88 | 27 | 21 | B5 | 5D | 83 | 27 | 2D | B8 | 5D | 88 | B7 | 5D |
| 84A0 | 88 | BD | 8B | 43 | BD | 84 | E9 | 96 | 74 | B7 | 52 | 94 | D6 | 6C | 53 | F4 |
| 84B0 | 5D | 83 | F7 | 5D | 83 | 20 | 06 | B8 | 5D | 88 | B7 | 5D | 88 | B6 | 5D | 8E |
| 84C0 | 26 | B5 | BD | CE | 0C | 16 | FE | DD | 0D | 22 | 26 | 0B | B8 | 5D | 88 | B7 |
| 84D0 | 5D | 88 | BD | 8B | 43 | 20 | E6 | BA | 5D | 83 | B7 | 5D | 83 | BD | 8B | 43 |
| 84E0 | 8D | 07 | B6 | 52 | 94 | 97 | 74 | 20 | D4 | 34 | 36 | BD | D0 | D7 | 86 | 65 |
| 84F0 | BD | 8B | 98 | 8E | 50 | 00 | F6 | 52 | 83 | 58 | A6 | A5 | B7 | 5D | AF | A6 |
| 8500 | 85 | A7 | A5 | B6 | 5D | AF | A7 | 85 | 5C | A6 | A5 | B7 | 5D | AF | A6 | 85 |
| 8510 | A7 | A5 | B6 | 5D | AF | A7 | 85 | 31 | A9 | 00 | 18 | B6 | 52 | 83 | C6 | 1D |
| 8520 | 3D | 31 | AB | 9E | 64 | C6 | 1D | A6 | 84 | B7 | 5D | AF | A6 | A4 | A7 | 80 |
| 8530 | B6 | 5D | AF | A7 | A0 | 5A | 26 | EF | 86 | 65 | BD | 8B | BE | 1F | 21 | F6 |
| 8540 | 52 | 83 | C4 | 07 | 58 | 58 | 3A | 96 | 1D | 8D | 23 | D7 | 1D | 96 | 1E | 8D |
| 8550 | 1D | D7 | 1E | 96 | 1F | 8D | 17 | D7 | 1F | 96 | 20 | 8D | 11 | D7 | 20 | BD |
| 8560 | D1 | 72 | 7F | 5D | AE | 96 | 7C | 27 | 03 | BD | 8D | 07 | 35 | B6 | E6 | 84 |
| 8570 | A7 | 80 | 39 | 8E | 96 | 4D | F6 | 52 | 8F | 58 | AE | 85 | 8C | A0 | FD | 27 |
| 8580 | 0A | 8C | A2 | C8 | 27 | 05 | 8C | A3 | 09 | 26 | 06 | 7F | 52 | 90 | 7F | 52 |
| 8590 | 97 | BD | D2 | DF | BD | 8B | 35 | BD | 8B | 24 | 7F | 5D | 87 | BD | D2 | B0 |

```
85A0   B6 52 8C 43 B7 30 10 BD  8B DB 7C 52 C2 B6 52 A3
85B0   B7 5D BC 7F 5D AE 1C AF  7F 5D 84 F6 52 C2 27 31
85C0   7F 5D 89 B6 52 86 81 02  26 0B 8E D2 0D B6 52 95
85D0   A6 86 B7 5D 89 F6 5D 8A  CA 0C C4 FE B6 52 86 27
85E0   0A 81 01 26 04 C4 FA 20  02 C4 F6 F7 5D 8A F7 30
85F0   04 BD 8D 3E BD C2 15 BD  C3 00 8E AC CC F6 52 93

8600   4F 58 49 AE 8B 8C B1 99  26 05 B6 52 94 26 51 4F
8610   8E 5B 5B E6 84 C1 10 24  32 30 01 4C E6 84 C1 10
8620   24 29 30 02 4C E6 84 C1  10 24 20 30 02 E6 84 C1
8630   10 25 2D C4 0F E7 84 FC  52 8F FD 52 96 86 02 B7
8640   52 90 4F B7 52 8F B7 52  86 20 0F C4 0F E7 84 B7
8650   52 86 26 06 FC 52 96 FD  52 8F 7C 52 C2 16 FF 56
8660   B6 5D 7C 2A 21 F6 52 86  58 8E 52 8F EC 85 10 83
8670   00 02 26 09 B6 52 86 81  02 10 25 00 D7 B6 5D 7C

8680   84 01 10 26 00 CE B6 5D  8F 27 06 85 01 10 26 00
8690   C3 F6 52 86 10 27 00 9D  C1 01 27 4F F6 52 95 BD
86A0   8B EE 85 10 27 24 B6 5D  8A 84 EF B7 30 04 B6 52
86B0   99 BD 89 55 F6 52 95 86  65 BD 89 55 BD 8C 53 B6
86C0   5D 8A 8A 10 B7 30 04 16  FE EC B6 5D 8E 10 26 00
86D0   90 F6 52 93 2A 01 5F C1  1A 23 02 C6 1A F7 52 93
86E0   8E AC CC 58 AE 85 AD 84  16 FE CB 85 10 27 27 B6
86F0   5D 8A 84 EF B7 30 04 B6  52 99 BD 88 70 86 65 BD

8700   88 70 B6 50 13 B7 5D 88  BD 8C 53 B6 5D 8A 8A 10
8710   B7 30 04 16 FE A0 B6 5D  8E 26 46 F6 52 91 2A 01
8720   5F C1 0E 23 02 C6 0E F7  52 91 8E A6 97 58 AE 85
8730   AD 84 16 FE 81 F6 52 8F  2A 01 5F C1 1E 23 02 C6
8740   1E F7 52 8F 8E 96 4D 58  AE 85 AD 84 B6 5D 8E 26
8750   10 16 FE 62 B6 52 85 B1  52 99 10 27 FB A8 16 FB
8760   92 5F 8E D2 0D A5 85 26  05 5C C1 07 23 F7 B6 52
8770   86 81 02 26 22 F1 52 95  26 1D 0D 22 27 19 BD 84

8780   E9 A6 85 B8 5D 83 B7 5D  83 96 74 97 75 B6 52 94
8790   97 74 96 75 B7 52 94 F7  52 95 A6 85 B7 5D 89 BD
87A0   8B EE B6 52 86 81 02 27  08 7F 52 94 86 02 B7 52
87B0   86 B7 52 C2 7F 5D AE 16  FD FC F6 5D 8A CA 02 B6
87C0   57 4C 88 01 84 01 B7 57  4C 27 0D C4 FD F7 5D 8A
87D0   F7 30 04 BE 57 4A 20 68  F7 5D 8A F7 30 04 CC 20
87E0   20 FD 50 98 FD 50 96 FD  50 94 FD 50 92 BD C0 9C
87F0   16 FB B2 85 04 26 1A 86  08 8D 5B BE 57 4A A6 1F

8800   81 64 10 27 FB 9F 30 1F  8C 56 E6 10 25 FB 96 20
8810   28 86 04 8D 41 BE 57 4A  30 01 8C 57 4A 10 24 FB
8820   84 A6 84 81 64 26 12 BE  57 4A 8C 56 E6 23 0A A6
8830   1F 81 63 22 04 30 1F 20  F1 7D 57 4C 10 27 FB 65
8840   A6 84 BF 57 4A 81 64 10  27 FB 5A 25 03 4F A7 84
8850   B7 52 98 16 FB 4F 34 06  86 0A BD CC 13 4F BD C4
8860   BE BD C4 BE A6 E4 BD C4  BE 86 F7 BD C4 BE 35 86
8870   34 04 8D 1F 24 05 BD 8C  7D 35 84 5F BD 8B EE 0F

8880   7C 0F 22 F6 52 83 5C C1  07 23 F1 7F 5D C2 7F 5D
8890   83 35 84 34 76 BD 8B BE  1F 23 BD 8B 98 A6 A8 17
88A0   2A 5C A6 E4 81 63 22 56  8E 88 B2 BD 8A 38 1A 01
88B0   35 F6 2F 2F 2F 2F 2F 2F  20 20 55 4E 41 42 4C 45
88C0   20 54 4F 20 57 52 49 54  45 20 47 4C 4F 42 41 4C
88D0   20 21 20 20 2F 2F 2F 2F  2F 2F 20 20 20 20 44 45
88E0   53 54 49 4E 41 54 49 4F  4E 20 4D 45 4D 4F 52 59
88F0   20 49 53 20 50 52 4F 54  45 43 54 45 44 FF 86 07

8900   BD 8B FB BD D0 D7 B6 52  83 4A 2A F4 8E 50 00 C6
```

| | | | | | | | | | | | | | | | | |
|---|---|---|---|---|---|---|---|---|---|---|---|---|---|---|---|---|
| 8910 | 18 | BD | 81 | 3D | 4F | BD | 8B | FB | 8D | 21 | 9E | 64 | C6 | 1D | BD | 81 |
| 8920 | 3D | 8D | 25 | C6 | 04 | A6 | 80 | A7 | C0 | 5A | 26 | F9 | BD | D1 | 72 | B6 |
| 8930 | 52 | 83 | 4C | 81 | 07 | 23 | DE | 1C | FE | 35 | F6 | 34 | 02 | B6 | 5D | DB |
| 8940 | B7 | 5D | 81 | B7 | 30 | 28 | 35 | 82 | 34 | 02 | B6 | 5D | DC | B7 | 5D | 81 |
| 8950 | B7 | 30 | 28 | 35 | 82 | 8D | 12 | 10 | 25 | 03 | 22 | 0F | 22 | 0F | 7C | 96 |
| 8960 | 6C | 43 | B4 | 5D | 83 | B7 | 5D | 83 | 39 | 34 | 36 | BD | 8B | 98 | A6 | A8 |
| 8970 | 17 | 2A | 10 | A6 | E4 | 81 | 63 | 22 | 0A | 8E | 88 | B2 | BD | 8A | 38 | 1A |
| 8980 | 01 | 35 | B6 | 31 | A9 | 00 | 18 | 86 | 1D | 3D | 31 | AB | B6 | 52 | 95 | BD |
| 8990 | 8B | FB | BD | D0 | D7 | 9E | 64 | C6 | 1D | BD | 81 | 3D | A6 | E4 | BD | 8B |
| 89A0 | BE | E6 | 61 | 58 | 58 | 31 | A5 | C6 | 04 | BD | 81 | 3D | A6 | E4 | BD | 8B |
| 89B0 | 98 | 8E | 50 | 00 | F6 | 52 | 95 | C4 | 07 | 58 | 3A | E6 | 61 | C4 | 07 | 58 |
| 89C0 | 31 | A5 | EC | 84 | 84 | 80 | C4 | 80 | 34 | 06 | EC | A4 | 84 | 7F | C4 | 7F |
| 89D0 | AA | E0 | A7 | A0 | EA | E0 | E7 | A4 | BD | D1 | 72 | 1C | FE | 35 | B6 | BD |
| 89E0 | C2 | F1 | 34 | 10 | 8E | 89 | F1 | BD | C0 | 24 | 35 | 10 | BD | C0 | 4C | 20 |
| 89F0 | 4D | 20 | 20 | 20 | 20 | 45 | 52 | 52 | 4F | 52 | 20 | 21 | 20 | 20 | 28 | 50 |
| 8A00 | 72 | 65 | 73 | 73 | 20 | 59 | 45 | 53 | 20 | 74 | 6F | 20 | 63 | 6F | 6E | 74 |
| 8A10 | 69 | 6E | 75 | 65 | 29 | FF | 4B | 45 | 59 | 53 | 43 | 41 | 4E | 4E | 45 | 52 |
| 8A20 | 20 | 4E | 4F | 54 | 20 | 52 | 45 | 53 | 50 | 4F | 4E | 44 | 49 | 4E | 47 | FF |
| 8A30 | 8E | 50 | 4A | 86 | FF | A7 | 88 | 4F | BD | C2 | F1 | BD | C0 | 24 | BD | C0 |
| 8A40 | 9C | CC | BF | BF | FD | 30 | 00 | FC | 52 | C6 | C3 | 0F | 42 | 34 | 06 | FC |
| 8A50 | 52 | C6 | 10 | A3 | E4 | 22 | 0B | BD | 8D | 3E | B6 | 5D | 8E | BA | 5D | 8F |
| 8A60 | 26 | ED | 35 | 06 | BD | 8D | 3E | B6 | 5D | 7C | 2B | 14 | B6 | 5D | 8E | BA |
| 8A70 | 5D | 8F | 26 | 0C | 4F | BD | DB | BE | 4D | 26 | 05 | BD | DC | 8E | 27 | E4 |
| 8A80 | BD | C2 | 15 | 7C | 52 | C2 | 7F | 5D | AE | 39 | BD | 8D | 3E | 4F | BD | DB |
| 8A90 | BE | 81 | 01 | 27 | 0A | 81 | FF | 26 | F1 | 1A | 01 | 34 | 01 | 20 | 07 | 7F |
| 8AA0 | 5D | AE | 1C | FE | 34 | 01 | 4F | B7 | 5D | 8E | B7 | 5D | 8F | B7 | 5D | AE |
| 8AB0 | BD | C2 | 15 | 7C | 52 | C2 | 35 | 81 | 34 | 11 | 1C | BF | 4F | B7 | 5D | 80 |
| 8AC0 | B7 | 30 | 20 | FC | 52 | C6 | C3 | 00 | 04 | FD | 5D | AF | FC | 52 | C6 | 10 |
| 8AD0 | B3 | 5D | AF | 23 | F7 | 86 | 7F | B7 | 30 | 20 | 1A | 40 | 4F | 8E | 00 | 00 |
| 8AE0 | A7 | 89 | 5A | 8D | A7 | 89 | 5A | ED | A7 | 89 | 5B | AD | A7 | 89 | 5B | 4D |
| 8AF0 | 30 | 01 | 8C | 00 | 58 | 25 | E9 | 86 | FF | B7 | 30 | 20 | B7 | 5D | 80 | 7F |
| 8B00 | 5D | AE | 35 | 91 | 34 | 17 | 1A | 40 | 4F | B7 | 52 | 83 | 8B | 40 | C6 | 80 |
| 8B10 | 1F | 01 | CC | 00 | 80 | A7 | 80 | 5A | 26 | FB | B6 | 52 | 83 | 4C | 81 | 07 |
| 8B20 | 23 | E7 | 35 | 97 | 34 | 17 | 1A | 40 | 8E | 5B | 4D | CC | 00 | 58 | A7 | 80 |
| 8B30 | 5A | 26 | FB | 35 | 97 | 34 | 02 | 86 | 07 | BD | 8B | FB | 8D | 05 | 4A | 2A |
| 8B40 | F8 | 35 | 82 | 34 | 16 | B6 | 52 | 83 | 8B | 40 | C6 | 80 | 1F | 01 | C6 | 7F |
| 8B50 | A6 | 85 | 26 | 2D | 5A | 2A | F9 | B6 | 50 | 17 | 85 | 40 | 26 | 21 | 9E | 64 |
| 8B60 | 30 | 89 | 00 | 14 | C6 | 09 | A6 | 80 | 81 | 40 | 27 | 05 | 5A | 26 | F7 | 35 |
| 8B70 | 96 | CC | B0 | 40 | 9A | 3B | FD | 52 | BF | 7F | 52 | C1 | BD | D0 | CA | 35 |
| 8B80 | 96 | 6A | 85 | 96 | 3B | 8A | 80 | FD | 52 | BF | 86 | 40 | B7 | 52 | C1 | BD |
| 8B90 | D0 | CA | A6 | 85 | 27 | BE | 20 | E9 | 34 | 06 | 44 | 44 | 44 | 44 | 44 | 84 |
| 8BA0 | 03 | 34 | 02 | B6 | 5D | 81 | 84 | FC | AA | E0 | B7 | 5D | 81 | B7 | 30 | 28 |
| 8BB0 | B7 | 5D | DB | A6 | E4 | 84 | 1F | 8A | 60 | 5F | 1F | 02 | 35 | 86 | 34 | 06 |
| 8BC0 | F6 | 5D | 81 | CA | 03 | F7 | 5D | 81 | F7 | 30 | 28 | F7 | 5D | DC | C6 | 20 |
| 8BD0 | 3D | 8B | 13 | 84 | 1F | 8A | 60 | 1F | 02 | 35 | 86 | 86 | 2D | B7 | 5D | 78 |
| 8BE0 | 86 | 3F | B7 | 5D | 79 | 86 | C8 | B0 | 5D | AD | B7 | 5D | 7A | 39 | 34 | 04 |
| 8BF0 | C4 | 07 | F7 | 52 | 83 | CB | 40 | 1F | 9B | 35 | 84 | 34 | 02 | 84 | 07 | B7 |
| 8C00 | 52 | 83 | 8B | 40 | 1F | 8B | 35 | 82 | 34 | 36 | 8E | 50 | 4A | 3A | 34 | 04 |
| 8C10 | 10 | 8E | 8C | 2E | C6 | 0C | BD | 81 | 32 | B6 | 52 | 99 | 35 | 04 | CB | 07 |
| 8C20 | BD | C1 | 5B | 10 | 8E | 50 | 00 | C6 | 10 | BD | 81 | 32 | 35 | B6 | 47 | 4C |
| 8C30 | 4F | 42 | 41 | 4C | 20 | 20 | 20 | 20 | 3D | 20 | 4F | 50 | 45 | 52 | 41 | 54 |
| 8C40 | 4F | 52 | 20 | 20 | 20 | 20 | 3D | FF | 4E | 4F | 20 | 4D | 45 | 53 | 53 | 41 |
| 8C50 | 47 | 45 | FE | 1C | AF | CC | 00 | 87 | 34 | 06 | BD | D6 | 7B | BD | D6 | 16 |
| 8C60 | C6 | 64 | 5A | 26 | FD | BD | D5 | D8 | BD | D6 | 22 | BD | D6 | 5B | EC | E4 |
| 8C70 | 83 | 00 | 01 | ED | E4 | 26 | E3 | 32 | 62 | 7F | 5D | AE | 39 | 34 | 36 | 10 |
| 8C80 | 8E | A9 | A6 | 8E | A6 | 97 | 5F | 10 | AC | 81 | 27 | 07 | 5C | C1 | 0E | 23 |

| | | | | | | | | | | | | | | | | |
|---|---|---|---|---|---|---|---|---|---|---|---|---|---|---|---|---|
| 8C90 | F6 | 35 | B6 | F7 | 52 | 91 | 7F | 52 | 92 | 86 | 01 | B7 | 52 | 86 | 35 | B6 |
| 8CA0 | CC | 52 | CF | FD | 52 | CB | FD | 52 | CD | CC | 53 | 54 | FD | 53 | 50 | FD |
| 8CB0 | 53 | 52 | CC | 53 | D9 | FD | 53 | D5 | FD | 53 | D7 | CC | 54 | 5E | FD | 54 |
| 8CC0 | 5A | FD | 54 | 5C | CC | 54 | E2 | FD | 54 | DE | FD | 54 | E0 | CC | 55 | E6 |
| 8CD0 | FD | 55 | E2 | FD | 55 | E4 | 86 | 7F | B7 | 52 | CA | B7 | 53 | 4F | B7 | 53 |
| 8CE0 | D4 | B7 | 54 | 59 | 86 | 03 | B7 | 00 | 00 | B7 | 08 | 00 | B7 | 10 | 00 | B7 |
| 8CF0 | 18 | 00 | 39 | 34 | 07 | 1A | 50 | CC | C3 | 9E | FD | 50 | 1B | 86 | 95 | 8D |
| 8D00 | E5 | 86 | 15 | 8D | E7 | 35 | 87 | 34 | 06 | 96 | 1F | 2B | 02 | 8D | 6A | D6 |
| 8D10 | 13 | 2B | 0A | 96 | 3B | 8A | C0 | FD | 52 | BF | BD | D0 | BE | 96 | 20 | 85 |
| 8D20 | 80 | 27 | 0E | BD | CC | 04 | 10 | 8E | 6D | 80 | 86 | FE | A7 | A8 | 64 | 8D |
| 8D30 | 76 | 96 | 1F | 2A | 02 | 8D | 42 | 35 | 86 | 8D | 08 | 7E | D6 | 5B | 8D | 03 |
| 8D40 | 7E | D6 | 5B | 1C | AF | BD | D6 | 16 | BD | DA | E3 | B6 | 5D | C4 | 27 | 26 |
| 8D50 | 2A | 12 | CC | 79 | 4F | FD | 5D | 8B | F7 | 5D | C4 | FC | 52 | C6 | C3 | 19 |
| 8D60 | 6E | FD | 52 | C8 | FC | 52 | C6 | 10 | B3 | 52 | C8 | 23 | 09 | B6 | 52 | 85 |
| 8D70 | BD | C1 | C0 | 7F | 5D | C4 | 7E | D6 | 22 | 96 | 1E | 85 | 20 | 26 | 14 | 86 |
| 8D80 | 70 | BD | 8B | 98 | D6 | 1E | C4 | 1F | 86 | 18 | 3D | 31 | AB | 96 | 20 | D6 |
| 8D90 | 1F | 8D | 1E | 39 | 34 | 26 | CC | C4 | BE | FD | 50 | 18 | A6 | E4 | 84 | 0F |
| 8DA0 | B7 | 50 | 1A | C6 | 80 | 20 | 1F | 96 | 20 | D6 | 1F | 34 | 26 | C6 | 80 | 20 |
| 8DB0 | 04 | 34 | 26 | C6 | 18 | 34 | 06 | CC | D0 | B8 | FD | 50 | 18 | 96 | 3B | 84 |
| 8DC0 | 0F | B7 | 50 | 1A | 35 | 06 | A6 | A0 | 2B | 07 | 5A | 26 | F9 | 35 | A6 | A6 |
| 8DD0 | A0 | 81 | FE | 27 | 2B | 81 | FD | 26 | 07 | A6 | A0 | 5A | 2A | 16 | 20 | 20 |
| 8DE0 | 81 | FF | 26 | 15 | A6 | E4 | 84 | 7F | 34 | 06 | EC | 62 | 1E | 89 | ED | 62 |
| 8DF0 | 35 | 06 | 20 | 05 | 84 | F0 | BA | 50 | 1A | AD | 9F | 50 | 18 | 5A | 26 | CF |
| 8E00 | 35 | A6 | 53 | 45 | 4C | 45 | 43 | 54 | FF | 20 | 54 | 52 | 41 | 4E | 53 | 4D |
| 8E10 | 49 | 54 | 20 | 4D | 41 | 53 | 54 | 45 | 52 | 20 | 54 | 55 | 4E | 45 | 20 | 43 |
| 8E20 | 4F | 4D | 4D | 41 | 4E | 44 | 20 | 4F | 4E | 20 | 20 | 20 | 20 | 20 | 20 | 20 |
| 8E30 | 20 | 20 | 20 | 41 | 4C | 4C | 20 | 41 | 43 | 54 | 49 | 56 | 45 | 20 | 4D | 49 |
| 8E40 | 44 | 49 | 20 | 4F | 55 | 54 | 50 | 55 | 54 | 53 | 2E | 2E | 2E | FF | 44 | 55 |
| 8E50 | 4D | 50 | 20 | 47 | 4C | 4F | 42 | 41 | 4C | 20 | 44 | 41 | 54 | 41 | 20 | 4F |
| 8E60 | 56 | 45 | 52 | 20 | 4D | 49 | 44 | 49 | 20 | 20 | 20 | 20 | 20 | 20 | 20 | 20 |
| 8E70 | 20 | 20 | 20 | 20 | 20 | 20 | 54 | 52 | 41 | 4E | 53 | 4D | 49 | 54 | 3A | 20 |
| 8E80 | 41 | 4C | 4C | FF | 54 | 52 | 41 | 4E | 53 | 4D | 49 | 54 | 54 | 49 | 4E | 47 |
| 8E90 | 3A | FF | 4E | 4F | 20 | 4E | 41 | 4D | 45 | 20 | 20 | 20 | 20 | 20 | 20 | 20 |
| 8EA0 | 20 | 20 | 20 | 20 | 4F | 50 | 45 | 52 | 41 | 54 | 49 | 4F | 4E | 20 | 43 | 4F |
| 8EB0 | 4D | 50 | 4C | 45 | 54 | 45 | 20 | 2D | 20 | 20 | 20 | 20 | 20 | 20 | 20 | 20 |
| 8EC0 | 20 | 20 | 20 | 20 | 20 | 20 | 20 | 20 | 20 | 50 | 52 | 45 | 53 | 53 | 20 | 22 |
| 8ED0 | 59 | 45 | 53 | 22 | 20 | 54 | 4F | 20 | 43 | 4F | 4E | 54 | 49 | 4E | 55 | 45 |
| 8EE0 | 2E | FF | 20 | 50 | 72 | 6F | 67 | 72 | 61 | 6D | 20 | 41 | 64 | 76 | 61 | 6E |
| 8EF0 | 63 | 65 | 20 | 4C | 69 | 62 | 72 | 61 | 72 | 79 | 20 | 45 | 44 | 49 | 54 | 20 |
| 8F00 | 20 | 20 | 20 | 20 | 20 | 20 | 20 | 50 | 41 | 4C | 20 | 20 | 20 | 20 | 3D | 20 |
| 8F10 | 47 | 4C | 4F | 42 | 41 | 4C | 20 | 20 | 20 | 20 | 3D | FF | 50 | 72 | 6F | 67 |
| 8F20 | 72 | 61 | 6D | 20 | 41 | 64 | 76 | 61 | 6E | 63 | 65 | 20 | 4C | 69 | 62 | 72 |
| 8F30 | 61 | 72 | 79 | 20 | 49 | 4E | 53 | 45 | 52 | 54 | 20 | 20 | 20 | 20 | 20 | 20 |
| 8F40 | 20 | 47 | 4C | 4F | 42 | 41 | 4C | 20 | 20 | 20 | 20 | 20 | 41 | 54 | 20 | 50 |
| 8F50 | 41 | 4C | 20 | 50 | 4F | 53 | 49 | 54 | 49 | 4F | 4E | FF | 44 | 45 | 4C | 45 |
| 8F60 | 54 | 45 | 50 | 41 | 4C | 20 | 20 | 20 | 20 | 3D | 20 | 4D | 41 | 52 | 4B | 45 |
| 8F70 | 52 | 20 | 31 | 30 | 30 | 20 | 4C | 4F | 4F | 50 | 20 | 42 | 41 | 43 | 4B | 20 |
| 8F80 | 54 | 4F | 20 | 50 | 41 | 4C | FF | 20 | 20 | 20 | 20 | 43 | 4F | 50 | 59 | 20 |
| 8F90 | 43 | 55 | 52 | 52 | 45 | 4E | 54 | 20 | 47 | 4C | 4F | 42 | 41 | 4C | 20 | 28 |
| 8FA0 | 20 | 20 | 29 | 20 | 20 | 20 | 20 | 20 | 20 | 20 | 20 | 20 | 20 | 20 | 20 | 20 |
| 8FB0 | 20 | 20 | 20 | 20 | 20 | 20 | 20 | 54 | 4F | 20 | 47 | 4C | 4F | 42 | 41 | 4C |
| 8FC0 | FF | 20 | 20 | 20 | 20 | 53 | 57 | 41 | 50 | 20 | 43 | 55 | 52 | 52 | 45 | 4E |
| 8FD0 | 54 | 20 | 47 | 4C | 4F | 42 | 41 | 4C | 20 | 28 | 20 | 20 | 29 | 20 | 20 | 20 |
| 8FE0 | 20 | 20 | 20 | 20 | 20 | 20 | 20 | 20 | 20 | 20 | 20 | 20 | 20 | 20 | 20 | 57 |
| 8FF0 | 49 | 54 | 48 | 20 | 47 | 4C | 4F | 42 | 41 | 4C | FF | 20 | 20 | 20 | 43 | 4F |
| 9000 | 50 | 59 | 20 | 4F | 50 | 45 | 52 | 41 | 54 | 4F | 52 | 20 | 20 | 20 | 22 | 20 |

| | | | | | | | | | | | | | | | | |
|---|---|---|---|---|---|---|---|---|---|---|---|---|---|---|---|---|
| 9010 | 20 | 20 | 20 | 20 | 20 | 20 | 20 | 20 | 20 | 22 | 20 | 20 | 20 | 20 | 20 | 20 |
| 9020 | 20 | 20 | 20 | 20 | 20 | 20 | 20 | 54 | 4F | 20 | 47 | 4C | 4F | 42 | 41 | 4C |
| 9030 | 20 | 20 | 20 | 20 | 4F | 50 | 45 | 52 | 41 | 54 | 4F | 52 | FF | 55 | 4E | 41 |
| 9040 | 42 | 4C | 45 | 20 | 54 | 4F | 20 | 43 | 4F | 50 | 59 | 20 | 46 | 52 | 4F | 4D |
| 9050 | 20 | 45 | 44 | 49 | 54 | 45 | 44 | 20 | 47 | 4C | 4F | 42 | 41 | 4C | FF | 20 |
| 9060 | 52 | 45 | 43 | 41 | 4C | 4C | 20 | 4C | 41 | 53 | 54 | 20 | 45 | 44 | 49 | 54 |
| 9070 | 45 | 44 | 20 | 47 | 4C | 4F | 42 | 41 | 4C | 20 | 28 | 20 | 20 | 29 | 20 | 20 |
| 9080 | 20 | 20 | 20 | 20 | 41 | 4E | 44 | 20 | 57 | 52 | 49 | 54 | 45 | 20 | 54 | 4F |
| 9090 | 20 | 43 | 55 | 52 | 52 | 45 | 4E | 54 | 20 | 47 | 4C | 4F | 42 | 41 | 4C | FF |
| 90A0 | 20 | 20 | 20 | 20 | 20 | 53 | 45 | 54 | 20 | 46 | 52 | 4F | 4E | 54 | 20 | 50 |
| 90B0 | 41 | 4E | 45 | 4C | 20 | 53 | 57 | 49 | 54 | 43 | 48 | 20 | 20 | 20 | 20 | 20 |
| 90C0 | 20 | 20 | 20 | 20 | 20 | 20 | 20 | 20 | 20 | 20 | 20 | 20 | 20 | 20 | 20 | 20 |
| 90D0 | 53 | 45 | 4E | 53 | 49 | 54 | 49 | 56 | 49 | 54 | 59 | 20 | 3D | FF | 45 | 44 |
| 90E0 | 49 | 54 | 20 | 43 | 55 | 53 | 54 | 4F | 4D | 20 | 53 | 43 | 41 | 4C | 45 | 20 |
| 90F0 | 20 | 20 | 20 | 3A | 20 | 20 | 5B | 31 | 32 | 33 | 34 | 35 | 36 | 37 | 38 | 5D |
| 9100 | FF | 55 | 53 | 45 | 52 | 20 | 4D | 49 | 44 | 49 | 20 | 4D | 45 | 53 | 53 | 41 |
| 9110 | 47 | 45 | FF | 7E | 54 | 4F | 20 | 4D | 49 | 44 | 49 | 20 | 52 | 45 | 51 | 55 |
| 9120 | 45 | 53 | 54 | 20 | 4D | 45 | 53 | 53 | 41 | 47 | 45 | FF | 53 | 57 | 49 | 54 |
| 9130 | 43 | 48 | 3A | 20 | 46 | 53 | 57 | 20 | 31 | 20 | 20 | 46 | 53 | 57 | 20 | 32 |
| 9140 | 20 | 20 | 46 | 53 | 57 | 20 | 33 | 20 | 20 | 45 | 44 | 49 | 54 | 20 | 20 | 20 |
| 9150 | 20 | 20 | 50 | 4F | 4C | 41 | 52 | 49 | 54 | 59 | 3A | FF | 20 | 20 | 20 | 20 |
| 9160 | 46 | 49 | 4C | 45 | 53 | 20 | 4F | 4E | 20 | 44 | 49 | 53 | 4B | 3A | 20 | 20 |
| 9170 | 20 | 20 | 25 | 20 | 4F | 46 | 20 | 53 | 50 | 41 | 43 | 45 | 20 | 55 | 53 | 45 |
| 9180 | 44 | FF | 20 | 53 | 45 | 4C | 45 | 43 | 54 | 20 | 50 | 52 | 49 | 4D | 41 | 52 |
| 9190 | 59 | 20 | 44 | 49 | 53 | 4B | 20 | 44 | 52 | 49 | 56 | 45 | 20 | 3A | 20 | 20 |
| 91A0 | 20 | 20 | 20 | 20 | 20 | 20 | 20 | 3C | 47 | 45 | 54 | 20 | 44 | 49 | 53 | 4B |
| 91B0 | 20 | 49 | 4E | 46 | 4F | 3E | FF | 53 | 41 | 56 | 45 | 20 | 53 | 59 | 53 | 54 |
| 91C0 | 45 | 4D | 20 | 28 | 41 | 4C | 4C | 20 | 47 | 4C | 4F | 42 | 41 | 4C | 53 | 20 |
| 91D0 | 26 | 20 | 50 | 41 | 4C | 29 | FF | 54 | 4F | 20 | 44 | 49 | 53 | 4B | 20 | 46 |
| 91E0 | 49 | 4C | 45 | 3A | FF | 53 | 41 | 56 | 45 | 3A | FF | 46 | 4F | 52 | 4D | 41 |
| 91F0 | 54 | 20 | 44 | 49 | 53 | 4B | 20 | 2D | 20 | 57 | 49 | 4C | 4C | 20 | 45 | 52 |
| 9200 | 41 | 53 | 45 | 20 | 44 | 49 | 53 | 4B | 20 | 28 | 41 | 29 | 21 | 20 | 20 | 20 |
| 9210 | 45 | 4E | 54 | 45 | 52 | 20 | 56 | 45 | 52 | 49 | 46 | 49 | 43 | 41 | 54 | 49 |
| 9220 | 4F | 4E | 20 | 43 | 4F | 44 | 45 | 20 | 52 | 20 | 3A | FF | 4C | 4F | 41 | 44 |
| 9230 | 20 | 46 | 52 | 4F | 4D | 20 | 44 | 49 | 53 | 4B | 3A | 20 | 46 | 49 | 4C | 45 |
| 9240 | 20 | 3F | 20 | 20 | 3A | FF | 45 | 52 | 41 | 53 | 45 | 20 | 46 | 49 | 4C | 45 |
| 9250 | 20 | 46 | 52 | 4F | 4D | 20 | 44 | 49 | 53 | 4B | 3A | 3F | FF | 43 | 4F | 50 |
| 9260 | 59 | 20 | 46 | 49 | 4C | 45 | 20 | 54 | 4F | 20 | 44 | 52 | 49 | 56 | 45 | 20 |
| 9270 | 20 | 3A | 3F | 20 | 20 | 3A | FF | 4C | 4F | 41 | 44 | 49 | 4E | 47 | 20 | 46 |
| 9280 | 49 | 4C | 45 | FF | 43 | 4F | 50 | 59 | 49 | 4E | 47 | 20 | 46 | 49 | 4C | 45 |
| 9290 | FF | 45 | 52 | 41 | 53 | 49 | 4E | 47 | 20 | 46 | 49 | 4C | 45 | FF | 44 | 49 |
| 92A0 | 53 | 4B | 20 | 49 | 53 | 20 | 45 | 4D | 50 | 54 | 59 | FF | 46 | 49 | 4C | 45 |
| 92B0 | 20 | 4E | 41 | 4D | 45 | 20 | 5B | 20 | 2E | 2E | 2E | 2E | 2E | 2E | 2E | 2E |
| 92C0 | 2E | 2E | 2E | 2E | 2E | 2E | 2E | 2E | 20 | 5D | 20 | 41 | 4C | 52 | 45 | 41 |
| 92D0 | 44 | 59 | 20 | 20 | 45 | 58 | 49 | 53 | 54 | 53 | 2E | 20 | 52 | 45 | 50 | 4C |
| 92E0 | 41 | 43 | 45 | 20 | 45 | 58 | 49 | 53 | 54 | 49 | 4E | 47 | 20 | 46 | 49 | 4C |
| 92F0 | 45 | 20 | 3F | 20 | 28 | 59 | 45 | 53 | 2F | 4E | 4F | 29 | FF | 2D | 2D | 20 |
| 9300 | 53 | 43 | 41 | 4E | 4E | 49 | 4E | 47 | 20 | 44 | 49 | 52 | 45 | 43 | 54 | 4F |
| 9310 | 52 | 59 | 20 | 2D | 2D | FF | 46 | 4F | 52 | 4D | 41 | 54 | 20 | 43 | 4F | 4D |
| 9320 | 50 | 4C | 45 | 54 | 45 | 20 | 2D | 20 | 20 | 20 | 20 | 20 | 42 | 41 | 44 | 20 |
| 9330 | 53 | 45 | 43 | 54 | 4F | 52 | 28 | 53 | 29 | FF | 45 | 4D | 50 | 54 | 59 | 20 |
| 9340 | 20 | 20 | 20 | 20 | 4D | 49 | 44 | 49 | 20 | 49 | 4E | 50 | 55 | 54 | FF | 20 |
| 9350 | 20 | 20 | 43 | 48 | 41 | 4E | 4E | 45 | 4C | 3A | 20 | 20 | 20 | 28 | 4F | 4D |
| 9360 | 4E | 49 | 29 | 20 | 30 | 30 | 20 | 28 | 4F | 4D | 4E | 49 | 29 | FF | 20 | 20 |
| 9370 | 50 | 52 | 4F | 47 | 52 | 41 | 4D | 20 | 43 | 48 | 41 | 4E | 47 | 45 | 53 | 3A |

| | | | | | | | | | | | | | | | | |
|---|---|---|---|---|---|---|---|---|---|---|---|---|---|---|---|---|
| 9380 | FF | 20 | 53 | 59 | 53 | 54 | 45 | 4D | 20 | 45 | 58 | 43 | 4C | 55 | 53 | 49 |
| 9390 | 56 | 45 | 3A | FF | 55 | 54 | 49 | 4C | 49 | 54 | 59 | 20 | 20 | 20 | 41 | 31 |
| 93A0 | 20 | 41 | 32 | 20 | 42 | 31 | 20 | 42 | 32 | 20 | 43 | 31 | 20 | 43 | 32 | 20 |
| 93B0 | 44 | 31 | 20 | 44 | 32 | 20 | 20 | 50 | 31 | 20 | 4D | 49 | 44 | 49 | 20 | 4F |
| 93C0 | 55 | 54 | 53 | 3A | FF | 55 | 4E | 44 | 45 | 46 | 49 | 4E | 45 | 44 | 20 | 20 |
| 93D0 | 20 | 20 | 53 | 49 | 4E | 47 | 4C | 45 | 20 | 47 | 4C | 4F | 42 | 41 | 4C | 47 |
| 93E0 | 5A | 20 | 53 | 59 | 53 | 54 | 45 | 4D | 20 | 20 | 20 | 20 | 44 | 41 | 54 | 41 |
| 93F0 | 20 | 52 | 45 | 51 | 55 | 45 | 53 | 54 | 20 | 4D | 49 | 44 | 49 | 20 | 53 | 59 |
| 9400 | 53 | 2E | 20 | 45 | 58 | 2E | 4D | 49 | 44 | 49 | 20 | 4D | 45 | 53 | 53 | 41 |
| 9410 | 47 | 45 | 53 | 4E | 41 | 4D | 45 | 20 | 46 | 49 | 4E | 44 | 45 | 52 | 20 | 20 |
| 9420 | 43 | 55 | 53 | 54 | 4F | 4D | 20 | 53 | 43 | 41 | 4C | 45 | 53 | 4D | 49 | 44 |
| 9430 | 49 | 20 | 43 | 54 | 52 | 4C | 20 | 4D | 53 | 47 | 53 | 4F | 46 | 54 | 57 | 41 |
| 9440 | 52 | 45 | 20 | 46 | 49 | 4C | 45 | 47 | 4C | 4F | 42 | 41 | 4C | 20 | 20 | 50 |
| 9450 | 41 | 4C | 20 | 20 | 20 | 20 | 20 | 53 | 43 | 41 | 4C | 45 | 53 | 20 | 20 | 55 |
| 9460 | 53 | 52 | 20 | 4D | 53 | 47 | 53 | 52 | 53 | 54 | 20 | 4D | 53 | 47 | 20 | B6 |
| 9470 | 5A | 7A | C6 | 18 | BD | C1 | 5B | BD | E0 | 12 | 24 | 07 | 7C | 52 | C2 | 7F |
| 9480 | 5D | DA | 39 | 34 | 10 | 30 | 08 | 10 | 8E | 50 | 73 | C6 | 10 | BD | 81 | 3D |
| 9490 | 35 | 90 | 34 | 04 | A6 | 84 | BD | DB | BE | A1 | 84 | 27 | 1B | 4D | 2A | 09 |
| 94A0 | 81 | C0 | 24 | 04 | 86 | 7F | 20 | 01 | 4F | A1 | E4 | 23 | 02 | A6 | E4 | A7 |
| 94B0 | 84 | 7C | 52 | C2 | 1A | 01 | 35 | 84 | A6 | 84 | 1C | FE | 35 | 84 | 34 | 36 |
| 94C0 | A6 | 01 | 81 | 09 | 23 | 01 | 4F | C6 | 0D | 3D | 8E | 93 | C5 | 30 | 8B | 10 |
| 94D0 | 8E | 50 | 4A | E6 | E4 | 31 | A5 | CC | 3A | 20 | ED | A1 | C6 | 0D | BD | 81 |
| 94E0 | 3D | 35 | B6 | 34 | 36 | BD | C2 | F1 | 8E | 92 | FD | BD | C0 | 4C | BD | C0 |
| 94F0 | 9C | 35 | B6 | 8E | 93 | 44 | 8D | 13 | CC | 31 | 32 | B7 | 50 | 60 | F7 | 50 |
| 9500 | 6A | 39 | 34 | 36 | 20 | 0A | 8D | 03 | 7E | BF | F4 | 34 | 36 | BD | C0 | 78 |
| 9510 | 5F | B6 | 52 | 8F | BD | C1 | 5B | CC | 50 | 30 | FD | 50 | 70 | B6 | 52 | 90 |
| 9520 | 26 | 06 | CC | 00 | 02 | BD | C2 | 8F | 35 | B6 | 86 | 01 | BD | DB | B5 | 81 |
| 9530 | 01 | 2F | 04 | 7C | 52 | C2 | 39 | 32 | 62 | 39 | 34 | 02 | B1 | 52 | 90 | 25 |
| 9540 | 19 | BD | DC | 8E | 26 | 08 | B6 | 52 | 90 | 27 | 1E | 32 | 61 | 39 | BB | 52 |
| 9550 | 90 | 2A | 01 | 4F | A1 | E4 | 23 | 02 | A6 | E4 | B7 | 52 | 90 | FC | 52 | 8F |
| 9560 | FD | 52 | 96 | 7C | 52 | C2 | 32 | 63 | 39 | B6 | 52 | 8F | BD | DB | B5 | B1 |
| 9570 | 52 | 8F | 27 | F2 | B7 | 52 | 8F | 20 | E4 | 8E | 52 | 99 | C6 | 63 | BD | 94 |
| 9580 | 92 | 24 | 06 | BD | CD | 9B | BD | 8B | DB | 39 | B6 | 52 | 86 | BD | DB | B5 |
| 9590 | B1 | 52 | 86 | 27 | 10 | 4D | 2A | 01 | 4F | 81 | 02 | 23 | 02 | 86 | 02 | B7 |
| 95A0 | 52 | 86 | 7C | 52 | C2 | 39 | BD | 95 | 0B | 8E | 91 | D7 | BD | C0 | 4C | CC |
| 95B0 | 5B | 5D | B7 | 50 | 7F | F7 | 50 | 90 | BD | BF | F4 | 39 | 34 | 06 | CC | 5B |
| 95C0 | 5D | B7 | 50 | 62 | F7 | 50 | 6D | 35 | 86 | 34 | 06 | B7 | 5D | AF | 7F | 5D |
| 95D0 | B0 | 86 | 58 | B7 | 5D | B3 | 8E | 50 | 72 | B6 | 5D | AF | 81 | 15 | 23 | 0B |
| 95E0 | 31 | 21 | B6 | 5D | AF | 4A | B7 | 5D | AF | 20 | F1 | 8C | 50 | 97 | 22 | 47 |
| 95F0 | A6 | A0 | 81 | FE | 27 | 41 | 81 | FF | 26 | 15 | 86 | 28 | A7 | 80 | B6 | 5D |
| 9600 | B3 | A7 | 80 | 88 | 01 | B7 | 5D | B3 | CC | 29 | 20 | ED | 81 | 20 | DC | 81 |
| 9610 | FD | 26 | 11 | CC | 28 | 7E | ED | 81 | CC | 29 | 20 | ED | 81 | 86 | 01 | B7 |
| 9620 | 5D | B0 | 20 | C7 | BD | C1 | 98 | 30 | 02 | 7D | 5D | B0 | 27 | BD | 86 | 63 |
| 9630 | A7 | 1D | 7F | 5D | B0 | 20 | B4 | A6 | E4 | 81 | 02 | 25 | 0E | B6 | 5D | AF |
| 9640 | 80 | 0C | 48 | 48 | 8B | 28 | C6 | 03 | BD | C2 | 8F | 35 | 86 | 96 | 8B | 97 |
| 9650 | 03 | 97 | 2A | 97 | CF | 98 | A9 | 99 | 00 | 99 | 84 | 9A | 4B | 9A | 98 | 9A |
| 9660 | D7 | 9B | 54 | 9C | 94 | 9D | 54 | 9D | 6E | 9D | E7 | A3 | 92 | A4 | 37 | A4 |
| 9670 | E0 | A5 | 49 | A4 | 92 | A5 | A3 | 9E | 8F | 9F | C9 | EE | 70 | A0 | FD | A2 |
| 9680 | C8 | A3 | 09 | A6 | 18 | F7 | 20 | F8 | E4 | 96 | E1 | B6 | 52 | C2 | 27 | 1D |
| 9690 | 8E | 80 | F9 | BD | C0 | 78 | 8E | 8E | 02 | BD | C0 | 4C | BD | 95 | 02 | C6 |
| 96A0 | 2F | BD | A6 | D8 | 8E | A7 | 6B | BD | C2 | 67 | BD | C0 | 99 | 86 | 02 | BD |
| 96B0 | 95 | 3A | 81 | 01 | 10 | 27 | FE | D2 | 16 | FE | BE | 8E | 5D | DD | 34 | 16 |
| 96C0 | 30 | 02 | 4F | 5F | EB | 80 | 89 | 00 | 8C | 5F | DD | 25 | F7 | 10 | B3 | 5D |
| 96D0 | DD | 26 | 0A | 10 | 83 | 00 | 00 | 27 | 04 | 1C | FE | 35 | 96 | 1A | 01 | 35 |
| 96E0 | 96 | 8D | D8 | 25 | 07 | B6 | 52 | 86 | A1 | 02 | 27 | 0E | B6 | 52 | 86 | 8E |
| 96F0 | 52 | 8F | 81 | 02 | 22 | 03 | 48 | 6A | 86 | 39 | B6 | 52 | C2 | 27 | 02 | 6E |

```
9700   05 6E 03 B6 52 C2 27 0F  8E 8E 09 BD 95 06 8E 98
9710   A7 BD C2 67 BD C0 99 86  01 BD 95 3A BD 95 2A 86
9720   F6 BD C4 BE 7F 52 90 16  07 5A B6 52 C2 27 62 8E
9730   8E E2 BD 95 0B BE 57 4A  A6 84 81 63 23 26 8E 8F
9740   62 BD C0 4C BE 57 4A 8C  56 E6 23 0A A6 1F 81 63
9750   22 04 30 1F 20 F1 1F 10  83 56 E6 1F 98 C6 4D BD
9760   C1 5B 20 14 34 02 C6 38  BD C1 5B 35 02 BD 8B 98
9770   8E 50 88 C6 10 BD 81 48  FC 57 4A 83 56 E6 1F 98

9780   C6 2C BD C1 5B 8E 97 CB  BD C2 67 7F 50 D5 BD C0
9790   99 BE 57 4A 86 02 BD 95  3A 81 01 26 29 1F 10 83
97A0   56 E6 1F 98 B7 5D AF BD  DB BE B1 5D AF 27 16 4D
97B0   2A 01 4F 81 63 23 02 86  63 1F 89 4F C3 56 E6 FD
97C0   57 4A 7C 52 C2 39 C6 64  7E 94 92 2C 02 38 17 B6
97D0   52 C2 10 27 00 5D 8E 8F  1C BD 95 06 B6 52 9A 2A
97E0   2B 8E 8F 5C 10 8E 50 65  C6 06 BD 81 3D A6 9F 57
97F0   4A 81 64 25 10 34 02 8E  8F 6B 10 8E 50 72 C6 06

9800   BD 81 3D 35 02 C6 2F BD  C1 5B 20 0E 81 64 23 02
9810   86 64 B7 52 9A C6 2F BD  C1 5B FC 57 4A 83 56 E6
9820   1F 98 C6 43 BD C1 5B 8E  98 A1 BD C2 67 BD C0 99
9830   7F 52 C3 86 04 BD 95 3A  BE 57 4A 81 01 27 46 81
9840   02 27 33 81 03 10 27 FF  54 BD 95 2A BE 57 4A B6
9850   52 9A 2B 17 E6 84 A7 80  1F 98 8C 57 49 23 F5 7A
9860   52 90 86 01 B7 52 C3 B7  52 C2 39 8C 57 49 24 EF
9870   A6 01 A7 80 20 F5 BE 57  4A B6 52 9A 10 2B FF 46

9880   C6 64 16 00 6F 86 01 BD  DB B5 81 01 27 12 F6 52
9890   9A 4D 2F 04 CA 80 20 02  C4 7F F7 52 9A 7C 52 C2
98A0   39 1B 06 2F 03 43 03 4D  02 B6 52 C2 27 27 8E 8F
98B0   87 BD 95 06 B6 52 99 C6  1C BD C1 5B B6 52 9A 81
98C0   63 23 01 4F B7 52 9A C6  3D BD C1 5B 8E 98 FA BD
98D0   C2 67 BD C0 99 86 03 BD  95 3A 81 01 10 27 FC 99
98E0   81 02 27 0E BD 95 2A B6  52 9A BD 88 93 10 24 05
98F0   90 39 C6 63 8E 52 9A 7E  94 92 1C 02 3D 02 4D 02

9900   B6 52 C2 27 27 8E 8F C1  BD 95 06 B6 52 99 C6 1C
9910   BD C1 5B B6 52 9A 81 63  23 01 4F B7 52 9A C6 3D
9920   BD C1 5B 8E 98 FA BD C2  67 BD C0 99 86 03 BD 95
9930   3A 81 01 10 27 FC 42 81  02 10 27 FF B5 BD 95 2A
9940   B6 52 99 8D 37 25 07 B6  52 9A 8D 30 24 06 8E 88
9950   B2 16 F0 E4 B6 52 99 34  02 86 66 BD 88 70 B6 52
9960   9A BD CD 9B A6 E4 BD 88  93 86 66 BD CD 9B B6 52
9970   9A BD 88 93 A6 E0 BD CD  9B 16 05 05 BD 8B 98 A6

9980   A8 17 48 39 B6 52 C2 27  42 8E 8F FB BD 95 06 F6
9990   52 95 BD 8B EE CB 31 F7  50 5E 9E 64 10 8E 50 61
99A0   C6 0A BD 81 3D B6 52 9A  81 63 23 01 4F B7 52 9A
99B0   C6 39 BD C1 5B B6 52 9C  84 07 B7 52 9C 8B 31 B7
99C0   50 8F 8E 9A 43 BD C2 67  BD C0 99 86 04 BD 95 3A
99D0   81 01 26 15 B6 5D 8E 27  0A 7F 5D 8E BD 9A 30 B7
99E0   52 95 39 8E 52 95 7E AD  02 81 02 10 27 FF 03 81
99F0   03 27 28 BD 95 2A B6 5D  C2 27 06 8E 90 3D 16 EF

9A00   DE B6 52 9A F6 52 9C BD  89 69 24 01 39 B6 52 9A
9A10   B1 52 99 26 03 BD CD 9B  16 04 66 B6 5D 8E 27 0A
9A20   7F 5D 8E BD 9A 30 B7 52  9C 39 8E 52 9C 7E AD 02
9A30   34 14 8E D2 0D 5F A5 85  26 05 5C C1 07 23 F7 1F
9A40   98 35 94 14 0E 39 02 45  01 4D 02 B6 52 C2 27 29
9A50   8E 90 5F BD 95 06 B6 52  84 81 63 23 03 B6 52 99
9A60   B7 52 84 C6 1F BD C1 5B  B6 52 99 C6 44 BD C1 5B
9A70   8E 98 A7 BD C2 67 BD C0  99 86 01 BD 95 3A BD 95
```

| | | | | | | | | | | | | | | | | |
|---|---|---|---|---|---|---|---|---|---|---|---|---|---|---|---|---|
| 9A80 | 2A | B6 | 52 | 99 | 34 | 02 | 86 | 64 | BD | CD | 9B | A6 | E4 | BD | 88 | 70 |
| 9A90 | 35 | 02 | BD | CD | 9B | 16 | 03 | E9 | B6 | 52 | C2 | 27 | 17 | 8E | 90 | A0 |
| 9AA0 | BD | 95 | 0B | B6 | 5D | AD | C6 | 41 | BD | C1 | 5B | 8E | 9A | C4 | BD | C2 |
| 9AB0 | 67 | BD | C0 | 99 | 86 | 01 | BD | 95 | 3A | 8E | 5D | AD | C6 | 63 | BD | 94 |
| 9AC0 | 92 | 7E | 8B | DB | 41 | 02 | B6 | 38 | 05 | 84 | 0F | B1 | 5D | AF | 27 | 06 |
| 9AD0 | B7 | 5D | AF | 7C | 52 | C2 | 39 | 8D | ED | B6 | 52 | C2 | 27 | 42 | 8E | 91 |
| 9AE0 | 2C | BD | 95 | 0B | 10 | 8E | 9B | 50 | 8E | 50 | 7D | 5F | 86 | 2B | A7 | 84 |
| 9AF0 | B6 | 5D | 7E | A5 | A5 | 26 | 04 | 86 | 2D | A7 | 84 | 86 | 28 | A7 | 01 | 86 |
| 9B00 | 29 | A7 | 05 | 30 | 02 | B6 | 38 | 05 | B8 | 5D | 7E | A4 | A5 | BD | BF | DE |
| 9B10 | 30 | 05 | 5C | C1 | 03 | 23 | D5 | 8E | 9B | 48 | BD | C2 | 67 | BD | C0 | 99 |
| 9B20 | 86 | 04 | BD | 95 | 3A | 8E | 9B | 4F | 30 | 86 | 86 | 01 | BD | DB | B5 | 81 |
| 9B30 | 01 | 27 | 14 | E6 | 84 | 4D | 2F | 05 | FA | 5D | 7E | 20 | 04 | 53 | F4 | 5D |
| 9B40 | 7E | F7 | 5D | 7E | 7C | 52 | C2 | 39 | 33 | 01 | 3A | 01 | 41 | 01 | 48 | 01 |
| 9B50 | 02 | 04 | 08 | 01 | B6 | 52 | C2 | 10 | 27 | 00 | 4E | 8E | 90 | DE | BD | 95 |
| 9B60 | 06 | B6 | 52 | 9D | 81 | 03 | 25 | 02 | 86 | 02 | B7 | 52 | 9D | 8B | 31 | B7 |
| 9B70 | 50 | 5F | 8E | 50 | EA | F6 | 52 | 9D | 58 | 58 | 58 | 3A | 10 | 8E | 50 | 66 |
| 9B80 | C6 | 08 | BD | 81 | 55 | 8E | 51 | 11 | B6 | 52 | 9D | 5F | 44 | 56 | 30 | 8B |
| 9B90 | C6 | 28 | A6 | 84 | BD | C1 | 5B | 30 | 88 | 10 | CB | 04 | C1 | 48 | 25 | F2 |
| 9BA0 | 8E | 9C | 65 | BD | C2 | 67 | BD | C0 | 99 | 86 | 12 | BD | 95 | 3A | 81 | 12 |
| 9BB0 | 27 | 3F | 81 | 01 | 27 | 24 | 81 | 0A | 25 | 28 | 80 | 0A | 48 | 48 | 48 | 48 |
| 9BC0 | 8B | 0F | 81 | 80 | 25 | 02 | 86 | 7F | 8E | 51 | 02 | 30 | 86 | B6 | 52 | 9D |
| 9BD0 | 5F | 44 | 56 | 30 | 8B | C6 | 7F | 7E | 94 | 92 | 8E | 52 | 9D | C6 | 02 | 7E |
| 9BE0 | AD | 04 | 8E | 50 | E8 | 30 | 86 | F6 | 52 | 9D | 58 | 58 | 58 | 3A | 16 | 03 |
| 9BF0 | 1B | BD | 95 | 2A | 86 | 01 | B7 | 52 | C2 | B7 | 52 | C3 | 4F | B7 | 52 | 90 |
| 9C00 | 5F | 34 | 06 | 4F | 34 | 02 | 8E | 51 | 02 | B6 | 52 | 9D | 5F | 44 | 56 | 30 |
| 9C10 | 8B | 86 | 08 | B7 | 5D | AF | A6 | 0F | A0 | E4 | 1F | 89 | C4 | 80 | 34 | 04 |
| 9C20 | 5F | 44 | 56 | AA | E4 | 44 | 56 | AA | E4 | 44 | 56 | AA | E4 | 44 | 56 | AA |
| 9C30 | E0 | ED | 61 | 10 | 8E | 00 | 10 | B6 | 5D | AF | 81 | 08 | 26 | 03 | 4F | 20 |
| 9C40 | 02 | A6 | E4 | 5F | E3 | 61 | 4D | 2A | 0B | 81 | C0 | 25 | 04 | 4F | 5F | 20 |
| 9C50 | 03 | CC | 7F | FF | A7 | 80 | 31 | 3F | 26 | EA | A7 | E4 | B6 | 5D | AF | 4A |
| 9C60 | 26 | B1 | 32 | 63 | 39 | 15 | 01 | 80 | 01 | 81 | 01 | 82 | 01 | 83 | 01 | 84 |
| 9C70 | 01 | 85 | 01 | 86 | 01 | 87 | 01 | 28 | 03 | 2C | 03 | 30 | 03 | 34 | 03 | 38 |
| 9C80 | 03 | 3C | 03 | 40 | 03 | 44 | 03 | 4D | 02 | 34 | 04 | F6 | 52 | 9D | 58 | 58 |
| 9C90 | 58 | 3A | 35 | 84 | B6 | 52 | C2 | 10 | 27 | 00 | 64 | 8E | 91 | 01 | BD | 95 |
| 9CA0 | 0B | BD | 95 | BC | 86 | 70 | BD | 8B | 98 | B6 | 52 | 9E | 84 | 1F | B7 | 52 |
| 9CB0 | 9E | C6 | 15 | BD | C1 | 5B | B6 | 52 | 90 | 81 | 01 | 26 | 06 | CC | 15 | 02 |
| 9CC0 | BD | C2 | 8F | B6 | 52 | 9E | C6 | 18 | 3D | 31 | AB | 10 | BF | 5D | B1 | 8E |
| 9CD0 | 50 | 63 | C6 | 0A | BD | 81 | 48 | F6 | 52 | 90 | C1 | 01 | 23 | 18 | C1 | 0B |
| 9CE0 | 22 | 14 | 8E | 50 | 61 | A6 | 85 | BD | C3 | 7D | B6 | 52 | 90 | 8B | 17 | C6 |
| 9CF0 | 01 | BD | C2 | 8F | 20 | 06 | B6 | 52 | 90 | BD | 95 | C9 | BD | C0 | 99 | 86 |
| 9D00 | 19 | BD | 9D | CA | 81 | 01 | 22 | 1F | B6 | 52 | 9E | BD | DB | B5 | B1 | 52 |
| 9D10 | 9E | 26 | 01 | 39 | 4D | 2F | 08 | 81 | 1F | 23 | 05 | 86 | 1F | 20 | 01 | 4F |
| 9D20 | B7 | 52 | 9E | 7C | 52 | C2 | 39 | 10 | BE | 5D | B1 | 80 | 02 | 31 | A6 | 81 |
| 9D30 | 09 | 22 | 0A | A6 | A4 | BD | DB | A4 | A1 | A4 | 26 | 0C | 39 | 1F | 89 | A6 |
| 9D40 | A4 | BD | DB | BE | A1 | A4 | 27 | 0B | C1 | 0A | 26 | 02 | 8A | 80 | A7 | A4 |
| 9D50 | 7C | 52 | C2 | 39 | BD | CC | 04 | 10 | 8E | 6D | 80 | 10 | BF | 5D | B1 | 86 |
| 9D60 | 64 | B7 | 5D | 86 | B6 | 52 | C2 | 27 | 58 | 8E | B7 | E3 | 20 | 18 | BD | CC |
| 9D70 | 04 | 10 | 8E | 6D | 00 | 10 | BF | 5D | B1 | 86 | 6E | B7 | 5D | 86 | B6 | 52 |
| 9D80 | C2 | 27 | 3E | 8E | 91 | 17 | BD | 95 | 0B | BD | 95 | BC | 10 | BE | 5D | B1 |
| 9D90 | 8E | 50 | 63 | C6 | 0A | BD | 81 | 48 | F6 | 52 | 90 | 27 | 18 | C1 | 0A | 22 |
| 9DA0 | 14 | 8E | 50 | 62 | A6 | 85 | BD | C3 | 7D | B6 | 52 | 90 | 8B | 18 | C6 | 01 |
| 9DB0 | BD | C2 | 8F | 20 | 09 | B6 | 52 | 90 | 27 | 01 | 4C | BD | 95 | C9 | BD | C0 |
| 9DC0 | 99 | B6 | 5D | 86 | 8D | 04 | 4C | 16 | FF | 5D | 34 | 16 | BE | 5D | B1 | 86 |
| 9DD0 | 0C | 30 | 0A | E6 | 80 | C1 | FE | 27 | 07 | 4C | 2B | 04 | A1 | E4 | 25 | F3 |
| 9DE0 | 32 | 61 | 35 | 14 | 7E | 95 | 3A | B6 | 52 | C2 | 27 | 30 | 8E | 8E | 4E | BD |
| 9DF0 | 95 | 06 | B6 | 52 | 9A | 81 | 64 | 24 | 1A | C6 | 20 | F7 | 50 | 81 | C6 | 35 |

| | | | | | | | | | | | | | | | | |
|---|---|---|---|---|---|---|---|---|---|---|---|---|---|---|---|---|
| 9E00 | BD | C1 | 5B | BD | 8B | 98 | 8E | 50 | 85 | C6 | 10 | BD | 81 | 48 | 86 | 3D |
| 9E10 | B7 | 50 | 83 | 8E | 9F | 1B | BD | C2 | 67 | BD | C0 | 99 | 86 | 02 | BD | 95 |
| 9E20 | 3A | 81 | 01 | 10 | 27 | 00 | 63 | BD | 95 | 2A | B6 | 52 | 9A | 81 | 64 | 24 |
| 9E30 | 05 | BD | CC | 62 | 20 | 4B | 8E | 8E | 84 | BD | C0 | 54 | BD | F3 | 60 | 4F |
| 9E40 | 34 | 02 | C6 | 17 | BD | C1 | 5B | BD | C0 | 9C | B6 | 38 | 03 | 85 | 01 | 26 |
| 9E50 | 0B | 35 | 02 | 7A | 52 | 90 | 8E | F4 | 63 | 7E | 89 | DF | BD | D5 | D8 | 35 |
| 9E60 | 02 | BD | CC | 62 | 4C | 81 | 63 | 23 | D7 | BD | CC | B6 | 4F | BD | CD | 24 |
| 9E70 | 4C | 81 | 02 | 23 | F8 | 4F | BD | CD | 47 | 4C | 81 | 1F | 23 | F8 | BD | CC |
| 9E80 | F5 | 7A | 52 | 90 | 8E | 8E | 99 | 16 | EB | AE | C6 | 65 | 16 | FA | 65 | B6 |
| 9E90 | 52 | C2 | 27 | 14 | 8E | 91 | B7 | BD | 95 | A6 | 86 | 36 | BD | A0 | 86 | 8E |
| 9EA0 | 9F | 21 | BD | C2 | 67 | BD | C0 | 99 | 86 | 11 | BD | 95 | 3A | 81 | 01 | 10 |
| 9EB0 | 26 | 00 | 54 | BD | 95 | 2A | 86 | 02 | B7 | 57 | 4E | CC | 00 | 76 | FD | 57 |
| 9EC0 | 52 | 7F | 57 | 54 | 5F | 4F | F7 | 57 | 4D | FD | 57 | 50 | 4C | B7 | 52 | C2 |
| 9ED0 | B7 | 57 | 4F | BD | E2 | 00 | 10 | 25 | 00 | 21 | 4D | 27 | 13 | BD | 9F | 49 |
| 9EE0 | 24 | 07 | 7C | 52 | 90 | 7C | 52 | C2 | 39 | BD | 9F | 6A | 10 | 25 | 00 | 0B |
| 9EF0 | BD | DC | D3 | BD | E9 | 1F | 25 | 06 | 16 | FF | 86 | BD | E9 | 1F | 7A | 52 |
| 9F00 | 90 | 7F | 5D | DA | 16 | EA | D8 | 8E | 57 | 53 | 30 | 86 | A6 | 84 | BD | DB |
| 9F10 | A4 | A1 | 84 | 27 | 05 | 7C | 52 | C2 | A7 | 84 | 39 | 35 | 03 | 4D | 02 | 08 |
| 9F20 | 0D | 4D | 02 | 9A | 01 | 9B | 01 | 9C | 01 | 9D | 01 | 9E | 01 | 9F | 01 | A0 |
| 9F30 | 01 | A1 | 01 | A2 | 01 | A3 | 01 | A4 | 01 | A5 | 01 | A6 | 01 | A7 | 01 | A8 |
| 9F40 | 01 | A9 | 01 | 38 | 03 | 23 | 03 | 4D | 02 | BD | E9 | 1F | 8E | 92 | AC | BD |
| 9F50 | C0 | 24 | 8E | 57 | 55 | 10 | 8E | 50 | 56 | C6 | 10 | BD | 81 | 3D | BD | C0 |
| 9F60 | 9C | CC | BF | BF | FD | 30 | 00 | 16 | EB | 20 | BE | 57 | 52 | B6 | 57 | 54 |
| 9F70 | 34 | 12 | 4F | B7 | 5D | DA | B7 | 5A | 7A | B7 | 5A | 79 | 8E | 58 | 65 | F6 |
| 9F80 | 59 | 67 | 30 | 8B | FC | 59 | 65 | ED | 03 | 10 | 8E | 48 | 00 | C6 | 18 | BD |
| 9F90 | 81 | 3D | BD | E3 | C5 | 35 | 22 | 10 | BF | 57 | 52 | B7 | 57 | 54 | 39 | 02 |
| 9FA0 | 07 | B7 | 56 | 03 | 05 | B7 | 56 | 01 | 08 | 6D | 80 | 01 | 06 | 67 | 00 | 01 |
| 9FB0 | 03 | 6D | 00 | 02 | 01 | 50 | 00 | 02 | 09 | B7 | 56 | F6 | 5D | BE | 8E | 9F |
| 9FC0 | 9F | 58 | 58 | 3A | EC | 84 | AE | 02 | 39 | B6 | 52 | C2 | 27 | 78 | 8E | 91 |
| 9FD0 | E5 | BD | 95 | A6 | F6 | 5D | BE | C1 | 06 | 23 | 03 | 7F | 5D | BE | C1 | 06 |
| 9FE0 | 26 | 08 | BD | 96 | BB | 24 | 03 | 7A | 5D | BE | B6 | 52 | 90 | 26 | 07 | 86 |
| 9FF0 | 3F | B7 | 50 | 59 | 20 | 2B | 8D | C3 | 8E | 93 | C5 | 86 | 0D | 3D | 30 | 8B |
| A000 | 10 | 8E | 50 | 52 | C6 | 0D | BD | 81 | 55 | 86 | 3A | A7 | A0 | BD | CC | 04 |
| A010 | 8D | A9 | A6 | 84 | 81 | 2A | 26 | 02 | 6C | 84 | 8D | 9F | C6 | 10 | BD | C0 |
| A020 | 85 | B6 | 57 | 55 | 81 | 2A | 26 | 10 | 8D | 91 | 8C | B7 | 56 | 27 | 09 | 10 |
| A030 | 8E | 57 | 55 | C6 | 10 | BD | C0 | 85 | 86 | 36 | BD | A0 | 86 | 8E | 9F | 1F |
| A040 | BD | C2 | 67 | BD | C0 | 99 | 86 | 12 | BD | 95 | 3A | 81 | 01 | 26 | 1D | B6 |
| A050 | 5D | BE | BD | DB | B5 | B1 | 5D | BE | 26 | 01 | 39 | 4D | 2A | 01 | 4F | 81 |
| A060 | 06 | 23 | 02 | 86 | 06 | B7 | 5D | BE | 7C | 52 | C2 | 39 | 4A | 81 | 01 | 10 |
| A070 | 26 | FE | 94 | BD | 95 | 2A | BD | 9F | BB | F7 | 57 | 4E | 5F | FD | 57 | 53 |
| A080 | F7 | 57 | 52 | 16 | FE | 3E | 34 | 36 | B6 | 57 | 55 | 81 | 20 | 2E | 3F | 10 |
| A090 | 8E | 8E | 92 | 8E | 57 | 55 | C6 | 10 | BD | 81 | 32 | FC | 52 | C6 | 98 | 00 |
| A0A0 | D8 | 00 | 34 | 06 | C6 | 41 | BD | C1 | 5B | FC | 50 | 8B | FD | 57 | 5F | B6 |
| A0B0 | 50 | 8D | B7 | 57 | 61 | A6 | E4 | B8 | 52 | C7 | 84 | 0F | 8B | 41 | B7 | 57 |
| A0C0 | 5D | 35 | 06 | 44 | 44 | 44 | 44 | 84 | 0F | 8B | 41 | B7 | 57 | 5E | 10 | 8E |
| A0D0 | 57 | 55 | E6 | E4 | 8E | 50 | 4A | 3A | C6 | 10 | BD | 81 | 32 | 35 | B6 | 02 |
| A0E0 | 00 | 00 | 02 | 00 | 00 | 04 | 67 | 01 | 02 | 00 | 00 | 02 | 00 | 02 | 04 | 1F |
| A0F0 | 01 | 02 | 00 | 00 | 04 | 02 | 01 | 02 | 00 | 00 | 02 | 00 | 00 | B6 | 52 | C2 |
| A100 | 10 | 27 | 00 | B1 | 8E | 92 | 2C | BD | A2 | 7E | 10 | 25 | 00 | A7 | A6 | 01 |
| A110 | 81 | 09 | 23 | 01 | 4F | C6 | 03 | 3D | 10 | 8E | A0 | DF | 31 | AB | E6 | A4 |
| A120 | F7 | 5D | 86 | E6 | 21 | F7 | 5D | B0 | 86 | 39 | BD | 94 | BE | A6 | 22 | 10 |
| A130 | 27 | 00 | 7F | 81 | 01 | 27 | 0F | 8E | 91 | 13 | 10 | 8E | 50 | 67 | C6 | 08 |
| A140 | BD | 81 | 3D | 16 | 00 | 6C | F6 | 52 | 9A | 2B | 5C | C1 | 64 | 25 | 19 | 86 |
| A150 | 03 | B7 | 5D | 86 | 8E | 94 | 4F | 10 | 8E | 50 | 67 | C0 | 64 | 86 | 08 | 3D |
| A160 | 3A | C6 | 08 | BD | 81 | 3D | 20 | 4A | B6 | 52 | 9B | B1 | 5D | B0 | 23 | 06 |
| A170 | B6 | 52 | 9A | B7 | 52 | 9B | B6 | 5D | B0 | 81 | 02 | 26 | 12 | B6 | 52 | 9A |

| | | |
|---|---|---|
| A180 | 8B 31 B7 50 67 B6 52 9B | 8B 31 B7 50 6D 20 10 B6 |
| A190 | 52 9A C6 1D BD C1 5B B6 | 52 9B C6 23 BD C1 5B CC |
| A1A0 | 54 4F FD 50 6A 20 0B CC | 41 4C FD 50 67 F7 50 69 |
| A1B0 | 20 00 BD A2 B4 B6 5D 86 | BD 95 3A 81 01 27 22 81 |
| A1C0 | 03 10 27 00 7E 81 04 10 | 27 00 A0 BD 95 2A 8E 92 |
| A1D0 | 77 BD C0 54 BD EA DA BD | E9 1F 10 25 FD 20 16 FC |
| A1E0 | A0 B6 5A 7A BD DB BE B1 | 5A 7A 27 26 C6 FF F7 52 |
| A1F0 | 9A 81 FE 25 01 4F B1 5A | 77 25 04 B6 5A 77 4A B7 |
| A200 | 5A 7A B1 5A 79 25 0C B0 | 5A 79 B1 5A 7B 24 04 7C |
| A210 | 52 C2 39 4F F6 5A 7A 83 | 00 20 2A 01 5F 1F 98 20 |
| A220 | 04 4F B7 5A 7A B7 5A 79 | BD 94 E3 BD DE 91 BD E9 |
| A230 | 1F 10 25 FC CC 86 01 B7 | 5D DA B7 52 C2 86 FF B7 |
| A240 | 52 9A 39 B6 52 9A BD DB | BE B1 52 9A 27 1C 7C 52 |
| A250 | C2 4D 2A 04 86 FF 20 08 | B1 5D B0 23 03 B6 5D B0 |
| A260 | B7 52 9A 81 63 22 03 B7 | 52 9B 39 8E 52 9B F6 5D |
| A270 | B0 BD 94 92 81 63 23 02 | 86 63 B7 52 9B 39 BD 95 |
| A280 | 06 B6 52 90 27 1D B6 5D | DA 26 05 32 62 7E A2 21 |
| A290 | B6 5A 77 27 06 BD 94 6F | 1C FE 39 8E 92 9E BD C0 |
| A2A0 | 4C 20 0C 4F B7 5A 7A B7 | 5D DA 86 FF B7 52 9A 86 |
| A2B0 | 01 B7 5D 86 8E A2 C0 BD | C2 67 BD C0 99 1A 01 39 |
| A2C0 | 18 03 4D 02 1D 03 23 03 | B6 52 C2 27 15 86 02 B7 |
| A2D0 | 5D 86 8E 92 46 BD A2 7E | 25 08 86 3B BD 94 BE BD |
| A2E0 | A2 B4 B6 5D 86 BD 95 3A | 81 01 10 23 FE F3 BD 95 |
| A2F0 | 2A 8E 92 91 BD C0 54 BD | E3 C5 25 03 BD DE 91 BD |
| A300 | E9 1F 10 25 FB FB 16 FB | 78 B6 52 C2 10 27 00 20 |
| A310 | 86 02 B7 5D 86 8E 92 5D | BD A2 7E 25 13 B6 5D D3 |
| A320 | 43 84 01 8B 41 B7 50 60 | 86 3B BD 94 BE BD A2 B4 |
| A330 | B6 5D 86 BD 95 3A 81 01 | 10 23 FE A5 BD 95 2A BD |
| A340 | C2 F1 BD E0 12 BD E0 2E | BD E3 53 BD E3 31 7F 5D |
| A350 | DA BD E2 00 24 06 BD E3 | 3E 7E 9E FB 4D 27 1D BD |
| A360 | 9F 49 24 09 7A 52 90 7C | 52 C2 7E E3 3E B6 5A 7A |
| A370 | 34 02 BD 9F 6A 35 02 B7 | 5A 7A 25 DA BD E3 3E BD |
| A380 | DE 91 25 D5 BD DF BC 25 | D0 BD E2 67 BD E3 3E 16 |
| A390 | FF 68 B6 52 C2 27 41 BD | 94 F3 8E 93 4F BD C0 4C |
| A3A0 | CC 2D 2D 7D 52 87 2B 06 | FD 50 81 FD 50 83 7D 52 |
| A3B0 | 88 2B 06 FD 50 8B FD 50 | 8D C6 3D B6 52 87 84 0F |
| A3C0 | 4C BD C1 5B C6 47 B6 52 | 88 84 0F 4C BD C1 5B 8E |
| A3D0 | A4 2F BD C2 67 BD C0 99 | 86 04 BD 95 3A 4A 10 8E |
| A3E0 | 52 87 85 02 27 04 10 8E | 52 88 85 01 27 29 A6 A4 |
| A3F0 | 84 0F 4C 34 02 BD DB B5 | A1 E0 26 01 39 4A 2B 08 |
| A400 | 81 0F 23 05 86 0F 20 01 | 4F 34 02 A6 A4 84 80 AA |
| A410 | E0 A7 A4 7C 52 C2 39 86 | 01 BD DB B5 81 01 27 0E |
| A420 | E6 A4 C4 0F 4D 2F 02 CA | 80 E7 A4 7C 52 C2 39 37 |
| A430 | 04 3D 02 41 04 47 02 B6 | 52 C2 27 20 BD 94 F3 C6 |
| A440 | 3D B6 52 89 84 80 BD BF | E2 C6 47 B6 52 8A 84 80 |
| A450 | BD BF E2 8E A4 8E BD C2 | 67 BD C0 99 86 02 BD 95 |
| A460 | 3A 8E D2 14 10 8E 52 88 | 31 A6 86 01 BD DB B5 81 |
| A470 | 01 27 16 4D 2F 06 A6 84 | AA A4 20 05 A6 84 43 A4 |
| A480 | A4 A7 A4 7C 52 C2 1A 01 | 39 A6 A4 1C FE 39 3D 04 |
| A490 | 47 04 B6 52 C2 27 1B 8E | 93 94 BD 95 0B 10 8E 52 |
| A4A0 | 8C 8E D2 19 C6 35 BD AA | D9 8E A8 56 BD C2 67 BD |
| A4B0 | C0 99 86 08 BD 95 3A 8E | D2 18 30 86 BD A4 6A BD |
| A4C0 | D2 B0 B6 52 8C 43 B7 30 | 10 39 34 16 8E 50 4A 3A |
| A4D0 | 81 02 25 0A CC 54 48 ED | 81 CC 52 55 ED 84 35 96 |
| A4E0 | B6 52 C2 27 2A BD 94 F3 | 8E 93 6E BD C0 4C C6 3D |
| A4F0 | B6 52 89 84 03 BD BF E2 | 8D D0 C6 47 B6 52 8A 84 |

| | | | | | | | | | | | | | | | |
|---|---|---|---|---|---|---|---|---|---|---|---|---|---|---|---|
| A500 | 03 | BD | BF | E2 | 8D | C4 | 8E | A4 | 8E | BD | C2 | 67 | BD | C0 | 99 | 86 |
| A510 | 02 | BD | 95 | 3A | 8E | D2 | 0D | 10 | 8E | 52 | 88 | 31 | A6 | A6 | A4 | 84 |
| A520 | 03 | B7 | 5D | AF | BD | DB | B5 | B1 | 5D | AF | 26 | 01 | 39 | 4D | 2B | 08 |
| A530 | 81 | 02 | 23 | 05 | 86 | 02 | 20 | 01 | 4F | B7 | 5D | AF | A6 | A4 | 84 | FC |
| A540 | BA | 5D | AF | A7 | A4 | 7C | 52 | C2 | 39 | B6 | 52 | C2 | 27 | 30 | BD | 94 |
| A550 | F3 | 8E | 93 | 81 | BD | C0 | 4C | B6 | 52 | 8B | 84 | 03 | 81 | 03 | 26 | 01 |
| A560 | 4F | B7 | 52 | 8B | C6 | 3D | 84 | 01 | BD | BF | E2 | C6 | 47 | B6 | 52 | 8B |
| A570 | 84 | 02 | BD | BF | E2 | 8E | A4 | 8E | BD | C2 | 67 | BD | C0 | 99 | 86 | 02 |
| A580 | BD | 95 | 3A | 8E | D2 | 0C | 30 | 86 | 86 | 01 | BD | DB | B5 | 81 | 01 | 26 |
| A590 | 01 | 39 | 4D | 2F | 04 | A6 | 84 | 20 | 01 | 4F | B7 | 52 | 8B | 7C | 52 | C2 |
| A5A0 | 7E | D2 | DF | B6 | 52 | C2 | 27 | 1C | 8E | 91 | 82 | BD | 95 | 06 | B6 | 5D |
| A5B0 | D3 | 84 | 01 | B7 | 5D | D3 | 8B | 41 | B7 | 50 | 6A | 8E | A6 | 14 | BD | C2 |
| A5C0 | 67 | BD | C0 | 99 | 86 | 02 | BD | 95 | 3A | 81 | 01 | 27 | 3D | BD | 95 | 2A |
| A5D0 | 4F | B7 | 5A | 79 | B7 | 52 | 90 | BD | 94 | E3 | BD | DE | 91 | BD | E9 | 1F |
| A5E0 | 10 | 25 | F9 | 1D | 8E | 91 | 5C | BD | C0 | 4C | B6 | 5A | 77 | C6 | 28 | BD |
| A5F0 | C1 | 5B | B6 | 5A | 7C | C6 | 0A | 3D | 34 | 04 | B6 | 5A | 7D | C6 | 0A | 3D |
| A600 | AB | E0 | C6 | 3B | BD | C1 | 5B | 16 | E4 | 26 | 10 | 8E | 5D | D3 | 8E | D2 |
| A610 | 0D | 16 | FE | 56 | 20 | 01 | 4D | 02 | B6 | 52 | C2 | 27 | 2A | 8E | 91 | EB |
| A620 | BD | 95 | 06 | B6 | 5D | D3 | 84 | 01 | 8B | 41 | B7 | 50 | 6C | B6 | 5D | AF |
| A630 | 2B | 04 | 81 | 20 | 24 | 02 | 86 | 20 | B7 | 5D | AF | B7 | 50 | 8E | 8E | A6 |
| A640 | 93 | BD | C2 | 67 | BD | C0 | 99 | 86 | 01 | F6 | 5D | AF | C1 | 52 | 26 | 02 |
| A650 | 86 | 02 | BD | 95 | 3A | 81 | 01 | 27 | 28 | BD | 95 | 2A | 7F | 5D | AF | BD |
| A660 | E7 | 3C | BD | E9 | 1F | 10 | 25 | F8 | 95 | 8E | 8E | 99 | B6 | 50 | 1A | 10 |
| A670 | 27 | E3 | C5 | 8E | 93 | 16 | BD | C0 | 24 | C6 | 12 | BD | C1 | 5B | 16 | E3 |
| A680 | AF | B6 | 5D | AF | BD | DB | A4 | B1 | 5D | AF | 27 | 06 | 7C | 52 | C2 | B7 |
| A690 | 5D | AF | 39 | 44 | 01 | 4D | 02 | A7 | 3B | A7 | C4 | A7 | 6F | A8 | 2C | A8 |
| A6A0 | 7D | A8 | BD | A9 | A6 | AA | 23 | A8 | 66 | A9 | 5E | AA | 68 | AA | 70 | A9 |
| A6B0 | C1 | A9 | CF | 96 | E1 | 34 | 36 | 20 | 05 | 34 | 36 | BD | C0 | 78 | 5F | B6 |
| A6C0 | 52 | 91 | BD | C1 | 5B | CC | 50 | 31 | FD | 50 | 70 | B6 | 52 | 92 | 26 | 06 |
| A6D0 | CC | 00 | 02 | BD | C2 | 8F | 35 | B6 | 34 | 36 | 8E | 50 | 4A | 3A | 10 | 8E |
| A6E0 | AA | FC | C6 | 06 | BD | 81 | 32 | E6 | 61 | CB | 07 | B6 | 52 | 99 | BD | C1 |
| A6F0 | 5B | 86 | 3D | A7 | 04 | 10 | 8E | 50 | 00 | 30 | 06 | C6 | 10 | BD | 81 | 32 |
| A700 | 35 | B6 | 34 | 02 | B1 | 52 | 92 | 25 | 19 | BD | DC | 8E | 26 | 08 | B6 | 52 |
| A710 | 92 | 27 | 18 | 32 | 61 | 39 | BB | 52 | 92 | 2A | 01 | 4F | A1 | E4 | 23 | 02 |
| A720 | A6 | E4 | B7 | 52 | 92 | 7C | 52 | C2 | 32 | 63 | 39 | B6 | 52 | 91 | BD | DB |
| A730 | B5 | B1 | 52 | 91 | 27 | F2 | B7 | 52 | 91 | 20 | EA | B6 | 52 | C2 | 27 | 1D |
| A740 | 8E | 80 | F9 | BD | C0 | 78 | 8E | AB | 09 | BD | C0 | 4C | BD | A6 | B5 | C6 |
| A750 | 2F | BD | A6 | D8 | 8E | A7 | 6B | BD | C2 | 67 | BD | C0 | 99 | 86 | 02 | BD |
| A760 | A7 | 02 | 81 | 01 | 10 | 27 | EE | 22 | 16 | EE | 0E | 26 | 02 | 36 | 02 | 7D |
| A770 | 52 | C2 | 27 | 14 | 8E | AA | F3 | BD | A6 | B9 | C6 | 28 | BD | A6 | D8 | 8E |
| A780 | A7 | A4 | BD | C2 | 67 | BD | C0 | 99 | 86 | 10 | BD | A7 | 02 | 8E | 4F | FF |
| A790 | 30 | 86 | A6 | 84 | BD | DB | A4 | A1 | 84 | 27 | 08 | A7 | 84 | B7 | 52 | C2 |
| A7A0 | B7 | 5D | C2 | 39 | 98 | 01 | 99 | 01 | 9A | 01 | 9B | 01 | 9C | 01 | 9D | 01 |
| A7B0 | 9E | 01 | 9F | 01 | A0 | 01 | A1 | 01 | A2 | 01 | A3 | 01 | A4 | 01 | A5 | 01 |
| A7C0 | A6 | 01 | A7 | 01 | 7D | 52 | C2 | 27 | 21 | 8E | AB | 10 | BD | A6 | B9 | 8E |
| A7D0 | A8 | 28 | BD | C2 | 67 | C6 | 2B | B6 | 50 | 10 | 2A | 03 | 40 | C6 | 2D | F7 |
| A7E0 | 50 | 83 | C6 | 3B | BD | C1 | 5B | BD | C0 | 99 | 86 | 02 | BD | A7 | 02 | 81 |
| A7F0 | 01 | 27 | 12 | 4F | BD | DB | B5 | 4D | 26 | 01 | 39 | B7 | 52 | C2 | B7 | 5D |
| A800 | C2 | 70 | 50 | 10 | 39 | 8E | 50 | 10 | A6 | 84 | BD | DB | BE | A1 | 84 | 27 |
| A810 | 16 | 81 | 30 | 2F | 02 | 86 | 30 | 81 | D0 | 2C | 02 | 86 | D0 | A7 | 84 | 86 |
| A820 | 01 | B7 | 5D | C2 | B7 | 52 | C2 | 39 | 3B | 02 | 39 | 01 | 10 | 8E | 50 | 14 |
| A830 | B6 | 52 | C2 | 27 | 17 | 8E | AB | 29 | BD | A6 | B9 | 8E | D2 | 19 | C6 | 35 |
| A840 | BD | AA | D9 | 8E | A8 | 56 | BD | C2 | 67 | BD | C0 | 99 | 86 | 08 | BD | A7 |
| A850 | 02 | 8E | D2 | 18 | 20 | 4F | 35 | 02 | 38 | 02 | 3B | 02 | 3E | 02 | 41 | 02 |
| A860 | 44 | 02 | 47 | 02 | 4A | 02 | 10 | 8E | 50 | 15 | B6 | 52 | C2 | 27 | 2E | 8E |
| A870 | AB | BD | BD | A6 | B9 | 8E | AB | FA | BD | C0 | 4C | 20 | 0F | 10 | 8E | 50 |

| | | | | | | | | | | | | | | | | |
|---|---|---|---|---|---|---|---|---|---|---|---|---|---|---|---|---|
| A880 | 13 | B6 | 52 | C2 | 27 | 17 | 8E | AB | BD | BD | A6 | B9 | 8E | D2 | 0D | C6 |
| A890 | 35 | BD | AA | D9 | 8E | A8 | 56 | BD | C2 | 67 | BD | C0 | 99 | 86 | 08 | BD |
| A8A0 | A7 | 02 | 8E | D2 | 0C | 30 | 86 | BD | A4 | 6A | 24 | 10 | 86 | 01 | B7 | 5D |
| A8B0 | C2 | 10 | 8C | 50 | 13 | 26 | 05 | A6 | A4 | B7 | 5D | 88 | 39 | B6 | 52 | C2 |
| A8C0 | 10 | 27 | 00 | 7C | 8E | AB | 5A | BD | A6 | B9 | 8E | AB | 77 | BD | C0 | 4C |
| A8D0 | B6 | 50 | 11 | 2A | 01 | 4F | 81 | 62 | 23 | 02 | 86 | 62 | B7 | 50 | 11 | B6 |
| A8E0 | 50 | 12 | 81 | 01 | 2C | 02 | 86 | 01 | 81 | 63 | 23 | 02 | 86 | 63 | B7 | 50 |
| A8F0 | 12 | B1 | 50 | 11 | 22 | 1F | 26 | 06 | 4C | B7 | 50 | 12 | 20 | 17 | F6 | 52 |
| A900 | 92 | 27 | 09 | C1 | 01 | 27 | 01 | 5F | 5C | F7 | 52 | 92 | F6 | 50 | 11 | F7 |
| A910 | 50 | 12 | B7 | 50 | 11 | C6 | 37 | B6 | 50 | 11 | BD | C1 | 5B | 81 | 0A | 22 |
| A920 | 05 | 86 | 21 | B7 | 50 | 84 | C6 | 49 | B6 | 50 | 12 | BD | C1 | 5B | 81 | 0F |
| A930 | 22 | 05 | 86 | 21 | B7 | 50 | 96 | 8E | A9 | 5A | BD | C2 | 67 | BD | C0 | 99 |
| A940 | 86 | 02 | BD | A7 | 02 | 8E | 50 | 10 | 30 | 86 | C6 | 63 | BD | 94 | 92 | 24 |
| A950 | 08 | 86 | 01 | B7 | 52 | C2 | B7 | 5D | C2 | 39 | 37 | 02 | 49 | 02 | B6 | 52 |
| A960 | C2 | 27 | 28 | 8E | AC | 8D | BD | A6 | B9 | B6 | 50 | 17 | C6 | 50 | 85 | 08 |
| A970 | 27 | 02 | C6 | 4D | F7 | 50 | 8D | C6 | 50 | 85 | 10 | 27 | 02 | C6 | 4D | F7 |
| A980 | 50 | 93 | 8E | A9 | A2 | BD | C2 | 67 | BD | C0 | 99 | 86 | 02 | BD | A7 | 02 |
| A990 | 81 | 01 | 26 | 07 | 10 | 8E | D2 | 10 | 16 | 00 | 5B | 10 | 8E | D2 | 11 | 16 |
| A9A0 | 00 | 54 | 43 | 01 | 49 | 01 | 10 | 8E | D2 | 14 | B6 | 52 | C2 | 10 | 27 | 00 |
| A9B0 | 40 | 8E | AB | 9B | BD | A6 | B9 | B6 | 52 | 99 | C6 | 0C | BD | C1 | 5B | 20 |
| A9C0 | 1D | 10 | 8E | D2 | 13 | B6 | 52 | C2 | 27 | 27 | 8E | AC | 05 | 20 | 0C | 10 |
| A9D0 | 8E | D2 | 12 | B6 | 52 | C2 | 27 | 19 | 8E | AC | 26 | BD | A6 | B9 | B6 | 50 |
| A9E0 | 17 | A4 | A4 | C6 | 39 | BD | BF | E2 | 8E | AA | 21 | BD | C2 | 67 | BD | C0 |
| A9F0 | 99 | 86 | 01 | BD | A7 | 02 | 1F | 21 | 10 | 8E | 50 | 17 | BD | A4 | 6A | 24 |
| AA00 | 1F | A6 | 84 | 81 | 80 | 10 | 26 | FF | 48 | B4 | 50 | 17 | BA | 5D | C2 | B7 |
| AA10 | 5D | C2 | B6 | 52 | 99 | BD | 8B | 98 | A6 | A8 | 17 | 84 | 7F | A7 | A8 | 17 |
| AA20 | 39 | 39 | 03 | B6 | 52 | C2 | 27 | 2B | 8E | AB | BD | BD | A6 | B9 | 8E | AB |
| AA30 | ED | BD | C0 | 4C | C6 | 35 | 4F | BD | 8B | FB | 96 | 3B | 4C | BD | C1 | 5B |
| AA40 | CB | 03 | B6 | 52 | 83 | 4C | 81 | 07 | 23 | ED | 8E | A8 | 56 | BD | C2 | 67 |
| AA50 | BD | C0 | 99 | 86 | 08 | BD | A7 | 02 | 4A | BD | 8B | FB | F6 | 5D | 83 | D4 |
| AA60 | 6C | 10 | 27 | 06 | 87 | 7E | DB | BE | 86 | 31 | 10 | 8E | AA | C9 | 20 | 06 |
| AA70 | 86 | 32 | 10 | 8E | AA | CD | 7D | 52 | C2 | 27 | 3A | 8E | AC | 43 | BD | A6 |
| AA80 | B9 | B7 | 50 | 58 | B6 | 50 | 16 | C6 | 21 | A4 | A4 | BD | BF | E2 | B6 | 50 |
| AA90 | 16 | C6 | 30 | A4 | 21 | BD | BF | E2 | B6 | 50 | 16 | C6 | 4D | A4 | 23 | BD |
| AAA0 | BF | E2 | B6 | 50 | 16 | C6 | 40 | A4 | 22 | BD | BF | E2 | 8E | AA | D1 | BD |
| AAB0 | C2 | 67 | BD | C0 | 99 | 86 | 04 | BD | A7 | 02 | 4A | 30 | A6 | 10 | 8E | 50 |
| AAC0 | 16 | BD | A4 | 6A | 10 | 25 | FE | 89 | 39 | 01 | 02 | 08 | 04 | 10 | 20 | 80 |
| AAD0 | 40 | 21 | 03 | 30 | 03 | 40 | 03 | 4D | 03 | 34 | 16 | 86 | 08 | 34 | 02 | A6 |
| AAE0 | A4 | A4 | 80 | BD | BF | C7 | CB | 03 | A6 | E4 | 4A | A7 | E4 | 26 | F0 | 32 |
| AAF0 | 61 | 35 | 96 | 20 | 20 | 20 | 20 | 20 | 20 | 20 | 20 | 20 | 47 | 4C | 4F | 42 |
| AB00 | 41 | 4C | 20 | 4E | 41 | 4D | 45 | 3A | FF | 20 | 20 | 45 | 44 | 49 | 54 | FF |
| AB10 | 20 | 20 | 20 | 20 | 20 | 20 | 20 | 47 | 4C | 4F | 42 | 41 | 4C | 20 | 54 | 52 |
| AB20 | 41 | 4E | 53 | 50 | 4F | 53 | 45 | 3A | FF | 4D | 49 | 44 | 49 | 20 | 4F | 55 |
| AB30 | 54 | 20 | 20 | 41 | 31 | 20 | 41 | 32 | 20 | 42 | 31 | 20 | 42 | 32 | 20 | 43 |
| AB40 | 31 | 20 | 43 | 32 | 20 | 44 | 31 | 20 | 44 | 32 | 20 | 20 | 50 | 31 | 20 | 20 |
| AB50 | 20 | 45 | 4E | 41 | 42 | 4C | 45 | 53 | 3A | FF | 20 | 20 | 20 | 20 | 20 | 20 |
| AB60 | 20 | 4B | 45 | 59 | 20 | 41 | 43 | 54 | 49 | 4F | 4E | 20 | 54 | 48 | 52 | 45 |
| AB70 | 53 | 48 | 4F | 4C | 44 | 53 | FF | 20 | 20 | 20 | 20 | 4E | 4F | 54 | 45 | 2D |
| AB80 | 4F | 46 | 46 | 20 | 3D | 20 | 30 | 30 | 20 | 20 | 20 | 20 | 20 | 20 | 4E | 4F |
| AB90 | 54 | 45 | 2D | 4F | 4E | 20 | 3D | 20 | 30 | 30 | FF | 20 | 20 | 47 | 4C | 4F |
| ABA0 | 42 | 41 | 4C | 20 | 20 | 20 | 20 | 4D | 45 | 4D | 4F | 52 | 59 | 20 | 50 | 52 |
| ABB0 | 4F | 54 | 45 | 43 | 54 | 20 | 53 | 54 | 41 | 54 | 55 | 53 | FF | 4F | 50 | 45 |
| ABC0 | 52 | 41 | 54 | 4F | 52 | 20 | 20 | 20 | 31 | 20 | 20 | 32 | 20 | 20 | 33 | 20 |
| ABD0 | 20 | 34 | 20 | 20 | 35 | 20 | 20 | 36 | 20 | 20 | 37 | 20 | 20 | 38 | 20 | 20 |
| ABE0 | 50 | 31 | 20 | 20 | 20 | 57 | 41 | 4B | 45 | 20 | 55 | 50 | FF | 4D | 49 | 44 |
| ABF0 | 49 | 20 | 43 | 48 | 41 | 4E | 4E | 45 | 4C | FF | 4C | 4F | 43 | 41 | 4C | 20 |

| | | | | | | | | | | | | | | | | |
|---|---|---|---|---|---|---|---|---|---|---|---|---|---|---|---|---|
| AC00 | 4D | 4F | 44 | 45 | FF | 20 | 20 | 20 | 20 | 4F | 50 | 45 | 52 | 41 | 54 | 4F |
| AC10 | 52 | 20 | 53 | 55 | 53 | 54 | 41 | 49 | 4E | 20 | 48 | 4F | 4C | 44 | 20 | 4F |
| AC20 | 50 | 54 | 49 | 4F | 4E | FF | 20 | 20 | 20 | 20 | 20 | 20 | 4D | 49 | 44 | 49 |
| AC30 | 20 | 43 | 4F | 4E | 54 | 52 | 4F | 4C | 4C | 45 | 52 | 20 | 4F | 55 | 54 | 50 |
| AC40 | 55 | 54 | FF | 4D | 49 | 44 | 49 | 20 | 49 | 4E | 50 | 55 | 54 | 20 | 32 | 20 |
| AC50 | 45 | 4E | 41 | 42 | 4C | 45 | 53 | 3A | 20 | 4E | 4F | 54 | 45 | 53 | 20 | 3D |
| AC60 | 20 | 20 | 20 | 20 | 20 | 20 | 50 | 31 | 43 | 54 | 52 | 4C | 53 | 20 | 3D | 20 |
| AC70 | 20 | 20 | 20 | 20 | 20 | 50 | 52 | 45 | 53 | 53 | 55 | 52 | 45 | 20 | 3D | 20 |
| AC80 | 20 | 20 | 20 | 20 | 20 | 46 | 41 | 2D | 46 | 43 | 20 | 3D | FF | 53 | 45 | 4C |
| AC90 | 45 | 43 | 54 | 20 | 4D | 49 | 44 | 49 | 20 | 49 | 4E | 50 | 55 | 54 | 20 | 20 |
| ACA0 | 20 | 20 | 20 | 20 | 20 | 31 | 20 | 20 | 20 | 20 | 20 | 32 | 20 | 20 | 20 | 20 |
| ACB0 | 50 | 31 | 4F | 50 | 45 | 52 | 41 | 54 | 4F | 52 | 20 | 41 | 53 | 53 | 49 | 47 |
| ACC0 | 4E | 4D | 45 | 4E | 54 | 20 | 4D | 4F | 44 | 45 | 3A | FF | AD | C5 | AE | 2D |
| ACD0 | B2 | C6 | AF | 90 | B0 | BA | B1 | 00 | B1 | 99 | B2 | 30 | B2 | 81 | B2 | FE |
| ACE0 | B4 | 6D | B4 | D0 | B3 | 8E | B5 | 89 | B6 | 3C | B6 | 42 | B6 | 48 | B6 | 4E |
| ACF0 | B5 | E3 | B6 | 54 | B6 | 5A | B5 | 19 | B6 | 2A | B6 | 30 | B6 | 36 | B1 | 4D |
| AD00 | 96 | E1 | C6 | 07 | 34 | 04 | A6 | 84 | 4C | BD | DB | B5 | 4A | A1 | 84 | 27 |
| AD10 | 0F | 4D | 2A | 01 | 4F | A1 | E4 | 23 | 02 | A6 | E4 | A7 | 84 | 7C | 52 | C2 |
| AD20 | 35 | 84 | C6 | 42 | 34 | 36 | C6 | 09 | 20 | 06 | C6 | 48 | 34 | 36 | C6 | 03 |
| AD30 | 10 | 8E | 50 | 4C | 8E | B7 | 43 | BD | 81 | 3D | CC | 20 | 31 | FB | 52 | 95 |
| AD40 | ED | A1 | A7 | A0 | EC | E4 | AE | 62 | BD | C0 | 85 | 20 | 02 | 34 | 36 | 5F |
| AD50 | B6 | 52 | 93 | BD | C1 | 5B | CC | 50 | 32 | FD | 50 | 70 | B6 | 52 | 94 | 26 |
| AD60 | 06 | CC | 00 | 02 | BD | C2 | 8F | 35 | B6 | 34 | 36 | 8E | 50 | 4A | 3A | 10 |
| AD70 | 9E | 64 | 31 | A9 | 00 | 00 | C6 | 0A | BD | 81 | 32 | 35 | B6 | 34 | 02 | B1 |
| AD80 | 52 | 94 | 25 | 19 | BD | DC | 8E | 26 | 08 | B6 | 52 | 94 | 27 | 18 | 32 | 61 |
| AD90 | 39 | BB | 52 | 94 | 2A | 01 | 4F | A1 | E4 | 23 | 02 | A6 | E4 | B7 | 52 | 94 |
| ADA0 | 7C | 52 | C2 | 32 | 63 | 39 | B6 | 52 | 93 | BD | DB | B5 | B1 | 52 | 93 | 27 |
| ADB0 | F2 | B7 | 52 | 93 | 20 | EA | 34 | 06 | F6 | 5D | 83 | D4 | 6C | 27 | 01 | 4F |
| ADC0 | B7 | 5D | 86 | 35 | 86 | B6 | 52 | C2 | 27 | 2A | 8E | 80 | F9 | BD | C0 | 78 |
| ADD0 | 8E | B7 | 39 | BD | C0 | 4C | BD | AD | 4D | F6 | 52 | 95 | CB | 31 | F7 | 50 |
| ADE0 | 87 | C6 | 41 | BD | AD | 69 | 86 | 3D | B7 | 50 | 89 | 8E | AE | 0E | BD | C2 |
| ADF0 | 67 | BD | C0 | 99 | 86 | 02 | BD | AD | 7D | 81 | 01 | 10 | 27 | E7 | 8B | 8E |
| AE00 | 52 | 95 | BD | AD | 02 | 8E | D2 | 0D | A6 | 86 | B7 | 5D | 89 | 39 | 26 | 02 |
| AE10 | 3D | 01 | 8E | 67 | 00 | 34 | 16 | BD | CC | 04 | C6 | 10 | A6 | 80 | 81 | 20 |
| AE20 | 2D | 07 | 5A | 26 | F7 | 1C | FE | 35 | 96 | 1A | 01 | 35 | 96 | 86 | 0C | BD |
| AE30 | AD | B6 | 7D | 52 | C2 | 10 | 27 | 00 | 77 | 8E | B7 | 4D | BD | AD | 22 | C6 |
| AE40 | 18 | BD | AD | 69 | B6 | 52 | 94 | 81 | 02 | 26 | 35 | 8E | B7 | 58 | BD | C0 |
| AE50 | 4C | BD | BF | F4 | BD | AE | 12 | 25 | 14 | 10 | 8E | 50 | 82 | C6 | 10 | BD |
| AE60 | 81 | 55 | 96 | 13 | 84 | 7F | C6 | 49 | BD | C1 | 5B | 20 | 3A | C6 | 03 | B6 |
| AE70 | 52 | 94 | B1 | 5D | AF | 22 | 02 | C6 | 01 | F7 | 52 | 94 | F7 | 52 | C2 | 39 |
| AE80 | 8E | B7 | 88 | BD | C0 | 4C | BD | AE | 12 | 25 | 0D | 8E | 50 | 96 | CC | 3C |
| AE90 | 4E | ED | 81 | CC | 46 | 3E | ED | 84 | C6 | 40 | 96 | 13 | 2B | 05 | BD | C1 |
| AEA0 | 5B | 20 | 04 | 4F | BD | BF | E2 | 8E | AF | 78 | BD | C2 | 67 | BD | C0 | 99 |
| AEB0 | B6 | 52 | 94 | B7 | 5D | AF | B6 | 5D | 86 | BD | AD | 7D | 81 | 02 | 10 | 27 |
| AEC0 | 00 | 41 | 81 | 01 | 26 | 1E | 96 | 13 | BD | DB | BE | 91 | 13 | 27 | 33 | 4D |
| AED0 | 2A | 0A | 81 | C0 | 22 | 04 | 86 | 80 | 20 | 02 | 86 | FF | 97 | 13 | 86 | 01 |
| AEE0 | 97 | 7C | 20 | 14 | 1F | 89 | 4F | D3 | 64 | CB | FD | 1F | 01 | A6 | 84 | BD |
| AEF0 | DB | A4 | A1 | 84 | 27 | 0C | A7 | 84 | 96 | 6C | B7 | 52 | C2 | 97 | 22 | B7 |
| AF00 | 5D | C2 | 39 | BD | 95 | 2A | BD | C2 | F1 | 8E | B7 | 68 | BD | C0 | 54 | BD |
| AF10 | C0 | 9C | 7F | 5D | C4 | 8E | 6E | 00 | BF | 5D | C9 | FC | 67 | 10 | C3 | 6E |
| AF20 | 00 | FD | 5D | AF | 10 | 8E | 67 | 13 | 96 | 13 | 84 | 7F | 1F | 89 | BD | 8D |
| AF30 | AB | BD | E6 | F5 | FC | 5D | C9 | 10 | B3 | 5D | AF | 24 | 1D | B6 | 5D | C4 |
| AF40 | 26 | 18 | FC | 52 | C6 | 10 | 83 | 05 | 16 | 24 | 0F | C4 | 07 | 26 | E5 | 7C |
| AF50 | 52 | C7 | BD | D5 | D8 | BD | C6 | A7 | 20 | DA | 10 | 8E | 67 | 00 | 4F | E6 |
| AF60 | A8 | 12 | 31 | AB | 8E | 6E | 00 | AD | A4 | 10 | 9E | 64 | 31 | A9 | 00 | 00 |
| AF70 | C6 | 0A | BD | 81 | 55 | 16 | FF | 80 | 40 | 03 | 4D | 02 | 7C | 01 | 7D | 01 |

| | | | | | | | | | | | | | | | | |
|---|---|---|---|---|---|---|---|---|---|---|---|---|---|---|---|---|
| AF80 | 7E | 01 | 7F | 01 | 80 | 01 | 81 | 01 | 82 | 01 | 83 | 01 | 84 | 01 | 85 | 01 |
| AF90 | 86 | 04 | BD | AD | B6 | B6 | 52 | C2 | 10 | 27 | 00 | 88 | 8E | B7 | A0 | BD |
| AFA0 | AD | 22 | 86 | 70 | BD | 8B | 98 | 96 | 1E | 84 | 1F | B7 | 52 | 9E | C6 | 23 |
| AFB0 | BD | C1 | 5B | B6 | 52 | 94 | 81 | 04 | 26 | 18 | 8E | B7 | F8 | BD | C0 | 4C |
| AFC0 | 96 | 1F | 2B | 57 | 8E | B8 | 1D | 10 | 8E | 50 | 83 | C6 | 06 | BD | 81 | 3D |
| AFD0 | 20 | 49 | 96 | 20 | 84 | 7F | C6 | 3A | BD | C1 | 5B | 96 | 1F | 84 | 7F | C6 |
| AFE0 | 44 | BD | C1 | 5B | 96 | 1F | 2B | 0C | 8E | B8 | 1D | 10 | 8E | 50 | 93 | C6 |
| AFF0 | 06 | BD | 81 | 3D | 96 | 1E | 85 | 20 | 27 | 08 | CC | 2D | 2D | FD | 50 | 6D |
| B000 | 20 | 19 | 86 | 70 | BD | 8B | 98 | B6 | 52 | 9E | C6 | 18 | 3D | 31 | AB | 10 |
| B010 | BF | 5D | B1 | 8E | 50 | 72 | C6 | 0A | BD | 81 | 48 | 8E | B0 | B2 | BD | C2 |
| B020 | 67 | BD | C0 | 99 | B6 | 5D | 86 | BD | AD | 7D | 81 | 01 | 27 | 24 | 81 | 02 |
| B030 | 27 | 50 | 81 | 03 | 27 | 50 | 86 | 01 | BD | DB | B5 | 81 | 01 | 26 | 01 | 39 |
| B040 | 4D | 2F | 06 | 96 | 1F | 8A | 80 | 20 | 04 | 96 | 1F | 84 | 7F | 97 | 1F | 16 |
| B050 | FE | 8C | 96 | 1E | 84 | 3F | 85 | 20 | 27 | 02 | 86 | FF | 34 | 02 | BD | DB |
| B060 | B5 | A1 | E0 | 26 | 01 | 39 | 4D | 2B | 11 | 81 | 1F | 22 | 11 | 34 | 02 | 96 |
| B070 | 1E | 84 | C0 | AA | E0 | 97 | 1E | 16 | FE | 64 | 86 | 3F | 20 | EF | 86 | 1F |
| B080 | 20 | EB | C6 | 20 | 20 | 02 | C6 | 1F | BD | B4 | 26 | A6 | 84 | 84 | 7F | 34 |
| B090 | 02 | BD | DB | BE | A1 | E0 | 26 | 01 | 39 | 4D | 2A | 09 | 81 | C0 | 22 | 04 |
| B0A0 | 86 | 7F | 20 | 01 | 4F | 34 | 02 | A6 | 84 | 84 | 80 | AA | E0 | A7 | 84 | 16 |
| B0B0 | FE | 2C | 23 | 02 | 3A | 03 | 44 | 03 | 39 | 06 | 86 | 01 | BD | AD | B6 | B6 |
| B0C0 | 52 | C2 | 27 | 22 | 8E | B7 | 56 | BD | AD | 22 | 8E | B8 | 23 | BD | C0 | 4C |
| B0D0 | C6 | 18 | BD | AD | 69 | C6 | 47 | 96 | 3B | 4C | BD | C1 | 5B | 8E | B0 | FE |
| B0E0 | BD | C2 | 67 | BD | C0 | 99 | B6 | 5D | 86 | BD | AD | 7D | C6 | 3B | BD | B4 |
| B0F0 | 26 | C6 | 0F | BD | AD | 04 | 7D | 52 | C2 | 10 | 26 | FD | FB | 39 | 47 | 02 |
| B100 | 86 | 04 | BD | AD | B6 | B6 | 52 | C2 | 27 | 22 | 8E | B8 | 42 | BD | AD | 2A |
| B110 | C6 | 3F | 8E | D2 | 0D | 96 | 0A | A4 | 80 | BD | BF | C7 | CB | 03 | 8C | D2 |
| B120 | 10 | 23 | F2 | 8E | B1 | 45 | BD | C2 | 67 | BD | C0 | 99 | B6 | 5D | 86 | BD |
| B130 | AD | 7D | 4A | 8E | D2 | 0D | 30 | 86 | C6 | 0A | BD | B4 | 2F | BD | A4 | 6A |
| B140 | 10 | 25 | FD | B4 | 39 | 3F | 02 | 42 | 02 | 45 | 02 | 48 | 02 | 86 | 02 | BD |
| B150 | AD | B6 | B6 | 52 | C2 | 27 | 21 | 8E | B8 | 72 | BD | AD | 22 | C6 | 35 | 96 |
| B160 | 1E | 84 | 80 | BD | BF | E2 | C6 | 4B | 96 | 1E | 84 | 40 | BD | BF | E2 | 8E |
| B170 | B1 | 95 | BD | C2 | 67 | BD | C0 | 99 | B6 | 5D | 86 | BD | AD | 7D | 8E | D2 |
| B180 | 14 | 81 | 01 | 27 | 03 | 8E | D2 | 13 | C6 | 1E | BD | B4 | 2F | BD | A4 | 6A |
| B190 | 10 | 25 | FD | 64 | 39 | 35 | 03 | 4B | 03 | 86 | 03 | BD | AD | B6 | B6 | 52 |
| B1A0 | C2 | 27 | 40 | 8E | B8 | AF | BD | AD | 22 | C6 | 3E | 96 | 0C | 4C | BD | C1 |
| B1B0 | 5B | C6 | 4B | 96 | 0B | 4C | BD | C1 | 5B | B6 | 52 | 94 | 27 | 22 | 8E | B8 |
| B1C0 | EC | 10 | 8E | 50 | 72 | C6 | 0E | BD | 81 | 3D | 8E | B2 | 2A | BD | C2 | 67 |
| B1D0 | B6 | 52 | 94 | 81 | 02 | 25 | 09 | CC | 01 | 01 | FD | 50 | D8 | FD | 50 | E5 |
| B1E0 | BD | C0 | 99 | B6 | 52 | 94 | 26 | 06 | B6 | 5D | 86 | BD | AD | 7D | 8E | 5B |
| B1F0 | 4D | 5F | A6 | 85 | 81 | 10 | 24 | 06 | 5C | C1 | 57 | 23 | F5 | 39 | 80 | 10 |
| B200 | A7 | 85 | B6 | 52 | 94 | 81 | 01 | 27 | 0B | D7 | 0B | 7F | 52 | 94 | D1 | 0C |
| B210 | 25 | 09 | 20 | 0D | D7 | 0C | 7C | 52 | 94 | 20 | 0C | 96 | 0C | 97 | 0B | D7 |
| B220 | 0C | BD | 8C | 53 | BD | 8A | B8 | 16 | FC | CE | 29 | 0C | 29 | 0C | 29 | 0C |
| B230 | 86 | 02 | BD | AD | B6 | B6 | 52 | C2 | 27 | 20 | 8E | B8 | FA | BD | AD | 22 |
| B240 | C6 | 2B | 96 | 12 | 2A | 03 | 40 | C6 | 2D | F7 | 50 | 83 | C6 | 3B | BD | C1 |
| B250 | 5B | 8E | A8 | 28 | BD | C2 | 67 | BD | C0 | 99 | B6 | 5D | 86 | BD | AD | 7D |
| B260 | 81 | 01 | 27 | 0D | 4F | BD | DB | B5 | 4D | 26 | 01 | 39 | 00 | 12 | 16 | FC |
| B270 | 87 | C6 | 12 | BD | B4 | 26 | BD | A8 | 08 | 7D | 52 | C2 | 10 | 26 | FC | 78 |
| B280 | 39 | 86 | 01 | BD | AD | B6 | B6 | 52 | C2 | 27 | 1C | 8E | B9 | 06 | BD | AD |
| B290 | 22 | C6 | 1F | 96 | 78 | 84 | 01 | 97 | 78 | 88 | 01 | BD | BF | E2 | 8E | B2 |
| B2A0 | C4 | BD | C2 | 67 | BD | C0 | 99 | B6 | 5D | 86 | BD | AD | 7D | C6 | 78 | BD |
| B2B0 | B4 | 2F | 8E | D2 | 0D | BD | A4 | 6A | 24 | 09 | A6 | A4 | 88 | 01 | A7 | A4 |
| B2C0 | 16 | FC | 35 | 39 | 1F | 03 | 86 | 01 | BD | AD | B6 | B6 | 52 | C2 | 27 | 18 |
| B2D0 | 8E | B7 | E3 | BD | AD | 22 | C6 | 39 | 96 | 20 | 84 | 80 | BD | BF | E2 | 8E |
| B2E0 | AA | 21 | BD | C2 | 67 | BD | C0 | 99 | B6 | 5D | 86 | BD | AD | 7D | C6 | 20 |
| B2F0 | BD | B4 | 2F | 8E | D2 | 14 | BD | A4 | 6A | 10 | 25 | FB | FB | 39 | 86 | 03 |

| | | |
|---|---|---|
| B300 | BD AD B6 B6 52 C2 27 29 | 8E B9 28 BD AD 2A 96 71 |
| B310 | C6 14 BD C1 5B D6 71 BD | B4 39 96 11 C6 37 BD C1 |
| B320 | 5B 96 10 C6 4D BD C1 5B | 8E B3 88 BD C2 67 BD C0 |
| B330 | 99 B6 5D 86 BD AD 7D 81 | 01 26 1B 96 71 BD DB B5 |
| B340 | 91 71 26 01 39 4D 2B 08 | 81 0F 23 05 86 0F 20 01 |
| B350 | 4F 97 71 16 FB A2 81 02 | 26 16 C6 11 BD B4 26 D6 |
| B360 | 10 BD 94 92 24 16 4D 26 | 02 86 01 97 11 16 FB 88 |
| B370 | C6 10 BD B4 26 C6 7F BD | 94 92 25 01 39 91 11 24 |
| B380 | 02 96 11 97 10 16 FB 70 | 14 02 37 03 4D 03 86 03 |
| B390 | BD AD B6 B6 52 C2 27 40 | 8E B9 28 BD AD 2A CC 50 |
| B3A0 | 52 FD 50 52 FD 50 75 FD | 50 8B 86 53 B7 50 54 B7 |
| B3B0 | 50 77 B7 50 8D 96 70 C6 | 14 BD C1 5B D6 70 BD B4 |
| B3C0 | 39 96 0F C6 37 BD C1 5B | 96 0E C6 4D BD C1 5B 8E |
| B3D0 | B3 88 BD C2 67 BD C0 99 | B6 5D 86 BD AD 7D 81 01 |
| B3E0 | 26 1B 96 70 BD DB B5 91 | 70 26 01 39 4D 2B 08 81 |
| B3F0 | 0F 23 05 86 0F 20 01 4F | 97 70 16 FA FB 81 02 26 |
| B400 | 0D C6 0F BD B4 26 D6 0E | BD 94 92 25 16 39 C6 0E |
| B410 | BD B4 26 C6 7F BD 94 92 | 25 01 39 91 0F 24 04 96 |
| B420 | 0F 97 0E 16 FA D2 34 06 | 9E 64 4F 30 8B 35 86 34 |
| B430 | 06 10 9E 64 4F 31 AB 35 | 86 34 36 8E D3 30 C4 07 |
| B440 | C1 05 25 08 C0 05 F7 52 | 9D 8E 50 EA 58 58 58 3A |
| B450 | 10 8E 50 67 C6 08 BD 81 | 55 A6 61 85 08 26 0C CC |
| B460 | 4E 4F FD 50 62 CC 52 4D | FD 50 64 35 B6 86 02 BD |
| B470 | AD B6 B6 52 C2 27 1D 8E | B9 6D BD AD 2A 96 6E C6 |
| B480 | 43 BD C1 5B 96 6D C6 49 | BD C1 5B 8E B4 CC BD C2 |
| B490 | 67 BD C0 99 B6 5D 86 BD | AD 7D 81 01 26 16 C6 6E |
| B4A0 | BD B4 26 D6 6D BD 94 92 | 24 16 4D 26 04 86 01 97 |
| B4B0 | 6E 16 FA 44 C6 6D BD B4 | 26 C6 7F BD 94 92 25 01 |
| B4C0 | 39 91 6E 24 04 96 6E 97 | 6D 16 FA 2C 43 03 49 03 |
| B4D0 | 86 02 BD AD B6 B6 52 C2 | 27 1D 8E B9 A7 BD AD 22 |
| B4E0 | 96 72 C6 4D BD BF E2 96 | 73 C6 38 BD BF E2 8E B5 |
| B4F0 | 15 BD C2 67 BD C0 99 B6 | 5D 86 BD AD 7D 81 01 27 |
| B500 | 04 C6 72 20 02 C6 73 BD | B4 2F 8E D2 0D BD A4 6A |
| B510 | 10 25 F9 E4 39 38 03 4D | 03 86 03 BD AD B6 BD 9A |
| B520 | C6 B6 52 C2 27 45 8E B9 | E6 BD AD 2A 10 8E D2 0D |
| B530 | 8E 50 85 C6 01 86 2B A7 | 84 96 6F A5 A5 26 04 86 |
| B540 | 2D A7 84 86 28 A7 01 86 | 29 A7 05 30 02 B6 38 05 |
| B550 | 43 B8 5D 7E 98 6F A4 A5 | BD BF DE 30 05 5C C1 03 |
| B560 | 23 D3 8E B5 83 BD C2 67 | BD C0 99 B6 5D 86 BD AD |
| B570 | 7D 8E D2 0D 30 86 C6 6F | BD B4 2F BD A4 6A 10 25 |
| B580 | F9 76 39 3B 01 42 01 49 | 01 86 04 BD AD B6 B6 52 |
| B590 | C2 27 2B 8E BA 18 BD AD | 2A 96 1D 8E D2 0D 10 8E |
| B5A0 | 50 84 A5 80 27 04 C6 2D | 20 02 C6 2B E7 A4 31 25 |
| B5B0 | 8C D2 10 23 ED 8E B5 DB | BD C2 67 BD C0 99 B6 5D |
| B5C0 | 86 BD AD 7D 8E D2 0C 30 | 86 C6 1D BD B4 2F BD A4 |
| B5D0 | 6A 24 07 A8 84 A7 A4 16 | F9 1E 39 3A 01 3F 01 44 |
| B5E0 | 01 49 01 86 02 BD AD B6 | B6 52 C2 27 2B 8E BA 46 |
| B5F0 | BD AD 2A 96 1D 8E D2 11 | 10 8E 50 85 A5 80 27 04 |
| B600 | C6 2D 20 02 C6 2B E7 A4 | 31 2A 8C D2 12 23 ED 8E |
| B610 | B6 26 BD C2 67 BD C0 99 | B6 5D 86 BD AD 7D 8E D2 |
| B620 | 10 30 86 16 FF A3 3B 01 | 45 01 C6 14 86 01 20 2E |
| B630 | C6 15 86 02 20 28 C6 16 | 86 03 20 22 C6 17 86 04 |
| B640 | 20 1C C6 18 86 05 20 16 | C6 19 86 06 20 10 C6 1A |
| B650 | 86 07 20 0A C6 1B 86 08 | 20 04 C6 1C 86 09 10 9E |
| B660 | 64 31 A5 B7 5D AF 86 01 | BD AD B6 7D 52 C2 10 27 |
| B670 | 00 B0 B6 5D AF 81 03 23 | 23 80 03 81 04 23 09 80 |

| | | | | | | | | | | | | | | | | |
|---|---|---|---|---|---|---|---|---|---|---|---|---|---|---|---|---|
| B680 | 04 | 34 | 02 | 8E | BA | 74 | 20 | 05 | 34 | 02 | 8E | BA | 9B | BD | AD | 22 |
| B690 | 35 | 02 | 8B | 30 | B7 | 50 | 61 | B7 | 50 | 76 | 20 | 12 | 34 | 02 | 8E | BA |
| B6A0 | C2 | BD | AD | 22 | 35 | 02 | 8B | 30 | B7 | 50 | 64 | B7 | 50 | 76 | 86 | 3D |
| B6B0 | B7 | 50 | 83 | A6 | A4 | C6 | 35 | BD | C1 | 5B | 8E | BA | F3 | E6 | A4 | C1 |
| B6C0 | 86 | 23 | 39 | B6 | 5D | AF | 81 | 03 | 22 | 30 | C1 | E8 | 24 | 2C | C1 | C8 |
| B6D0 | 25 | 28 | 34 | 20 | 8E | BA | E9 | 10 | 8E | 50 | 85 | C6 | 0A | BD | 81 | 3D |
| B6E0 | 86 | 70 | BD | 8B | 98 | AE | E4 | A6 | 84 | 80 | C8 | 84 | 1F | C6 | 18 | 3D |
| B6F0 | 30 | AB | 10 | 8E | 50 | 8F | C6 | 0A | 20 | 11 | C6 | 86 | 4F | 58 | 49 | 30 |
| B700 | 8B | AE | 84 | 34 | 20 | 10 | 8E | 50 | 85 | C6 | 14 | A6 | 80 | 2B | 05 | A7 |
| B710 | A0 | 5A | 26 | F7 | 35 | 20 | 8E | B7 | 37 | BD | C2 | 67 | 7F | 50 | D3 | BD |
| B720 | C0 | 99 | B6 | 5D | 86 | BD | AD | 7D | A6 | A4 | BD | DB | BE | A1 | A4 | 26 |
| B730 | 01 | 39 | A7 | A4 | 16 | F7 | C1 | 35 | 1B | 20 | 20 | 20 | 20 | 20 | 20 | 45 |
| B740 | 44 | 49 | 54 | 20 | 4F | 50 | 45 | 52 | 41 | 54 | 4F | 52 | FF | 4E | 41 | 4D |
| B750 | 45 | 20 | 20 | 20 | 20 | 3D | 20 | FF | 47 | 45 | 54 | 20 | 46 | 52 | 4F | 4D |
| B760 | 20 | 53 | 59 | 4E | 54 | 48 | 3A | FF | 57 | 41 | 49 | 54 | 49 | 4E | 47 | 20 |
| B770 | 46 | 4F | 52 | 20 | 53 | 59 | 4E | 54 | 48 | 20 | 54 | 4F | 20 | 52 | 45 | 53 |
| B780 | 50 | 4F | 4E | 44 | 2E | 2E | 2E | FF | 20 | 20 | 20 | 53 | 59 | 4E | 54 | 48 |
| B790 | 20 | 50 | 41 | 54 | 43 | 48 | 20 | 53 | 45 | 4C | 45 | 43 | 54 | 20 | 3D | FF |
| B7A0 | 55 | 53 | 45 | 52 | 20 | 57 | 41 | 4B | 45 | 2D | 55 | 50 | 20 | 4D | 45 | 53 |
| B7B0 | 53 | 41 | 47 | 45 | 20 | 20 | 20 | 20 | 20 | 20 | 20 | 20 | 20 | 20 | 20 | 20 |
| B7C0 | 20 | 20 | 20 | 20 | 20 | 20 | 28 | 58 | 29 | 20 | 3D | 20 | 20 | 20 | 20 | 20 |
| B7D0 | 28 | 59 | 29 | 20 | 3D | 20 | 20 | 20 | 20 | 20 | 28 | 41 | 46 | 54 | 45 | 52 |
| B7E0 | 20 | 29 | FF | 4D | 49 | 44 | 49 | 20 | 43 | 4F | 4E | 54 | 52 | 4F | 4C | 20 |
| B7F0 | 4D | 45 | 53 | 53 | 41 | 47 | 45 | FF | 54 | 52 | 41 | 4E | 53 | 4D | 49 | 54 |
| B800 | 20 | 4D | 45 | 53 | 53 | 41 | 47 | 45 | 20 | 41 | 46 | 54 | 45 | 52 | 20 | 20 |
| B810 | 50 | 41 | 54 | 43 | 48 | 20 | 53 | 45 | 4C | 45 | 43 | 54 | FF | 42 | 45 | 46 |
| B820 | 4F | 52 | 45 | 20 | 20 | 20 | 20 | 20 | 20 | 20 | 4D | 49 | 44 | 49 | 20 | 54 |
| B830 | 52 | 41 | 4E | 53 | 4D | 49 | 54 | 20 | 43 | 48 | 41 | 4E | 4E | 45 | 4C | 20 |
| B840 | 3D | FF | 54 | 52 | 41 | 4E | 53 | 4D | 49 | 54 | 54 | 45 | 52 | 20 | 20 | 20 |
| B850 | 20 | 20 | 41 | 20 | 20 | 42 | 20 | 20 | 43 | 20 | 20 | 44 | 20 | 20 | 20 | 20 |
| B860 | 50 | 32 | 20 | 20 | 20 | 20 | 20 | 20 | 20 | 20 | 45 | 4E | 41 | 42 | 4C | 45 |
| B870 | 53 | FF | 20 | 4D | 49 | 44 | 49 | 20 | 49 | 4E | 50 | 55 | 54 | 20 | 50 | 52 |
| B880 | 4F | 43 | 45 | 53 | 53 | 49 | 4E | 47 | 20 | 20 | 50 | 32 | 43 | 48 | 41 | 4E |
| B890 | 4E | 45 | 4C | 49 | 5A | 45 | 20 | 3D | 20 | 20 | 20 | 20 | 20 | 20 | 50 | 52 |
| B8A0 | 4F | 47 | 52 | 41 | 4D | 20 | 43 | 48 | 41 | 4E | 47 | 45 | 20 | 3D | FF | 20 |
| B8B0 | 53 | 45 | 54 | 20 | 4B | 45 | 59 | 42 | 4F | 41 | 52 | 44 | 20 | 4C | 49 | 4D |
| B8C0 | 49 | 54 | 53 | 20 | 20 | 20 | 20 | 50 | 32 | 20 | 20 | 20 | 20 | 20 | 20 | 20 |
| B8D0 | 20 | 20 | 20 | 20 | 20 | 20 | 20 | 20 | 20 | 4C | 4F | 57 | 20 | 3D | 20 | 30 |
| B8E0 | 30 | 20 | 20 | 20 | 20 | 48 | 49 | 47 | 48 | 20 | 3D | FF | 28 | 50 | 52 | 45 |
| B8F0 | 53 | 53 | 20 | 32 | 20 | 4B | 45 | 59 | 53 | 29 | 20 | 54 | 52 | 41 | 4E | 53 |
| B900 | 50 | 4F | 53 | 45 | 3A | FF | 4B | 45 | 59 | 42 | 4F | 41 | 52 | 44 | 20 | 50 |
| B910 | 49 | 54 | 43 | 48 | 20 | 3D | FF | 4C | 4F | 43 | 41 | 4C | 20 | 43 | 4F | 4E |
| B920 | 54 | 52 | 4F | 4C | 20 | 20 | 3D | FF | 56 | 45 | 4C | 2E | 53 | 43 | 41 | 4C |
| B930 | 45 | 20 | 3D | 20 | 58 | 58 | 20 | 20 | 52 | 45 | 56 | 20 | 20 | 58 | 58 | 58 |
| B940 | 58 | 58 | 58 | 58 | 58 | 20 | 50 | 32 | 4C | 4F | 20 | 56 | 45 | 4C | 20 | 4C |
| B950 | 49 | 4D | 49 | 54 | 20 | 3D | 20 | 20 | 20 | 20 | 20 | 20 | 20 | 20 | 48 | 49 |
| B960 | 20 | 56 | 45 | 4C | 20 | 4C | 49 | 4D | 49 | 54 | 20 | 3D | FF | 56 | 45 | 4C |
| B970 | 4F | 43 | 49 | 54 | 59 | 20 | 57 | 49 | 4E | 44 | 4F | 57 | 20 | 20 | 20 | 20 |
| B980 | 4C | 4F | 57 | 20 | 20 | 48 | 49 | 47 | 48 | 20 | 20 | 50 | 32 | 50 | 4C | 41 |
| B990 | 59 | 20 | 4E | 4F | 54 | 45 | 53 | 20 | 57 | 2F | 56 | 45 | 4C | 2E | 20 | 42 |
| B9A0 | 45 | 54 | 57 | 45 | 45 | 4E | FF | 20 | 20 | 41 | 46 | 54 | 45 | 52 | 54 | 4F |
| B9B0 | 55 | 43 | 48 | 20 | 45 | 4E | 41 | 42 | 4C | 45 | 20 | 20 | 20 | 20 | 20 | 50 |
| B9C0 | 32 | 43 | 48 | 41 | 4E | 20 | 50 | 52 | 45 | 53 | 53 | 55 | 52 | 45 | 20 | 3D |
| B9D0 | 20 | 20 | 20 | 20 | 20 | 20 | 50 | 4F | 4C | 59 | 20 | 50 | 52 | 45 | 53 | 53 |
| B9E0 | 55 | 52 | 45 | 20 | 3D | FF | 46 | 4F | 4F | 54 | 53 | 57 | 49 | 54 | 43 | 48 |
| B9F0 | 20 | 31 | 20 | 20 | 20 | 20 | 20 | 20 | 32 | 20 | 20 | 20 | 20 | 20 | 20 | 33 |

| | | | | | | | | | | | | | | | | |
|---|---|---|---|---|---|---|---|---|---|---|---|---|---|---|---|---|
| BA00 | 20 | 20 | 20 | 20 | 50 | 32 | 20 | 20 | 20 | 20 | 20 | 20 | 20 | 20 | 20 | 50 |
| BA10 | 4F | 4C | 41 | 52 | 49 | 54 | 59 | FF | 50 | 45 | 44 | 41 | 4C | 20 | 20 | 20 |
| BA20 | 50 | 45 | 44 | 31 | 20 | 50 | 45 | 44 | 32 | 20 | 50 | 45 | 44 | 33 | 20 | 50 |
| BA30 | 45 | 44 | 34 | 20 | 20 | 20 | 50 | 32 | 20 | 20 | 20 | 20 | 20 | 50 | 4F | 4C |
| BA40 | 41 | 52 | 49 | 54 | 59 | FF | 57 | 48 | 45 | 45 | 4C | 20 | 20 | 20 | 20 | 57 |
| BA50 | 48 | 45 | 45 | 4C | 31 | 20 | 20 | 20 | 57 | 48 | 45 | 45 | 4C | 32 | 20 | 20 |
| BA60 | 20 | 20 | 20 | 20 | 50 | 32 | 20 | 20 | 20 | 20 | 20 | 50 | 4F | 4C | 41 | 52 |
| BA70 | 49 | 54 | 59 | FF | 20 | 20 | 20 | 57 | 48 | 45 | 45 | 4C | 20 | 58 | 20 | 52 |
| BA80 | 4F | 55 | 54 | 49 | 4E | 47 | 3A | 20 | 20 | 20 | 20 | 20 | 50 | 32 | 57 | 48 |
| BA90 | 4C | 20 | 58 | 20 | 3D | 20 | 43 | 54 | 52 | 4C | FF | 20 | 20 | 20 | 50 | 45 |
| BAA0 | 44 | 41 | 4C | 20 | 58 | 20 | 52 | 4F | 55 | 54 | 49 | 4E | 47 | 3A | 20 | 20 |
| BAB0 | 20 | 20 | 20 | 50 | 32 | 50 | 45 | 44 | 20 | 58 | 20 | 3D | 20 | 43 | 54 | 52 |
| BAC0 | 4C | FF | 20 | 46 | 4F | 4F | 54 | 53 | 57 | 49 | 54 | 43 | 48 | 20 | 58 | 20 |
| BAD0 | 52 | 4F | 55 | 54 | 49 | 4E | 47 | 3A | 20 | 20 | 50 | 32 | 46 | 53 | 57 | 20 |
| BAE0 | 58 | 20 | 3D | 20 | 43 | 54 | 52 | 4C | FF | 55 | 53 | 45 | 52 | 20 | 4D | 53 |
| BAF0 | 47 | 3A | 20 | BC | 12 | BC | 27 | BC | 38 | BC | 12 | BC | 4A | BC | 5A | BC |
| BB00 | 6A | BC | 75 | BC | 81 | BC | 12 | BC | 89 | BC | 8D | BC | 12 | BC | 12 | BC |
| BB10 | 12 | BC | 12 | BC | 98 | BC | AB | BC | BE | BC | D1 | BC | 12 | BC | 12 | BC |
| BB20 | 12 | BC | 12 | BC | 12 | BC | 12 | BC | 12 | BC | 12 | BC | 12 | BC | 12 | BC |
| BB30 | 12 | BC | 12 | BC | 12 | BC | 27 | BC | 38 | BC | 12 | BC | 4A | BC | 5A | BC |
| BB40 | 6A | BC | 75 | BC | 81 | BC | 12 | BC | 89 | BC | 8D | BC | 12 | BC | 12 | BC |
| BB50 | 12 | BC | 12 | BC | 98 | BC | AB | BC | BE | BC | D1 | BC | 12 | BC | 12 | BC |
| BB60 | 12 | BC | 12 | BC | 12 | BC | 12 | BC | 12 | BC | 12 | BC | 12 | BC | 12 | BC |
| BB70 | 12 | BC | 12 | BC | E4 | BC | F1 | BC | FC | BD | 06 | BC | 12 | BD | 11 | BC |
| BB80 | 12 | BC | 12 | BC | 12 | BC | 12 | BC | 12 | BC | 12 | BC | 12 | BC | 12 | BC |
| BB90 | 12 | BC | 12 | BD | 18 | BD | 2B | BD | 3E | BD | 51 | BC | 12 | BC | 12 | BC |
| BBA0 | 12 | BC | 12 | BC | 12 | BC | 12 | BC | 12 | BD | 64 | BD | 77 | BD | 85 | BD |
| BBB0 | 92 | BD | A0 | BD | AD | BD | BC | BD | CB | BD | DE | BD | F1 | BE | 06 | BC |
| BBC0 | 12 | BC | 12 | BC | 12 | BC | 12 | BC | 12 | BC | 12 | BC | 12 | BC | 12 | BC |
| BBD0 | 12 | BC | 12 | BC | 12 | BC | 12 | BC | 12 | BC | 12 | BC | 12 | BC | 12 | BC |
| BBE0 | 12 | BC | 12 | BC | 12 | BE | 1B | BE | 67 | BE | 7C | BE | 8A | BE | 9F | BE |
| BBF0 | B3 | BE | C7 | BE | 5C | BE | 4D | BE | 3B | BE | 2D | BE | DB | BE | F0 | BC |
| BC00 | 01 | 2D | 20 | 4E | 4F | 54 | 20 | 41 | 53 | 53 | 49 | 47 | 4E | 45 | 44 | 20 |
| BC10 | 2D | FF | 75 | 6E | 64 | 65 | 66 | 69 | 6E | 65 | 64 | 20 | 63 | 6F | 6E | 74 |
| BC20 | 72 | 6F | 6C | 6C | 65 | 72 | FF | 4D | 4F | 44 | 55 | 4C | 41 | 54 | 49 | 4F |
| BC30 | 4E | 20 | 44 | 45 | 50 | 54 | 48 | FF | 42 | 52 | 45 | 41 | 54 | 48 | 20 | 43 |
| BC40 | 4F | 4E | 54 | 52 | 4F | 4C | 4C | 45 | 52 | FF | 46 | 4F | 4F | 54 | 20 | 43 |
| BC50 | 4F | 4E | 54 | 52 | 4F | 4C | 4C | 45 | 52 | FF | 50 | 4F | 52 | 54 | 41 | 4D |
| BC60 | 45 | 4E | 54 | 4F | 20 | 54 | 49 | 4D | 45 | FF | 44 | 41 | 54 | 41 | 20 | 45 |
| BC70 | 4E | 54 | 52 | 59 | FF | 4D | 41 | 49 | 4E | 20 | 56 | 4F | 4C | 55 | 4D | 45 |
| BC80 | FF | 42 | 41 | 4C | 41 | 4E | 43 | 45 | FF | 50 | 41 | 4E | FF | 45 | 58 | 50 |
| BC90 | 52 | 45 | 53 | 53 | 49 | 4F | 4E | FF | 47 | 45 | 4E | 45 | 52 | 41 | 4C | 20 |
| BCA0 | 50 | 55 | 52 | 50 | 4F | 53 | 45 | 20 | 23 | 31 | FF | 47 | 45 | 4E | 45 | 52 |
| BCB0 | 41 | 4C | 20 | 50 | 55 | 52 | 50 | 4F | 53 | 45 | 20 | 23 | 32 | FF | 47 | 45 |
| BCC0 | 4E | 45 | 52 | 41 | 4C | 20 | 50 | 55 | 52 | 50 | 4F | 53 | 45 | 20 | 23 | 33 |
| BCD0 | FF | 47 | 45 | 4E | 45 | 52 | 41 | 4C | 20 | 50 | 55 | 52 | 50 | 4F | 53 | 45 |
| BCE0 | 20 | 23 | 34 | FF | 44 | 41 | 4D | 50 | 45 | 52 | 20 | 50 | 45 | 44 | 41 | 4C |
| BCF0 | FF | 50 | 4F | 52 | 54 | 41 | 4D | 45 | 4E | 54 | 4F | FF | 53 | 4F | 53 | 54 |
| BD00 | 45 | 4E | 55 | 54 | 4F | FF | 53 | 4F | 46 | 54 | 20 | 50 | 45 | 44 | 41 | 4C |
| BD10 | FF | 48 | 4F | 4C | 44 | 20 | 32 | FF | 47 | 45 | 4E | 45 | 52 | 41 | 4C | 20 |
| BD20 | 50 | 55 | 52 | 50 | 4F | 53 | 45 | 20 | 23 | 35 | FF | 47 | 45 | 4E | 45 | 52 |
| BD30 | 41 | 4C | 20 | 50 | 55 | 52 | 50 | 4F | 53 | 45 | 20 | 23 | 36 | FF | 47 | 45 |
| BD40 | 4E | 45 | 52 | 41 | 4C | 20 | 50 | 55 | 52 | 50 | 4F | 53 | 45 | 20 | 23 | 37 |
| BD50 | FF | 47 | 45 | 4E | 45 | 52 | 41 | 4C | 20 | 50 | 55 | 52 | 50 | 4F | 53 | 45 |
| BD60 | 20 | 23 | 38 | FF | 45 | 58 | 54 | 2E | 20 | 45 | 46 | 46 | 45 | 43 | 54 | 53 |
| BD70 | 20 | 44 | 45 | 50 | 54 | 48 | FF | 54 | 52 | 45 | 4D | 45 | 4C | 4F | 20 | 44 |

| | | | | | | | | | | | | | | | | |
|---|---|---|---|---|---|---|---|---|---|---|---|---|---|---|---|---|
| BD80 | 45 | 50 | 54 | 48 | FF | 43 | 48 | 4F | 52 | 55 | 53 | 20 | 44 | 45 | 50 | 54 |
| BD90 | 48 | FF | 43 | 45 | 4C | 45 | 53 | 54 | 45 | 20 | 44 | 45 | 50 | 54 | 48 | FF |
| BDA0 | 50 | 48 | 41 | 53 | 45 | 52 | 20 | 44 | 45 | 50 | 54 | 48 | FF | 44 | 41 | 54 |
| BDB0 | 41 | 20 | 49 | 4E | 43 | 52 | 45 | 4D | 45 | 4E | 54 | FF | 44 | 41 | 54 | 41 |
| BDC0 | 20 | 44 | 45 | 43 | 52 | 45 | 4D | 45 | 4E | 54 | FF | 4E | 4F | 4E | 2D | 52 |
| BDD0 | 45 | 47 | 2E | 20 | 50 | 41 | 52 | 41 | 4D | 20 | 4D | 53 | 42 | FF | 4E | 4F |
| BDE0 | 4E | 2D | 52 | 45 | 47 | 2E | 20 | 50 | 41 | 52 | 41 | 4D | 20 | 4C | 53 | 42 |
| BDF0 | FF | 52 | 45 | 47 | 49 | 53 | 54 | 45 | 52 | 45 | 44 | 20 | 50 | 41 | 52 | 41 |
| BE00 | 4D | 20 | 4D | 53 | 42 | FF | 52 | 45 | 47 | 49 | 53 | 54 | 45 | 52 | 45 | 44 |
| BE10 | 20 | 50 | 41 | 52 | 41 | 4D | 20 | 4C | 53 | 42 | FF | 52 | 45 | 53 | 45 | 54 |
| BE20 | 20 | 41 | 4C | 4C | 20 | 43 | 54 | 52 | 4C | 4C | 52 | 53 | FF | 53 | 45 | 51 |
| BE30 | 55 | 45 | 4E | 43 | 45 | 20 | 53 | 54 | 4F | 50 | FF | 53 | 45 | 51 | 55 | 45 |
| BE40 | 4E | 43 | 45 | 20 | 43 | 4F | 4E | 54 | 49 | 4E | 55 | 45 | FF | 53 | 45 | 51 |
| BE50 | 55 | 45 | 4E | 43 | 45 | 20 | 53 | 54 | 41 | 52 | 54 | FF | 50 | 49 | 54 | 43 |
| BE60 | 48 | 20 | 42 | 45 | 4E | 44 | FF | 4C | 4F | 43 | 41 | 4C | 20 | 43 | 4F | 4E |
| BE70 | 54 | 52 | 4F | 4C | 20 | 53 | 57 | 49 | 54 | 43 | 48 | FF | 41 | 4C | 4C | 20 |
| BE80 | 4E | 4F | 54 | 45 | 53 | 20 | 4F | 46 | 46 | FF | 4F | 4D | 4E | 49 | 20 | 4D |
| BE90 | 4F | 44 | 45 | 20 | 4F | 46 | 46 | 20 | 53 | 57 | 49 | 54 | 43 | 48 | FF | 4F |
| BEA0 | 4D | 4E | 49 | 20 | 4D | 4F | 44 | 45 | 20 | 4F | 4E | 20 | 53 | 57 | 49 | 54 |
| BEB0 | 43 | 48 | FF | 4D | 4F | 4E | 4F | 20 | 4D | 4F | 44 | 45 | 20 | 4F | 4E | 20 |
| BEC0 | 53 | 57 | 49 | 54 | 43 | 48 | FF | 50 | 4F | 4C | 59 | 20 | 4D | 4F | 44 | 45 |
| BED0 | 20 | 4F | 4E | 20 | 53 | 57 | 49 | 54 | 43 | 48 | FF | 4D | 49 | 44 | 49 | 20 |
| BEE0 | 4D | 53 | 47 | 20 | 50 | 41 | 52 | 41 | 4D | 45 | 54 | 45 | 52 | 20 | 58 | FF |
| BEF0 | 4D | 49 | 44 | 49 | 20 | 4D | 53 | 47 | 20 | 50 | 41 | 52 | 41 | 4D | 45 | 54 |
| BF00 | 45 | 52 | 20 | 59 | FF | 7D | 38 | 06 | 2A | 09 | 7C | 52 | C7 | 26 | 03 | 7C |
| BF10 | 52 | C6 | 3B | 34 | 16 | 1A | 50 | FC | 38 | 00 | 5D | 2B | 13 | 8E | 5A | ED |
| BF20 | 3A | 43 | 26 | 01 | 4C | A7 | 84 | 8E | 5B | 4D | 3A | 6C | 84 | 35 | 16 | 3B |
| BF30 | C4 | 7F | 8E | 5A | 8D | 3A | 43 | 26 | 01 | 4C | A7 | 84 | 8E | 5B | 4D | 3A |
| BF40 | A6 | 84 | 8B | 10 | A7 | 84 | 35 | 16 | 3B | A6 | E4 | 1E | 8A | 34 | 02 | F6 |
| BF50 | 5D | 80 | C4 | 7F | 8E | 5B | AD | 3A | B6 | 38 | 06 | 85 | 40 | 27 | 0D | B6 |
| BF60 | 38 | 06 | 85 | 40 | 27 | 06 | B6 | 38 | 02 | 35 | 01 | 3B | B6 | 38 | 02 | 35 |
| BF70 | 01 | A7 | 84 | CE | 5D | 5D | 37 | 88 | B6 | 5D | 7F | 27 | 14 | 7F | 5D | 7F |
| BF80 | F6 | 52 | C5 | 5A | F7 | 52 | C5 | 2A | 08 | C6 | FF | F7 | 5D | 80 | F7 | 30 |
| BF90 | 20 | 3B | 91 | 7A | 23 | 02 | 97 | 7A | 37 | 88 | 38 | 38 | 06 | 0C | 01 | FF |
| BFA0 | 34 | 12 | 8E | BF | 9A | A6 | 80 | B7 | 28 | 00 | B6 | 28 | 00 | 2B | FB | A6 |
| BFB0 | 80 | 81 | FF | 27 | 05 | B7 | 28 | 00 | 20 | F0 | 35 | 92 | 34 | 36 | 10 | 8E |
| BFC0 | 50 | 86 | C6 | 0A | 16 | 00 | 6F | 34 | 16 | 8E | 50 | 4A | 3A | 4D | 27 | 07 |
| BFD0 | CC | 4F | 4E | ED | 84 | 35 | 96 | CC | 2D | 2D | ED | 84 | 35 | 96 | 34 | 16 |
| BFE0 | 20 | 06 | 34 | 16 | 8E | 50 | 4A | 3A | 4D | 26 | E5 | CC | 4F | 46 | ED | 81 |
| BFF0 | E7 | 84 | 35 | 96 | 34 | 06 | B6 | 52 | C3 | 26 | 0E | CC | 3C | 47 | FD | 50 |
| C000 | 96 | CC | 4F | 3E | FD | 50 | 98 | 35 | 86 | CC | 2D | 4F | FD | 50 | 96 | CC |
| C010 | 4B | 2D | FD | 50 | 98 | 7A | 52 | C3 | 35 | 86 | 34 | 36 | 10 | 8E | 50 | 50 |
| C020 | C6 | 22 | 20 | 12 | 34 | 36 | 10 | 8E | 50 | 4A | C6 | 50 | 20 | 08 | 34 | 36 |
| C030 | 10 | 8E | 50 | 4A | C6 | 28 | A6 | 80 | 81 | FF | 27 | 07 | A7 | A0 | 5A | 26 |
| C040 | F5 | 35 | B6 | 86 | 20 | A7 | A0 | 5A | 26 | FB | 35 | B6 | 34 | 36 | 10 | 8E |
| C050 | 50 | 72 | 20 | E0 | BD | C2 | F1 | 8D | 02 | 20 | 41 | 34 | 36 | 10 | 8E | 50 |
| C060 | 4A | 8E | C0 | 6F | C6 | 09 | BD | 81 | 3D | AE | 62 | C6 | 47 | 20 | C7 | 2D |
| C070 | 20 | 42 | 55 | 53 | 59 | 20 | 2D | 20 | 10 | 8E | 50 | 4A | CC | 20 | 20 | ED |
| C080 | A1 | A7 | A0 | C6 | 4D | A6 | 80 | 81 | 80 | 24 | 06 | A7 | A0 | 5A | 26 | F5 |
| C090 | 39 | 86 | 20 | A7 | A0 | 5A | 26 | FB | 39 | 7F | 52 | C2 | 34 | 16 | 86 | FF |
| C0A0 | B7 | 5D | 96 | 8E | 50 | 4A | C6 | 50 | B6 | 28 | 00 | 2B | FB | 86 | 02 | B7 |
| C0B0 | 28 | 00 | B6 | 5D | 98 | 27 | 3C | B6 | 5D | 97 | 27 | 37 | B6 | 28 | 00 | 2B |
| C0C0 | FB | A6 | 88 | 50 | 27 | 08 | B6 | 5D | 96 | 2A | 03 | F7 | 5D | 96 | A6 | 88 |
| C0D0 | 50 | 27 | 16 | 2B | 04 | 30 | 01 | 20 | 0C | A6 | 80 | 84 | 7F | 81 | 20 | 26 |
| C0E0 | 04 | 86 | FF | 20 | 06 | 86 | 20 | 20 | 02 | A6 | 80 | B7 | 28 | 01 | 5A | 26 |
| C0F0 | CB | 20 | 21 | B6 | 28 | 00 | 2B | FB | B6 | 5D | 98 | 27 | 0D | A6 | 88 | 50 |

| | | | | | | | | | | | | | | | | |
|---|---|---|---|---|---|---|---|---|---|---|---|---|---|---|---|---|
| C100 | 27 | 08 | B6 | 5D | 96 | 2A | 03 | F7 | 5D | 96 | A6 | 80 | 84 | 7F | B7 | 28 |
| C110 | 01 | 5A | 26 | DF | B6 | 5D | 96 | 2B | 05 | 86 | 50 | B0 | 5D | 96 | 81 | 50 |
| C120 | 25 | 0C | B6 | 28 | 00 | 2B | FB | 86 | 0C | B7 | 28 | 00 | 20 | 28 | 81 | 28 |
| C130 | 25 | 02 | 8B | 18 | 34 | 02 | B6 | 28 | 00 | 2B | FB | 86 | 02 | B7 | 28 | 00 |
| C140 | B6 | 28 | 00 | 2B | FB | 35 | 02 | 8A | 80 | B7 | 28 | 00 | B6 | 28 | 00 | 2B |
| C150 | FB | 86 | 0E | B7 | 28 | 00 | 35 | 96 | 64 | 0A | 01 | 34 | 36 | 8E | 50 | 4A |
| C160 | 3A | 10 | 8E | C1 | 58 | 5F | A1 | A4 | 25 | 05 | 5C | A0 | A4 | 20 | F7 | 5D |
| C170 | 27 | 04 | CB | 30 | E7 | 80 | 5F | 31 | 21 | A1 | A4 | 25 | 05 | 5C | A0 | A4 |
| C180 | 20 | F7 | CB | 30 | E7 | 80 | 5F | 31 | 21 | A1 | A4 | 25 | 05 | 5C | A0 | A4 |
| C190 | 20 | F7 | CB | 30 | E7 | 84 | 35 | B6 | 34 | 26 | 10 | 8E | C1 | B0 | 44 | 44 |
| C1A0 | 44 | 44 | A6 | A6 | A7 | 80 | A6 | E4 | 84 | 0F | A6 | A6 | A7 | 80 | 35 | A6 |
| C1B0 | 30 | 31 | 32 | 33 | 34 | 35 | 36 | 37 | 38 | 39 | 41 | 42 | 43 | 44 | 45 | 46 |
| C1C0 | 34 | 16 | 81 | 63 | 22 | 24 | 5F | 81 | 0A | 25 | 05 | 5C | 80 | 0A | 20 | F7 |
| C1D0 | 34 | 02 | 7F | 5D | 8B | 5D | 27 | 08 | 1F | 98 | 8E | 5D | 8B | BD | C1 | F7 |
| C1E0 | 35 | 02 | 8E | 5D | 8C | BD | C1 | F7 | 20 | 08 | 86 | 40 | B7 | 5D | 8B | B7 |
| C1F0 | 5D | 8C | BD | C2 | 15 | 35 | 96 | 34 | 10 | 8E | C2 | 05 | 84 | 0F | A6 | 86 |
| C200 | 35 | 10 | A7 | 84 | 39 | 3F | 06 | 5B | 4F | 66 | 6D | 7D | 07 | 7F | 6F | 77 |
| C210 | 7C | 58 | 5E | 79 | 71 | 34 | 06 | FC | 5D | 8B | 84 | 7F | 7D | 5D | C7 | 27 |
| C220 | 05 | 7A | 5D | C7 | 8A | 80 | C4 | 7F | 7D | 5D | C8 | 27 | 05 | 7A | 5D | C8 |
| C230 | CA | 80 | FD | 5D | 8B | 43 | 53 | FD | 30 | 00 | B6 | 5D | 88 | 43 | B7 | 30 |
| C240 | 02 | F6 | 5D | 89 | F4 | 5D | 83 | 34 | 04 | B6 | 5D | 97 | 27 | 0B | B6 | 5D |
| C250 | 89 | 43 | 32 | 61 | B7 | 30 | 03 | 35 | 86 | B6 | 5D | 89 | BA | 5D | 83 | 43 |
| C260 | A8 | E0 | B7 | 30 | 03 | 35 | 86 | 34 | 16 | B6 | 52 | 86 | 27 | 0E | 81 | 01 |
| C270 | 27 | 05 | F6 | 52 | 94 | 20 | 08 | F6 | 52 | 92 | 20 | 03 | F6 | 52 | 90 | 26 |
| C280 | 02 | 35 | 96 | 5A | 4F | 58 | 49 | 30 | 8B | EC | 84 | 8D | 02 | 35 | 96 | 34 |
| C290 | 10 | 81 | 64 | 25 | 0E | 80 | 64 | 34 | 02 | 8E | 50 | 4A | A6 | 86 | BD | C3 |
| C2A0 | 7D | 35 | 02 | 34 | 06 | 86 | 01 | C1 | 01 | 26 | 02 | 86 | FF | 34 | 02 | 8D |
| C2B0 | 2A | EC | 61 | 8E | 50 | 9A | 30 | 86 | A6 | E4 | A7 | 80 | 5A | 26 | FB | 32 |
| C2C0 | 61 | 35 | 96 | 34 | 06 | 8D | 2A | CC | 01 | 01 | FD | 50 | 9A | 20 | 12 | 34 |
| C2D0 | 06 | 8D | 1E | CC | 01 | 01 | FD | 50 | E7 | 20 | 06 | 34 | 06 | 8D | 12 | 86 |
| C2E0 | 01 | B7 | 5D | 98 | 7F | 5D | 97 | FC | 52 | C6 | 8B | 03 | FD | 5D | 99 | 35 |
| C2F0 | 86 | 34 | 16 | 4F | C6 | 50 | 8E | 50 | 9A | A7 | 80 | 5A | 26 | FB | 35 | 96 |
| C300 | B6 | 5D | 98 | 26 | 01 | 39 | FC | 52 | C6 | 10 | B3 | 5D | 99 | 22 | 01 | 39 |
| C310 | B6 | 5D | 97 | 26 | 15 | 7C | 5D | 97 | BD | C0 | 9C | BD | C2 | 15 | FC | 52 |
| C320 | C6 | C3 | 01 | 04 | C4 | 80 | FD | 5D | 99 | 39 | 7F | 5D | 97 | BD | C0 | 9C |
| C330 | BD | C2 | 15 | FC | 52 | C6 | C3 | 02 | 09 | C4 | 80 | FD | 5D | 99 | 39 | FC |
| C340 | 52 | C6 | 10 | B3 | 5D | 99 | 22 | 0C | B6 | 5D | C7 | BA | 5D | C8 | 27 | 03 |
| C350 | BD | C2 | 15 | 39 | B6 | 5D | 97 | 26 | 12 | 7C | 5D | 97 | BD | C2 | 15 | FC |
| C360 | 52 | C6 | C3 | 01 | 04 | C4 | 80 | FD | 5D | 99 | 39 | 7F | 5D | 97 | BD | C2 |
| C370 | 15 | FC | 52 | C6 | C3 | 02 | 09 | C4 | 80 | FD | 5D | 99 | 39 | 34 | 06 | B7 |
| C380 | 50 | 98 | 80 | 20 | C6 | 48 | BD | C1 | 5B | CC | 20 | 3D | FD | 50 | 94 | CC |
| C390 | 20 | 22 | FD | 50 | 96 | F7 | 50 | 99 | 35 | 86 | 6E | 9F | 50 | 1B | 4F | 34 |
| C3A0 | 02 | F6 | 00 | 00 | 2A | 5C | 6C | E4 | C5 | 02 | 27 | 25 | BE | 52 | CB | BC |
| C3B0 | 52 | CD | 27 | 1D | A6 | 80 | B7 | 00 | 01 | 8C | 53 | 4F | 25 | 03 | 8E | 52 |
| C3C0 | CF | BF | 52 | CB | 7C | 52 | CA | BC | 52 | CD | 26 | 05 | 86 | 95 | B7 | 00 |
| C3D0 | 00 | C5 | 70 | 27 | 0D | B6 | 00 | 01 | C4 | 7C | FA | 5D | C3 | F7 | 5D | C3 |
| C3E0 | 20 | 20 | C5 | 01 | 27 | 1C | B6 | 5D | C7 | 4C | 27 | 03 | B7 | 5D | C7 | B6 |
| C3F0 | 00 | 01 | BE | 54 | E0 | A7 | 80 | 8C | 55 | E2 | 25 | 03 | 8E | 54 | E2 | BF |
| C400 | 54 | E0 | F6 | 08 | 00 | 2A | 5C | 6C | E4 | C5 | 02 | 27 | 25 | BE | 53 | 50 |
| C410 | BC | 53 | 52 | 27 | 1D | A6 | 80 | B7 | 08 | 01 | 8C | 53 | D4 | 25 | 03 | 8E |
| C420 | 53 | 54 | BF | 53 | 50 | 7C | 53 | 4F | BC | 53 | 52 | 26 | 05 | 86 | 95 | B7 |
| C430 | 08 | 00 | C5 | 70 | 27 | 0D | B6 | 08 | 01 | C4 | 7C | FA | 5D | C3 | F7 | 5D |
| C440 | C3 | 20 | 20 | C5 | 01 | 27 | 1C | B6 | 5D | C8 | 4C | 27 | 03 | B7 | 5D | C8 |
| C450 | B6 | 08 | 01 | BE | 55 | E4 | A7 | 80 | 8C | 56 | E6 | 25 | 03 | 8E | 55 | E6 |
| C460 | BF | 55 | E4 | B6 | 10 | 00 | 2A | 22 | 6C | E4 | BE | 53 | D5 | A6 | 80 | B7 |
| C470 | 10 | 01 | 8C | 54 | 59 | 25 | 03 | 8E | 53 | D9 | BF | 53 | D5 | 7C | 53 | D4 |

| | | | | | | | | | | | | | | | | |
|---|---|---|---|---|---|---|---|---|---|---|---|---|---|---|---|---|
| C480 | BC | 53 | D7 | 26 | 05 | 86 | 15 | B7 | 10 | 00 | B6 | 18 | 00 | 2A | 22 | 6C |
| C490 | E4 | BE | 54 | 5A | A6 | 80 | B7 | 18 | 01 | 8C | 54 | DE | 25 | 03 | 8E | 54 |
| C4A0 | 5E | BF | 54 | 5A | 7C | 54 | 59 | BC | 54 | 5C | 26 | 05 | 86 | 15 | B7 | 18 |
| C4B0 | 00 | A6 | E0 | 26 | 08 | B6 | 20 | 00 | 8A | 80 | B7 | 5D | D8 | 3B | 34 | 77 |
| C4C0 | CE | C4 | C5 | 37 | 80 | C4 | CF | C5 | 45 | C5 | BB | C6 | 31 | C6 | A5 | 34 |
| C4D0 | 22 | 7D | 52 | CA | 26 | 05 | BD | D5 | D8 | 20 | F6 | 1A | 10 | BE | 52 | CD |
| C4E0 | 20 | 48 | 34 | 22 | B6 | 52 | CA | 81 | 02 | 24 | 05 | BD | D5 | D8 | 20 | F4 |
| C4F0 | 1A | 10 | BE | 52 | CD | 20 | 22 | 34 | 22 | B6 | 52 | CA | 81 | 03 | 24 | 05 |
| C500 | BD | D5 | D8 | 20 | F4 | 1A | 10 | BE | 52 | CD | A6 | A0 | A7 | 80 | 8C | 53 |
| C510 | 4F | 25 | 03 | 8E | 52 | CF | 7A | 52 | CA | A6 | A0 | A7 | 80 | 8C | 53 | 4F |
| C520 | 25 | 03 | 8E | 52 | CF | 7A | 52 | CA | A6 | A0 | A7 | 80 | 8C | 53 | 4F | 25 |
| C530 | 03 | 8E | 52 | CF | 7A | 52 | CA | BF | 52 | CD | 86 | B5 | B7 | 00 | 00 | 35 |
| C540 | 22 | 1C | EF | 37 | 80 | 34 | 22 | 7D | 53 | 4F | 26 | 05 | BD | D5 | D8 | 20 |
| C550 | F6 | 1A | 10 | BE | 53 | 52 | 20 | 48 | 34 | 22 | B6 | 53 | 4F | 81 | 02 | 24 |
| C560 | 05 | BD | D5 | D8 | 20 | F4 | 1A | 10 | BE | 53 | 52 | 20 | 22 | 34 | 22 | B6 |
| C570 | 53 | 4F | 81 | 03 | 24 | 05 | BD | D5 | D8 | 20 | F4 | 1A | 10 | BE | 53 | 52 |
| C580 | A6 | A0 | A7 | 80 | 8C | 53 | D4 | 25 | 03 | 8E | 53 | 54 | 7A | 53 | 4F | A6 |
| C590 | A0 | A7 | 80 | 8C | 53 | D4 | 25 | 03 | 8E | 53 | 54 | 7A | 53 | 4F | A6 | A0 |
| C5A0 | A7 | 80 | 8C | 53 | D4 | 25 | 03 | 8E | 53 | 54 | 7A | 53 | 4F | BF | 53 | 52 |
| C5B0 | 86 | B5 | B7 | 08 | 00 | 35 | 22 | 1C | EF | 37 | 80 | 34 | 22 | 7D | 53 | D4 |
| C5C0 | 26 | 05 | BD | D5 | D8 | 20 | F6 | 1A | 10 | BE | 53 | D7 | 20 | 48 | 34 | 22 |
| C5D0 | B6 | 53 | D4 | 81 | 02 | 24 | 05 | BD | D5 | D8 | 20 | F4 | 1A | 10 | BE | 53 |
| C5E0 | D7 | 20 | 22 | 34 | 22 | B6 | 53 | D4 | 81 | 03 | 24 | 05 | BD | D5 | D8 | 20 |
| C5F0 | F4 | 1A | 10 | BE | 53 | D7 | A6 | A0 | A7 | 80 | 8C | 54 | 59 | 25 | 03 | 8E |
| C600 | 53 | D9 | 7A | 53 | D4 | A6 | A0 | A7 | 80 | 8C | 54 | 59 | 25 | 03 | 8E | 53 |
| C610 | D9 | 7A | 53 | D4 | A6 | A0 | A7 | 80 | 8C | 54 | 59 | 25 | 03 | 8E | 53 | D9 |
| C620 | 7A | 53 | D4 | BF | 53 | D7 | 86 | 35 | B7 | 10 | 00 | 35 | 22 | 1C | EF | 37 |
| C630 | 80 | 34 | 22 | 7D | 54 | 59 | 26 | 05 | BD | D5 | D8 | 20 | F6 | 1A | 10 | BE |
| C640 | 54 | 5C | 20 | 48 | 34 | 22 | B6 | 54 | 59 | 81 | 02 | 24 | 05 | BD | D5 | D8 |
| C650 | 20 | F4 | 1A | 10 | BE | 54 | 5C | 20 | 22 | 34 | 22 | B6 | 54 | 59 | 81 | 03 |
| C660 | 24 | 05 | BD | D5 | D8 | 20 | F4 | 1A | 10 | BE | 54 | 5C | A6 | A0 | A7 | 80 |
| C670 | 8C | 54 | DE | 25 | 03 | 8E | 54 | 5E | 7A | 54 | 59 | A6 | A0 | A7 | 80 | 8C |
| C680 | 54 | DE | 25 | 03 | 8E | 54 | 5E | 7A | 54 | 59 | A6 | A0 | A7 | 80 | 8C | 54 |
| C690 | DE | 25 | 03 | 8E | 54 | 5E | 7A | 54 | 59 | BF | 54 | 5C | 86 | 35 | B7 | 18 |
| C6A0 | 00 | 35 | 22 | 1C | EF | 35 | F7 | 8D | 03 | 7E | C7 | 3C | 1A | 10 | BE | 54 |
| C6B0 | DE | BC | 54 | E0 | 26 | 03 | 1C | EF | 39 | A6 | 80 | 8C | 55 | E2 | 25 | 03 |
| C6C0 | 8E | 54 | E2 | BF | 54 | DE | 8E | C6 | E9 | BF | 50 | 1D | 10 | FF | 5A | 86 |
| C6D0 | 10 | FE | 5A | 88 | 20 | 2A | BE | 50 | 1D | 8C | C6 | E9 | 10 | 26 | 00 | 86 |
| C6E0 | 10 | CE | 5D | 1B | BD | C6 | E9 | 20 | F7 | 1A | 10 | BE | 54 | DE | BC | 54 |
| C6F0 | E0 | 27 | 3E | A6 | 80 | 8C | 55 | E2 | 25 | 03 | 8E | 54 | E2 | BF | 54 | DE |
| C700 | 1C | EF | 4D | 2B | 01 | 39 | 81 | F0 | 24 | 23 | 10 | CE | 5D | 1B | B7 | 50 |
| C710 | 21 | 7D | 52 | 87 | 2B | 07 | 84 | 0F | B1 | 52 | 87 | 26 | C3 | F6 | 50 | 21 |
| C720 | C4 | 70 | 54 | 54 | 54 | 8E | 50 | 24 | B6 | 50 | 21 | 6E | 95 | 6E | 9F | 50 |
| C730 | 32 | 10 | FF | 5A | 88 | 10 | FE | 5A | 86 | 1C | EF | 39 | 1A | 10 | BE | 55 |
| C740 | E2 | BC | 55 | E4 | 26 | 03 | 1C | EF | 39 | A6 | 80 | 8C | 56 | E6 | 25 | 03 |
| C750 | 8E | 55 | E6 | BF | 55 | E2 | 8E | C7 | 6F | BF | 50 | 1D | 10 | FF | 5A | 86 |
| C760 | 10 | FE | 5A | 8A | 20 | 20 | 10 | CE | 5D | 5B | BD | C7 | 6F | 20 | F7 | 1A |
| C770 | 10 | BE | 55 | E2 | BC | 55 | E4 | 27 | 3E | A6 | 80 | 8C | 56 | E6 | 25 | 03 |
| C780 | 8E | 55 | E6 | BF | 55 | E2 | 1C | EF | 4D | 2B | 01 | 39 | 81 | F0 | 24 | 23 |
| C790 | 10 | CE | 5D | 5B | B7 | 50 | 22 | 7D | 52 | 88 | 2B | 07 | 84 | 0F | B1 | 52 |
| C7A0 | 88 | 26 | C3 | F6 | 50 | 22 | C4 | 70 | 54 | 54 | 54 | 8E | 50 | 34 | B6 | 50 |
| C7B0 | 22 | 6E | 95 | 6E | 9F | 50 | 42 | 10 | FF | 5A | 8A | 10 | FE | 5A | 86 | 1C |
| C7C0 | EF | 39 | B7 | 50 | 44 | BD | C6 | E9 | B7 | 50 | 45 | BD | C6 | E9 | B7 | 50 |
| C7D0 | 46 | 8E | 50 | 44 | BD | C8 | 41 | 20 | EC | B7 | 50 | 47 | BD | C7 | 6F | B7 |
| C7E0 | 50 | 48 | BD | C7 | 6F | B7 | 50 | 49 | 8E | 50 | 47 | BD | C8 | 68 | 20 | EC |
| C7F0 | AD | 9F | 50 | 1D | 81 | 64 | 24 | F8 | B7 | 52 | 98 | 20 | F3 | B7 | 50 | 44 |

```
C800   BD C6 E9 B7 50 45 8E 50   44 BD C8 41 20 F2 B7 50
C810   47 BD C7 6F B7 50 48 8E   50 47 BD C8 68 20 F2 B7
C820   50 44 BD C6 E9 B7 50 45   8E 50 44 BD C8 41 20 F2
C830   B7 50 47 BD C7 6F B7 50   48 8E 50 47 BD C8 68 20
C840   F2 B6 50 17 85 08 27 16   B6 52 87 84 0F 34 02 B6
C850   50 21 A0 E0 84 0F 81 07   22 03 BD C8 82 39 4F BD
C860   C8 82 4C 81 07 23 F8 39   B6 50 17 85 10 27 EF B6
C870   52 88 84 0F 34 02 B6 50   22 A0 E0 84 0F 81 07 23

C880   D9 39 34 36 10 8E D2 0D   F6 50 15 53 F4 5D 88 E5
C890   A6 26 02 35 B6 B7 52 83   8B 40 1F 8B A6 84 84 F0
C8A0   81 C0 10 27 00 C4 81 D0   10 27 00 A5 81 B0 10 24
C8B0   00 88 E6 01 C0 15 10 2B   00 7E BD D9 77 10 25 00
C8C0   77 0D 78 27 04 D6 79 20   04 DB 21 2B 6B A6 84 0D
C8D0   1E 2A 04 84 F0 9A 3B FD   52 BF E6 02 84 F0 81 A0
C8E0   27 49 81 90 26 03 5D 27   13 10 9E 66 E6 A5 C4 7F
C8F0   81 90 26 1C D1 6D 22 40   D1 6E 25 3C F7 52 C1 BD

C900   D0 CA 10 9E 64 F6 52 C0   31 A5 6C A9 00 80 35 B6
C910   F7 52 C1 BD D0 CA 10 9E   64 F6 52 C0 31 A5 A6 A9
C920   00 80 27 14 4A A7 A9 00   80 35 B6 10 9E 68 E6 A5
C930   C4 7F F7 52 C1 BD D0 CA   35 B6 EC 84 0D 1E 2A 04
C940   84 F0 9A 3B FD 52 BF A6   02 B7 52 C1 BD D0 CA 35
C950   B6 EC 84 0D 1E 2A 04 84   F0 9A 3B 10 9E 68 E6 A5
C960   C4 7F FD 52 BF BD D0 BE   35 B6 96 1E 85 40 27 10
C970   EC 84 0D 1E 2A 04 84 F0   9A 3B FD 52 BF BD D0 BE

C980   35 B6 84 0F 48 8E C9 96   6E 96 84 0F 10 27 FD 46
C990   48 8E C9 96 6E 96 C9 D1   C6 D6 C6 D6 C6 D6 C6 D6
C9A0   C6 D6 C9 CD C6 D6 C9 CD   C9 CD C9 B6 C9 B6 C9 B6
C9B0   C9 CD C9 CD C9 CD 44 8A   F0 F6 52 8D BE 50 1D 8C
C9C0   C6 E9 27 03 F6 52 8E 5D   27 03 BD C4 BE 35 10 6E
C9D0   1D AD 9F 50 1D 81 7E 27   30 4D 26 4C AD 9F 50 1D
C9E0   4D 26 45 AD 9F 50 1D 81   24 26 3D AD 9F 50 1D 81
C9F0   01 26 35 B7 5D C5 AD 9F   50 1D BD CB FA 81 0A 10

CA00   22 FC D3 48 8E CA 51 6E   96 AD 9F 50 1D AD 9F 50
CA10   1D 81 06 26 10 AD 9F 50   1D 81 01 26 08 10 8E 81
CA20   1F 4F BD 8D 94 16 FC AE   8E 6E 00 BD CC 04 A7 80
CA30   BF 5D C9 AD 9F 50 1D BE   5D C9 8C 6F FF 25 08 86
CA40   01 B7 5D C4 16 FC 8F BD   CC 04 A7 80 BF 5D C9 20
CA50   E2 CB 72 CA 67 CC E6 CB   05 CC A7 CA CC CD 35 CB
CA60   3B CC 90 C6 D6 CD 72 7F   5D C9 AD 9F 50 1D BD CB
CA70   FA 81 63 10 22 FC 5F BD   8B 98 6D A8 17 10 2B FC

CA80   55 B7 5D CB BD CB E2 34   02 B6 5D CB BD 8B 98 F6
CA90   5D C9 4F 31 AB 35 02 A7   A4 5C F7 5D C9 26 E5 BD
CAA0   CB E2 34 02 B6 5D CB BD   8B BE F6 5D C9 35 02 A7
CAB0   A5 5C F7 5D C9 C1 1F 23   E6 AD 9F 50 1D C6 01 B1
CAC0   5D C5 27 02 C6 FF F7 5D   C4 7E C6 D6 AD 9F 50 1D
CAD0   BD CB FA 81 0C 10 22 FB   FD C6 03 3D 8E CB 82 30
CAE0   8B EC 84 FD 5D C9 E6 02   F7 5D CB AD 9F 50 1D BD
CAF0   CB FA BD CC 04 BE 5D C9   A7 80 BF 5D C9 F6 5D CB

CB00   5A 26 E5 20 B4 AD 9F 50   1D BD CB FA 81 12 10 22
CB10   FB C4 C6 03 3D 8E CB A9   30 8B EC 84 FD 5D C9 E6
CB20   02 F7 5D CB BD CB E2 BD   CC 04 BE 5D C9 A7 80 BF
CB30   5D C9 F6 5D CB 5A 26 E9   16 FF 7E AD 9F 50 1D BD
CB40   CB FA 34 02 86 70 BD 8B   98 35 02 84 1F C6 18 3D
CB50   31 AB 10 BF 5D C9 C6 18   F7 5D CB BD CB E2 BD CC
CB60   04 BE 5D C9 A7 80 BF 5D   C9 F6 5D CB 5A 26 E9 16
CB70   FF 47 AD 9F 50 1D 81 63   10 22 FB 5A BD CC 62 16
```

| | | | | | | | | | | | | | | | | |
|---|---|---|---|---|---|---|---|---|---|---|---|---|---|---|---|---|
| CB80 | FB | 54 | 56 | E6 | 64 | 50 | EA | 08 | 50 | F2 | 08 | 50 | FA | 08 | 51 | 02 |
| CB90 | 80 | 51 | 82 | 80 | 52 | 02 | 80 | 50 | 4A | 50 | 52 | 8F | 07 | 52 | 98 | 01 |
| CBA0 | 52 | C2 | 01 | 5D | A6 | 06 | 5D | 9D | 06 | 57 | 4A | 03 | 67 | 00 | 00 | 50 |
| CBB0 | 00 | 18 | 40 | 00 | 00 | 41 | 00 | 00 | 42 | 00 | 00 | 43 | 00 | 00 | 44 | 00 |
| CBC0 | 00 | 45 | 00 | 00 | 46 | 00 | 00 | 47 | 00 | 00 | 6D | 00 | 6E | 6D | 80 | 64 |
| CBD0 | 50 | 9A | 50 | 5D | 88 | 05 | 52 | 87 | 06 | 57 | 4D | 18 | 5D | DD | 00 | 5E |
| CBE0 | DD | 00 | AD | 9F | 50 | 1D | 8D | 12 | 84 | 0F | B7 | 5D | CC | AD | 9F | 50 |
| CBF0 | 1D | 8D | 07 | 48 | 84 | F0 | BA | 5D | CC | 39 | 34 | 02 | B8 | 5D | C5 | B7 |
| CC00 | 5D | C5 | 35 | 82 | 34 | 02 | B6 | 5D | 81 | 8A | 03 | B7 | 5D | 81 | B7 | 30 |
| CC10 | 28 | 35 | 82 | 34 | 02 | 86 | F0 | BD | C4 | BE | 4F | BD | C4 | BE | BD | C4 |
| CC20 | BE | 86 | 24 | BD | C4 | BE | 86 | 01 | BD | C4 | BE | B7 | 5D | C6 | A6 | E4 |
| CC30 | 84 | 7F | 8D | 13 | 35 | 82 | 34 | 02 | B6 | 5D | C6 | 84 | 7F | BD | C4 | BE |
| CC40 | 86 | F7 | BD | C4 | BE | 35 | 82 | BD | C4 | BE | B8 | 5D | C6 | B7 | 5D | C6 |
| CC50 | 39 | 34 | 02 | 84 | 0F | BD | CC | 47 | A6 | E4 | 44 | 84 | 78 | BD | CC | 47 |
| CC60 | 35 | 82 | 34 | 36 | BD | 8B | 98 | 86 | 01 | BD | CC | 13 | A6 | E4 | 84 | 7F |
| CC70 | BD | CC | 47 | 5F | A6 | A0 | BD | CC | 51 | 5A | 26 | F8 | C6 | 20 | A6 | E4 |
| CC80 | BD | 8B | BE | A6 | A0 | BD | CC | 51 | 5A | 26 | F8 | BD | CC | 36 | 35 | B6 |
| CC90 | 86 | 09 | BD | CC | 13 | 8E | 80 | 8D | C6 | 28 | A6 | 80 | 84 | 7F | BD | CC |
| CCA0 | 47 | 5A | 26 | F6 | 16 | FF | 8F | AD | 9F | 50 | 1D | 81 | 0C | 10 | 22 | FA |
| CCB0 | 25 | 8D | 04 | 16 | FA | 20 | 4F | 34 | 02 | 86 | 05 | BD | CC | 13 | A6 | E4 |
| CCC0 | 84 | 7F | BD | CC | 47 | 35 | 02 | 84 | 7F | C6 | 03 | 3D | 8E | CB | 82 | 30 |
| CCD0 | 8B | 10 | AE | 84 | E6 | 02 | BD | CC | 04 | A6 | A0 | 84 | 7F | BD | CC | 47 |
| CCE0 | 5A | 26 | F6 | 16 | FF | 50 | AD | 9F | 50 | 1D | 81 | 12 | 10 | 22 | F9 | E6 |
| CCF0 | 8D | 05 | 16 | F9 | E1 | 86 | 0C | 34 | 02 | 86 | 03 | BD | CC | 13 | A6 | E4 |
| CD00 | 84 | 7F | BD | CC | 47 | 35 | 02 | 84 | 7F | C6 | 03 | 3D | 8E | CB | A9 | 30 |
| CD10 | 8B | 10 | AE | 84 | E6 | 02 | BD | CC | 04 | A6 | A0 | BD | CC | 51 | 5A | 26 |
| CD20 | F8 | 16 | FF | 12 | 34 | 36 | 4C | 34 | 02 | BD | CC | B7 | 35 | 02 | 8B | 03 |
| CD30 | BD | CC | B7 | 35 | B6 | AD | 9F | 50 | 1D | BD | CB | FA | 81 | 1F | 10 | 22 |
| CD40 | F9 | 94 | 8D | 03 | 16 | F9 | 8F | 34 | 36 | 86 | 07 | BD | CC | 13 | A6 | E4 |
| CD50 | 84 | 1F | BD | CC | 47 | 86 | 70 | BD | 8B | 98 | A6 | E4 | 84 | 1F | C6 | 18 |
| CD60 | 3D | 31 | AB | C6 | 18 | A6 | A0 | BD | CC | 51 | 5A | 26 | F8 | BD | CC | 36 |
| CD70 | 35 | B6 | AD | 9F | 50 | 1D | BA | 5D | 8E | B7 | 5D | 8E | AD | 9F | 50 | 1D |
| CD80 | 48 | BA | 5D | 8E | B7 | 5D | 8E | AD | 9F | 50 | 1D | BA | 5D | 8F | B7 | 5D |
| CD90 | 8F | 16 | F9 | 42 | 34 | 76 | B7 | 52 | 99 | 20 | 08 | 34 | 76 | B7 | 52 | 99 |
| CDA0 | BD | 8B | 35 | B6 | 5D | C2 | 27 | 0B | 86 | 64 | BD | 88 | 70 | B6 | 52 | 85 |
| CDB0 | B7 | 52 | 84 | B6 | 52 | 99 | 84 | 7F | B7 | 52 | 99 | B7 | 52 | 85 | BD | C1 |
| CDC0 | C0 | B6 | 52 | 99 | BD | 8B | BE | 1F | 23 | B6 | 52 | 99 | BD | 8B | 98 | 8E |
| CDD0 | 50 | 00 | C6 | 18 | BD | 81 | 32 | B6 | 50 | 13 | B7 | 5D | 88 | 4F | BD | 8B |
| CDE0 | FB | BD | 89 | 3B | 1F | B8 | 5F | 1F | 01 | C6 | 1D | BD | 81 | 32 | BD | 89 |
| CDF0 | 48 | C6 | 04 | A6 | C0 | A7 | 80 | 5A | 26 | F9 | BD | D1 | 72 | B6 | 52 | 83 |
| CE00 | 4C | 81 | 07 | 23 | D9 | 86 | 65 | BD | 88 | 70 | 35 | F6 | 7F | 5D | DA | B6 |
| CE10 | 5D | 88 | B4 | 50 | 15 | B7 | 52 | 82 | B7 | 5A | 8C | BD | C2 | 15 | B6 | 50 |
| CE20 | 11 | BD | D2 | 21 | B7 | 5D | 78 | B6 | 50 | 12 | BD | D2 | 21 | B7 | 5D | 79 |
| CE30 | BD | D2 | B0 | B6 | 50 | 14 | 43 | B7 | 30 | 10 | BD | D2 | DF | 8E | 50 | 24 |
| CE40 | B6 | 52 | 89 | 2A | 40 | 85 | 01 | 27 | 05 | CE | C7 | F0 | EF | 08 | 85 | 02 |
| CE50 | 27 | 05 | CE | C7 | FD | EF | 08 | CE | C7 | C2 | B6 | 50 | 16 | 10 | 8E | D2 |
| CE60 | 0D | A5 | A4 | 27 | 04 | EF | 84 | EF | 02 | 5F | A5 | 22 | 27 | 01 | 5C | F7 |
| CE70 | 52 | 8D | A5 | 21 | 27 | 04 | EF | 06 | EF | 0C | A5 | 23 | 27 | 07 | EF | 04 |
| CE80 | CE | C8 | 1F | EF | 0A | 8E | 50 | 34 | B6 | 52 | 8A | 2A | 40 | 85 | 01 | 27 |
| CE90 | 05 | CE | C7 | F0 | EF | 08 | 85 | 02 | 27 | 05 | CE | C8 | 0E | EF | 08 | CE |
| CEA0 | C7 | D9 | B6 | 50 | 16 | 10 | 8E | D2 | 11 | A5 | A4 | 27 | 04 | EF | 84 | EF |
| CEB0 | 02 | 5F | A5 | 22 | 27 | 01 | 5C | F7 | 52 | 8E | A5 | 21 | 27 | 04 | EF | 06 |
| CEC0 | EF | 0C | A5 | 23 | 27 | 07 | EF | 04 | CE | C8 | 30 | EF | 0A | 4F | BD | 8B |
| CED0 | FB | 8E | D2 | 0D | E6 | 86 | D7 | 6C | 1F | B8 | 5F | DD | 64 | C3 | 08 | 00 |
| CEE0 | DD | 66 | C3 | 00 | 80 | DD | 68 | 96 | 77 | 43 | 97 | 77 | C6 | 23 | 4F | D3 |
| CEF0 | 64 | DD | 6A | 8E | 5D | B8 | 96 | 0B | 91 | 0C | 22 | 06 | D6 | 0C | D7 | 0B |

| | | | | | | | | | | | | | | | | |
|---|---|---|---|---|---|---|---|---|---|---|---|---|---|---|---|---|
| CF00 | 97 | 0C | 10 | 8E | 00 | 00 | 6F | 84 | 96 | 0A | A4 | A9 | D2 | 0D | 27 | 12 |
| CF10 | B6 | 50 | 14 | 43 | A4 | A9 | D2 | 15 | A1 | A9 | D2 | 15 | 27 | 04 | 86 | 01 |
| CF20 | A7 | 84 | 31 | 21 | 30 | 01 | 10 | 8C | 00 | 04 | 25 | DA | DE | 6A | B6 | 5D |
| CF30 | B8 | 27 | 10 | CC | C4 | F7 | ED | C8 | 10 | CC | C4 | E2 | ED | 48 | CC | C4 |
| CF40 | CF | ED | C1 | B6 | 5D | B9 | 27 | 10 | CC | C5 | 6D | ED | C8 | 10 | CC | C5 |
| CF50 | 58 | ED | 48 | CC | C5 | 45 | ED | C1 | B6 | 5D | BA | 27 | 10 | CC | C5 | E3 |
| CF60 | ED | C8 | 10 | CC | C5 | CE | ED | 48 | CC | C5 | BB | ED | C1 | B6 | 5D | BB |
| CF70 | 26 | 0C | CC | C6 | A5 | ED | C4 | ED | 48 | ED | C8 | 10 | 20 | 10 | CC | C6 |
| CF80 | 59 | ED | C8 | 10 | CC | C6 | 44 | ED | 48 | CC | C6 | 31 | ED | C4 | DE | 64 |
| CF90 | C6 | 3C | 4F | 33 | CB | B6 | 50 | 17 | 85 | 20 | 10 | 27 | 00 | B2 | 10 | 9E |
| CFA0 | 64 | 4F | C6 | 17 | 31 | AB | 5F | A6 | A5 | 81 | 86 | 24 | 53 | 81 | 79 | 25 |
| CFB0 | 38 | 81 | 80 | 27 | 1F | 81 | 84 | 25 | 47 | B7 | 5F | E1 | 8E | D2 | 0D | A6 |
| CFC0 | 85 | 8E | DA | 86 | 95 | 1D | 27 | 03 | 8E | DA | 8A | B6 | 5F | E1 | AF | C1 |
| CFD0 | ED | C1 | 20 | 2C | 8E | D2 | 0D | A6 | 85 | 8E | DA | 58 | 95 | 1D | 27 | 03 |
| CFE0 | 8E | DA | 5C | AF | C1 | E7 | C0 | 20 | 17 | 8E | D2 | 0D | 34 | 02 | A6 | 85 |
| CFF0 | 8E | DA | 29 | 95 | 1D | 27 | 03 | 8E | DA | 2D | 35 | 02 | AF | C1 | ED | C1 |
| D000 | 5C | C1 | 05 | 23 | A2 | 10 | 9E | 64 | 4F | C6 | 14 | 31 | AB | 5F | A6 | A5 |
| D010 | 81 | E8 | 24 | 2E | 81 | C8 | 25 | 05 | 8E | D9 | FD | 20 | 21 | 81 | 84 | 24 |
| D020 | 21 | 81 | 80 | 27 | 1D | 81 | 79 | 27 | 0D | 81 | 7A | 23 | 0E | 81 | 7F | 23 |
| D030 | 05 | 8E | D9 | D8 | 20 | 08 | 8E | D9 | B1 | 20 | 03 | 8E | D9 | 85 | AF | C1 |
| D040 | ED | C1 | 5C | C1 | 02 | 23 | C7 | 96 | 73 | 27 | 05 | 8E | DA | C3 | AF | C1 |
| D050 | 8E | D8 | 0C | AF | C4 | 96 | 6F | B8 | 5D | 7E | 97 | 7D | 86 | 15 | 9B | 12 |
| D060 | BB | 50 | 10 | 97 | 21 | 86 | 3C | 9B | 12 | 97 | 79 | 96 | 20 | 84 | 7F | D6 |
| D070 | 1F | C4 | 7F | DD | 7E | 9E | 66 | 96 | 71 | 84 | 0F | BD | D2 | 4D | 9E | 68 |
| D080 | 96 | 70 | 84 | 0F | BD | D2 | 31 | 96 | 72 | 26 | 09 | 96 | 6C | 43 | B4 | 5A |
| D090 | 8C | B7 | 5A | 8C | B6 | 52 | 83 | 4C | 81 | 07 | 10 | 23 | FE | 30 | B6 | 38 |
| D0A0 | 05 | 43 | B7 | 5D | C1 | C6 | 08 | 8E | 52 | 9F | 10 | 8E | 52 | AF | A6 | 80 |
| D0B0 | 8B | 40 | A7 | A0 | 5A | 26 | F7 | 39 | 34 | 77 | DE | 6A | 37 | 80 | 34 | 77 |
| D0C0 | 10 | 8E | 52 | BF | DE | 6A | 33 | 48 | 37 | 80 | 34 | 77 | 10 | 8E | 52 | BF |
| D0D0 | DE | 6A | 33 | C8 | 10 | 37 | 80 | 34 | 36 | 1F | B8 | 5F | 1F | 01 | D6 | 70 |
| D0E0 | 58 | 58 | 58 | 58 | D7 | 70 | 58 | 96 | 6D | 49 | 10 | 8E | 00 | 08 | E6 | 84 |
| D0F0 | 58 | 48 | 56 | E7 | 80 | 31 | 3F | 26 | F5 | 96 | 6E | 10 | 8E | 00 | 07 | 48 |
| D100 | E6 | 84 | 58 | 48 | 56 | E7 | 80 | 31 | 3F | 26 | F5 | 96 | 71 | 48 | 48 | 48 |
| D110 | 48 | 10 | 8E | 00 | 04 | E6 | 84 | 58 | 48 | 56 | E7 | 80 | 31 | 3F | 26 | F5 |
| D120 | 96 | 6F | 48 | 48 | 48 | 84 | 70 | 34 | 02 | 96 | 0A | 84 | 8F | AA | E0 | 97 |
| D130 | 0A | 96 | 70 | 84 | 70 | 34 | 02 | 96 | 0D | 84 | 80 | 9A | 3B | AA | E0 | 97 |
| D140 | 0D | D6 | 1D | CA | C0 | C4 | BF | 96 | 78 | 26 | 02 | C4 | 7F | D7 | 1D | 1F |
| D150 | B9 | C0 | 40 | 58 | 8E | 50 | 00 | 3A | A6 | 84 | 84 | 7F | D6 | 72 | 27 | 02 |
| D160 | 8A | 80 | A7 | 80 | A6 | 84 | 84 | 7F | D6 | 73 | 27 | 02 | 8A | 80 | A7 | 84 |
| D170 | 35 | B6 | 34 | 36 | 1F | B8 | 5F | 1F | 01 | 10 | 8E | 00 | 08 | 5F | A6 | 84 |
| D180 | 48 | 59 | 44 | A7 | 80 | 31 | 3F | 26 | F5 | 4F | 54 | 46 | D7 | 6D | 84 | 80 |
| D190 | 97 | 70 | 10 | 8E | 00 | 07 | 4F | E6 | 84 | 58 | 49 | 54 | E7 | 80 | 31 | 3F |
| D1A0 | 26 | F5 | 97 | 6E | 10 | 8E | 00 | 04 | 4F | E6 | 84 | 58 | 49 | 54 | E7 | 80 |
| D1B0 | 31 | 3F | 26 | F5 | 97 | 71 | 96 | 0A | 84 | 70 | 44 | 44 | 44 | 97 | 6F | 96 |
| D1C0 | 0A | 84 | 0F | 97 | 0A | 96 | 0D | 84 | 0F | 97 | 3B | 96 | 0D | 84 | 70 | 9A |
| D1D0 | 70 | 44 | 44 | 44 | 44 | 97 | 70 | 96 | 12 | 85 | 40 | 27 | 04 | 8A | 80 | 97 |
| D1E0 | 12 | 5F | 96 | 1D | 48 | 59 | D7 | 78 | 96 | 1D | 84 | 3F | 97 | 1D | 1F | B9 |
| D1F0 | C0 | 40 | 58 | 8E | 50 | 00 | 3A | 5F | A6 | 84 | 48 | 59 | 44 | A7 | 80 | D7 |
| D200 | 72 | 5F | A6 | 84 | 48 | 59 | 44 | D7 | 73 | A7 | 84 | 35 | B6 | 01 | 02 | 04 |
| D210 | 08 | 10 | 20 | 40 | 80 | 03 | 0C | 30 | C0 | 02 | 01 | 08 | 04 | 20 | 10 | 80 |
| D220 | 40 | 34 | 04 | C6 | 05 | 3D | 44 | 56 | 4D | 27 | 02 | C6 | FF | 1F | 98 | 35 |
| D230 | 84 | 34 | 36 | D6 | 0E | 2A | 04 | C6 | 7F | D7 | 0E | F7 | 5D | B0 | D6 | 0F |
| D240 | D1 | 0E | 23 | 04 | D6 | 0E | D7 | 0F | F7 | 5D | AF | 20 | 28 | 34 | 36 | D6 |
| D250 | 10 | 2A | 04 | C6 | 7F | D7 | 10 | 5D | 26 | 04 | C6 | 01 | D7 | 10 | F7 | 5D |
| D260 | B0 | D6 | 11 | D1 | 10 | 23 | 04 | D6 | 10 | D7 | 11 | 5D | 26 | 04 | C6 | 01 |
| D270 | D7 | 11 | F7 | 5D | AF | 34 | 02 | 84 | 07 | 48 | 10 | 8E | D3 | 20 | 10 | AE |

| | | | | | | | | | | | | | | | | |
|---|---|---|---|---|---|---|---|---|---|---|---|---|---|---|---|---|
| D280 | A6 | C6 | 80 | 35 | 02 | 34 | 04 | 5F | 84 | 08 | 27 | 02 | C6 | 7F | 34 | 04 |
| D290 | A6 | A0 | A8 | E4 | B1 | 5D | AF | 24 | 03 | B6 | 5D | AF | B1 | 5D | B0 | 23 |
| D2A0 | 03 | B6 | 5D | B0 | 84 | 7F | A7 | 80 | 6A | 61 | 26 | E4 | 32 | 62 | 35 | B6 |
| D2B0 | 34 | 07 | 1C | EF | FC | 52 | CD | 10 | B3 | 52 | CB | 26 | F7 | FC | 53 | 52 |
| D2C0 | 10 | B3 | 53 | 50 | 26 | F7 | FC | 53 | D7 | 10 | B3 | 53 | D5 | 26 | F7 | FC |
| D2D0 | 54 | 5C | 10 | B3 | 54 | 5A | 26 | F7 | C6 | 81 | 5A | 26 | FD | 35 | 87 | 34 |
| D2E0 | 76 | 8E | 50 | 24 | 10 | 8E | 50 | 34 | C6 | 08 | CE | C6 | E0 | EF | 81 | CE |
| D2F0 | C7 | 66 | EF | A1 | 5A | 26 | F3 | B6 | 52 | 8B | F6 | 52 | 89 | 2A | 0D | 8E |
| D300 | C9 | 82 | 81 | 01 | 27 | 03 | 8E | C9 | 8A | BF | 50 | 32 | F6 | 52 | 8A | 2A |
| D310 | 0D | 8E | C9 | 82 | 81 | 02 | 27 | 03 | 8E | C9 | 8A | BF | 50 | 42 | 35 | F6 |
| D320 | D3 | D8 | D4 | D8 | D4 | 58 | D5 | 58 | D3 | 58 | 51 | 02 | 51 | 82 | 52 | 02 |
| D330 | 45 | 58 | 50 | 4F | 2D | 31 | 20 | 20 | 52 | 41 | 44 | 49 | 41 | 4C | 20 | 20 |
| D340 | 41 | 46 | 54 | 52 | 20 | 54 | 43 | 48 | 4C | 4F | 20 | 4C | 45 | 56 | 45 | 4C |
| D350 | 4C | 49 | 4E | 45 | 41 | 52 | 20 | 20 | 00 | 01 | 02 | 03 | 04 | 05 | 06 | 07 |
| D360 | 08 | 09 | 0A | 0B | 0C | 0D | 0E | 0F | 10 | 11 | 12 | 13 | 14 | 15 | 16 | 17 |
| D370 | 18 | 19 | 1A | 1B | 1C | 1D | 1E | 1F | 20 | 21 | 22 | 23 | 24 | 25 | 26 | 27 |
| D380 | 28 | 29 | 2A | 2B | 2C | 2D | 2E | 2F | 30 | 31 | 32 | 33 | 34 | 35 | 36 | 37 |
| D390 | 38 | 39 | 3A | 3B | 3C | 3D | 3E | 3F | 40 | 41 | 42 | 43 | 44 | 45 | 46 | 47 |
| D3A0 | 48 | 49 | 4A | 4B | 4C | 4D | 4E | 4F | 50 | 51 | 52 | 53 | 54 | 55 | 56 | 57 |
| D3B0 | 58 | 59 | 5A | 5B | 5C | 5D | 5E | 5F | 60 | 61 | 62 | 63 | 64 | 65 | 66 | 67 |
| D3C0 | 68 | 69 | 6A | 6B | 6C | 6D | 6E | 6F | 70 | 71 | 72 | 73 | 74 | 75 | 76 | 77 |
| D3D0 | 78 | 79 | 7A | 7B | 7C | 7D | 7E | 7F | 00 | 01 | 01 | 01 | 01 | 01 | 01 | 01 |
| D3E0 | 01 | 01 | 01 | 02 | 02 | 02 | 02 | 02 | 02 | 02 | 02 | 02 | 02 | 02 | 02 | 02 |
| D3F0 | 02 | 03 | 03 | 03 | 03 | 03 | 03 | 03 | 03 | 04 | 04 | 04 | 04 | 04 | 04 | 04 |
| D400 | 05 | 05 | 05 | 05 | 05 | 06 | 06 | 06 | 06 | 06 | 07 | 07 | 07 | 08 | 08 | 08 |
| D410 | 08 | 09 | 09 | 09 | 0A | 0A | 0B | 0B | 0B | 0C | 0C | 0D | 0D | 0E | 0E | 0F |
| D420 | 10 | 10 | 11 | 11 | 12 | 13 | 14 | 14 | 15 | 16 | 17 | 18 | 19 | 1A | 1B | 1C |
| D430 | 1D | 1E | 1F | 20 | 21 | 23 | 24 | 25 | 27 | 28 | 2A | 2C | 2D | 2F | 31 | 33 |
| D440 | 35 | 37 | 39 | 3B | 3E | 40 | 42 | 45 | 48 | 4A | 4D | 50 | 53 | 57 | 5A | 5E |
| D450 | 61 | 65 | 69 | 6D | 71 | 76 | 7A | 7F | 00 | 00 | 00 | 00 | 00 | 00 | 00 | 00 |
| D460 | 00 | 00 | 00 | 00 | 00 | 00 | 00 | 00 | 00 | 00 | 00 | 00 | 00 | 00 | 00 | 00 |
| D470 | 00 | 00 | 00 | 00 | 00 | 00 | 00 | 00 | 00 | 00 | 00 | 00 | 00 | 00 | 00 | 00 |
| D480 | 00 | 00 | 00 | 00 | 00 | 00 | 00 | 00 | 00 | 00 | 00 | 00 | 00 | 00 | 00 | 00 |
| D490 | 00 | 00 | 00 | 00 | 00 | 00 | 00 | 00 | 00 | 00 | 00 | 00 | 00 | 00 | 00 | 00 |
| D4A0 | 00 | 00 | 00 | 00 | 00 | 00 | 00 | 00 | 00 | 00 | 00 | 00 | 00 | 00 | 00 | 00 |
| D4B0 | 00 | 00 | 00 | 00 | 00 | 00 | 00 | 00 | 00 | 00 | 00 | 00 | 00 | 00 | 00 | 00 |
| D4C0 | 00 | 00 | 00 | 00 | 00 | 00 | 00 | 00 | 00 | 00 | 00 | 03 | 09 | 11 | 2E | 3A |
| D4D0 | 45 | 4F | 57 | 5F | 67 | 6F | 77 | 7F | 00 | 00 | 00 | 00 | 00 | 00 | 00 | 00 |
| D4E0 | 00 | 00 | 00 | 00 | 01 | 01 | 01 | 01 | 01 | 01 | 01 | 01 | 02 | 02 | 02 | 02 |
| D4F0 | 02 | 02 | 03 | 03 | 03 | 03 | 04 | 04 | 04 | 04 | 05 | 05 | 05 | 06 | 06 | 06 |
| D500 | 06 | 07 | 07 | 08 | 08 | 08 | 09 | 09 | 09 | 0A | 0A | 0B | 0B | 0C | 0C | 0D |
| D510 | 0D | 0E | 0E | 0F | 0F | 10 | 10 | 11 | 11 | 12 | 12 | 13 | 14 | 14 | 15 | 16 |
| D520 | 16 | 17 | 18 | 19 | 19 | 1A | 1B | 1C | 1C | 1D | 1E | 1F | 20 | 21 | 22 | 22 |
| D530 | 23 | 24 | 25 | 26 | 27 | 29 | 2A | 2B | 2C | 2D | 2E | 2F | 31 | 32 | 33 | 35 |
| D540 | 36 | 38 | 39 | 3B | 3C | 3E | 40 | 41 | 43 | 45 | 47 | 49 | 4B | 4E | 50 | 53 |
| D550 | 55 | 58 | 5C | 5F | 64 | 69 | 6F | 7F | 00 | 01 | 01 | 01 | 01 | 01 | 01 | 01 |
| D560 | 01 | 01 | 01 | 01 | 01 | 01 | 01 | 01 | 01 | 01 | 01 | 01 | 01 | 01 | 01 | 01 |
| D570 | 01 | 01 | 01 | 01 | 01 | 01 | 01 | 01 | 01 | 01 | 01 | 01 | 01 | 01 | 01 | 01 |
| D580 | 01 | 01 | 01 | 01 | 01 | 01 | 01 | 01 | 01 | 01 | 01 | 01 | 01 | 01 | 01 | 01 |
| D590 | 01 | 01 | 01 | 01 | 01 | 01 | 01 | 01 | 01 | 01 | 01 | 01 | 01 | 01 | 01 | 01 |
| D5A0 | 01 | 01 | 01 | 01 | 01 | 01 | 01 | 01 | 01 | 01 | 01 | 01 | 01 | 01 | 01 | 01 |
| D5B0 | 01 | 01 | 01 | 01 | 01 | 01 | 01 | 01 | 01 | 01 | 01 | 01 | 01 | 01 | 01 | 01 |
| D5C0 | 01 | 01 | 01 | 01 | 01 | 01 | 01 | 01 | 01 | 03 | 06 | 0A | 0F | 15 | 1C | 24 |
| D5D0 | 2D | 37 | 42 | 4E | 5B | 69 | 78 | 7F | 34 | 06 | B6 | 5D | 78 | B7 | 30 | 18 |
| D5E0 | F6 | 5D | 7B | C4 | 0F | F7 | 30 | 08 | CA | 30 | F7 | 30 | 08 | B6 | 5D | 79 |
| D5F0 | B7 | 30 | 18 | C4 | 0F | CA | 10 | F7 | 30 | 08 | CA | 30 | F7 | 30 | 08 | B6 |

| | | | | | | | | | | | | | | | | |
|---|---|---|---|---|---|---|---|---|---|---|---|---|---|---|---|---|
| D600 | 5D | 7A | B7 | 30 | 18 | C4 | 0F | CA | 20 | F7 | 30 | 08 | CA | 30 | F7 | 30 |
| D610 | 08 | F7 | 5D | 7B | 35 | 86 | B6 | 5D | 7B | 8A | 08 | B7 | 30 | 08 | B6 | 38 |
| D620 | 04 | 39 | 8E | 52 | 9F | F6 | 5D | 7B | C4 | 07 | 3A | C6 | B8 | B6 | 38 | 04 |
| D630 | 3D | 80 | 1B | AB | 08 | 81 | 7F | 23 | 09 | 81 | C0 | 22 | 04 | 86 | 7F | 20 |
| D640 | 01 | 4F | 7D | 5D | 84 | 26 | 07 | 8C | 52 | A4 | 26 | 02 | 8D | 3D | A7 | 84 |
| D650 | F6 | 5D | 7B | C4 | F0 | CA | 07 | F7 | 30 | 08 | 39 | 8D | 1E | 34 | 06 | F6 |
| D660 | 5D | 7B | C4 | 07 | 5C | C1 | 05 | 23 | 01 | 5F | 34 | 04 | F6 | 5D | 7B | C4 |
| D670 | F0 | EA | E0 | F7 | 5D | 7B | F7 | 30 | 08 | 35 | 86 | 34 | 06 | C6 | 1D | 34 |
| D680 | 04 | BD | C6 | A7 | 35 | 04 | 5A | 26 | F6 | 35 | 86 | 34 | 10 | 81 | 30 | 25 |
| D690 | 0B | 81 | 4F | 22 | 07 | 8E | D6 | 9E | 80 | 30 | A6 | 86 | 35 | 90 | 30 | 32 |
| D6A0 | 33 | 35 | 37 | 38 | 3A | 3C | 3D | 3F | 40 | 40 | 40 | 40 | 40 | 40 | 40 | 40 |
| D6B0 | 40 | 40 | 40 | 40 | 40 | 41 | 43 | 44 | 46 | 48 | 49 | 4B | 4D | 4E | 8E | 5A |
| D6C0 | 8D | F6 | 52 | C5 | C1 | 58 | 25 | 1E | C6 | 57 | F7 | 52 | C5 | 4F | B7 | 5D |
| D6D0 | 7F | B7 | 52 | 83 | 8B | 40 | 1F | 8B | 96 | 7A | 97 | 7B | 0F | 7A | B6 | 52 |
| D6E0 | 83 | 4C | 81 | 07 | 23 | EB | A6 | 85 | 26 | 78 | B7 | 5D | 7F | 5A | 2B | 6C |
| D6F0 | A6 | 85 | 26 | 6E | 5A | 2B | 65 | A6 | 85 | 26 | 67 | 5A | 2B | 5E | A6 | 85 |
| D700 | 26 | 60 | 5A | 2B | 57 | A6 | 85 | 26 | 59 | 5A | 2B | 50 | A6 | 85 | 26 | 52 |
| D710 | 5A | 2B | 49 | A6 | 85 | 26 | 4B | 5A | 2B | 42 | A6 | 85 | 26 | 44 | 5A | 2B |
| D720 | 3B | A6 | 85 | 26 | 3D | 5A | 2B | 34 | A6 | 85 | 26 | 36 | 5A | 2B | 2D | A6 |
| D730 | 85 | 26 | 2F | 5A | A6 | 85 | 26 | 2A | 5A | 2B | 21 | A6 | 85 | 26 | 23 | 5A |
| D740 | 2B | 1A | A6 | 85 | 26 | 1C | 5A | 2B | 13 | A6 | 85 | 26 | 15 | 5A | 2B | 0C |
| D750 | A6 | 85 | 26 | 0E | 5A | 2B | 05 | A6 | 85 | 26 | 07 | 5A | C4 | 7F | F7 | 52 |
| D760 | C5 | 39 | B6 | 5D | 7F | 26 | F7 | 86 | FF | B7 | 30 | 20 | B7 | 5D | 7F | C4 |
| D770 | 7F | 8E | 5D | 5D | 10 | 8E | BF | 92 | 4F | B7 | 52 | 83 | 8B | 40 | 1F | 8B |
| D780 | 96 | 73 | 27 | 13 | 96 | 6C | B5 | 52 | 82 | 27 | 0C | BD | D9 | 77 | 25 | 07 |
| D790 | 1F | B8 | A7 | 80 | 10 | AF | 81 | B6 | 52 | 83 | 4C | 81 | 07 | 23 | DA | A7 |
| D7A0 | 80 | 10 | 8E | BF | 78 | 10 | AF | 81 | F7 | 52 | C5 | CA | 80 | F7 | 5D | 80 |
| D7B0 | F7 | 30 | 20 | 39 | B6 | 38 | 05 | 34 | 02 | B8 | 5D | C1 | B7 | 5D | C0 | 35 |
| D7C0 | 02 | B7 | 5D | C1 | 8E | 52 | 9F | A6 | 84 | A1 | 88 | 10 | 24 | 07 | A6 | 88 |
| D7D0 | 10 | A0 | 84 | 20 | 03 | A0 | 88 | 10 | A7 | 88 | 18 | 81 | 02 | 23 | 05 | A6 |
| D7E0 | 84 | A7 | 88 | 10 | 30 | 01 | 8C | 52 | A4 | 23 | DC | 4F | 8E | D2 | 0D | E6 |
| D7F0 | 86 | F5 | 52 | 82 | 26 | 06 | 4C | 81 | 07 | 23 | F1 | 39 | B7 | 52 | 83 | 8B |
| D800 | 40 | 1F | 8B | DE | 64 | 4F | C6 | 3C | 33 | CB | 37 | 80 | B6 | 52 | 83 | 4C |
| D810 | 81 | 07 | 23 | D8 | 39 | 8E | 00 | 00 | A6 | 89 | 5B | 4D | 26 | 16 | B6 | 5A |
| D820 | 8C | 27 | 09 | A6 | 89 | 5A | 8D | 27 | 03 | BD | D9 | 24 | 30 | 01 | 8C | 00 |
| D830 | 58 | 23 | E5 | 39 | 81 | 10 | 25 | 0A | 8D | 1F | A6 | 89 | 5B | 4D | 84 | 0F |
| D840 | 27 | D6 | BD | D8 | C4 | 1A | 40 | A6 | 89 | 5B | 4D | 26 | 08 | 6F | 89 | 5A |
| D850 | 8D | 1C | BF | 20 | C3 | 1C | BF | 20 | DB | 1A | 40 | A6 | 89 | 5B | 4D | 80 |
| D860 | 10 | A7 | 89 | 5B | 4D | 1C | BF | 4F | 10 | 8E | D2 | 0D | E6 | A6 | F5 | 52 |
| D870 | 82 | 26 | 06 | 4C | 81 | 07 | 23 | F0 | 39 | B7 | 52 | 83 | 8B | 40 | 1F | 8B |
| D880 | BD | D9 | 75 | 25 | 36 | 96 | 3B | 8A | 90 | 0D | 78 | 27 | 04 | D6 | 79 | 20 |
| D890 | 04 | DB | 21 | 2B | 26 | FD | 52 | BF | A6 | 89 | 5A | 8D | 44 | 10 | 9E | 66 |
| D8A0 | A6 | A6 | 84 | 7F | 91 | 6D | 22 | 13 | 91 | 6E | 25 | 0F | B7 | 52 | C1 | BD |
| D8B0 | D0 | CA | 10 | 9E | 64 | 31 | A5 | 6C | A9 | 00 | 80 | B6 | 52 | 83 | 4C | 81 |
| D8C0 | 07 | 23 | A5 | 39 | 6A | 89 | 5B | 4D | 4F | 10 | 8E | D2 | 0D | E6 | A6 | F5 |
| D8D0 | 52 | 82 | 26 | 06 | 4C | 81 | 07 | 23 | F0 | 39 | B7 | 52 | 83 | 8B | 40 | 1F |
| D8E0 | 8B | BD | D9 | 75 | 25 | 35 | 96 | 3B | 8A | 80 | 0D | 78 | 27 | 04 | D6 | 79 |
| D8F0 | 20 | 04 | DB | 21 | 2B | 25 | FD | 52 | BF | A6 | 89 | 5A | ED | 44 | 10 | 9E |
| D900 | 66 | A6 | A6 | 84 | 7F | B7 | 52 | C1 | 10 | 9E | 64 | 31 | A5 | A6 | A9 | 00 |
| D910 | 80 | 27 | 08 | 4A | A7 | A9 | 00 | 80 | BD | D0 | CA | B6 | 52 | 83 | 4C | 81 |
| D920 | 07 | 23 | A6 | 39 | A6 | 89 | 5B | AD | A1 | 89 | 5C | 05 | 26 | 01 | 39 | A7 |
| D930 | 89 | 5C | 05 | 4F | BD | 8B | FB | 96 | 6C | B5 | 5A | 8C | 27 | 2E | BD | D9 |
| D940 | 75 | 25 | 29 | 96 | 3B | 8A | A0 | 0D | 78 | 27 | 04 | D6 | 79 | 20 | 04 | DB |
| D950 | 21 | 2B | 19 | FD | 52 | BF | E6 | 89 | 5B | AD | 2B | 01 | 5F | C4 | 7F | 10 |
| D960 | 9E | 68 | A6 | A5 | 84 | 7F | B7 | 52 | C1 | BD | D0 | CA | B6 | 52 | 83 | 4C |
| D970 | 81 | 07 | 23 | C0 | 39 | 1F | 10 | D1 | 0C | 25 | 07 | D1 | 0B | 22 | 03 | 1C |

| | | | | | | | | | | | | | | | | |
|---|---|---|---|---|---|---|---|---|---|---|---|---|---|---|---|---|
| D980 | FE | 39 | 1A | 01 | 39 | 96 | 3B | 8A | B0 | 37 | 04 | FD | 52 | BF | 7F | 52 |
| D990 | C1 | 37 | 04 | 10 | 8E | D2 | 0E | B6 | 5D | C0 | A4 | A5 | 27 | 11 | B6 | 5D |
| D9A0 | C1 | 98 | 7D | A4 | A5 | 26 | 05 | 86 | 7F | B7 | 52 | C1 | BD | D0 | CA | 37 |
| D9B0 | 80 | 96 | 3B | 8A | B0 | 37 | 04 | FD | 52 | BF | 7F | 52 | C1 | 37 | 04 | 10 |
| D9C0 | 8E | D2 | 0E | B6 | 5D | C0 | A4 | A5 | 27 | 0C | B6 | 5D | C1 | 98 | 7D | A4 |
| D9D0 | A5 | 26 | 03 | BD | D0 | CA | 37 | 80 | 37 | 02 | 8B | 79 | B7 | 52 | BF | 37 |
| D9E0 | 04 | 10 | 8E | D2 | 0E | B6 | 5D | C0 | A4 | A5 | 27 | 0F | B6 | 5D | C1 | 98 |
| D9F0 | 7D | A4 | A5 | 26 | 06 | B6 | 52 | BF | BD | D0 | B8 | 37 | 80 | 86 | 70 | BD |
| DA00 | 8B | 98 | 37 | 02 | 80 | C8 | 84 | 1F | C6 | 18 | 3D | 31 | AB | 37 | 04 | 8E |
| DA10 | D2 | 0E | B6 | 5D | C0 | A4 | 85 | 27 | 0E | B6 | 5D | C1 | 98 | 7D | A4 | 85 |
| DA20 | 26 | 05 | DC | 7E | BD | 8D | B1 | 37 | 80 | 0F | 75 | 20 | 04 | 86 | FF | 97 |
| DA30 | 75 | 96 | 3B | 8A | B0 | 37 | 04 | FD | 52 | BF | 37 | 04 | 10 | 8E | 52 | B7 |
| DA40 | A6 | A5 | 81 | 02 | 23 | 10 | 10 | 8E | 52 | 9F | A6 | A5 | 98 | 75 | 84 | 7F |
| DA50 | B7 | 52 | C1 | BD | D0 | CA | 37 | 80 | 0F | 75 | 20 | 04 | 86 | FF | 97 | 75 |
| DA60 | 96 | 3B | 8A | E0 | 5F | FD | 52 | BF | 37 | 04 | 10 | 8E | 52 | B7 | A6 | A5 |
| DA70 | 81 | 02 | 23 | 10 | 10 | 8E | 52 | 9F | A6 | A5 | 98 | 75 | 84 | 7F | B7 | 52 |
| DA80 | C1 | BD | D0 | CA | 37 | 80 | 0F | 75 | 20 | 04 | C6 | FF | D7 | 75 | 10 | 8E |
| DA90 | 5F | DF | 9E | 64 | C6 | 7E | 3A | 37 | 04 | C4 | 01 | 31 | A5 | 34 | 20 | 3A |
| DAA0 | 37 | 04 | 10 | 8E | 52 | B7 | A6 | A5 | 81 | 02 | 23 | 13 | 10 | 8E | 52 | 9F |
| DAB0 | A6 | A5 | 98 | 75 | 84 | 7F | A7 | 84 | AE | E4 | A7 | 84 | 7C | 5F | E1 | 32 |
| DAC0 | 62 | 37 | 80 | 96 | 7B | 2B | 01 | 4F | 84 | 7F | 10 | 9E | 68 | E6 | A6 | C4 |
| DAD0 | 7F | D1 | 77 | 27 | 0C | D7 | 77 | 96 | 3B | 8A | D0 | FD | 52 | BF | BD | D0 |
| DAE0 | BE | 37 | 80 | B6 | 5D | 8A | 8A | E0 | 84 | BF | B7 | 30 | 04 | 8A | E0 | 84 |
| DAF0 | DF | 34 | 02 | BD | D5 | D8 | 35 | C2 | F6 | 38 | 03 | C4 | 0F | 34 | 04 | B7 |
| DB00 | 30 | 04 | 8A | E0 | 84 | 7F | F6 | 38 | 03 | 58 | 58 | 58 | 58 | EA | E0 | 53 |
| DB10 | F7 | 5D | 92 | 34 | 04 | F8 | 5D | 90 | E4 | E4 | F7 | 5D | 8E | 35 | 04 | F7 |
| DB20 | 5D | 90 | B7 | 30 | 04 | 8A | E0 | 12 | F6 | 38 | 03 | C4 | 0F | 34 | 04 | B7 |
| DB30 | 30 | 04 | B7 | 5D | 8A | F6 | 38 | 03 | 58 | 58 | 58 | 58 | EA | E0 | 53 | C5 |
| DB40 | 0C | 27 | 28 | B6 | 5D | 95 | 4C | 84 | 07 | B7 | 5D | 95 | 26 | 25 | B6 | 5D |
| DB50 | 94 | 4A | 27 | 05 | B7 | 5D | 94 | 20 | 1A | 86 | 0B | B7 | 5D | 94 | 1F | 98 |
| DB60 | 84 | 0C | 43 | B4 | 5D | 91 | B7 | 5D | 91 | 20 | 08 | 86 | 4B | B7 | 5D | 94 |
| DB70 | 7F | 5D | 95 | 34 | 04 | F8 | 5D | 91 | E4 | E4 | F7 | 5D | 8F | 35 | 04 | F7 |
| DB80 | 5D | 91 | B6 | 38 | 05 | B3 | 5D | 7E | 84 | 01 | 34 | 02 | B7 | 5D | 7C | B8 |
| DB90 | 5D | 7D | 85 | 01 | 27 | 08 | 86 | 80 | BA | 5D | 7C | B7 | 5D | 7C | 35 | 02 |
| DBA0 | B7 | 5D | 7D | 39 | 80 | 20 | 8D | 16 | 4D | 2A | 01 | 4F | 81 | 60 | 25 | 02 |
| DBB0 | 86 | 5F | 8B | 20 | 39 | 34 | 36 | 86 | 01 | B7 | 5D | AC | 20 | 05 | 34 | 36 |
| DBC0 | 7F | 5D | AC | B6 | 5D | 9F | 85 | 04 | 26 | 08 | 85 | 08 | 27 | 0D | 86 | FF |
| DBD0 | 20 | 02 | 86 | 01 | 7F | 5D | AE | AB | E0 | 35 | B4 | B6 | 5D | AE | 26 | 10 |
| DBE0 | B6 | 52 | A3 | B0 | 5D | BC | 2A | 03 | 40 | 81 | 0F | 25 | 24 | 7C | 5D | AE |
| DBF0 | B6 | 52 | A3 | B1 | 5D | BC | 27 | 19 | 1F | 89 | B0 | 5D | BC | F7 | 5D | BC |
| DC00 | 7D | 5D | AC | 27 | 08 | 32 | 61 | 1F | 98 | 44 | 44 | 35 | B4 | AB | E0 | 35 |
| DC10 | B4 | B6 | 5B | 65 | 27 | 19 | 81 | 10 | 24 | 08 | 7F | 5B | 65 | 7F | 5D | 87 |
| DC20 | 20 | 0D | 86 | FF | E7 | 5D | 87 | B6 | 5B | 65 | 84 | 0F | B7 | 5B | 65 | 8E |
| DC30 | 5B | 67 | 4F | 10 | 8E | DC | C7 | E6 | 84 | C1 | 10 | 24 | 0A | E6 | A0 | 3A |
| DC40 | 4C | 81 | 0C | 23 | F2 | 20 | 16 | C4 | 0F | E7 | 84 | C6 | 0A | 3D | 1F | 98 |
| DC50 | 7D | 5D | 87 | 27 | 01 | 40 | 7F | 5D | AE | 32 | 61 | 35 | B4 | 86 | FF | 8E |
| DC60 | 5B | 7D | 10 | 8E | DC | C6 | E6 | 84 | C1 | 10 | 24 | 0A | E6 | A0 | 3A | 4C |
| DC70 | 81 | 09 | 23 | F2 | 35 | B6 | C4 | 07 | E7 | 84 | 7F | 5D | AE | 4D | 26 | 04 |
| DC80 | 32 | 61 | 35 | B4 | 7D | 5D | 87 | 27 | 01 | 40 | AB | E0 | 35 | B4 | B6 | 5B |
| DC90 | 4D | 81 | 10 | 24 | 1B | B6 | 5B | 4F | 81 | 10 | 24 | 09 | B6 | 5B | 50 | 81 |
| DCA0 | 10 | 24 | 18 | 4F | 39 | 7F | 5D | AE | 84 | 0F | B7 | 5B | 4F | 86 | 01 | 39 |
| DCB0 | 7F | 5D | AE | 84 | 0F | B7 | 5B | 4D | 86 | FF | 39 | 7F | 5D | AE | 84 | 0F |
| DCC0 | B7 | 5B | 50 | 86 | C1 | 39 | 02 | 01 | 02 | 02 | 01 | 02 | 02 | 02 | 01 | 02 |
| DCD0 | 02 | 01 | 02 | 8E | E7 | 1D | BD | C0 | 54 | BD | E0 | 8C | 25 | 79 | BD | E0 |
| DCE0 | 40 | B6 | 57 | 4E | 48 | 10 | 8E | DC | E9 | 6E | B6 | DC | FD | DD | A0 | DD |
| DCF0 | 2E | DD | 57 | DD | 3D | DD | 29 | DD | 58 | DD | 33 | DD | 18 | B6 | 52 | 99 |

| | | | | | | | | | | | | | | | | |
|---|---|---|---|---|---|---|---|---|---|---|---|---|---|---|---|---|
| DD00 | BD | 8B | 98 | 1F | 21 | BD | DD | 8A | B6 | 52 | 99 | BD | 8B | BE | 1F | 21 |
| DD10 | BD | DD | 8A | 25 | 42 | 7E | DE | 4C | 8E | 5D | DD | 8D | 6D | 25 | 38 | 8E |
| DD20 | 5E | DD | 8D | 66 | 25 | 31 | 7E | DE | 4C | 8E | 67 | 00 | 20 | 08 | 8E | 6D |
| DD30 | 00 | 20 | 03 | 8E | 6D | 80 | 8D | 4F | 25 | 1D | 7E | DE | 4C | 86 | 70 | BD |
| DD40 | 8B | 98 | 1F | 21 | 10 | 8E | 00 | 03 | 8D | 40 | 25 | 0B | 30 | 89 | 01 | 00 |
| DD50 | 31 | 3F | 26 | F4 | BD | DE | 4C | 39 | 8E | 57 | 65 | 10 | 8E | 50 | EA | C6 |
| DD60 | 18 | BD | 81 | 32 | C6 | 68 | 4F | A7 | 80 | 5A | 26 | FB | 10 | 8E | 51 | 02 |
| DD70 | C6 | 80 | BD | 81 | 32 | 8E | 57 | 65 | 8D | 10 | 25 | 0A | 8E | 51 | 82 | 8D |
| DD80 | 09 | 25 | 03 | BD | DE | 4C | 39 | BD | CC | 04 | BD | E0 | 5C | 25 | F7 | 7E |
| DD90 | E6 | 1A | A6 | A0 | BD | DE | 24 | 25 | 04 | 5A | 26 | F6 | 39 | 32 | 62 | 39 |
| DDA0 | 8E | 8F | 41 | 10 | 8E | 50 | 5A | C6 | 07 | BD | 81 | 3D | 8E | 57 | 65 | BF |
| DDB0 | 5D | B1 | 4F | B7 | 5D | CD | C6 | 18 | BD | C1 | 5B | BD | C0 | 9C | BD | 8B |
| DDC0 | 98 | 5F | 8D | CE | B6 | 5D | CD | BD | 8B | BE | C6 | 20 | 8D | C4 | B6 | 5D |
| DDD0 | CD | 4C | 81 | 63 | 23 | DD | 10 | 8E | 56 | E6 | C6 | 64 | 8D | B4 | C6 | 1C |
| DDE0 | 8D | 2B | 10 | 8E | 50 | EA | C6 | 18 | 8D | A8 | 10 | 8E | 6D | 80 | C6 | 64 |
| DDF0 | 8D | A0 | C6 | 04 | 8D | 17 | 10 | 8E | 51 | 02 | 8E | 01 | 80 | 8D | 17 | 86 |
| DE00 | 70 | BD | 8B | 98 | 8E | 03 | 00 | 8D | 0D | BD | DE | 4C | 39 | 4F | 8D | 14 |
| DE10 | 25 | 0F | 5A | 26 | F9 | 39 | A6 | A0 | 8D | 0A | 25 | 05 | 30 | 1F | 26 | F6 |
| DE20 | 39 | 32 | 62 | 39 | 34 | 16 | BE | 5D | B1 | A7 | 80 | 8C | 58 | 65 | 24 | 07 |
| DE30 | BF | 5D | B1 | 1C | FE | 35 | 96 | 8E | 57 | 65 | BF | 5D | B1 | BD | E0 | 5C |
| DE40 | 25 | 05 | BD | E6 | 1A | 24 | 03 | 32 | 64 | 39 | 35 | 96 | 34 | 36 | BD | E0 |
| DE50 | 40 | BD | E0 | 5C | 25 | 05 | BD | E3 | F4 | 20 | F6 | 8D | 07 | 25 | 02 | 35 |
| DE60 | B6 | 32 | 66 | 39 | 34 | 36 | 86 | 68 | BD | 8B | 98 | 1F | 21 | 4F | 5F | BD |
| DE70 | E6 | 1A | 25 | 17 | 5C | 30 | 89 | 01 | 00 | BD | E6 | 1A | 25 | 0D | 8E | 58 |
| DE80 | 65 | FC | 59 | 65 | BD | E6 | 1A | 25 | 02 | 35 | B6 | 8E | E9 | A2 | 32 | 66 |
| DE90 | 39 | 34 | 16 | CC | 00 | 40 | FD | 5A | 7C | B7 | 5D | DA | B7 | 5A | 7B | B7 |
| DEA0 | 5A | 77 | B7 | 5D | B3 | 10 | 8E | 48 | 00 | C6 | 02 | FD | 59 | 65 | B7 | 59 |
| DEB0 | 67 | BD | E4 | 29 | 25 | 2D | 8E | 58 | 65 | BD | E5 | 82 | 25 | 25 | 8D | 7C |
| DEC0 | A6 | 84 | 27 | 27 | B6 | 59 | 67 | 8B | 40 | B7 | 59 | 67 | 26 | F0 | 4F | F6 |
| DED0 | 59 | 66 | 5C | F7 | 59 | 66 | C1 | 40 | 25 | DC | 86 | 01 | B7 | 5D | DA | 1C |
| DEE0 | FE | 35 | 96 | 7F | 52 | 90 | 32 | 64 | 1A | 01 | 39 | 7C | 5A | 77 | B6 | 5D |
| DEF0 | B3 | 27 | 39 | 2B | 1D | B6 | 5A | 7B | 81 | 40 | 24 | 29 | 7C | 5A | 7B | 8D |
| DF00 | 3B | C6 | 18 | 34 | 20 | BD | 81 | 3D | 35 | 20 | FC | 59 | 65 | ED | 23 | 31 |
| DF10 | A8 | 18 | 8D | 28 | E6 | 07 | CB | 80 | EC | 05 | F9 | 5A | 7D | B9 | 5A | 7C |
| DF20 | FD | 5A | 7C | 20 | 9F | 86 | FF | B7 | 5D | B3 | 20 | E6 | B6 | 5A | 79 | 4C |
| DF30 | B1 | 5A | 77 | 26 | DD | 86 | 01 | B7 | 5D | B3 | 20 | B9 | 34 | 06 | 8E | 58 |
| DF40 | 65 | F6 | 59 | 67 | 4F | 30 | 8B | 35 | 86 | 34 | 06 | B6 | 52 | 9A | 81 | 63 |
| DF50 | 22 | 07 | C6 | 18 | BD | C1 | 5B | 20 | 06 | CC | 2D | 2D | FD | 50 | 62 | BD |
| DF60 | C0 | 9C | 6D | E4 | 27 | 09 | BD | E0 | 5C | 25 | 1B | 6A | E4 | 20 | F3 | BD |
| DF70 | E0 | 5C | 25 | 12 | 8E | 57 | 65 | BD | E5 | 82 | 25 | 0A | 8E | 57 | 65 | 35 |
| DF80 | 06 | 30 | 8B | 1C | FE | 39 | 32 | 62 | 39 | 8D | 0B | 25 | 06 | A7 | A0 | 5A |
| DF90 | 26 | F7 | 39 | 32 | 62 | 39 | 34 | 14 | BE | 5D | B1 | 8C | 58 | 65 | 24 | 09 |
| DFA0 | A6 | 80 | BF | 5D | B1 | 1C | FE | 35 | 94 | 8E | 57 | 65 | BF | 5D | B1 | BD |
| DFB0 | E0 | 5C | 25 | 05 | BD | E5 | 82 | 24 | DF | 32 | 63 | 39 | 34 | 36 | BD | E0 |
| DFC0 | 12 | 25 | 47 | EC | 03 | FD | 59 | 65 | 10 | 83 | 00 | 40 | 24 | 3C | BD | E0 |
| DFD0 | 2E | BD | E4 | 77 | 25 | 37 | FC | 59 | 65 | 8E | 58 | 65 | BD | E5 | 82 | 25 |
| DFE0 | 2C | 7F | 59 | 67 | F6 | 59 | 67 | 4F | 8E | 58 | 65 | 30 | 8B | 10 | 8E | 57 |
| DFF0 | 4D | C6 | 18 | A6 | 80 | A1 | A0 | 26 | 07 | 5A | 26 | F7 | 1C | FE | 35 | B6 |
| E000 | B6 | 59 | 67 | 8B | 40 | B7 | 59 | 67 | 26 | DA | 8E | EA | A1 | 32 | 66 | 1A |
| E010 | 01 | 39 | 34 | 06 | B6 | 5A | 7A | B0 | 5A | 79 | 81 | 3F | 22 | 0C | C6 | 18 |
| E020 | 3D | 8E | 48 | 00 | 30 | 8B | 1C | FE | 35 | 86 | 1A | 01 | 35 | 86 | 34 | 36 |
| E030 | 10 | 8E | 57 | 4D | C6 | 18 | BD | 81 | 3D | 4F | 5F | ED | A8 | EB | 35 | B6 |
| E040 | 34 | 06 | CE | 58 | 7D | 8E | 58 | 65 | F6 | 59 | 67 | 4F | 33 | CB | 30 | 8B |
| E050 | E6 | C0 | F7 | 59 | 6B | EC | C1 | FD | 59 | 69 | 35 | 86 | B6 | 59 | 6B | 27 |
| E060 | 19 | FC | 59 | 69 | 34 | 06 | C3 | 00 | 01 | FD | 59 | 69 | 7A | 59 | 6B | 35 |
| E070 | 06 | 10 | 83 | 00 | 40 | 25 | 0E | 1C | FE | 39 | E6 | C0 | F7 | 59 | 6B | 27 |

| | | | | | | | | | | | | | | | | |
|---|---|---|---|---|---|---|---|---|---|---|---|---|---|---|---|---|
| E080 | 04 | EC | C1 | 20 | DF | 8E | EA | B0 | 4F | 1A | 01 | 39 | 34 | 36 | BD | E1 |
| E090 | F4 | FD | 59 | 6C | BD | E4 | 29 | 10 | 25 | 01 | 54 | CC | 00 | 02 | FD | 59 |
| E0A0 | 65 | 8E | 58 | 65 | BD | E5 | 82 | 10 | 25 | 01 | 44 | 5F | 4F | F7 | 59 | 67 |
| E0B0 | 6D | 8B | 26 | 15 | CB | 40 | 26 | F5 | FC | 59 | 65 | 5C | F7 | 59 | 66 | C1 |
| E0C0 | 40 | 25 | DE | 8E | E9 | BD | 16 | 01 | 26 | 8E | 57 | 4D | 10 | 8E | 58 | 65 |
| E0D0 | 4F | 31 | AB | C6 | 18 | BD | 81 | 3D | 4F | C6 | 28 | A7 | A0 | 5A | 26 | FB |
| E0E0 | 7F | 59 | 68 | CC | 00 | 40 | FD | 59 | 69 | FC | 59 | 69 | 7F | 59 | 6B | 10 |
| E0F0 | 83 | 0A | 00 | 25 | 06 | 8E | E9 | D4 | 16 | 00 | F4 | BD | E3 | EC | 27 | 08 |
| E100 | C3 | 00 | 01 | FD | 59 | 69 | 20 | E7 | B6 | 59 | 6B | 4C | 27 | 10 | B7 | 59 |
| E110 | 6B | FC | 59 | 69 | FB | 59 | 6B | 89 | 00 | BD | E3 | EC | 27 | EA | 7C | 59 |
| E120 | 68 | FC | 59 | 6C | 4D | 26 | 07 | F1 | 59 | 6B | 10 | 23 | 00 | 9F | 8E | 58 |
| E130 | 7A | B6 | 59 | 68 | C6 | 03 | 3D | FB | 59 | 67 | 30 | 8B | B6 | 59 | 6B | A7 |
| E140 | 84 | FC | 59 | 69 | ED | 01 | 4F | F6 | 59 | 6B | 34 | 06 | FC | 59 | 6C | A3 |
| E150 | E1 | FD | 59 | 6C | F6 | 59 | 6B | 4F | F3 | 59 | 69 | FD | 59 | 69 | B6 | 59 |
| E160 | 68 | 81 | 0C | 25 | 84 | 7F | 5D | CD | 7F | 5D | CE | 86 | FF | B7 | 5D | CF |
| E170 | 8E | 58 | 7D | F6 | 5D | CD | 3A | F6 | 59 | 67 | 4F | 30 | 8B | A6 | 84 | 27 |
| E180 | 18 | B1 | 5D | CF | 24 | 09 | B7 | 5D | CF | B6 | 5D | CD | B7 | 5D | CE | B6 |
| E190 | 5D | CD | 8B | 03 | B7 | 5D | CD | 20 | D7 | C6 | 27 | F0 | 5D | CE | 2F | 28 |
| E1A0 | 4F | 1F | 02 | 8E | 58 | 7D | F6 | 5D | CE | 3A | F6 | 59 | 67 | 4F | 30 | 8B |
| E1B0 | A6 | 03 | A7 | 80 | 31 | 3F | 26 | F8 | 7A | 59 | 68 | 4F | F6 | 5D | CF | F3 |
| E1C0 | 59 | 6C | FD | 59 | 6C | 16 | FF | 21 | 8E | E9 | E1 | 20 | 22 | 8E | 58 | 7A |
| E1D0 | B6 | 59 | 68 | C6 | 03 | 3D | FB | 59 | 67 | 30 | 8B | B6 | 59 | 6D | A7 | 84 |
| E1E0 | FC | 59 | 69 | ED | 01 | 4F | 5F | ED | 03 | ED | 05 | 1C | FE | 35 | B6 | 1A |
| E1F0 | 01 | 32 | 66 | 39 | FC | 57 | 52 | 7D | 57 | 54 | 27 | 03 | C3 | 00 | 01 | 39 |
| E200 | 34 | 34 | 8E | E7 | 29 | BD | C0 | 54 | BD | E4 | 77 | 25 | 57 | CC | 00 | 02 |
| E210 | FD | 59 | 65 | B7 | 59 | 67 | 8E | 58 | 65 | BD | E5 | 82 | 25 | 46 | 5F | 4F |
| E220 | F7 | 59 | 67 | 6D | 8B | 27 | 14 | CB | 40 | 26 | F5 | FC | 59 | 65 | 5C | F7 |
| E230 | 59 | 66 | C1 | 40 | 25 | E0 | 4F | 1C | FE | 35 | B4 | 30 | 8B | A6 | 01 | B1 |
| E240 | 57 | 4E | 26 | 17 | 30 | 08 | 10 | 8E | 57 | 55 | C6 | 10 | A6 | 80 | A1 | A0 |
| E250 | 26 | 09 | 5A | 26 | F7 | 86 | 01 | 1C | FE | 35 | B4 | 4F | F6 | 59 | 67 | 8E |
| E260 | 58 | 65 | 20 | C3 | 32 | 65 | 39 | BD | E0 | 40 | BD | E3 | 31 | BD | E0 | 8C |
| E270 | 10 | 25 | 00 | 9D | 8E | 92 | 84 | BD | C0 | 54 | BD | E1 | F4 | FD | 5D | B3 |
| E280 | BD | E0 | 40 | FC | 5D | B3 | 10 | 27 | 00 | 81 | BD | E3 | 3E | 7F | 5D | B5 |
| E290 | B6 | 5D | D7 | BD | E3 | 62 | 25 | 79 | 8E | 48 | 00 | BD | D5 | D8 | BD | E0 |
| E2A0 | 5C | 25 | 6E | BD | E5 | 82 | 25 | 69 | 30 | 89 | 01 | 00 | 7C | 5D | B5 | FC |
| E2B0 | 5D | B3 | 83 | 00 | 01 | FD | 5D | B3 | 27 | 07 | B6 | 5D | B5 | 81 | 08 | 25 |
| E2C0 | DA | CC | 20 | 20 | FD | 50 | 67 | FC | 5D | B3 | C3 | 00 | 03 | 44 | 56 | 44 |
| E2D0 | 56 | 1F | 98 | C6 | 1C | BD | C1 | 5B | 86 | 4B | B7 | 50 | 69 | BD | C0 | 9C |
| E2E0 | 8D | 4F | B6 | 5D | D6 | BD | E3 | 62 | 25 | 27 | 8E | 48 | 00 | B6 | 5D | B5 |
| E2F0 | 27 | 19 | BD | D5 | D8 | BD | E0 | 5C | 25 | 17 | BD | E6 | 1A | 25 | 12 | 30 |
| E300 | 89 | 01 | 00 | 7A | 5D | B5 | 26 | EA | 16 | FF | 78 | BD | D5 | D8 | BD | DE |
| E310 | 4C | 20 | 2B | 34 | 36 | FF | 59 | 6C | 8E | 58 | 65 | 10 | 8E | 59 | 6E | A6 |
| E320 | 84 | E6 | A4 | A7 | A0 | E7 | 80 | 8C | 59 | 6D | 23 | F3 | FE | 59 | 6C | 35 |
| E330 | B6 | 34 | 03 | B6 | 20 | 01 | B7 | 5D | D7 | B6 | 5D | D5 | 20 | 0B | 34 | 03 |
| E340 | B6 | 20 | 01 | B7 | 5D | D6 | B6 | 5D | D4 | B7 | 5D | D3 | 7F | 5D | D9 | 8D |
| E350 | C2 | 35 | 83 | B6 | 5D | D3 | 84 | 01 | B7 | 5D | D4 | 43 | 84 | 01 | B7 | 5D |
| E360 | D5 | 39 | 34 | 16 | BD | E5 | 32 | A6 | E4 | B7 | 20 | 01 | BD | E6 | F5 | 8E |
| E370 | 5D | 9D | 86 | C4 | BD | E9 | 10 | B6 | 38 | 05 | 2B | 1B | FC | 52 | C6 | 10 |
| E380 | 83 | 0F | 42 | 10 | 22 | 01 | 52 | B6 | 38 | 03 | 85 | 01 | 10 | 27 | 01 | 56 |
| E390 | B6 | 5D | D8 | 27 | E2 | 20 | 29 | 1A | 40 | B6 | 20 | 03 | A7 | 80 | 8C | 5D |
| E3A0 | A2 | 23 | D4 | 1C | BF | B6 | 5D | D8 | 26 | 0B | FC | 52 | C6 | 10 | 83 | 0F |
| E3B0 | 42 | 25 | F0 | 20 | 0B | 1A | 40 | B6 | 5D | 9D | A1 | E4 | 10 | 27 | 01 | 62 |
| E3C0 | 35 | 16 | 16 | 00 | B2 | 34 | 36 | BD | E4 | 29 | 25 | 1D | BD | DF | BC | 25 |
| E3D0 | 18 | BD | E0 | 40 | 86 | FF | A7 | 84 | BD | E0 | 5C | 25 | 05 | BD | E3 | FE |
| E3E0 | 20 | F6 | BD | DE | 64 | 25 | 02 | 35 | B6 | 32 | 66 | 39 | 34 | 36 | 8D | 1B |
| E3F0 | A5 | 85 | 35 | B6 | 34 | 36 | 8D | 13 | AA | 85 | A7 | A4 | 35 | B6 | 34 | 36 |

| | | | | | | | | | | | | | | | | |
|---|---|---|---|---|---|---|---|---|---|---|---|---|---|---|---|---|
| E400 | 8D | 09 | A6 | 85 | 43 | A4 | A4 | A7 | A4 | 35 | B6 | 86 | 68 | BD | 8B | 98 |
| E410 | EC | 62 | 44 | 56 | 44 | 56 | 44 | 56 | 84 | 01 | C3 | 00 | C0 | 31 | AB | E6 |
| E420 | 63 | C4 | 07 | A6 | A4 | 8E | D2 | 0D | 39 | 34 | 36 | BD | E4 | 77 | 25 | 42 |
| E430 | 86 | 68 | BD | 8B | 98 | 10 | BF | 5D | AF | 1F | 21 | 4F | 5F | BD | E5 | 82 |
| E440 | 25 | 2D | 30 | 89 | 01 | 00 | CC | 00 | 01 | BD | E5 | 82 | 25 | 21 | 86 | FF |
| E450 | A7 | 89 | 01 | 00 | BE | 5D | AF | 10 | 8E | 80 | 65 | C6 | 0B | A6 | 80 | A1 |
| E460 | A0 | 26 | 07 | 5A | 26 | F7 | 1C | FE | 35 | B6 | 8E | EA | 01 | 20 | 03 | 8E |
| E470 | EA | 5D | 1A | 01 | 32 | 66 | 39 | 34 | 16 | B6 | 5D | D9 | 10 | 26 | 00 | A2 |
| E480 | 4F | B7 | 5D | AF | B7 | 5D | D1 | B7 | 5D | D2 | BD | E5 | 32 | 1A | 50 | 86 |
| E490 | 7F | B7 | 30 | 20 | 86 | FF | B7 | 52 | C5 | B7 | 5D | 80 | B6 | 38 | 02 | BD |
| E4A0 | D2 | B0 | BD | E5 | 58 | BD | E6 | F5 | 1C | AF | 86 | 00 | BD | E9 | 10 | B6 |
| E4B0 | 38 | 05 | 84 | 40 | B7 | 5D | B0 | B6 | 5D | D8 | 26 | 3D | BD | D5 | D8 | B6 |
| E4C0 | 38 | 05 | 84 | 40 | B8 | 5D | B0 | 26 | 22 | B6 | 38 | 03 | 85 | 01 | 27 | 16 |
| E4D0 | FC | 52 | C6 | 10 | 83 | 0F | 42 | 23 | DE | 8E | EA | 11 | 86 | D0 | BD | E9 |
| E4E0 | 10 | 32 | 64 | 1A | 01 | 39 | 8E | F4 | 63 | 20 | F1 | FC | 52 | C6 | 10 | 83 |
| E4F0 | 14 | 58 | 22 | E5 | B6 | 5D | D8 | 27 | F2 | BD | E6 | F5 | FC | 52 | C6 | 10 |
| E500 | 83 | 07 | A1 | 22 | 28 | 8D | 5A | 25 | F3 | BD | E6 | F5 | FC | 52 | C6 | 10 |
| E510 | 83 | 01 | 12 | 22 | 18 | 8D | 4A | 25 | F3 | FC | 52 | C6 | 10 | 83 | 00 | F7 |
| E520 | 23 | 0B | 86 | 01 | B7 | 5D | D9 | 1A | 40 | 1C | FE | 35 | 96 | 8E | EA | 22 |
| E530 | 20 | AF | BD | F3 | 60 | C6 | 10 | B6 | 5D | D3 | 27 | 02 | C6 | 20 | 34 | 04 |
| E540 | B6 | 5D | 81 | 84 | 03 | B7 | 30 | 28 | C6 | 13 | 5A | 26 | FD | 8A | 04 | AA |
| E550 | E0 | B7 | 30 | 28 | B7 | 5D | 81 | 39 | 34 | 02 | 86 | 15 | BD | 8C | E6 | 35 |
| E560 | 82 | B6 | 38 | 05 | 1F | 89 | B8 | 5D | AF | B4 | 5D | AF | 84 | 40 | 26 | 06 |
| E570 | F7 | 5D | AF | 1A | 01 | 39 | F7 | 5D | AF | 1C | FE | 39 | 34 | 16 | 86 | 02 |
| E580 | 20 | 09 | 34 | 16 | BD | E6 | B6 | 25 | 7A | 86 | 0A | B7 | 5D | D0 | E6 | 61 |
| E590 | C4 | 0F | F7 | 20 | 02 | AE | 62 | 86 | 80 | BD | E9 | 10 | 5F | B6 | 38 | 05 |
| E5A0 | 2B | 1A | B6 | 38 | 05 | 2B | 15 | B6 | 38 | 05 | 2B | 10 | B6 | 38 | 05 | 2B |
| E5B0 | 0B | 85 | 10 | 26 | 53 | B6 | 5D | D8 | 27 | E3 | 20 | 14 | B6 | 20 | 03 | A7 |
| E5C0 | 80 | 5A | 26 | D9 | B6 | 38 | 05 | 85 | 10 | 26 | 3D | B6 | 5D | D8 | 27 | F4 |
| E5D0 | 7A | 5D | D0 | 84 | 3C | 27 | 0C | 85 | 10 | 26 | 0C | 85 | 08 | 26 | 12 | 85 |
| E5E0 | 04 | 26 | 18 | 1C | FE | 35 | 96 | 7D | 5D | D0 | 26 | A2 | 8E | EA | 31 | 20 |
| E5F0 | 12 | 7D | 5D | D0 | 26 | 98 | 8E | EA | 42 | 20 | 08 | 7D | 5D | D0 | 26 | 8E |
| E600 | 8E | EA | 53 | 32 | 64 | 1A | 01 | 39 | 86 | D0 | BD | E9 | 10 | 4F | 5F | FD |
| E610 | 59 | 65 | F7 | 59 | 67 | 8E | EA | C5 | 20 | E9 | 34 | 16 | BD | E6 | B6 | 10 |
| E620 | 25 | 00 | 8E | 86 | 0A | B7 | 5D | D0 | E6 | 61 | C4 | 0F | F7 | 20 | 02 | AE |
| E630 | 62 | 86 | 02 | E6 | E4 | C1 | 05 | 25 | 01 | 4F | 8A | A0 | BD | E9 | 10 | 5F |
| E640 | B6 | 38 | 05 | 2B | 1A | B6 | 38 | 05 | 2B | 15 | B6 | 38 | 05 | 2B | 10 | B6 |
| E650 | 38 | 05 | 2B | 0B | 85 | 10 | 26 | B0 | B6 | 5D | D8 | 27 | E3 | 20 | 14 | A6 |
| E660 | 80 | B7 | 20 | 03 | 5A | 26 | D9 | B6 | 38 | 05 | 85 | 10 | 26 | 9A | B6 | 5D |
| E670 | D8 | 27 | F4 | 7A | 5D | D0 | 84 | 7C | 27 | 10 | 85 | 40 | 26 | 10 | 85 | 10 |
| E680 | 26 | 11 | 85 | 08 | 26 | 17 | 85 | 04 | 26 | 1D | 1C | FE | 35 | 96 | 8E | EA |
| E690 | 73 | 20 | 1E | 7D | 5D | D0 | 26 | 90 | 8E | EA | 31 | 20 | 14 | 7D | 5D | D0 |
| E6A0 | 26 | 86 | 8E | EA | 42 | 20 | 0A | 7D | 5D | D0 | 10 | 26 | FF | 7A | 8E | EA |
| E6B0 | 53 | 32 | 64 | 1A | 01 | 39 | 34 | 06 | B6 | 5D | 81 | 84 | F7 | B7 | 5D | 81 |
| E6C0 | 54 | C4 | 08 | FA | 5D | 81 | F7 | 5D | 81 | F7 | 30 | 28 | EC | E4 | 58 | 49 |
| E6D0 | 58 | 49 | 58 | 49 | 84 | 7F | B7 | 20 | 03 | 86 | 10 | BD | E9 | 10 | B6 | 38 |
| E6E0 | 05 | 85 | 10 | 26 | 09 | B6 | 5D | D8 | 27 | F4 | 1C | FE | 35 | 86 | 1A | 01 |
| E6F0 | 8E | EA | C5 | 35 | 86 | 34 | 06 | 4F | 5F | FD | 52 | C6 | 35 | 86 | 20 | 20 |
| E700 | 46 | 4F | 52 | 4D | 41 | 54 | 54 | 49 | 4E | 47 | 20 | 54 | 52 | 41 | 43 | 4B |
| E710 | 20 | 20 | 20 | 30 | 31 | 20 | 20 | 2F | 20 | 31 | 36 | 30 | FF | 53 | 41 | 56 |
| E720 | 49 | 4E | 47 | 20 | 46 | 49 | 4C | 45 | FF | 43 | 48 | 45 | 43 | 4B | 49 | 4E |
| E730 | 47 | 20 | 44 | 49 | 52 | 45 | 43 | 54 | 4F | 52 | 59 | FF | 8E | E6 | FE | BD |
| E740 | C0 | 54 | 86 | 68 | BD | 8B | 98 | 8E | 80 | 65 | C6 | 50 | BD | 81 | 3D | 4F |
| E750 | C6 | 70 | A7 | A0 | 5A | 26 | FB | C6 | 08 | 86 | FF | A7 | A0 | 5A | 26 | FB |
| E760 | 8E | 01 | 38 | 4F | A7 | A0 | 30 | 1F | 26 | FA | BD | E4 | 77 | 24 | 01 | 39 |
| E770 | 4F | 5F | FD | 5A | 84 | B7 | 50 | 1A | 10 | 8E | E9 | 80 | BD | E8 | 1F | 10 |

| | | | | | | | | | | | | | | | | |
|---|---|---|---|---|---|---|---|---|---|---|---|---|---|---|---|---|
| E780 | 25 | 00 | 98 | A6 | A0 | BD | E8 | 44 | 10 | 25 | 00 | 8F | 10 | 8C | E9 | 90 |
| E790 | 25 | F1 | BD | E8 | B2 | 10 | 8E | E9 | 80 | FC | 5A | 84 | C4 | F0 | EA | A0 |
| E7A0 | 8E | 57 | 65 | BD | E5 | 7C | 24 | 15 | FC | 5A | 84 | 10 | 83 | 00 | 40 | 25 |
| E7B0 | 6A | BD | E3 | F4 | B6 | 50 | 1A | 4C | 27 | 03 | B7 | 50 | 1A | 10 | 8C | E9 |
| E7C0 | 90 | 25 | D6 | B6 | 5D | D1 | 4C | B7 | 5D | D1 | C6 | 1E | BD | C1 | 5B | BD |
| E7D0 | C0 | 9C | BD | D5 | D8 | FC | 5A | 84 | C3 | 00 | 10 | FD | 5A | 84 | B6 | 5D |
| E7E0 | D1 | 81 | A0 | 24 | 20 | 85 | 01 | 26 | 8F | 86 | 50 | BD | E9 | 10 | 1C | EF |
| E7F0 | B6 | 38 | 05 | 85 | 10 | 26 | 08 | B6 | 5D | D8 | 27 | F4 | 16 | FF | 79 | 8E |
| E800 | EA | C5 | 1A | 01 | 39 | 86 | 68 | BD | 8B | 98 | 1F | 21 | 4F | 5F | BD | E6 |
| E810 | 1A | 25 | 0B | 5C | 30 | 89 | 01 | 00 | 7E | E6 | 1A | 8E | EA | 8B | 39 | B6 |
| E820 | 5D | 81 | 84 | F7 | F6 | 5D | D1 | 54 | 24 | 02 | 8A | 08 | B7 | 5D | 81 | B7 |
| E830 | 30 | 28 | 86 | F6 | C1 | 28 | 25 | 02 | 84 | FD | BD | E9 | 10 | C6 | 20 | 8E |
| E840 | E9 | 60 | 20 | 7B | B7 | 5D | CD | C6 | 10 | 8E | E9 | 50 | BD | E8 | BF | 25 |
| E850 | 60 | B6 | 5D | D1 | 44 | BD | E8 | EA | 25 | 57 | B6 | 5D | D1 | 84 | 01 | BD |
| E860 | E8 | EA | 25 | 4D | B6 | 5D | CD | BD | E8 | EA | 25 | 45 | 86 | 01 | BD | E8 |
| E870 | EA | 25 | 3E | 86 | F7 | BD | E8 | EA | 25 | 37 | C6 | 16 | 8E | E9 | 60 | BD |
| E880 | E8 | BF | 25 | 2D | C6 | 0F | 8E | E9 | 50 | BD | E8 | BF | 25 | 23 | 86 | FB |
| E890 | BD | E8 | EA | 25 | 1C | 8E | 01 | 00 | 86 | E5 | BD | E8 | EA | 25 | 12 | 30 |
| E8A0 | 1F | 26 | F5 | 86 | F7 | BD | E8 | EA | 25 | 07 | C6 | 18 | 8E | E9 | 60 | 20 |
| E8B0 | 0E | 39 | C6 | 20 | 8E | E9 | 60 | BD | E8 | BF | 24 | F6 | 1C | FE | 39 | B6 |
| E8C0 | 38 | 05 | 2B | 1B | B6 | 38 | 05 | 2B | 16 | B6 | 38 | 05 | 2B | 11 | B6 | 38 |
| E8D0 | 05 | 2B | 0C | 85 | 10 | 26 | 05 | B6 | 5D | D8 | 27 | E3 | 1A | 01 | 39 | A6 |
| E8E0 | 80 | B7 | 20 | 03 | 5A | 26 | D8 | 1C | FE | 39 | F6 | 38 | 05 | 2B | 1B | F6 |
| E8F0 | 38 | 05 | 2B | 16 | F6 | 38 | 05 | 2B | 11 | F6 | 38 | 05 | 2B | 0C | C5 | 10 |
| E900 | 26 | 05 | F6 | 5D | D8 | 27 | E3 | 1A | 01 | 39 | B7 | 20 | 03 | 1C | FE | 39 |
| E910 | 34 | 02 | 7F | 5D | D8 | B7 | 20 | 00 | 86 | 05 | 4A | 26 | FD | 35 | 82 | 34 |
| E920 | 03 | BD | 8C | F3 | 8D | 11 | 86 | FF | B7 | 30 | 20 | B7 | 5D | 80 | 7F | 5D |
| E930 | D9 | 35 | 01 | 1C | AF | 35 | 82 | 34 | 06 | B6 | 5D | 81 | 84 | 03 | B7 | 30 |
| E940 | 28 | C6 | 13 | 5A | 26 | FD | 8A | 04 | B7 | 30 | 28 | B7 | 5D | 81 | 35 | 86 |
| E950 | 00 | 00 | 00 | 00 | 00 | 00 | 00 | 00 | 00 | 00 | 00 | 00 | F5 | F5 | F5 | FE |
| E960 | 4E | 4E | 4E | 4E | 4E | 4E | 4E | 4E | 4E | 4E | 4E | 4E | 4E | 4E | 4E | 4E |
| E970 | 4E | 4E | 4E | 4E | 4E | 4E | 4E | 4E | 4E | 4E | 4E | 4E | 4E | 4E | 4E | 4E |
| E980 | 00 | 0B | 06 | 01 | 0C | 07 | 02 | 0D | 08 | 03 | 0E | 09 | 04 | 0F | 0A | 05 |
| E990 | 55 | 4E | 4B | 4E | 4F | 57 | 4E | 20 | 46 | 49 | 4C | 45 | 20 | 54 | 59 | 50 |
| E9A0 | 45 | FF | 55 | 4E | 41 | 42 | 4C | 45 | 20 | 54 | 4F | 20 | 55 | 50 | 44 | 41 |
| E9B0 | 54 | 45 | 20 | 44 | 49 | 52 | 45 | 43 | 54 | 4F | 52 | 59 | FF | 54 | 4F | 4F |
| E9C0 | 20 | 4D | 41 | 4E | 59 | 20 | 46 | 49 | 4C | 45 | 53 | 20 | 4F | 4E | 20 | 44 |
| E9D0 | 49 | 53 | 4B | FF | 44 | 49 | 53 | 4B | 20 | 49 | 53 | 20 | 46 | 55 | 4C | 4C |
| E9E0 | FF | 46 | 49 | 4C | 45 | 20 | 52 | 45 | 51 | 55 | 49 | 52 | 45 | 53 | 20 | 54 |
| E9F0 | 4F | 4F | 20 | 4D | 41 | 4E | 59 | 20 | 53 | 45 | 47 | 4D | 45 | 4E | 54 | 53 |
| EA00 | FF | 4E | 4F | 54 | 20 | 41 | 20 | 47 | 5A | 2D | 44 | 49 | 53 | 4B | 20 | 21 |
| EA10 | FF | 4E | 4F | 20 | 44 | 49 | 53 | 4B | 20 | 49 | 4E | 20 | 44 | 52 | 49 | 56 |
| EA20 | 45 | FF | 52 | 4F | 54 | 41 | 54 | 49 | 4F | 4E | 20 | 53 | 50 | 45 | 45 | 44 |
| EA30 | FF | 52 | 45 | 43 | 4F | 52 | 44 | 20 | 4E | 4F | 54 | 20 | 46 | 4F | 55 | 4E |
| EA40 | 44 | FF | 42 | 41 | 44 | 20 | 44 | 41 | 54 | 41 | 20 | 4F | 4E | 20 | 44 | 49 |
| EA50 | 53 | 4B | FF | 4C | 4F | 53 | 54 | 20 | 44 | 41 | 54 | 41 | FF | 44 | 49 | 53 |
| EA60 | 4B | 20 | 49 | 53 | 20 | 4E | 4F | 54 | 20 | 47 | 5A | 20 | 46 | 4F | 52 | 4D |
| EA70 | 41 | 54 | FF | 44 | 49 | 53 | 4B | 20 | 49 | 53 | 20 | 57 | 52 | 49 | 54 | 45 |
| EA80 | 2D | 50 | 52 | 4F | 54 | 45 | 43 | 54 | 45 | 44 | FF | 55 | 4E | 41 | 42 | 4C |
| EA90 | 45 | 20 | 54 | 4F | 20 | 46 | 4F | 52 | 4D | 41 | 54 | 20 | 44 | 49 | 53 | 4B |
| EAA0 | FF | 46 | 49 | 4C | 45 | 20 | 4E | 4F | 54 | 20 | 46 | 4F | 55 | 4E | 44 | FF |
| EAB0 | 49 | 4E | 54 | 45 | 52 | 4E | 41 | 4C | 20 | 4C | 4F | 47 | 49 | 43 | 20 | 45 |
| EAC0 | 52 | 52 | 4F | 52 | FF | 44 | 49 | 53 | 4B | 20 | 44 | 52 | 49 | 56 | 45 | 20 |
| EAD0 | 4E | 4F | 54 | 20 | 52 | 45 | 41 | 44 | 59 | FF | BD | DF | BC | 25 | 1A | BD |
| EAE0 | E0 | 40 | A6 | 01 | 27 | 0E | BD | C0 | 9C | 81 | 09 | 22 | 07 | 48 | 10 | 8E |
| EAF0 | EA | F8 | 6E | B6 | 8E | E9 | 90 | 1A | 01 | 39 | EB | 0C | EC | 3B | EB | 2F |

| | | | | | | | | | | | | | | | | |
|---|---|---|---|---|---|---|---|---|---|---|---|---|---|---|---|---|
| EB00 | ED | A8 | EB | 3E | EC | 0E | EB | 94 | EC | 1D | EC | 2C | B6 | 52 | 99 | BD |
| EB10 | 8B | 98 | 1F | 21 | BD | E0 | 5C | 25 | 15 | BD | E5 | 82 | 25 | 10 | BD | EE |
| EB20 | 35 | 25 | 0B | B6 | 52 | 99 | BD | 8B | BE | C6 | 20 | BD | 81 | 3D | 39 | BD |
| EB30 | EE | 35 | 25 | 09 | 10 | 8E | 6D | 00 | C6 | 6E | BD | 81 | 3D | 39 | F6 | 52 |
| EB40 | 9A | 2B | 2B | C4 | 1F | 86 | 18 | 3D | BD | DF | 49 | 25 | 20 | BF | 5D | B1 |
| EB50 | 86 | 70 | BD | 8B | 98 | B6 | 52 | 9B | 84 | 1F | C6 | 18 | 3D | 31 | AB | C6 |
| EB60 | 18 | BD | DF | 96 | 25 | 07 | A7 | A0 | 5A | 26 | F6 | 1C | FE | 39 | 86 | 70 |
| EB70 | 34 | 02 | BD | 8B | 98 | 1F | 21 | BD | E0 | 5C | 25 | 13 | BD | E5 | 82 | 25 |
| EB80 | 0E | A6 | E4 | 4C | A7 | E4 | 81 | 72 | 23 | E8 | 32 | 61 | 1C | FE | 39 | 32 |
| EB90 | 61 | 1A | 01 | 39 | F6 | 52 | 9A | 2B | 4F | BD | EE | 35 | 25 | 49 | F6 | 52 |
| EBA0 | 9A | C4 | 03 | 58 | 58 | 58 | 3A | 10 | 8E | 50 | EA | B6 | 52 | 9B | 84 | 03 |
| EBB0 | 48 | 48 | 48 | 31 | A6 | C6 | 08 | BD | 81 | 3D | B6 | 52 | 9A | 27 | 08 | BD |
| EBC0 | EE | 35 | 25 | 23 | B6 | 52 | 9A | 4A | 84 | 01 | C6 | 80 | 3D | 8E | 57 | 65 |
| EBD0 | 30 | 8B | 10 | 8E | 51 | 02 | F6 | 52 | 9B | C4 | 03 | 86 | 80 | 3D | 31 | AB |
| EBE0 | C6 | 80 | BD | 81 | 3D | 1C | FE | 39 | BD | EE | 35 | 25 | 20 | 10 | 8E | 50 |
| EBF0 | EA | C6 | 18 | BD | 81 | 3D | 8E | 57 | E5 | 10 | 8E | 51 | 02 | C6 | 80 | BD |
| EC00 | 81 | 3D | BD | E0 | 5C | 25 | 06 | 8E | 51 | 82 | BD | E5 | 82 | 39 | BD | E0 |
| EC10 | 5C | 25 | 09 | BD | CC | 04 | 8E | 67 | 00 | BD | E5 | 82 | 39 | BD | EE | 35 |
| EC20 | 25 | 09 | 10 | 8E | 6D | 80 | C6 | 64 | BD | 81 | 3D | 39 | 8E | 5D | DD | BD |
| EC30 | EE | 3B | 25 | 06 | 8E | 5E | DD | BD | EE | 3B | 39 | F6 | 52 | 9A | 10 | 2B |
| EC40 | 00 | DB | C1 | 64 | 10 | 25 | 00 | 96 | 10 | 27 | 00 | 67 | C1 | 65 | 27 | 36 |
| EC50 | C1 | 67 | 27 | 73 | CC | 73 | 00 | BD | DF | 49 | 25 | C0 | 86 | 70 | BD | 8B |
| EC60 | 98 | 5F | BD | 81 | 3D | 86 | 71 | 34 | 02 | BD | 8B | 98 | 1F | 21 | BD | E0 |
| EC70 | 5C | 25 | 10 | BD | E5 | 82 | 25 | 0B | A6 | E4 | 4C | A7 | E4 | 81 | 72 | 23 |
| EC80 | E8 | 1C | FE | 32 | 61 | 39 | CC | 71 | 00 | BD | DF | 49 | 25 | 24 | C6 | 18 |
| EC90 | 10 | 8E | 50 | EA | BD | 81 | 3D | 8E | 57 | E5 | 10 | 8E | 51 | 02 | C6 | 80 |
| ECA0 | BD | 81 | 3D | BD | EE | 35 | 25 | 0A | 10 | 8E | 51 | 82 | 5F | BD | 81 | 3D |
| ECB0 | 1C | FE | 39 | CC | 70 | 80 | BD | DF | 49 | 25 | F7 | C6 | 64 | 10 | 8E | 56 |
| ECC0 | E6 | BD | 81 | 3D | 1C | FE | 39 | BD | CC | 04 | CC | 71 | 18 | BD | DF | 49 |
| ECD0 | 25 | E0 | C6 | 64 | 10 | 8E | 6D | 80 | BD | 81 | 3D | 1C | FE | 39 | 86 | 20 |
| ECE0 | 3D | BB | 52 | 9A | BD | DF | 49 | 25 | C9 | BF | 5D | B1 | B6 | 52 | 9B | BD |
| ECF0 | 8B | 98 | A6 | A8 | 17 | 2A | 06 | 8E | 88 | DA | 1A | 01 | 39 | 5F | BD | DF |
| ED00 | 96 | 25 | AF | A7 | A0 | 5A | 26 | F6 | B6 | 52 | 9B | BD | 8B | BE | C6 | 20 |
| ED10 | BD | DF | 96 | 25 | 9D | A7 | A0 | 5A | 26 | F6 | 1C | FE | 39 | 8E | 57 | 65 |
| ED20 | BF | 5D | B1 | BD | EE | 3B | 25 | 7F | 4F | B7 | 5D | CD | C6 | 19 | BD | C1 |
| ED30 | 5B | BD | C0 | 9C | B6 | 5D | CD | BD | 8B | 98 | 5F | BD | DF | 89 | B6 | 5D |
| ED40 | CD | BD | 8B | BE | C6 | 20 | BD | DF | 89 | B6 | 5D | CD | 4C | 81 | 63 | 23 |
| ED50 | D8 | 10 | 8E | 56 | E6 | C6 | 64 | BD | DF | 89 | C6 | 1C | BD | DF | 96 | 25 |
| ED60 | 46 | 5A | 26 | F8 | 10 | 8E | 50 | EA | C6 | 18 | BD | DF | 89 | 10 | 8E | 6D |
| ED70 | 80 | C6 | 64 | BD | DF | 89 | C6 | 04 | BD | DF | 96 | 25 | 2A | 5A | 26 | F8 |
| ED80 | 10 | 8E | 51 | 02 | 8E | 01 | 80 | BD | DF | 96 | 25 | 1B | A7 | A0 | 30 | 1F |
| ED90 | 26 | F5 | 86 | 70 | BD | 8B | 98 | 8E | 03 | 00 | BD | DF | 96 | 25 | 08 | A7 |
| EDA0 | A0 | 30 | 1F | 26 | F5 | 1C | FE | 39 | 34 | 10 | 8E | 8E | 84 | BD | C0 | 54 |
| EDB0 | BD | F3 | 60 | 35 | 10 | A6 | 05 | B7 | 5A | 7E | EC | 06 | FD | 5A | 7F | BD |
| EDC0 | D2 | B0 | BD | E5 | 58 | BD | EE | 35 | 25 | 15 | BD | EE | 58 | 5F | B6 | 38 |
| EDD0 | 03 | 43 | 44 | 25 | 05 | 8D | 6D | 25 | 07 | 39 | 8E | F4 | 63 | 1A | 01 | 39 |
| EDE0 | A6 | 80 | 7D | 50 | 23 | 27 | 08 | 81 | FE | 27 | 22 | 81 | F8 | 27 | 1E | BD |
| EDF0 | C4 | BE | 81 | F7 | 26 | 17 | 34 | 07 | 1C | BF | 8D | 5C | BD | D2 | B0 | FC |
| EE00 | 52 | C6 | C3 | 00 | 14 | 10 | B3 | 52 | C6 | 26 | FA | 35 | 07 | BD | D5 | D8 |
| EE10 | B6 | 5A | 80 | 4A | B7 | 5A | 80 | 81 | FF | 26 | 12 | B6 | 5A | 7F | 4A | B7 |
| EE20 | 5A | 7F | 81 | FF | 26 | 07 | B6 | 5A | 7E | 4A | B7 | 5A | 7E | 5A | 26 | 9E |
| EE30 | 8D | 12 | 25 | 8B | 39 | BD | CC | 04 | 8E | 57 | 65 | BD | E0 | 5C | 25 | 03 |
| EE40 | BD | E5 | 82 | 39 | 34 | 06 | FC | 5A | 7F | 26 | 09 | B6 | 5A | 7E | 26 | 04 |
| EE50 | 1C | FE | 35 | 86 | 1A | 01 | 35 | 86 | 34 | 36 | 8E | 50 | 61 | 10 | 8E | 5A |
| EE60 | 7E | C6 | 03 | A6 | A0 | BD | C1 | 98 | 5A | 26 | F8 | BD | C0 | 9C | 35 | B6 |
| EE70 | BD | CC | 04 | B6 | 52 | C2 | 10 | 27 | 00 | 80 | B6 | 52 | 90 | 81 | 11 | 22 |

| | | | | | | | | | | | | | | | | |
|---|---|---|---|---|---|---|---|---|---|---|---|---|---|---|---|---|
| EE80 | 10 | 8E | F3 | 71 | BD | 95 | 0B | BD | 95 | A6 | 86 | 36 | BD | A0 | 86 | 20 |
| EE90 | 60 | 8E | F3 | 8B | BD | C0 | 24 | 81 | 12 | 26 | 0E | 8E | F3 | EB | BD | C0 |
| EEA0 | 4C | B6 | 5D | B7 | C6 | 38 | BD | C1 | 5B | BD | BF | F4 | FC | 5F | DD | C4 |
| EEB0 | FC | 26 | 02 | C6 | 04 | FD | 5F | DD | 10 | 83 | 03 | FC | 23 | 03 | CC | 03 |
| EEC0 | FC | 44 | 56 | 44 | 56 | F7 | 5D | AF | 1F | 98 | C6 | 23 | BD | C1 | 5B | B6 |
| EED0 | 52 | 90 | 81 | 12 | 27 | 1B | 8E | 6D | 00 | 10 | 8E | 50 | 88 | A6 | 84 | 2B |
| EEE0 | 08 | 81 | 20 | 25 | 04 | C6 | 0A | 20 | 05 | 8E | F3 | FB | C6 | 04 | BD | 81 |
| EEF0 | 55 | 8E | 9F | 21 | BD | C2 | 67 | BD | C0 | 99 | 86 | 14 | BD | 95 | 3A | 81 |
| EF00 | 13 | 27 | 20 | 81 | 12 | 27 | 16 | 81 | 14 | 27 | 42 | 81 | 01 | 10 | 26 | AF |
| EF10 | F6 | BD | 95 | 2A | 86 | 13 | B7 | 52 | 90 | 7C | 52 | C2 | 39 | 8E | 5D | B7 |
| EF20 | 7E | 9B | D5 | B6 | 5D | AF | BD | DB | BE | B1 | 5D | AF | 26 | 01 | 39 | 4D |
| EF30 | 26 | 0D | B6 | 5D | AF | 81 | C0 | 22 | 04 | 86 | FF | 20 | 02 | 86 | 01 | 1F |
| EF40 | 89 | 4F | 58 | 49 | 58 | 49 | FD | 5F | DD | 7C | 52 | C2 | 39 | BD | 95 | 2A |
| EF50 | 7F | 52 | 90 | 7C | 52 | C2 | B6 | 52 | 8B | 84 | 03 | 26 | 06 | 8E | F3 | FF |
| EF60 | 7E | 89 | DF | 85 | 01 | 26 | 07 | B6 | 52 | 8A | 2B | 07 | 20 | EF | B6 | 52 |
| EF70 | 89 | 2A | EA | 86 | 04 | B7 | 57 | 4E | FC | 5F | DD | FD | 57 | 52 | 7F | 57 |
| EF80 | 54 | 5F | F7 | 52 | 90 | 86 | 01 | B7 | 52 | C2 | B7 | 57 | 4F | F7 | 57 | 4D |
| EF90 | F7 | 57 | 50 | F7 | 57 | 51 | BD | E2 | 00 | 25 | 11 | 4D | 27 | 1C | BD | 9F |
| EFA0 | 49 | 24 | 12 | 86 | 02 | B7 | 52 | 90 | 7C | 52 | C2 | 39 | BD | E9 | 1F | 7A |
| EFB0 | 52 | 90 | 7E | 89 | DF | BD | 9F | 6A | 25 | F2 | 8E | E7 | 29 | BD | C0 | 54 |
| EFC0 | BD | E0 | 8C | 25 | E7 | 10 | 8E | 6D | 00 | A6 | A4 | 2B | 0C | 81 | 20 | 25 |
| EFD0 | 08 | B6 | 5D | B7 | 84 | 7F | BD | 8D | 94 | BD | D2 | B0 | 4F | 5F | FD | 5A |
| EFE0 | 7E | B7 | 5A | 80 | FD | 52 | C6 | 1A | 10 | 8E | 54 | DE | B6 | 52 | 8B | 85 |
| EFF0 | 01 | 26 | 03 | 8E | 55 | E2 | EC | 81 | FD | 55 | E2 | EC | 84 | FD | 55 | E4 |
| F000 | B3 | 55 | E2 | 24 | 03 | C3 | 00 | 80 | FD | 5A | 84 | 10 | 8E | 48 | 00 | 10 |
| F010 | BF | 54 | DE | 31 | AB | 10 | BF | 54 | E0 | BD | E5 | 58 | 86 | FF | B7 | 30 |
| F020 | 20 | 5F | F7 | 5D | C3 | B6 | 52 | 8B | 85 | 01 | 26 | 02 | C6 | 08 | 1F | 9B |
| F030 | CC | F3 | 27 | FD | 50 | 1B | 86 | 95 | 97 | 00 | 1C | AF | 10 | BE | 54 | DE |
| F040 | BE | 55 | E2 | BC | 55 | E4 | 27 | 0E | A6 | 80 | A7 | A0 | 8C | 56 | E6 | 25 |
| F050 | F2 | 8E | 55 | E6 | 20 | ED | BD | F3 | 60 | 8E | F3 | D5 | BD | C0 | 54 | BD |
| F060 | E0 | 40 | 1C | AF | BD | E0 | 5C | 24 | 06 | 8E | F4 | 38 | 7E | F2 | 42 | FD |
| F070 | 5D | BE | BD | E6 | B6 | 10 | 25 | 01 | C9 | FC | 5A | 84 | 10 | 83 | 01 | 00 |
| F080 | 10 | 24 | 00 | 90 | FC | 52 | C6 | 10 | 83 | 98 | 96 | 10 | 24 | 01 | D6 | B6 |
| F090 | 38 | 03 | 85 | 01 | 10 | 27 | 01 | CD | B6 | 38 | 05 | B8 | 5D | 7E | 84 | 01 |
| F0A0 | 10 | 26 | 01 | C1 | BD | D5 | D8 | 8E | 50 | 72 | 86 | C0 | BD | E9 | 10 | C6 |
| F0B0 | 05 | B6 | 38 | 05 | 2A | 25 | 1A | 50 | B6 | 20 | 03 | A7 | 80 | 86 | 15 | 97 |
| F0C0 | 00 | 1C | EF | B6 | 38 | 05 | 2A | 0C | B6 | 20 | 03 | A7 | 80 | 5A | 26 | 04 |
| F0D0 | 86 | 95 | 97 | 00 | B6 | 5D | D8 | 27 | EA | 20 | 05 | B6 | 5D | D8 | 27 | D1 |
| F0E0 | 1C | AF | 86 | 95 | 97 | 00 | 8E | 50 | 72 | A6 | 02 | 84 | 0F | 34 | 12 | CC |
| F0F0 | 20 | 10 | A7 | 80 | 5A | 26 | FB | 35 | 12 | C6 | 7E | E7 | 86 | B6 | 52 | C2 |
| F100 | 4A | 27 | 06 | B7 | 52 | C2 | 16 | FF | 70 | 86 | 03 | B7 | 52 | C2 | BD | C0 |
| F110 | 9C | 16 | FF | 65 | 1A | 40 | FC | 5D | BE | C4 | 0F | F7 | 20 | 02 | 10 | BE |
| F120 | 54 | DE | C6 | 02 | 81 | 05 | 25 | 01 | 5F | 1F | 98 | 8A | A0 | BD | E9 | 10 |
| F130 | C6 | 15 | 1C | EF | B6 | 38 | 05 | 2B | 31 | B6 | 38 | 05 | 2B | 2C | B6 | 38 |
| F140 | 05 | 2B | 27 | B6 | 38 | 05 | 2B | 22 | B6 | 38 | 05 | 2B | 1D | 1A | 10 | 85 |
| F150 | 10 | 26 | 11 | B6 | 5D | D8 | 10 | 26 | 00 | E6 | B6 | 38 | 03 | 85 | 01 | 26 |
| F160 | D1 | 16 | 01 | 01 | 8E | EA | C5 | 16 | 00 | D8 | 1A | 10 | D7 | 00 | 1C | EF |
| F170 | A6 | A0 | B7 | 20 | 03 | D6 | 00 | C5 | 01 | 26 | 29 | B6 | 38 | 05 | 2B | F0 |
| F180 | B6 | 38 | 05 | 2B | EB | B6 | 38 | 05 | 2B | E6 | B6 | 38 | 05 | 2B | E1 | B6 |
| F190 | 38 | 05 | 2B | DC | B6 | 38 | 05 | 2B | D7 | 85 | 10 | 26 | C7 | B6 | 5D | D8 |
| F1A0 | 27 | D3 | 20 | 6A | C5 | 70 | 27 | 20 | B6 | 38 | 05 | 2A | 05 | A6 | A0 | B7 |
| F1B0 | 20 | 03 | C4 | 7C | FA | 5D | C3 | F7 | 5D | C3 | 96 | 01 | B6 | 38 | 05 | 2A |
| F1C0 | B4 | A6 | A0 | B7 | 20 | 03 | 20 | AD | B6 | 38 | 05 | 2A | 05 | A6 | A0 | B7 |
| F1D0 | 20 | 03 | 96 | 01 | BE | 54 | E0 | A7 | 80 | F6 | 38 | 05 | 2A | 05 | E6 | A0 |
| F1E0 | F7 | 20 | 03 | 8C | 50 | 00 | 25 | 03 | 8E | 48 | 00 | BF | 54 | E0 | F6 | 38 |
| F1F0 | 05 | 2A | 05 | E6 | A0 | F7 | 20 | 03 | FC | 5A | 84 | C3 | 00 | 01 | FD | 5A |

| | | | | | | | | | | | | | | | | |
|---|---|---|---|---|---|---|---|---|---|---|---|---|---|---|---|---|
| F200 | 84 | F6 | 38 | 05 | 2A | C0 | E6 | A0 | F7 | 20 | 03 | 7E | F1 | 75 | C6 | 95 |
| F210 | D7 | 00 | 1C | AF | 84 | 7C | 26 | 28 | 10 | 8C | 50 | 00 | 25 | 04 | 10 | 8E |
| F220 | 48 | 00 | 10 | BF | 54 | DE | 1A | 10 | B6 | 5A | 84 | 4A | B7 | 5A | 84 | 1C |
| F230 | EF | FC | 5A | 7E | C3 | 00 | 01 | FD | 5A | 7E | BD | E6 | F5 | 16 | FE | 22 |
| F240 | 8D | 13 | 1A | 50 | 34 | 10 | BD | 8C | A0 | BD | E9 | 1F | 4F | BD | 8B | FB |
| F250 | 35 | 10 | 16 | 97 | 8A | 8E | F4 | 56 | 34 | 16 | C6 | 01 | F7 | 5D | D0 | B6 |
| F260 | 5D | D8 | 7E | E6 | 73 | 1A | 50 | 86 | 15 | 97 | 00 | FC | 5A | 84 | 10 | 83 |
| F270 | 00 | FF | 23 | 07 | 4F | 5F | FD | 5A | 84 | 20 | 0F | BE | 54 | DE | FC | 5D |
| F280 | BE | 1C | EF | BD | E6 | 1A | 10 | 25 | FF | B8 | BD | E0 | 40 | F6 | 5A | 85 |
| F290 | 4F | F3 | 5A | 7F | FD | 5A | 7F | ED | 06 | FD | 57 | 53 | B6 | 5A | 7E | 89 |
| F2A0 | 00 | B7 | 5A | 7E | A7 | 05 | B7 | 57 | 52 | FC | 5A | 7E | 7D | 5A | 80 | 27 |
| F2B0 | 03 | C3 | 00 | 01 | FD | 5A | 7E | 27 | 0D | BD | E0 | 5C | 25 | 1A | FC | 5A |
| F2C0 | 7E | 83 | 00 | 01 | 20 | EE | F6 | 59 | 6B | 27 | 07 | E6 | 5D | F0 | 59 | 6B |
| F2D0 | E7 | 5D | 4F | 5F | A7 | C4 | ED | 41 | 1C | EF | 8E | F4 | 27 | FC | 57 | 52 |
| F2E0 | 26 | 07 | B6 | 57 | 54 | 10 | 27 | FF | 59 | BD | DE | 4C | 10 | 25 | FF | 52 |
| F2F0 | BD | 8C | A0 | BD | E9 | 1F | BD | 8B | FB | 8E | F4 | 6D | BD | C0 | 24 | C6 |
| F300 | 03 | 10 | 8E | 57 | 52 | 8E | 50 | 91 | A6 | A0 | BD | C1 | 98 | 5A | 26 | F8 |
| F310 | FC | 57 | 52 | C3 | 00 | 04 | FD | 5F | DD | 44 | 56 | 44 | 56 | 1F | 98 | C6 |
| F320 | 14 | BD | C1 | 5B | 7E | 8A | 30 | D6 | 00 | 2B | 03 | 16 | D1 | 87 | C5 | 01 |
| F330 | 26 | 03 | 16 | D1 | 80 | C5 | 70 | 27 | 0B | 96 | 01 | C4 | 7C | FA | 5D | C3 |
| F340 | F7 | 5D | C3 | 3B | 96 | 01 | BE | 54 | E0 | A7 | 80 | 8C | 50 | 00 | 25 | 03 |
| F350 | 8E | 48 | 00 | BF | 54 | E0 | FC | 5A | 84 | C3 | 00 | 01 | FD | 5A | 84 | 3B |
| F360 | 34 | 02 | B6 | 5D | 8A | 84 | 1F | 8A | 60 | B7 | 30 | 04 | B7 | 5D | 8A | 35 |
| F370 | 82 | 52 | 45 | 43 | 4F | 52 | 44 | 20 | 49 | 4E | 43 | 4F | 4D | 49 | 4E | 47 |
| F380 | 20 | 4D | 49 | 44 | 49 | 20 | 44 | 41 | 54 | 41 | FF | 52 | 45 | 43 | 4F | 52 |
| F390 | 44 | 20 | 4D | 49 | 44 | 49 | 20 | 54 | 4F | 20 | 44 | 49 | 53 | 4B | 3A | 20 |
| F3A0 | 44 | 41 | 54 | 41 | 20 | 4C | 45 | 4E | 47 | 54 | 48 | 20 | 3D | 20 | 20 | 20 |
| F3B0 | 20 | 4B | 20 | 44 | 41 | 54 | 41 | 20 | 52 | 45 | 51 | 55 | 45 | 53 | 54 | 20 |
| F3C0 | 4D | 45 | 53 | 53 | 41 | 47 | 45 | 3A | 5B | 20 | 20 | 20 | 20 | 20 | 20 | 20 |
| F3D0 | 20 | 20 | 20 | 5D | FF | 57 | 41 | 49 | 54 | 49 | 4E | 47 | 20 | 46 | 4F | 52 |
| F3E0 | 20 | 4D | 49 | 44 | 49 | 20 | 44 | 41 | 54 | 41 | FF | 50 | 41 | 52 | 41 | 4D |
| F3F0 | 45 | 54 | 45 | 52 | 20 | 28 | 58 | 29 | 20 | 3D | FF | 4E | 4F | 4E | 45 | 4D |
| F400 | 49 | 44 | 49 | 20 | 49 | 4E | 50 | 55 | 54 | 20 | 53 | 59 | 53 | 54 | 45 | 4D |
| F410 | 20 | 45 | 58 | 43 | 4C | 55 | 53 | 49 | 56 | 45 | 20 | 4E | 4F | 54 | 20 | 45 |
| F420 | 4E | 41 | 42 | 4C | 45 | 44 | FF | 4E | 4F | 20 | 44 | 41 | 54 | 41 | 20 | 52 |
| F430 | 45 | 43 | 45 | 49 | 56 | 45 | 44 | FF | 46 | 49 | 4C | 45 | 20 | 4F | 56 | 45 |
| F440 | 52 | 4C | 4F | 41 | 44 | 20 | 2D | 20 | 54 | 4F | 4F | 20 | 4D | 55 | 43 | 48 |
| F450 | 20 | 44 | 41 | 54 | 41 | FF | 4D | 49 | 44 | 49 | 20 | 52 | 45 | 43 | 45 | 49 |
| F460 | 56 | 45 | 20 | 43 | 41 | 4E | 43 | 45 | 4C | 4C | 45 | 44 | FF | 4F | 50 | 45 |
| F470 | 52 | 41 | 54 | 49 | 4F | 4E | 20 | 43 | 4F | 4D | 50 | 4C | 45 | 54 | 45 | 3A |
| F480 | 20 | 20 | 20 | 20 | 4B | 20 | 42 | 59 | 54 | 45 | 53 | 20 | 52 | 45 | 43 | 45 |
| F490 | 49 | 56 | 45 | 44 | 2E | FF | 53 | 45 | 43 | 52 | 45 | 54 | 45 | 4E | 54 | 45 |
| F4A0 | 52 | 20 | 43 | 4F | 44 | 45 | 3A | 20 | 20 | 20 | 20 | 20 | 5B | 20 | 20 | 20 |
| F4B0 | 20 | 20 | 20 | 5D | FF | 53 | 45 | 4C | 45 | 43 | 54 | 20 | 53 | 45 | 43 | 52 |
| F4C0 | 45 | 54 | 20 | 41 | 43 | 43 | 45 | 53 | 53 | 20 | 43 | 4F | 44 | 45 | 20 | 2D |
| F4D0 | 20 | 20 | 52 | 45 | 4D | 45 | 4D | 42 | 45 | 52 | 20 | 49 | 54 | FF | 20 | 20 |
| F4E0 | 20 | 20 | 20 | 20 | 20 | 20 | 20 | 20 | 4E | 4F | 54 | 48 | 49 | 4E | 47 | 20 |
| F4F0 | 48 | 41 | 50 | 50 | 45 | 4E | 45 | 44 | 2E | FF | 4D | 45 | 4D | 4F | 52 | 59 |
| F500 | 20 | 44 | 52 | 4F | 50 | 20 | 2D | 20 | 43 | 48 | 45 | 43 | 4B | 20 | 42 | 41 |
| F510 | 54 | 54 | 45 | 52 | 59 | FF | FC | 5D | A4 | 10 | 83 | AB | CD | 27 | 2A | 8E |
| F520 | 89 | F1 | BD | C0 | 2E | 8E | F4 | FA | BD | C0 | 4C | BD | C0 | 9C | BD | 8A |
| F530 | 8A | CC | AB | CD | FD | 5D | A4 | 7F | 5D | A3 | 8E | F4 | 96 | 10 | 8E | 5D |
| F540 | A6 | C6 | 06 | BD | 81 | 3D | 7F | 67 | 00 | B6 | 5D | A3 | 84 | 80 | B7 | 5D |
| F550 | A3 | 2B | 01 | 39 | BD | D2 | DF | B6 | 52 | 8B | 81 | 01 | 27 | 0A | 81 | 02 |
| F560 | 27 | 06 | CC | C9 | 82 | FD | 50 | 32 | BD | F6 | 45 | BD | D2 | B0 | 4F | B7 |
| F570 | 30 | 10 | 8E | 5D | A6 | 10 | 8E | 5D | A6 | C6 | 06 | BD | 81 | 55 | 86 | 01 |

| | | | | | | | | | | | | | | | | |
|---|---|---|---|---|---|---|---|---|---|---|---|---|---|---|---|---|
| F580 | B7 | 52 | C2 | 7F | 5D | AF | CC | 40 | 40 | FD | 5D | 8B | 86 | 1E | B7 | 5D |
| F590 | 8A | B7 | 30 | 04 | BD | C2 | 15 | FC | 52 | C6 | C3 | 00 | 41 | FD | 5D | 9B |
| F5A0 | B6 | 52 | A4 | B7 | 5D | BC | BD | 8D | 3E | BD | F6 | 54 | BD | F8 | A0 | B6 |
| F5B0 | 52 | C2 | 27 | 12 | BD | C2 | DB | 8E | 80 | 3C | BD | C0 | 2E | B6 | 5D | AF |
| F5C0 | BD | F8 | 77 | BD | C0 | 99 | BD | DC | 8E | 27 | 1D | BB | 5D | AF | 2A | 01 |
| F5D0 | 4F | 81 | 05 | 23 | 02 | 86 | 05 | B7 | 5D | AF | 7C | 52 | C2 | 8D | 23 | 10 |
| F5E0 | 25 | FF | C3 | 7F | 5D | A3 | 20 | 5D | 8E | 5D | 9D | F6 | 5D | AF | 3A | A6 |
| F5F0 | 84 | BD | DB | A4 | A1 | 84 | 10 | 27 | FF | AC | A7 | 84 | 7C | 52 | C2 | 16 |
| F600 | FF | A4 | 34 | 36 | C6 | 06 | 8E | 5D | A6 | 10 | 8E | 5D | 9D | A6 | 80 | 81 |
| F610 | 2A | 27 | 2E | A1 | A0 | 26 | 07 | 5A | 26 | F3 | 1C | FE | 35 | B6 | C6 | 05 |
| F620 | 8E | F8 | D9 | 10 | 8E | 5D | 9D | A6 | 80 | A8 | 05 | A1 | A0 | 26 | 0E | 5A |
| F630 | 26 | F5 | 8E | F4 | DE | BD | 8A | 38 | 7C | 52 | C2 | 20 | DD | 1A | 01 | 35 |
| F640 | B6 | 31 | 21 | 20 | D2 | 34 | 16 | CC | 20 | 06 | 8E | 5D | 9D | A7 | 80 | 5A |
| F650 | 26 | FB | 35 | 96 | FC | 52 | C6 | 10 | B3 | 5D | 9B | 22 | 01 | 39 | C3 | 00 |
| F660 | 64 | FD | 5D | 9B | B6 | 5D | B0 | 4C | 84 | 1F | B7 | 5D | B0 | 8E | F6 | 8D |
| F670 | 10 | 8E | D2 | 0D | E6 | 86 | E6 | A5 | 53 | F7 | 30 | 02 | F7 | 5D | 88 | 8B |
| F680 | 08 | E6 | 86 | E6 | A5 | 53 | F7 | 30 | 03 | F7 | 5D | 89 | 39 | 04 | 04 | 05 |
| F690 | 05 | 06 | 06 | 07 | 07 | 07 | 07 | 07 | 06 | 06 | 05 | 05 | 04 | 03 | 03 | 02 |
| F6A0 | 02 | 01 | 01 | 00 | 00 | 00 | 00 | 00 | 01 | 01 | 02 | 02 | 03 | 04 | 04 | 05 |
| F6B0 | 05 | 06 | 06 | 07 | 07 | 07 | 07 | 07 | 06 | 06 | 05 | 05 | 04 | 20 | 20 | 4B |
| F6C0 | 45 | 59 | 42 | 4F | 41 | 52 | 44 | 20 | 4C | 4F | 43 | 4B | 20 | 3D | FF | 20 |
| F6D0 | 20 | 20 | 20 | 20 | 28 | 50 | 52 | 45 | 53 | 53 | 20 | 22 | 57 | 52 | 49 | 54 |
| F6E0 | 45 | 22 | 20 | 41 | 47 | 41 | 49 | 4E | 20 | 54 | 4F | 20 | 45 | 58 | 49 | 54 |
| F6F0 | 29 | 20 | 20 | 20 | 20 | 20 | 20 | 50 | 4C | 45 | 41 | 53 | 45 | 20 | 57 | 52 |
| F700 | 49 | 54 | 45 | 20 | 44 | 4F | 57 | 4E | 20 | 59 | 4F | 55 | 52 | 20 | 4E | 45 |
| F710 | 57 | 20 | 43 | 4F | 44 | 45 | 3A | 22 | 20 | 20 | 20 | 20 | 20 | 20 | 22 | FF |
| F720 | B6 | 5D | A3 | 84 | 7F | 27 | 10 | 81 | 01 | 27 | 1C | 81 | 02 | 10 | 27 | 00 |
| F730 | A8 | 81 | 03 | 10 | 27 | 01 | 0A | B6 | 5D | A3 | 84 | 80 | 8A | 01 | B7 | 5D |
| F740 | A3 | B7 | 52 | C2 | 16 | FE | FE | B6 | 52 | C2 | 27 | 2F | 8E | F6 | BD | BD |
| F750 | 95 | 0B | B6 | 52 | 90 | 81 | 02 | 25 | 08 | 80 | 02 | BD | C2 | DB | BD | F8 |
| F760 | 77 | B6 | 5D | A3 | 84 | 80 | C6 | 15 | BD | BF | E2 | B6 | 52 | 90 | 81 | 01 |
| F770 | 26 | 06 | CC | 15 | 03 | BD | C2 | 8F | BD | C0 | 99 | 86 | 07 | BD | 95 | 3A |
| F780 | 81 | 01 | 27 | 2D | 8E | 5D | 9B | F6 | 52 | 90 | 3A | A6 | 84 | BD | DB | A4 |
| F790 | A1 | 84 | 27 | 05 | A7 | 84 | 7C | 52 | C2 | BD | F6 | 02 | 25 | 12 | 7C | 5D |
| F7A0 | A3 | 7F | 5D | AF | 10 | 8E | 5D | 9D | 8E | 5D | A6 | C6 | 06 | BD | 81 | 3D |
| F7B0 | 39 | B6 | 5D | A3 | 48 | 49 | 84 | 01 | 34 | 02 | BD | DB | B5 | A1 | E0 | 26 |
| F7C0 | 01 | 39 | 2B | 09 | 27 | 07 | 86 | 80 | BA | 5D | A3 | 20 | 05 | B6 | 5D | A3 |
| F7D0 | 84 | 7F | B7 | 5D | A3 | 7C | 52 | C2 | 39 | B6 | 52 | C2 | 27 | 18 | 8E | F4 |
| F7E0 | B5 | BD | C0 | 2E | 8E | F4 | 9C | BD | C0 | 4C | BD | C2 | DB | B6 | 5D | AF |
| F7F0 | BD | F8 | 77 | BD | C0 | 99 | B6 | 5D | 8F | 85 | 10 | 26 | 2F | BD | DC | 8E |
| F800 | 27 | 13 | BB | 5D | AF | 2A | 01 | 4F | 81 | 05 | 23 | 02 | 86 | 05 | B7 | 5D |
| F810 | AF | 7C | 52 | C2 | 39 | 8E | 5D | 9D | F6 | 5D | AF | 3A | A6 | 84 | BD | DB |
| F820 | A4 | A1 | 84 | 26 | 01 | 39 | A7 | 84 | 7C | 52 | C2 | 39 | 8E | 5D | 9D | 10 |
| F830 | 8E | 5D | A6 | C6 | 06 | BD | 81 | 3D | 7C | 5D | A3 | 7C | 52 | C2 | 16 | FE |
| F840 | 04 | B6 | 52 | C2 | 27 | 18 | BD | C2 | F1 | 8E | F6 | CF | BD | C0 | 24 | 8E |
| F850 | 5D | A6 | 10 | 8E | 50 | 93 | C6 | 06 | BD | 81 | 3D | BD | C0 | 99 | B6 | 5D |
| F860 | 8F | 85 | 10 | 26 | 01 | 39 | B6 | 5D | A3 | 84 | 80 | B7 | 5D | A3 | 7F | 52 |
| F870 | 90 | 7C | 52 | C2 | 16 | FD | CE | 34 | 36 | 8E | F4 | 9C | BD | C0 | 4C | 8E |
| F880 | 5D | 9D | 10 | 8E | 50 | 83 | 5F | E1 | E4 | 26 | 0A | A6 | 84 | BD | C3 | 7D |
| F890 | 86 | FF | A7 | A8 | 50 | A6 | 80 | A7 | A0 | 5C | C1 | 05 | 23 | E9 | 35 | B6 |
| F8A0 | B6 | 5D | 98 | 26 | 01 | 39 | FC | 52 | C6 | 10 | B3 | 5D | 99 | 22 | 01 | 39 |
| F8B0 | B6 | 5D | 97 | 26 | 12 | 7C | 5D | 97 | BD | C0 | 9C | FC | 52 | C6 | C3 | 01 |
| F8C0 | 04 | C4 | 80 | FD | 5D | 99 | 39 | 7F | 5D | 97 | BD | C0 | 9C | FC | 52 | C6 |
| F8D0 | C3 | 02 | 09 | C4 | 80 | FD | 5D | 99 | 39 | 86 | 99 | 4A | 26 | FD | 39 | DE |
| F8E0 | C0 | 10 | 7C | A4 | B6 | 52 | C2 | 27 | 12 | 8E | FD | C6 | BD | 95 | 0B | BD |
| F8F0 | BF | F4 | 8E | 98 | A7 | BD | C2 | 67 | BD | C0 | 99 | 86 | 01 | BD | 95 | 3A |

| | | | | | | | | | | | | | | | | |
|---|---|---|---|---|---|---|---|---|---|---|---|---|---|---|---|---|
| F900 | BD | 95 | 2A | 7F | 5D | 85 | 86 | 01 | B7 | 5D | 84 | B7 | 5D | 8E | 7F | 52 |
| F910 | 90 | BD | C2 | F1 | 20 | 09 | BD | 8D | 43 | BD | D6 | BE | BD | D6 | 5B | F6 |
| F920 | 5D | 85 | C4 | 07 | F7 | 5D | 85 | B6 | 5D | 92 | 81 | 54 | 27 | 6F | B6 | 5D |
| F930 | 8E | 27 | 2E | C6 | 07 | 8E | D2 | 0D | A5 | 85 | 26 | 03 | 5A | 2A | F9 | BD |
| F940 | FD | AC | B6 | 5D | 8A | 84 | FE | B7 | 5D | 8A | B7 | 30 | 04 | A6 | 85 | 43 |
| F950 | B7 | 30 | 02 | F7 | 5D | 85 | 4F | 5F | FD | 5D | B3 | FD | 5D | B5 | 7C | 52 |
| F960 | C2 | F6 | 5D | 85 | 8E | F9 | BB | 58 | AE | 85 | AD | 84 | B6 | 52 | C7 | 2A |
| F970 | 08 | 86 | 01 | B7 | 52 | C2 | B7 | 52 | C7 | B6 | 5D | 7C | 2A | 04 | 84 | 01 |
| F980 | 26 | 12 | B6 | 5D | 85 | 81 | 02 | 10 | 27 | FF | 8B | B6 | 5D | 8F | 85 | 01 |
| F990 | 10 | 27 | FF | 82 | 7F | 5D | 84 | 7C | 52 | C2 | 16 | 04 | 0F | 8E | 80 | B6 |
| F9A0 | BD | C0 | 24 | BD | C0 | 99 | 7F | 5D | AF | BD | 8C | 53 | 7C | 5D | AF | B6 |
| F9B0 | 5D | AF | 81 | 14 | 25 | F3 | 7F | 5D | 8E | 20 | B1 | F9 | CB | FA | 7A | FA |
| F9C0 | F6 | FB | DD | FB | 46 | FC | 52 | FD | 3B | FD | 2B | B6 | 52 | C2 | 10 | 27 |
| F9D0 | 00 | 5B | 8E | FD | D8 | BD | C0 | 24 | B6 | 5D | B3 | C6 | 05 | BD | C1 | 5B |
| F9E0 | B6 | 5D | B5 | 27 | 05 | C6 | 15 | BD | C1 | 5B | B6 | 5D | B6 | 27 | 05 | C6 |
| F9F0 | 25 | BD | C1 | 5B | 4F | BD | 8B | FB | 96 | 7B | B1 | 5D | CF | 25 | 03 | B7 |
| FA00 | 5D | CF | C6 | 05 | 3D | BD | FD | A1 | 86 | 2A | 10 | 8E | 50 | 72 | 5D | 27 |
| FA10 | 05 | A7 | A0 | 5A | 26 | FB | 86 | 20 | 10 | 8C | 50 | 9A | 24 | 04 | A7 | A0 |
| FA20 | 20 | F6 | B6 | 5D | CF | C6 | 28 | BD | C1 | 5B | BD | C0 | 99 | 8E | 00 | 00 |
| FA30 | A6 | 89 | 5B | 4D | 26 | 08 | 30 | 01 | 8C | 00 | 58 | 23 | F3 | 39 | 7C | 52 |
| FA40 | C2 | 34 | 02 | 1F | 10 | 5C | F7 | 5D | B3 | 35 | 02 | 81 | 10 | 25 | 1C | 1A |
| FA50 | 40 | A6 | 89 | 5B | 4D | 80 | 10 | A7 | 89 | 5B | 4D | 1C | BF | A6 | 89 | 5A |
| FA60 | 8D | B7 | 5D | B5 | 7F | 5D | B6 | 7F | 5D | CF | 39 | 6A | 89 | 5B | 4D | A6 |
| FA70 | 89 | 5A | ED | B7 | 5D | B6 | 7F | 5D | B5 | 39 | B6 | 52 | C2 | 27 | 4D | 8E |
| FA80 | B7 | 56 | BD | C0 | 2E | 8E | FE | 01 | BD | C0 | 4C | CC | 5B | 5D | B7 | 50 |
| FA90 | 5C | F7 | 50 | 5F | 8E | 52 | 9F | 10 | 8E | FA | EF | E6 | A0 | 27 | 07 | A6 |
| FAA0 | 80 | BD | C1 | 5B | 20 | F5 | 8E | 50 | 4A | C6 | 7E | 81 | 3F | 25 | 0E | C6 |
| FAB0 | 7F | 81 | 40 | 22 | 08 | CC | 7E | 7F | ED | 88 | 13 | 20 | 0C | 34 | 04 | C6 |
| FAC0 | 0A | 3D | BD | FD | A1 | 35 | 02 | A7 | 85 | BD | C0 | 99 | B6 | 5D | 8F | 85 |
| FAD0 | 10 | 27 | 14 | B6 | 5D | 8A | 84 | EF | B7 | 30 | 04 | BD | FD | 87 | B6 | 5D |
| FAE0 | 8A | 8A | 10 | B7 | 30 | 04 | 39 | 85 | 02 | 27 | 03 | BD | FD | 95 | 39 | 30 |
| FAF0 | 34 | 38 | 3C | 49 | 4D | 00 | B6 | 52 | C2 | 27 | 4A | 86 | FF | B7 | 30 | 04 |
| FB00 | 8E | FE | 22 | BD | C0 | 24 | B6 | 38 | 03 | 43 | 84 | 01 | C6 | 7F | F7 | 30 |
| FB10 | 04 | C6 | 32 | BD | BF | E2 | C6 | 3A | B6 | 38 | 03 | 43 | B7 | 5D | B3 | 84 |
| FB20 | 01 | BD | BF | E2 | C6 | 36 | B6 | 5D | B3 | 84 | 02 | BD | BF | E2 | C6 | 3E |
| FB30 | B6 | 5D | B3 | 84 | 08 | BD | BF | E2 | C6 | 42 | B6 | 5D | B3 | 84 | 04 | BD |
| FB40 | BF | E2 | BD | C0 | 99 | 39 | B6 | 52 | C2 | 26 | 01 | 39 | B6 | 5D | B3 | 27 |
| FB50 | 08 | 4A | B7 | 5D | B3 | 7F | 52 | C2 | 39 | 86 | 02 | B7 | 5D | B3 | B6 | 5D |
| FB60 | B5 | 81 | 28 | 23 | 04 | 4F | B7 | 5D | B5 | 81 | 25 | 23 | 07 | BD | FD | AC |
| FB70 | 7C | 5D | B5 | 39 | 8E | FE | 40 | BD | C0 | 24 | BD | C0 | 99 | 8E | D2 | 0D |
| FB80 | F6 | 5D | B5 | C1 | 07 | 22 | 07 | 8D | 4D | B7 | 30 | 02 | 20 | E2 | C0 | 08 |
| FB90 | C1 | 07 | 22 | 07 | 8D | 40 | B7 | 30 | 03 | 20 | D5 | C0 | 08 | C1 | 07 | 22 |
| FBA0 | 07 | 8D | 33 | B7 | 30 | 00 | 20 | C8 | C0 | 08 | C1 | 07 | 22 | 07 | 8D | 26 |
| FBB0 | B7 | 30 | 01 | 20 | BB | C0 | 08 | C1 | 04 | 22 | B5 | BD | FD | AC | B6 | 5D |
| FBC0 | 8A | 84 | E0 | B7 | 5D | 8A | A6 | 85 | 43 | 84 | 1F | BA | 5D | 8A | B7 | 5D |
| FBD0 | 8A | B7 | 30 | 04 | 20 | 9A | BD | FD | AC | A6 | 85 | 43 | 39 | B6 | 52 | C2 |
| FBE0 | 26 | 01 | 39 | 4F | BD | FD | AE | 86 | E0 | B4 | 5D | 8A | BD | FD | BF | FC |
| FBF0 | 5D | B3 | 27 | 07 | 83 | 00 | 01 | FD | 5D | B3 | 39 | CC | 01 | 0E | FD | 5D |
| FC00 | B3 | B6 | 5D | B5 | 4C | 84 | 03 | B7 | 5D | B5 | 27 | 0C | 81 | 01 | 27 | 3E |
| FC10 | 8E | FE | 57 | BD | C0 | 24 | 20 | 0C | 86 | 20 | C6 | 50 | 8E | 50 | 4A | A7 |
| FC20 | 80 | 5A | 26 | FB | 8E | 50 | 4A | C6 | 50 | B6 | 28 | 00 | 2B | FB | 86 | 02 |
| FC30 | B7 | 28 | 00 | B6 | 28 | 00 | 2B | FB | A6 | 80 | B7 | 28 | 01 | 5A | 26 | F3 |
| FC40 | B6 | 28 | 00 | 2B | FB | 86 | 0C | B7 | 28 | 00 | 7F | 52 | C2 | 39 | 86 | FF |
| FC50 | 20 | C8 | B6 | 5D | B3 | 81 | 40 | 25 | 04 | 81 | DF | 23 | 05 | 86 | 40 | B7 |
| FC60 | 5D | B3 | B6 | 52 | C2 | 27 | 50 | 8E | FE | 77 | BD | C0 | 24 | B6 | 5D | B3 |
| FC70 | 8E | 50 | 63 | BD | C1 | 98 | 4F | BD | C1 | 98 | B6 | 5D | B3 | 81 | 60 | 25 |

| | | | | | | | | | | | | | | | | |
|---|---|---|---|---|---|---|---|---|---|---|---|---|---|---|---|---|
| FC80 | 05 | 86 | 35 | B7 | 50 | 5A | B6 | 5D | B5 | 27 | 29 | 8E | FE | 89 | BD | C0 |
| FC90 | 4C | B6 | 5D | B5 | 85 | 01 | 27 | 0C | 86 | 55 | B7 | 50 | 82 | 86 | 7C | C6 |
| FCA0 | 39 | BD | C1 | 5B | 85 | 02 | 27 | 0C | 86 | 55 | B7 | 50 | 88 | 86 | 7D | C6 |
| FCB0 | 3F | BD | C1 | 5B | BD | C0 | 99 | B6 | 5D | B3 | 81 | 60 | 25 | 0C | 80 | 60 |
| FCC0 | BD | 8B | 98 | B6 | 5D | B3 | 84 | 1F | 8A | 60 | 5F | 1F | 01 | 10 | 8E | 01 |
| FCD0 | 00 | 86 | FF | B7 | 30 | 20 | B6 | 38 | 02 | 1A | 50 | E6 | 84 | 4F | A7 | 84 |
| FCE0 | 12 | 12 | A6 | 84 | 26 | 32 | 86 | AA | A7 | 84 | 12 | 12 | A6 | 84 | 81 | AA |
| FCF0 | 26 | 26 | 86 | 55 | A7 | 84 | 12 | 12 | A6 | 84 | 81 | 55 | 26 | 1A | 86 | FF |
| FD00 | A7 | 84 | 12 | 12 | A6 | 84 | 81 | FF | 26 | 0E | E7 | 80 | 1C | AF | 31 | 3F |
| FD10 | 26 | C7 | 7C | 5D | B3 | 1C | AF | 39 | E7 | 84 | B6 | 5D | B3 | 48 | 49 | 48 |
| FD20 | 49 | 84 | 03 | BA | 5D | B5 | B7 | 5D | B5 | 20 | E7 | B6 | 52 | C2 | 26 | 01 |
| FD30 | 39 | 8E | FE | 92 | BD | C0 | 24 | BD | C0 | 99 | 39 | B6 | 52 | C2 | 27 | F0 |
| FD40 | 8E | FE | 9F | BD | C0 | 24 | 8E | FF | F2 | 4F | 5F | EB | 80 | 89 | 00 | 8C |
| FD50 | 00 | 00 | 26 | F7 | 8E | 80 | 00 | EB | 80 | 89 | 00 | 8C | FF | F0 | 25 | F7 |
| FD60 | 34 | 06 | 8E | 50 | 5F | BD | C1 | 98 | A6 | 61 | BD | C1 | 98 | 35 | 06 | 8E |
| FD70 | FE | B3 | 10 | B3 | FF | F0 | 27 | 03 | 8E | EA | 42 | 10 | 8E | 50 | 65 | C6 |
| FD80 | 04 | BD | 81 | 3D | 7E | C0 | 99 | 8D | 0C | BD | 8C | 53 | C6 | 40 | F0 | 52 |
| FD90 | A4 | F7 | 52 | AC | 39 | 4F | C6 | 05 | 8E | 52 | A7 | A7 | 85 | 5A | 2A | FB |
| FDA0 | 39 | 44 | 56 | 44 | 56 | 44 | 56 | 44 | 56 | 44 | 56 | 39 | 86 | FF | B7 | 30 |
| FDB0 | 02 | B7 | 30 | 03 | B7 | 30 | 00 | B7 | 30 | 01 | 86 | 1F | BA | 5D | 8A | B7 |
| FDC0 | 5D | 8A | B7 | 30 | 04 | 39 | 20 | 45 | 4E | 54 | 45 | 52 | 20 | 54 | 45 | 53 |
| FDD0 | 54 | 20 | 4D | 4F | 44 | 45 | 3A | FF | 4E | 4F | 54 | 45 | 20 | 38 | 38 | 3A |
| FDE0 | 20 | 20 | 20 | 4F | 4E | 20 | 56 | 45 | 4C | 4F | 20 | 3D | 20 | 20 | 20 | 20 |
| FDF0 | 2C | 20 | 4F | 46 | 46 | 20 | 56 | 45 | 4C | 4F | 20 | 3D | 20 | 20 | 20 | 20 |
| FE00 | FF | 50 | 45 | 44 | 41 | 4C | 53 | 3A | 20 | 20 | 20 | 20 | 20 | 20 | 20 | 20 |
| FE10 | 20 | 20 | 20 | 20 | 20 | 20 | 20 | 20 | 20 | 20 | 57 | 48 | 45 | 45 | 4C | 53 |
| FE20 | 3A | FF | 53 | 57 | 49 | 54 | 43 | 48 | 45 | 53 | 3A | 20 | 57 | 52 | 20 | 20 |
| FE30 | 50 | 41 | 4C | 20 | 45 | 44 | 20 | 20 | 4E | 4F | 20 | 20 | 59 | 45 | 53 | FF |
| FE40 | 54 | 45 | 53 | 54 | 20 | 35 | 20 | 2D | 20 | 52 | 4F | 54 | 41 | 54 | 49 | 4E |
| FE50 | 47 | 20 | 4C | 45 | 44 | 53 | FF | 54 | 45 | 53 | 54 | 20 | 34 | 20 | 2D | 20 |
| FE60 | 4C | 43 | 44 | 20 | 54 | 45 | 53 | 54 | 20 | 2F | 20 | 41 | 4C | 4C | 20 | 4C |
| FE70 | 45 | 44 | 53 | 20 | 4F | 4E | FF | 54 | 45 | 53 | 54 | 49 | 4E | 47 | 20 | 52 |
| FE80 | 41 | 4D | 3A | 20 | 55 | 31 | 32 | 34 | FF | 45 | 52 | 52 | 4F | 52 | 20 | 49 |
| FE90 | 4E | FF | 4E | 4F | 20 | 54 | 45 | 53 | 54 | 20 | 48 | 45 | 52 | 45 | FF | 45 |
| FEA0 | 50 | 52 | 4F | 4D | 20 | 43 | 48 | 45 | 43 | 4B | 53 | 55 | 4D | 20 | 54 | 45 |
| FEB0 | 53 | 54 | FF | 47 | 4F | 4F | 44 | 42 | C1 | 53 | C9 | 43 | A0 | 53 | C5 | 54 |
| FEC0 | D5 | 50 | A0 | 20 | A0 | 20 | A0 | 00 | 0F | 1E | FF | FF | FF | FF | 20 | CF |
| FED0 | D0 | C5 | D2 | C1 | D4 | CF | 52 | 20 | 31 | 71 | 57 | 00 | 20 | FF | 00 | 7F |
| FEE0 | 01 | 00 | FF | 40 | FF | FF | 07 | FF | FF | FF | 01 | 80 | CF | D0 | C5 | D2 |
| FEF0 | C1 | D4 | CF | 52 | 20 | 32 | 72 | 57 | 00 | 21 | FF | 00 | 7F | 01 | 00 | FF |
| FF00 | 40 | FF | FF | 07 | FF | FF | FF | 01 | 80 | CF | D0 | C5 | D2 | C1 | D4 | CF |
| FF10 | 52 | 20 | 33 | 74 | 57 | 00 | 22 | FF | 00 | 7F | 01 | 00 | FF | 40 | FF | FF |
| FF20 | 07 | FF | FF | FF | 01 | 80 | CF | D0 | C5 | D2 | C1 | D4 | CF | 52 | 20 | 34 |
| FF30 | 78 | 57 | 00 | 23 | FF | 00 | 7F | 01 | 00 | FF | 40 | FF | FF | 07 | FF | FF |
| FF40 | FF | 01 | 80 | CF | D0 | C5 | D2 | C1 | D4 | CF | 52 | 20 | 35 | 71 | 57 | 00 |
| FF50 | 24 | FF | 00 | 7F | 01 | 00 | FF | 40 | FF | FF | 07 | FF | FF | FF | 01 | 80 |
| FF60 | CF | D0 | C5 | D2 | C1 | D4 | CF | 52 | 20 | 36 | 72 | 57 | 00 | 25 | FF | 00 |
| FF70 | 7F | 01 | 00 | FF | 40 | FF | FF | 07 | FF | FF | FF | 01 | 80 | CF | D0 | C5 |
| FF80 | D2 | C1 | D4 | CF | 52 | 20 | 37 | 74 | 57 | 00 | 26 | FF | 00 | 7F | 01 | 00 |
| FF90 | FF | 40 | FF | FF | 07 | FF | FF | FF | 01 | 80 | CF | D0 | C5 | D2 | C1 | D4 |
| FFA0 | CF | 52 | 20 | 38 | 78 | 57 | 00 | 27 | FF | 00 | 7F | 01 | 00 | FF | 40 | FF |
| FFB0 | FF | 07 | FF | FF | FF | 01 | 80 | 00 | A0 | 80 | 00 | 00 | A0 | 80 | 00 | 00 |
| FFC0 | A0 | 80 | 00 | 00 | A0 | 80 | 00 | 00 | A0 | 80 | 00 | 00 | A0 | 80 | 00 | 00 |
| FFD0 | A0 | 80 | 00 | 00 | A0 | 80 | 00 | FF | FF | FF | FF | FF | FF | FF | FF | FF |
| FFE0 | FF | FF | FF | FF | FF | FF | FF | FF | FF | FF | FF | FF | FF | FF | FF | FF |
| FFF0 | 10 | F4 | 81 | E1 | 81 | E1 | BF | 05 | C3 | 9A | 81 | E1 | BF | 49 | 81 | E1 |

While the apparatus and methods of the present invention have been summarized and explained by an illustrative embodiment of an improved percussive action electronic keyboard for controlling musical synthesis and sound generation equipment, it will be readily apparent to those skilled in the art that many widely varying embodiments and applications are within the teaching and scope of the present invention, and that the examples presented herein are by way of illustration only and should not be construed as limiting of the scope of the present invention.

We claim:

1. A percussive action electronic keyboard for play as a musical instrument of the type having pivoted playing keys having camming surfaces distal from finger contact surfaces thereof, pivoted hammers having impact cam follower surfaces for following the playing key impact camming surfaces, hammer stop means for stopping the swing of the hammer in response to impact of its associated key, comprising:

electronic sensor means for generating an electrical signal for each impacted key, the electrical signal a product of key impact relative to at least one key impact compensation means;

scanning keyboard state monitoring means connected to said sensor means including keyboard scanner means for scanning each key of the keyboard to determine whether a key event has occurred, comparison means for determining when a key impact causes a key impact signal to exceed predetermined minimum and maximum threshold values, and scan counting means for counting the number of scans when the key impact amplitude signal passes between the minimum and maximum threshold values.

2. The percussive action electronic keyboard set forth in claim 1 wherein said scanning keyboard state monitoring means includes key impact determining means for determining the impact with which a key is depressed during play.

3. The percussive action electronic keyboard set forth in claim 1 wherein the electronic sensor means comprises force sensitive resistance material having an electrical resistance characteristic which is inversely related to the force with which the material is urged toward conductor means.

4. The percussive action electronic keyboard set forth in claim 3 wherein the electronic sensor means comprises an XYZ force sensitive array means.

5. The percussive action electronic keyboard set forth in claim 3 wherein the electronic sensor means comprises a continuous film substrate carrying a force sensitive resistance coating on one side and at least one printed circuit substrate means carrying arrays of interleaved conductors forming individual sense cells for each key of the keyboard facing said one side.

6. The percussive action electronic keyboard set forth in claim 5 further comprising a strip of elastomeric material placed between the keys and the continuous film substrate.

7. The percussive action electronic keyboard set forth in claim 5 wherein the individual sense cells are grouped into predetermined groups and wherein the keyboard scanner means includes group select means for individually enabling each group of the predetermined groups and wherein the cells within each group are individually connected to plural scan buses, there being in number as many scan buses as there are cells within each group, so that by enabling a group and then by scanning each scan bus, each key of the keyboard may thereby be scanned in its turn.

8. The percussive action electronic keyboard set forth in claim 1 wherein the scanning keyboard state monitoring means further includes digital output means for putting out the number of scans as a digital value and further comprising programmed microprocessor means connected to receive the digital value scan count for a key and convert the scan count into a key velocity value.

9. The percussive action electronic keyboard set forth in claim 1 wherein the scanning keyboard state monitoring means further includes memory means for recording scan counts for all keys being played during a scan of the keyboard.

10. The percussive action electronic keyboard set forth in claim 8 further comprising programmable output path means connected to said microprocessor means for putting out said key velocity value to music generation equipment via said programmable output path means.

11. The percussive action electronic keyboard set forth in claim 10 further comprising programmable input path means connected to said microprocessor means for receiving incoming keyboard programming information from a source thereof via said input path means.

12. The percussive action electronic keyboard set forth in claim 8 further comprising keyboard setup memory means connected to the microprocessor means for recording user provided setup parameters for operation of the keyboard, and wherein the microprocessor means is programmed to operate the keyboard in accordance with the setup parameters recorded in the keyboard setup memory means.

13. The percussive action electronic keyboard set forth in claim 12 further comprising disk file subsystem means connected to said microprocessor means for recording as disk files a plurality of different user provided setup parameters for operation of the keyboard.

14. The percussive action electronic keyboard set forth in claim 12 wherein the keyboard has a performance mode during which the playing keys emulate play of the musical instrument and has an edit mode during which the playing keys act as data entry ports for entry of the setup parameters provided by the user.

15. The percussive action electronic keyboard set forth in claim 14 wherein the playing keys bear indicia indicative of the data entry function of the particular key during edit mode.

16. The percussive action electronic keyboard set forth in claim 12 further comprising plural programmable output path means connected to said microprocessor means for putting out said key velocity value to a plurality of music generation equipment via said plural programmable output path means and wherein said microprocessor means is programmed to provide a plurality of internal operators, each operator being configured to operate a said music generation equipment through a said one of the plurality of output path means.

17. The percussive action electronic keyboard set forth in claim 16 wherein said keyboard setup memory means is paged into a plurality of functional pages, including a first page for utility functions, a second page for global program setup functions and a third page for operator functions.

18. The percussive action electronic keyboard set forth in claim 8 further including data entry switches formed on a front panel of the keyboard for enabling the user to provide commands to the microprocessor means.

19. The percussive action electronic keyboard set forth in claim 8 further including status indicating means fored on a front panel of the keyboard for enabling the microprocessor means to indicate the status of the keyboard to the user.

20. The percussive action electronic keyboard set forth in claim 10 wherein said programmable output path means comprises a plurality of output paths separately programmable by the microprocessor means.

21. The percussive action electronic keyboard set forth in claim 11 wherein said programmable input path means comprises a plurality of input paths separately programmable by the microprocessor means.

22. The percussive action electronic keyboard set forth in claim 8 further comprising at least one proportional control means operable by the user during play and further comprising analog to digital conversion means connected between the proportional control means and the microprocessor means for converting proportional analog control values into digital values.

23. The percussive action electronic keyboard set forth in claim 12 wherein the microprocessor means is programmed to operate the keyboard in accordance with the setup parameters recorded in the keyboard setup memory means by page arrangement, there being a utilities page, a global setup program page and an operator page.

24. The percussive action electronic keyboard of claim 1 wherein the key impact compensation means comprises a user adjustable hammer position relative to the impact camming surface of each key.

25. The percussive action electronic keyboard of claim 1 wherein the key impact compensation means comprises a means for adjusting the position of the key relative to the electronic sensor means associated with each key.

26. The percussive action electronic keyboard of claim 1 wherein the key impact compensation means comprises programmable minimum and maximum threshold values, a means for adjusting the position of the key relative to the electronic sensor means associated with each key, and a user adjustable hammer position relative to the impact camming surface of each key.

27. The percussive action electronic keyboard for play as a musical instrument comprising:

a plurality of pivoted playing keys each having a finger contact surface, a cam surface distal from the finger contact surface, and capable of being impacted at varying speeds, compensation means adjustably responsive to the actuation of at least one key for providing a compensation signal representative of the travel of the key after being impacted by the finger; and sensor means for producing a tone generation signal in response to the compensation signal and the speed at which the key is impacted.

28. A percussive action electronic keyboard as in claim 27 wherein the adjustment of the compensation means may be made by the user.

29. A percussive action electronic keyboard as in claim 27 wherein the compensation means comprises a user adjustable hammer position relative to the cam surface of each key.

30. A percussive action electronic keyboard as in claim 27 wherein the compensation means comprises a means for adjusting the position of the key relative to the electronic sensor means associated with each key, and user adjustable key position relative to the cam surface of each key.

31. A percussive action electronic keyboard as in claim 27 wherein the compensation means comprises programmable minimum and maximum threshold values, a means for adjusting the position of the key relative to the electronic sensor means associated with each key, and a user adjustable hammer position relative to the cam surface of each key.

* * * * *